US012735952B2

(12) United States Patent
Larsen et al.

(10) Patent No.: US 12,735,952 B2
(45) Date of Patent: Sep. 15, 2026

(54) LATCH COUPLING INCLUDING UNIQUE AXIAL ALIGNMENT SLOTS

(71) Applicant: Halliburton Energy Services, Inc., Houston, TX (US)

(72) Inventors: Lars Petter Larsen, Stavanger (NO); Borisa Lajesic, Stavanger (NO); Morten Falnes, Stavanger (NO); Vegard Dyrseth, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/326,367

(22) Filed: Sep. 11, 2025

(65) Prior Publication Data

US 2026/0009301 A1 Jan. 8, 2026

Related U.S. Application Data

(63) Continuation of application No. 18/481,587, filed on Oct. 5, 2023, now Pat. No. 12,448,857.
(Continued)

(51) Int. Cl.

| | |
|---|---|
| ***E21B 23/02*** | (2006.01) |
| ***E21B 7/06*** | (2006.01) |
| ***E21B 17/046*** | (2006.01) |
| ***E21B 23/01*** | (2006.01) |
| ***E21B 23/03*** | (2006.01) |
| ***E21B 23/06*** | (2006.01) |

(Continued)

(52) U.S. Cl.
CPC ..... *E21B 23/02* (2013.01); *E21B 7/061* (2013.01); *E21B 17/046* (2013.01); *E21B 17/0465* (2020.05); *E21B 23/01* (2013.01); *E21B 23/03* (2013.01); *E21B 23/06* (2013.01); *E21B 33/12* (2013.01); *E21B 41/0035* (2013.01); *E21B 47/00* (2013.01)

(58) Field of Classification Search
CPC ..... E21B 17/08; E21B 17/046; E21B 23/02
See application file for complete search history.

(56) References Cited

U.S. PATENT DOCUMENTS

| | | | |
|---|---|---|---|
| 1,571,931 | A | 2/1926 | Church |
| 1,636,032 | A | 7/1927 | Abbott |

(Continued)

FOREIGN PATENT DOCUMENTS

| | | | |
|---|---|---|---|
| CN | 105507839 | A | 4/2016 |
| EP | 961008 | B1 | 12/2006 |

(Continued)

OTHER PUBLICATIONS

Westgard, D., How Operators Are Benefiting From Level 3 Multilaterals in Alaska, World Oil, vol. 223, No. 6, Jun. 2002, 6 pages.

*Primary Examiner* — Shane Bomar
(74) *Attorney, Agent, or Firm* — Scott Richardson; Parker Justiss, P.C.

(57) ABSTRACT

Provided is a latch coupling, a well system, and a method for forming a well system. The latch coupling, in one aspect, includes a housing having an outside diameter (OD) and an inside diameter (ID). The latch coupling, according to this aspect, further includes a plurality of axial alignment slots located along the inside diameter (ID) of the housing, wherein a width ($W_{AS}$) of each of the plurality of axial alignment slots is within 10% of each other.

21 Claims, 149 Drawing Sheets

Related U.S. Application Data

(60) Provisional application No. 63/414,272, filed on Oct. 7, 2022.

(51) Int. Cl.

| | |
|---|---|
| ***E21B 33/12*** | (2006.01) |
| ***E21B 41/00*** | (2006.01) |
| ***E21B 47/00*** | (2012.01) |

(56) References Cited

U.S. PATENT DOCUMENTS

| | | | |
|---|---|---|---|
| 2,107,420 | A | 2/1938 | Kothny |
| 2,314,352 | A | 3/1943 | Hoffoss |
| 2,894,586 | A | 7/1959 | Schramm et al. |
| 2,948,338 | A | 8/1960 | Raulins et al. |
| 2,962,097 | A | 11/1960 | Dollison |
| 2,994,389 | A | 8/1961 | Le Bus, Sr. |
| 3,117,636 | A | 1/1964 | Wilcox et al. |
| 3,190,378 | A | 6/1965 | Davey, Sr. et al. |
| 3,292,938 | A | 12/1966 | Tamplen |
| 3,409,081 | A | 11/1968 | Brown |
| 3,450,205 | A | 6/1969 | Current |
| 3,856,081 | A | 12/1974 | Canalizo |
| 3,934,648 | A | 1/1976 | Amancharla et al. |
| 4,042,033 | A | 8/1977 | Holland et al. |
| 4,307,902 | A | 12/1981 | Schnatzmeyer |
| 4,362,211 | A | 12/1982 | Fisher, Jr. |
| 4,406,324 | A | 9/1983 | Baugh et al. |
| 4,465,133 | A | 8/1984 | Bridges |
| 4,545,434 | A | 10/1985 | Higgins |
| 4,623,277 | A | 11/1986 | Wayne et al. |
| 4,726,425 | A | 2/1988 | Smith, Jr. |
| 5,092,402 | A | 3/1992 | Perricone et al. |
| 5,320,176 | A | 6/1994 | Naquin et al. |
| 5,398,763 | A | 3/1995 | Watson et al. |
| 5,433,275 | A | 7/1995 | Melenyzer et al. |
| 5,692,564 | A | 12/1997 | Brooks |
| 5,806,596 | A | 9/1998 | Hardy et al. |
| 5,829,518 | A | 11/1998 | Gano et al. |
| 5,944,103 | A | 8/1999 | White et al. |
| 5,957,224 | A | 9/1999 | Ilomaki |
| 6,012,527 | A | 1/2000 | Nitis et al. |
| 6,035,953 | A | 3/2000 | Rear |
| 6,145,593 | A | 11/2000 | Hennig |
| 7,240,738 | B2 | 7/2007 | Pendleton |
| 7,416,036 | B2 | 8/2008 | Forstner et al. |
| 8,439,131 | B2 | 5/2013 | Runia |
| 8,678,097 | B1 | 3/2014 | Telfer et al. |
| 8,936,101 | B2 | 1/2015 | McGlothen et al. |
| 9,546,535 | B2 | 1/2017 | Hayter et al. |
| 9,739,117 | B2 | 8/2017 | Campbell et al. |
| 10,066,452 | B2 | 9/2018 | Cochran et al. |
| 10,450,801 | B2 | 10/2019 | Zhang et al. |
| 10,513,898 | B2 | 12/2019 | Allamon et al. |
| 10,724,342 | B2 | 7/2020 | MacDonald |
| 10,724,344 | B2 | 7/2020 | Dietz |
| 10,989,022 | B2 | 4/2021 | Kohn et al. |
| 11,377,920 | B2 | 7/2022 | Parameshwaraiah et al. |
| 11,506,013 | B2 | 11/2022 | Nordheimer et al. |
| 11,713,638 | B2 | 8/2023 | Nordheimer et al. |
| 11,905,773 | B2 | 2/2024 | Atkins et al. |
| 12,338,697 | B2 | 6/2025 | Larsen et al. |
| 2001/0040054 | A1 | 11/2001 | Haugen et al. |
| 2004/0216892 | A1 | 11/2004 | Giroux et al. |
| 2005/0257935 | A1 | 11/2005 | Craig |
| 2006/0260796 | A1 | 11/2006 | Layton |
| 2007/0221384 | A1 | 9/2007 | Murray |
| 2008/0173481 | A1 | 7/2008 | Menezes et al. |
| 2011/0220345 | A1 | 9/2011 | Evans |
| 2012/0012338 | A1 | 1/2012 | Blanton et al. |
| 2012/0067595 | A1 | 3/2012 | Noske et al. |
| 2012/0160521 | A1 | 6/2012 | McGlothen et al. |
| 2013/0161027 | A1 | 6/2013 | Inglis et al. |
| 2013/0319666 | A1 | 12/2013 | Nygardsvoll et al. |
| 2014/0251615 | A1 | 9/2014 | Donovan et al. |
| 2015/0034330 | A1 | 2/2015 | Merron et al. |
| 2015/0060049 | A1 | 3/2015 | Saurer et al. |
| 2015/0129242 | A1 | 5/2015 | Farquhar |
| 2015/0197996 | A1 | 7/2015 | Latiolais, Jr. et al. |
| 2015/0308206 | A1 | 10/2015 | Yue et al. |
| 2016/0145956 | A1 | 5/2016 | Dahl et al. |
| 2016/0258253 | A1 | 9/2016 | MacLeod et al. |
| 2016/0273288 | A1 | 9/2016 | Lajesic et al. |
| 2016/0273290 | A1 | 9/2016 | Harms |
| 2016/0298404 | A1 | 10/2016 | Beckett et al. |
| 2016/0356117 | A1 | 12/2016 | Tuckness et al. |
| 2017/0198543 | A1 | 7/2017 | Nordheimer et al. |
| 2017/0211346 | A1 | 7/2017 | Bullock |
| 2018/0003005 | A1 | 1/2018 | Dorban et al. |
| 2018/0023370 | A1 | 1/2018 | Silva |
| 2018/0163486 | A1 | 6/2018 | Davies |
| 2018/0171724 | A1 | 6/2018 | Daigle et al. |
| 2018/0195356 | A1 | 7/2018 | Mailand |
| 2018/0195365 | A1 | 7/2018 | Cocker, III et al. |
| 2018/0274300 | A1 | 9/2018 | Vemuri et al. |
| 2018/0274316 | A1 | 9/2018 | Dancer |
| 2018/0363401 | A1 | 12/2018 | Van der Veen et al. |
| 2019/0100978 | A1 | 4/2019 | Carmody et al. |
| 2019/0153813 | A1 | 5/2019 | Campbell et al. |
| 2019/0316444 | A1 | 10/2019 | Entchev et al. |
| 2019/0390526 | A1 | 12/2019 | Durst et al. |
| 2020/0018135 | A1 | 1/2020 | Zeng |
| 2021/0140278 | A1 | 5/2021 | Steele et al. |
| 2021/0310338 | A1 | 10/2021 | Turley et al. |
| 2021/0332658 | A1 | 10/2021 | Hepburn et al. |
| 2021/0396086 | A1 | 12/2021 | Payne et al. |
| 2023/0265719 | A1 | 8/2023 | Lajesic |
| 2023/0265743 | A1 | 8/2023 | Lajesic |
| 2024/0117679 | A1 | 4/2024 | Lajesic et al. |
| 2024/0117680 | A1 | 4/2024 | Lajesic et al. |
| 2024/0117701 | A1 | 4/2024 | Larsen et al. |

FOREIGN PATENT DOCUMENTS

| | | | |
|---|---|---|---|
| EP | 3211176 | A1 | 8/2017 |
| EP | 3241981 | A1 | 11/2017 |
| WO | 2012166400 | A2 | 12/2012 |
| WO | 2013122589 | A1 | 8/2013 |
| WO | 2017083072 | A1 | 5/2017 |
| WO | 2019096990 | A1 | 5/2019 |
| WO | 2019194800 | A1 | 10/2019 |
| WO | 2021080934 | A1 | 4/2021 |

300

900

900

900

LATCH COUPLING INCLUDING UNIQUE AXIAL ALIGNMENT SLOTS

CROSS-REFERENCE TO RELATED APPLICATION

This application is a continuation of U.S. application Ser. No. 18/481,587, filed on Oct. 5, 2023, entitled "LATCH COUPLING INCLUDING UNIQUE AXIAL ALIGNMENT SLOTS," which claims the benefit of U.S. Provisional Application Ser. No. 63/414,272, filed on Oct. 7, 2022, entitled "ADAPTIVE ORIENTING LATCH," commonly assigned with this application and incorporated herein by reference in their entirety.

BACKGROUND

The unconventional market is extremely competitive. The market is trending towards longer horizontal wells to increase reservoir contact. Multilateral wells offer an alternative approach to maximize reservoir contact. Multilateral wells include one or more lateral wellbores (e.g., secondary wellbores) extending from a main wellbore (e.g., primary wellbore). A lateral wellbore is a wellbore that is diverted from the main wellbore or another lateral wellbore.

Lateral wellbores are typically formed by positioning one or more deflector assemblies (e.g., whipstock assemblies) at desired locations in the main wellbore (e.g., an open hole section or cased hole section) with a running tool. The deflector assemblies are often laterally and rotationally fixed within the primary wellbore using a wellbore anchor.

BRIEF DESCRIPTION

Reference is now made to the following descriptions taken in conjunction with the accompanying drawings, in which.

Figure 5A:
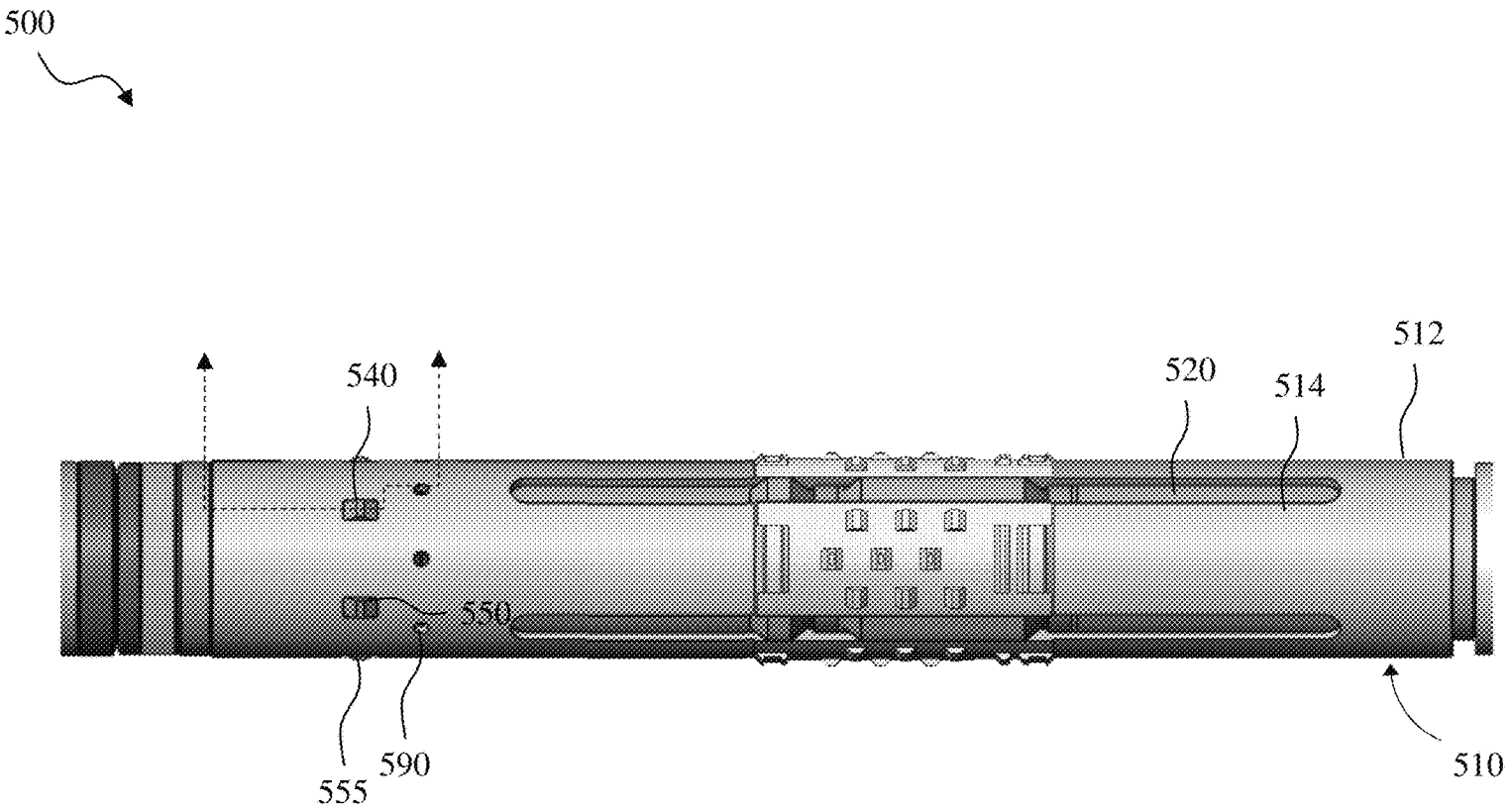
FIG. 5A illustrates a downhole tool designed, manufactured and/or operated according to one or more embodiments of the disclosure.
Figure 6A:
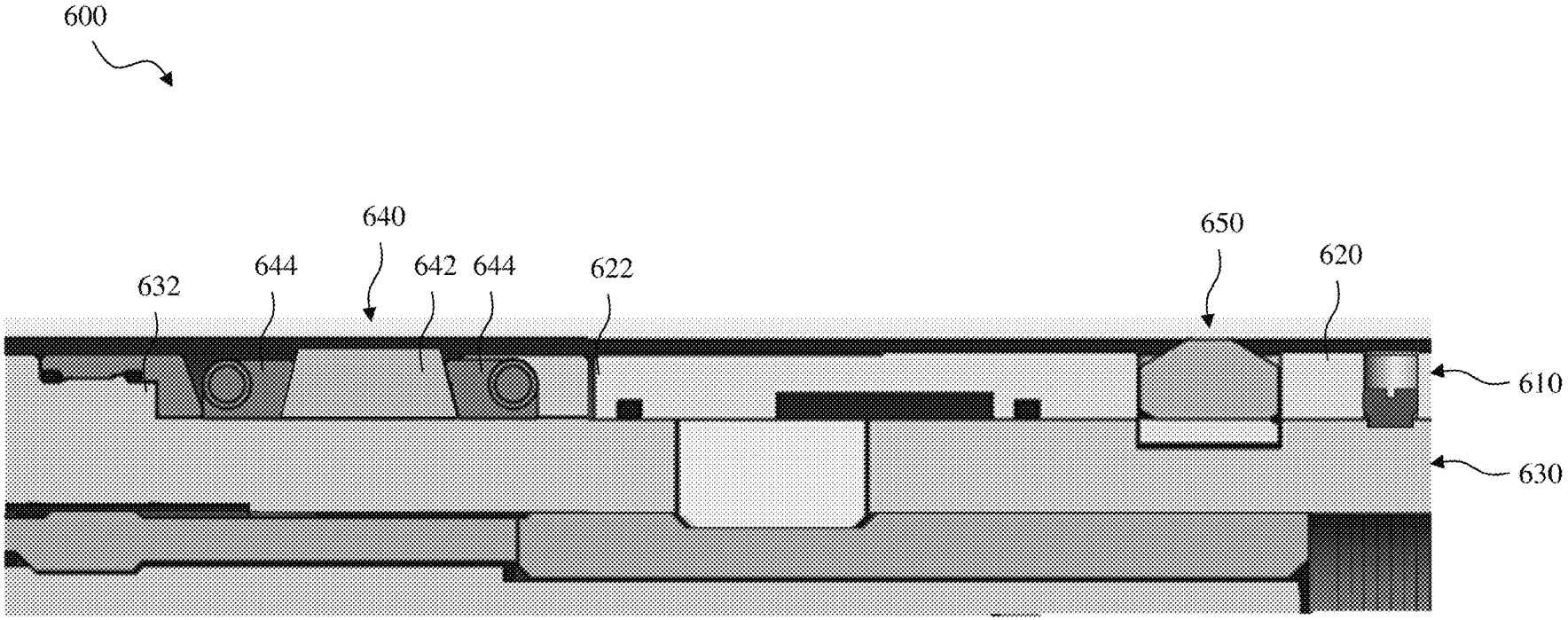
Figure 6B:
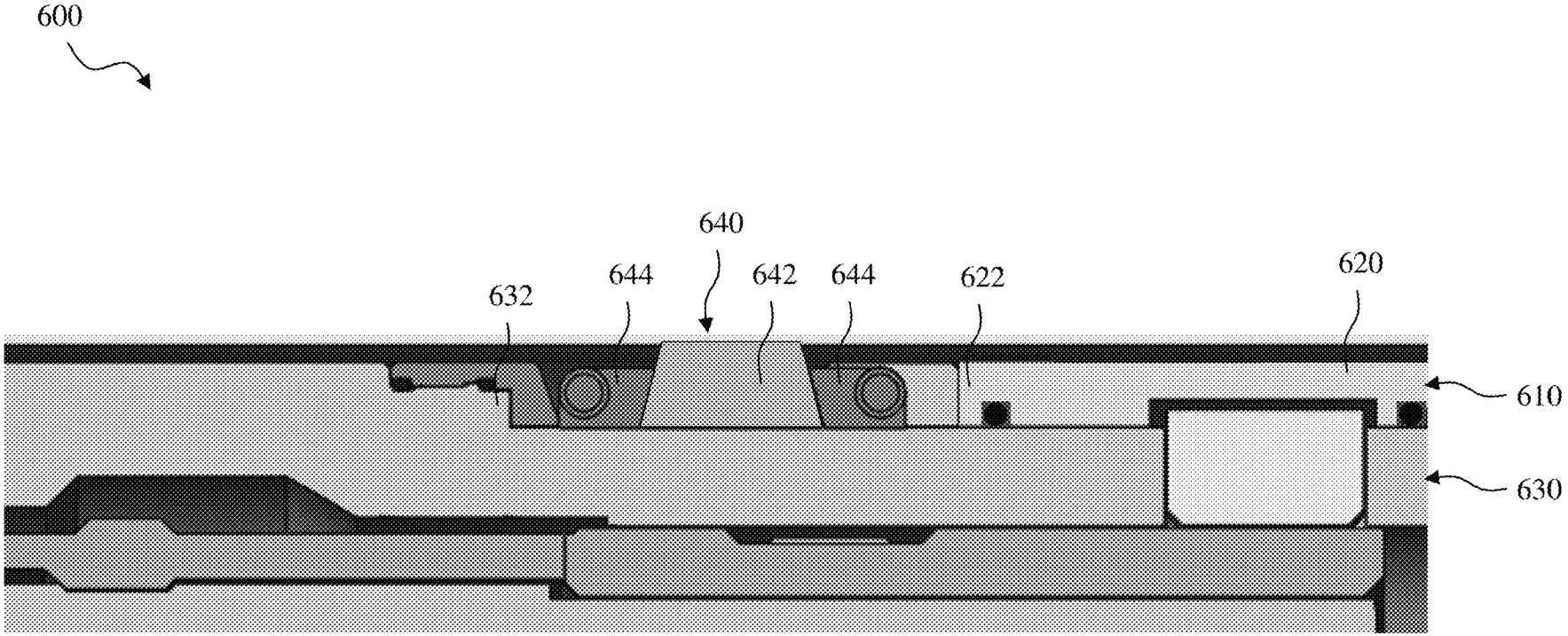
Figure 7A:
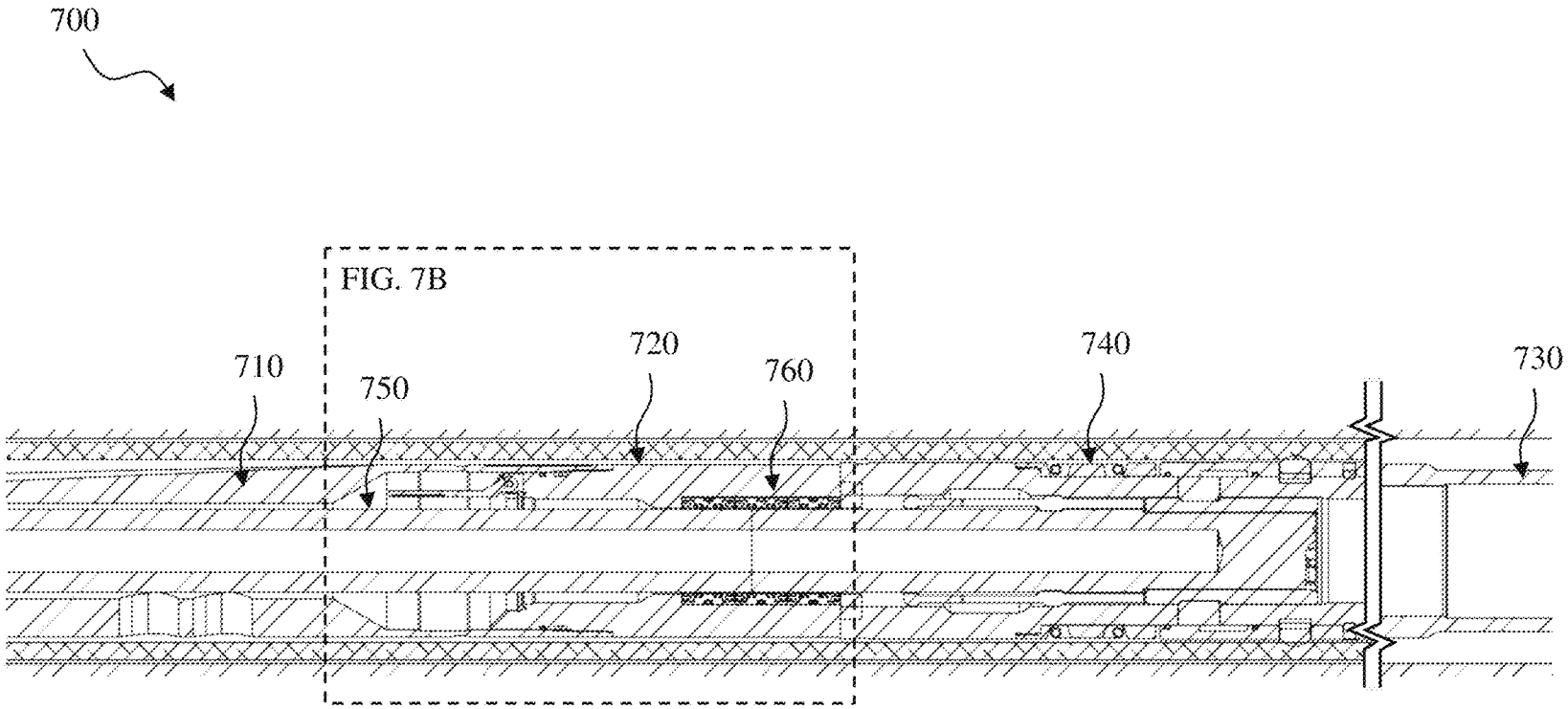
Figure 7B:
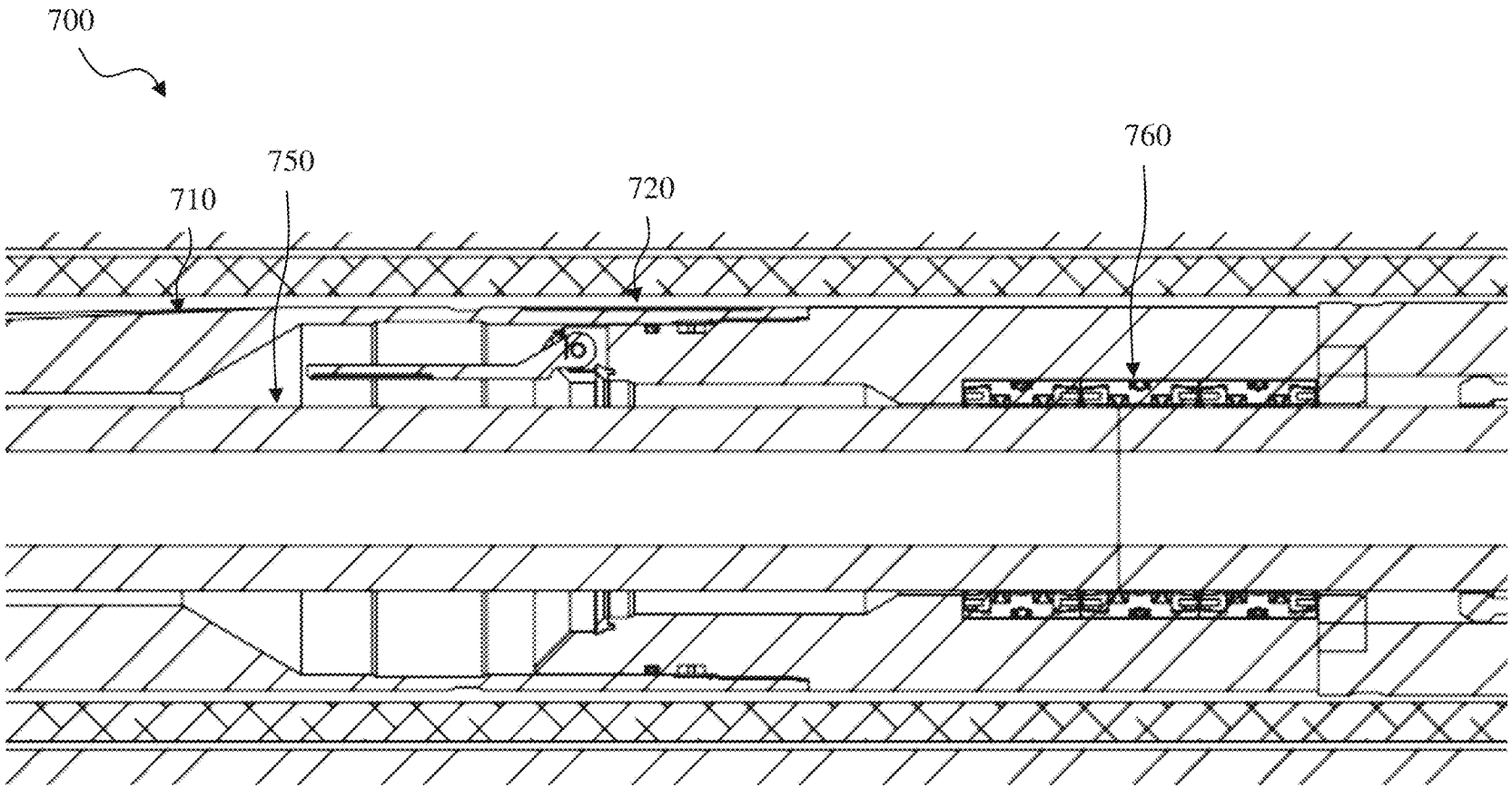

FIGS. 5B through 5E provide an operational sequence of the downhole tool of FIG. 5A;

FIGS. 6A and 6B illustrate different operational states of a downhole tool designed, manufactured and/or operated according to one or more alternative embodiments of the disclosure;

FIGS. 7A and 7B illustrate a downhole tool designed, manufactured and/or operated according to one or more embodiments of the disclosure;

FIGS. 8A through 8D illustrate a two-part drilling and running tool designed, manufactured and/or operated according to one or more embodiments of the disclosure;

FIGS. 9A through 18H illustrate an operational sequence for designing, manufacturing and/or operating a well system according to one embodiment of the disclosure; and FIGS. 19A through 31D illustrate an operational sequence for designing, manufacturing and/or operating a well system according to another embodiment of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

One challenge with constructing oil and gas wells in general and multilateral wells in particular is the costly rig time it takes to drill and complete a well. Reducing the number of trips required to construct a multilateral junction is a great way to reduce that time.

Presented here is a new multilateral system that combines several new features to achieve a significant reduction in the number of trips needed to build a multilateral junction. If all new features are implemented, a level 5 multilateral junction could be completed in 1 trip devoted exclusively to the multilateral technology (MLT), or in certain instances even less than 1 trip as further discussed below.

One example idea is to run the mainbore completion (e.g., lower main bore screens) with a whipstock, anchor them in the mainbore and establish an annular seal (e.g., if required). Then, one may release the running tool, turn it into a milling bottom hole assembly (BHA), mill the window exit, and drill a short rat hole and lateral wellbore. Once the lateral wellbore has been drilled, the lateral bore completion (e.g., lateral bore screens) may be dropped off, and on the same trip the upper part of the system (e.g., the whipstock) may be retrieved, exposing a set of seals for the junction to land in.

The new system proposed here also features a new latch collet design that incorporates a packer assembly to achieve an annular seal between the anchor and the casing of the main bore. To prevent premature compression of the packer elements, the new latch collet incorporates one or more (e.g., three) independent anti-preset features.

Also present is a new running tool that automatically releases once the latch collet has engaged with the correct latch coupling without any action required to be taken on the surface. Together, with the anti-preset features of the latch collet, this ensure that the running tool will only release when the BHA has reached the correct depth and orientation in the well.

Since, in at least one embodiment, the running tool is a solid piece with no moving parts, it is possible to realize further trip savings by employing a two part milling/running tool, such that the simple running tool becomes the milling assembly for milling the window from the main bore.

Once the lateral wellbore has been drilled, and lateral bore completion dropped off, the upper part of the bottom hole assembly (BHA) (e.g., the whipstock) may be retrieved, leaving behind the anchor part of the system which incorporates a set of seals. At this point, the junction may be installed into the well, for example by using a deflector-less system to direct the lateral leg out the window exit.

Trip savings have been one of the most important drivers of new technology development when it comes to multilateral technology. This system eliminates 4-5 trips that are currently required when constructing multilateral junctions of a trilateral well, which is an unprecedented leap forward in terms of operational efficiency over the current state of the art. This system also eliminates 2+ trips when constructing a multilateral junction of a single bilateral well, the benefits of which cannot be overstated.

Figure 1:
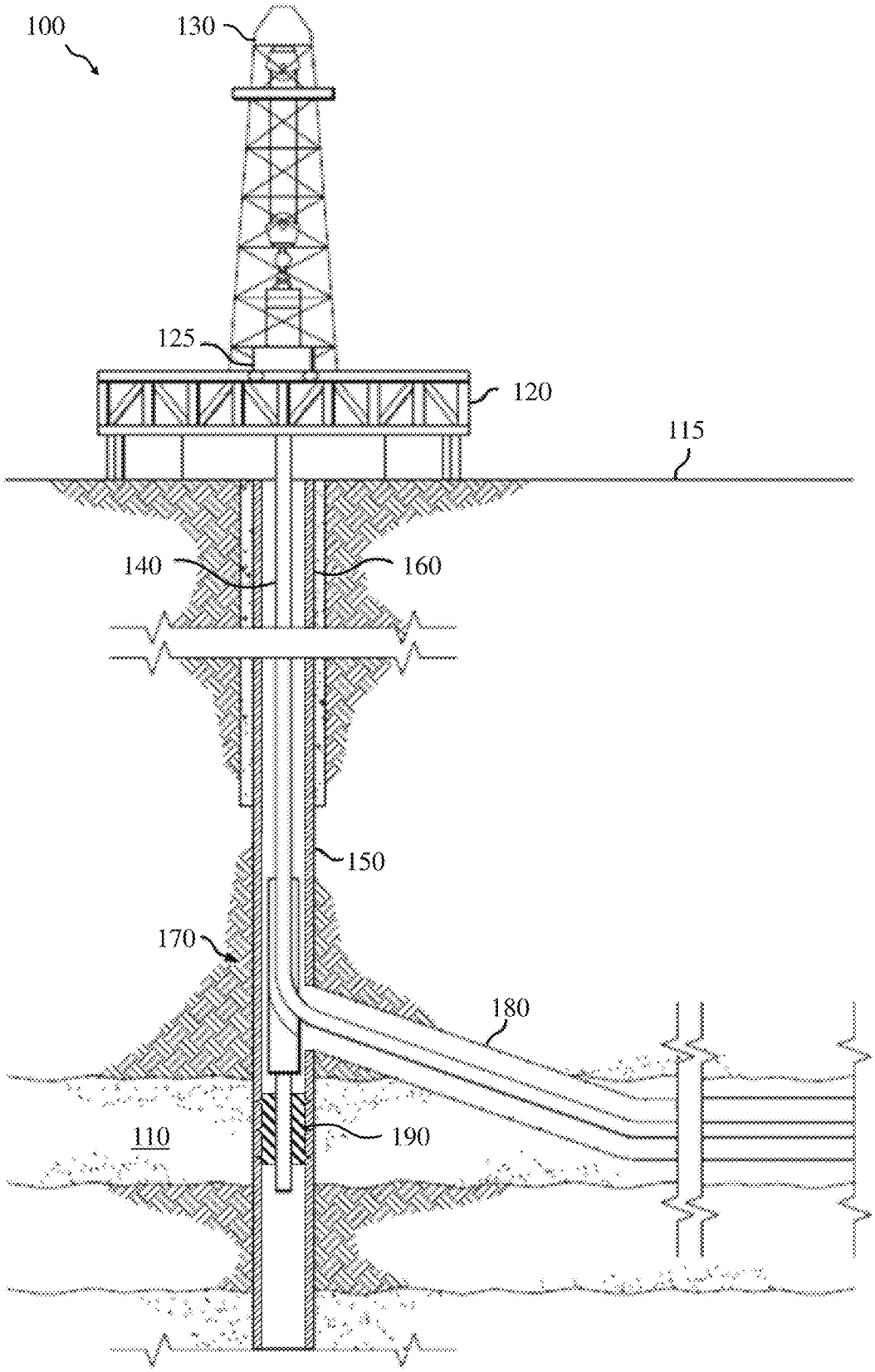
FIG. 1 is a schematic view of a well system designed, manufactured and operated according to one or more embodiments disclosed herein.

FIG. 1 is a schematic view of a well system 100 designed, manufactured and/or operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a primary wellbore from which another secondary wellbore is drilled. It is to be noted, however, that a main wellbore 150 does not necessarily need to extend directly to the earth's surface, but could instead be a branch of yet another lateral wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock assembly 170 according to one or more embodiments of the present disclosure may be positioned at a location in the main wellbore 150. Specifically, the whipstock assembly 170 could be placed at a location in the main wellbore 150 where it is desirable for a lateral wellbore 180 to exit. Accordingly, the whipstock assembly 170 may be used to support a drilling/milling tool used to penetrate a window in the main wellbore 150. In at least one embodiment, once the window has been milled and a lateral wellbore 180 formed, the whipstock assembly 170 may be retrieved and returned uphole by a retrieval tool, in some embodiments in only a single trip.

In some embodiments, an anchor assembly 190 may be placed downhole in the wellbore 150 to support and anchor downhole tools, such as the whipstock assembly 170, for maintaining the whipstock assembly 170 in place while drilling the lateral wellbore 180. The anchor assembly 190, in accordance with the disclosure, may be employed in a cased section of the main wellbore 150, such as shown, or may be located in an open-hole section of the main wellbore 150. As such, the anchor assembly 190 in at least one embodiment may be configured to resist at least 6,750 newton meters (Nm) (e.g., about 5,000 lb-ft) of torque. In yet another embodiment, the anchor assembly 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchor assembly 190 may be configured to resist at least 1814 kg (e.g., about 4,000 lb) of axial force. In yet another embodiment, the anchor assembly 190 may be configured to resist at least 4536 kg (e.g., about 10,000 lb) of axial force, and in yet another embodiment the anchor assembly 190 may be configured to resist at least 6804 kg (e.g., about 15,000 lb) of axial force.

In the illustrated embodiment, the anchor assembly 190 is a latch coupling. In this embodiment, the latch coupling (e.g., a profile in the casing engages with a reciprocal profile in another downhole tool) anchors the whipstock assembly 170, and any other features hanging there below (e.g., main wellbore completion, screens, valves, etc.) in the wellbore 150. Once the ancho assembly 190 reaches a desired location in the main wellbore 150, the reciprocal profile in the downhole tool (e.g., whipstock assembly 170) may be activated to engage with the profile in the casing string 160, thereby setting the anchor assembly 190. One aspect of the present disclosure provides a new latch coupling. The well system 100 may be manufactured using any one or more of the devices and/or methods disclosed below.

One embodiment of a well system (e.g., the well system 100 of FIG. 1) may incorporate several new features that all contribute to eliminating trips. Beginning with a down-hole end of the BHA, there is a latch collet. (See, FIGS. 2A & 2B). New, in this embodiment, is the addition of a set of packer elements at the up-hole end of the latch collet that when compressed will form an annular seal between the BHA and the main wellbore. (See, FIGS. 6A and 6B). New profiles between the collet fingers are there to allow torque to be transmitted between the latch collet and the inner mandrel.

To ensure that the packer elements are not prematurely energized, the latch mechanism incorporates several features that when taken together will ensure that the latch mechanism only actuates when in the correct latch coupling. Below the external profile on the collet fingers is a set of internal profiles (e.g., collet prop buttons) that match groves on the OD of the mandrel. (See, FIGS. 2A and 2B) When the latch collet is inside of the system casing size, the collet fingers are compressed and the internal profiles (e.g., collet prop buttons) engage the OD groves on the mandrel, preventing relative axial movement between the latch collet and the mandrel. Once the latch collet latches into a latch coupling, the collet fingers snap out into the pockets in the latch coupling, and the internal profiles (e.g., collet prop buttons) retract from the groves in the mandrel thereby allowing movement between the mandrel and latch collet.

To prevent movement between the latch collet and the mandrel if the latch mechanism is in larger casing when the latch collet fingers are not compressed, the upper part of the latch mechanism incorporates a bore sensor. (See, FIGS. 5A through 5E). This bore sensor locks the latch collet and mandrel together when not in system size casing (see, FIG. 5B), and unlocks when in the correct casing (see, FIG. 5C). Placing the bore sensor above the latch collet ensures that the mandrel and latch collet are always locked together, until the latch coupling is reached. For example, when entering a liner, the latch collet fingers will lock onto the mandrel, before the bore sensor unlocks.

Moreover, a set of shear screws may also be used, which can be varied in quantity (or omitted entirely), to require a certain amount of weight to be set down before the latch mechanism will actuate. (See, FIGS. 5A through 5E).

Once all three features have been triggered, the packer elements are compressed, and the annular seal is established by setting down weight. At the end of the stroke, a locking snap ring may be used to ensure that the mechanism does not release again. This snap ring may also be designed to shear at a certain load such that the latch collet may be released, if necessary. Similarly (e.g., simultaneously), the profiles on the ID of the latch collet (e.g., collet prop buttons) may move out of their corresponding grooves in the mandrel. When dimensioned correctly this will serve to prop open the latch collet preventing it from releasing from the latch coupling as long as it is prevented from moving axially relative to the mandrel (e.g., the above-mentioned snap ring).

It is possible to combine the above-described latch mechanism with a new style running tool that automatically releases once the latch mechanism has locked into the latch coupling. A running tool collet inside the mandrel may be used to connect the running tool to the latch mechanism. Prior to setting the latch mechanism, profiles in the OD of the running tool collet engage with dogs that protrude through the body of the mandrel. In this state the dogs may lock the collet in tension, though they may also be used for compression and torque. Before the latch mechanism has actuated, the dogs are held in place by the body of the latch collet. Once the latch collet moves into the final position the dogs are free to move radially outward thereby also unlocking the running tool collet. (See, FIGS. 5A through 5E).

Once the latch mechanism has locked into the latch coupling, simply applying tension to the tool string will free the running tool with no further action required on the surface. As the running tool is pulled up, the running tool collet pushes the unsupported dogs radially outward and at the end of the travel and the collet fingers are free to expand over the body of the running tool. Continuing to pull on the running tool will retract the milling features into the outer mill body thereby creating a combined milling assembly.

The running tool may be used to install two separate assemblies in the well. The anchor, of which the latch mechanism is a part, and the whipstock assembly. The anchor features a set of seals for a multilateral junction, and above that a Muleshoe profile as well as groves and slots for transmitting tension, compression, and torque. This part may be used to allow for a straight pull to shear some shear screws and release the whipstock.

A lower portion of the whipstock assembly may be connected to the running tool collet in such a way to allow the two to move relative to each other, such that the running tool collet can release the running tool and be retrieved with the whipstock when it is retrieved. A connecting piece engages with the completion seals in the anchor assembly thereby providing pressure integrity between the whipstock and the anchor. Depending on the application it may or may not be necessary to have this temporary seal.

A second set of seals may be present in the whipstock assembly, the second set of seals scaling on the OD of the running tool thereby completing the pressure barrier. With a fully sealed system, as described, it would be possible to use the system to apply pressure to components below the anchor or to circulate.

As presented in one embodiment, the whipstock assembly incorporates a fluid loss device (e.g., including a flapper valve) that is held open by the running tool and automatically closes once the running tool is pulled back. (See, FIGS. 7A and 7B). This serves as a fluid loss device while drilling the lateral, thereby protecting the main wellbore from drilling pressures, and also prevents milling/drilling debris from entering further. Since the flapper valve is part of the retrievable whipstock assembly, once it is retrieved after the lateral has been drilled, the main wellbore will once again be in communication to the rest of the well. The milling/drilling debris may also be retrieved with the whipstock, leaving behind a clean seal assembly in the anchor assembly. Depending on the well and/or field, this may or may not be acceptable and the isolation may need to be maintained until a later time, perhaps until after the junction has been installed. In such instances, the fluid loss device may instead be installed in a different part of the system, or it may be omitted entirely. Likewise, while a flapper valve style fluid loss device is shown, many other types of flow/pressure isolating devices may be used.

The whipstock assembly may include a set of holes through the body. These are for a hydraulic retrieving tool to engage with and retrieve the whipstock assembly. Nevertheless, this is not the only way that a whipstock assembly can be retrieved. In the interest of brevity, whipstock retrieval options will not be discussed as part of this disclosure, but it is understood that any whipstock retrieval option may be used, and a typical whipstock is designed for several contingencies.

Returning to the two-part drilling assembly, once the smaller assembly, inner mill, is pulled back it will engage with the larger bit assembly. (See, FIGS. 8A through 8D). At this point locking the two mills together is important for the successful milling of the window exit. A no-go shoulder is there to provide a hard stop once the smaller assembly is pulled into position. A one-way mechanism is used to then prevent the smaller assembly from coming back out of the larger bit assembly. (See, FIGS. 8A through 8D). A spring pushes a segmented cone downward into a narrowing space inside the larger bit assembly, such that it is squeezed onto the OD of the body of the smaller assembly. Downward movement of the smaller assembly will be prevented by the geometry of the cone and ID of the larger bit assembly, the more downward force is applied the harder the smaller assembly will be squeezed.

In addition to preventing axial movement between the two mills, it is important to ensure that torque applied to the smaller assembly by the drill string is transmitted to the larger bit assembly. With sufficient axial force applied as described above, this is not a problem, as this is the operating principle of collet chucks that are used in many different applications. As an additional feature to aid with torque transfer, profiles may be added to the two mills and match the shape of the segmented cone fingers. (See, FIGS. 8A through 8D). Friction enhancing surface treatments, or geometries may be added to the various components to enhance grip and make for a better connection.

The operational sequence for this system would, in one embodiment, start off by having a latch coupling already installed in the well. Then the main wellbore screens and whipstock/anchor assembly may be latched into the latch coupling. Weight may then be set down to energize the packer elements, and in the same sequence the running tool is released. Pulling up retracts the running tool from the whipstock assembly bore, and the flapper valve closes creating a fluid loss barrier. The smaller assembly of the two-part drilling and running tool may then be further pulled uphole until the larger bit assembly is tagged, and then may shear off. At this point, normal window milling and lateral drilling operations can commence. The lateral screens may then be dropped off, and a whipstock retrieving tool that is connected to the liner running tool may be used to retrieve the whipstock. The junction may then be installed, landing (e.g., simultaneously landing) in the seals in the main wellbore anchor, and then tying back the already dropped off lateral liner and/or screens. Since, in this embodiment, there is no completion deflector, the lateral leg of the junction may need to employ a deflector less solution to exit out into the lateral. Again, such an operational sequence can save 4-5 trips when constructing one or more multilateral junctions of a trilateral well, and 2+ trips when constructing a multilateral junction of a single bilateral well.

Operational Sequence of One Embodiment

0) Main wellbore latch coupling is present in well;
1) Run whipstock/anchor assembly and main wellbore lower completion string;
2) Latch in to latch coupling;
3) Set down weight;
   a. Energize packer elements, if present; and
   b. Release running tool;
4) Pull up running tool/smaller assembly;
   a. Flapper valve closes;
   b. Lock smaller assembly and larger bit assembly together to form combined bit assembly; and
   c. Shear off the combined bit assembly from the whipstock assembly;
5) Mill window;
6) Drill lateral;
7) Drop off lateral lower completion;
8) Retrieve whipstock assembly; and
9) Land multilateral junction.

Operational Sequence of Another Embodiment

1) Main wellbore latch coupling is present in well;
2) Run whipstock/anchor assembly and main wellbore lower completion string;
3) Latch in to latch coupling;
4) Set down weight;
   a. Energize packer elements, if present; and
   b. Release running tool;
5) Pull up running tool/smaller assembly;
   a. Flapper valve closes;
   b. Lock smaller assembly and larger bit assembly together to form combined bit assembly; and
   c. Shear off the combined bit assembly from the whipstock assembly;
6) Mill window;
7) Drill lateral;
8) Drop off lateral lower completion; and
9) Land multilateral junction with whipstock assembly in place.

Since the upper part of the system (e.g., the whipstock assembly) is retrieved, the lower anchor can have a larger ID. This means that it is possible to install a junction that is compatible with the intelligent completions such as the FlexRite® MIC family of junctions.

As can be appreciated, with a large system there are several changes that can be made to tailor the system for other applications. One possible variation is in the selection of anchoring in the main bore. While the latch collet and latch coupling have been discussed in detail above, the ideas have more universal applications. For example, in place of a latch coupling an XtremeGrip® MLT anchor may be used with the compatible latch mechanism. As discussed above, the XtremeGrip® compatible latches feature a mandrel and an external housing that slides relative to the mandrel. Incorporating the automatic release features and anti-preset features into a different latch mechanism is quite feasible. Selecting this alternative has the benefit of allowing the system to be used for existing well that may not have a latch coupling already present.

It would also be possible to incorporate more components from a traditional packer into the system. The axial movement could also be used to set slips into the casing, thereby achieving the required mechanical anchoring. This variation could have a far simpler profile in the well than a latch coupling, perhaps just a recessed no-go.

A major change that could be made to the system is to remove the whipstock assembly disconnect features and instead have the whipstock be installed permanently with the latch collet in the well. In this embodiment, the whipstock assembly would incorporate completion seals to ensure pressure integrity for the life of the well. These seals may be the same seals in the same location as the seals previously discussed that seal on the body of the running tool, below the flapper valve. With this variation, once the lateral is drilled the lateral screens could be run on the junction and installed at the same time. A flapper valve may be present in the same location to protect the main wellbore from drilling pressures as well as milling/drilling debris. This flapper valve could then be broken while landing the junction with the main wellbore seal stinger, or a different kind of valve could be shifted open. If implemented as described, this embodiment would be a "zero trip" system that does not require any trips that are solely devoted to the construction of a multilateral junction. One likely required sacrifice of this option is the change to a junction that may not be compatible with intelligent completions since the bore in the whipstock is not large enough to accommodate all the necessary equipment.

This system is also stackable, as in multiple junctions can be installed in the same well. The upper whipstock/anchor assembly would have the lower junction connected to it instead of the main bore screens as described earlier.

Furthermore, a latch system different from that described above could also be used. A challenge is to latch in and set various orientation-critical well equipment in a matching well bore latch profile, such as a whipstock and/or a deflector device for a multilateral installation, without the need for latch profile pre-orientation, and/or an additional verification run to confirm latch profile orientation in the wellbore casing upon installation at depth.

An adaptive orienting latch according to the present disclosure could be used. The adaptive orienting latch (e.g., a latch-in device, for locking in various well equipment at depth and within a specific required orientation range), in one embodiment, consists of a latch collet, as the anchor of the orientational critic well equipment, and a latch coupling with an internal mating profile, run and installed in a well bore as a part of the casing liner run. The latch coupling, when placed within the wellbore, does not require any orientational alignment to the wellbore casing. The latch collet, run in as part of the well equipment, also does not require any orientational alignment to its connected well equipment. Upon reaching the planned depth of the latch coupling with the latch collet, the latch collet will be oriented, by the help of an orientation device in the running string. The latch collet may have one or more selector profiles (e.g., having multiple shoulders), and multiple torque buttons set up in a pattern to match the latch coupling torsional slots in any orientation, such that the latch collet will lock in independent of its orientation. The latch coupling is set up with multiple sets of matching torque slots, axially through the collet, where the latch collet torque buttons engage to hold in torsional loading. The number of matching profiles determines the accuracy of latch in orientation. For example, if:

- two matching profiles were used, the accuracy would be ±90 degrees;
- four matching profiles were used, the accuracy would be ±45 degrees;
- six matching profiles were used, the accuracy would be ±30 degrees;
- ten matching profiles were used, the accuracy would be ±18 degrees;
- sixteen matching profiles were used, the accuracy would be ±11.25 degrees;
- matching profiles were used, the accuracy would be ±9 degrees; and Etc. . . .

The latch collet has multiple sets of torque buttons. In the illustrated embodiment, the multiple sets of torque buttons may each be separated into multiple linearly aligned and spaced apart torque button portions (e.g., three torque button portions in the illustrated embodiment). In one or more embodiments, the torque buttons (and/or torque button portions) may be set up in an alternating pattern to increase debris tolerance and engagement into the latch coupling.

The latch collet, in the illustrated embodiment, may also have one or more coupling selector buttons. In one or more embodiments, the latch collet includes an uphole coupling selector button and a downhole coupling selector button. In accordance with one embodiment, the one or more coupling selector button include one or more transaxial compressive shoulders (e.g., a set of three transaxial compressive shoulders) and one or more transaxial tensile shoulders (e.g., a set of three transaxial tensile shoulders), locking the latch collet at depth into the latch coupling upon latching in. The latch collet may also be propped and locked into position, as discussed in the paragraphs above employing the mandrel, for increased latch rating or permanent anchoring by an internal mandrel.

The coupling selector buttons, in at least one embodiment, may be used to selectively engage with one latch coupling while passing upon another latch coupling. For example, a size and/or shape of the coupling selector buttons may change based upon the latch collet selector profiles in the latch coupling that a particular coupling selector button is intended to engage with. For example, if the latch couplings were installed within the wellbore, each having sequentially smaller latch collet selector profiles (e.g., from heal to toc), then larger coupling selector buttons would pass the smaller latch collet selector profiles until such time as the coupling selector buttons matched with the latch collet selector profiles in the latch collet.

One novelty of this new adaptive orienting latch lies in how the latch collet can latch in and lock into the latch coupling at any desired orientation without any required pre-alignment of latch collet or orientation (or verification) of the casing latch coupling upon casing liner installation in wellbore. The latch collet torque buttons, in combination with its transaxial shoulders, has a novel method of locking into the latch couplings profile, at depth and at desired orientation, even though the latch couplings orientation is an unknown.

With the adaptive orienting latch, an operator will be able to run and install casing liner to depth without need to rotate or orient. This means less risk, and potentially longer sections with increased well exposure. Also, if the adaptive orienting latch is being run in multiple sections of liner, alignment in between is no longer critical and can be disregarded. This leads to reduced time spent on alignment and reduced potential risk of misalignment. The adaptive latch coupling does not require any alignment to the connected well equipment and may be installed in any orientation with respect to the whipstock taper. This will then reduce and/or eliminate the risk of any misalignment upon the assembly process.

Figure 4A:
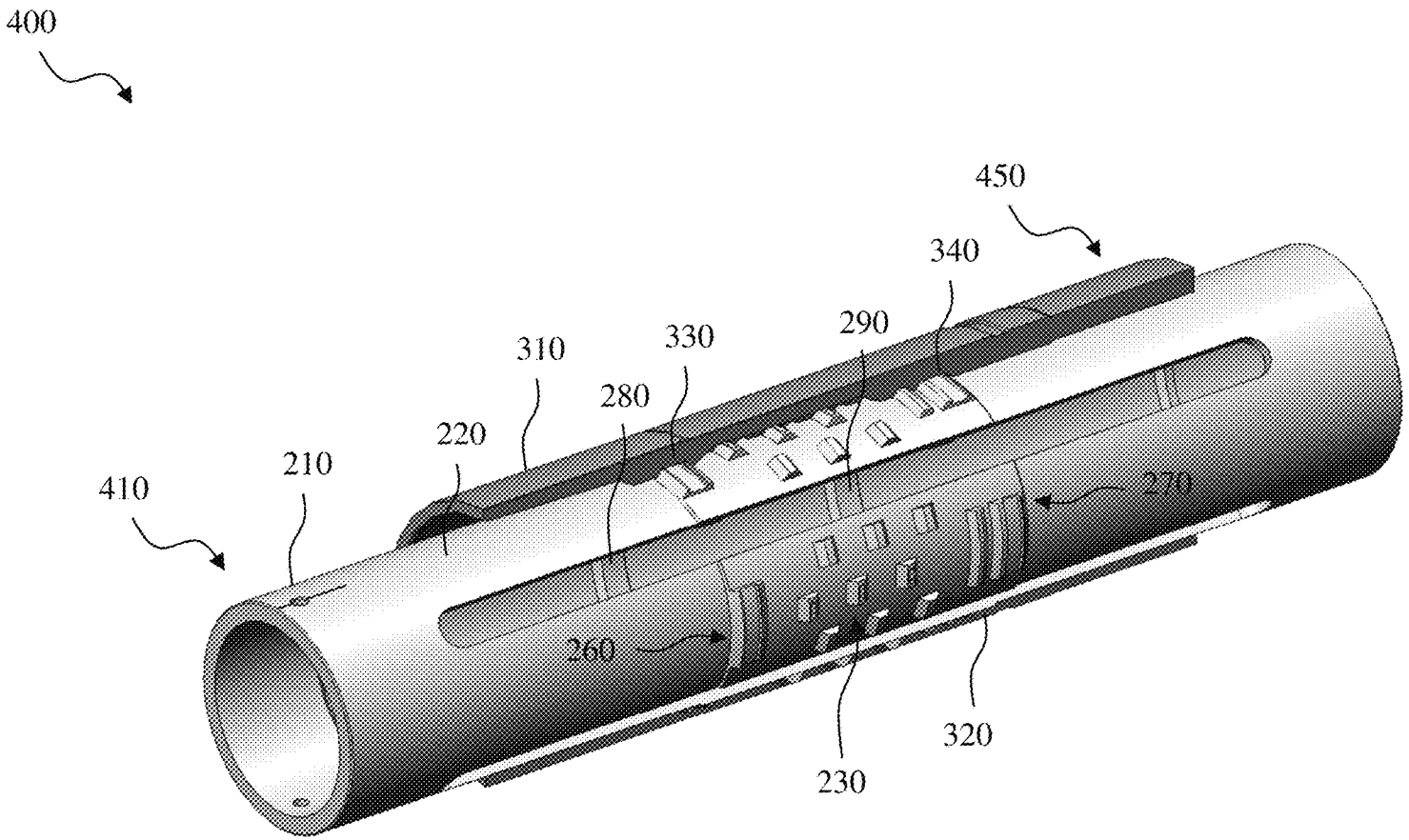
FIGS. 4A through 4C illustrate one embodiment of how a latch collet designed, manufactured and/or operated according to one or more embodiments of the disclosure engages with a latch coupling designed, manufactured and/or operated according to one or more embodiments of the disclosure.
Figure 4B:
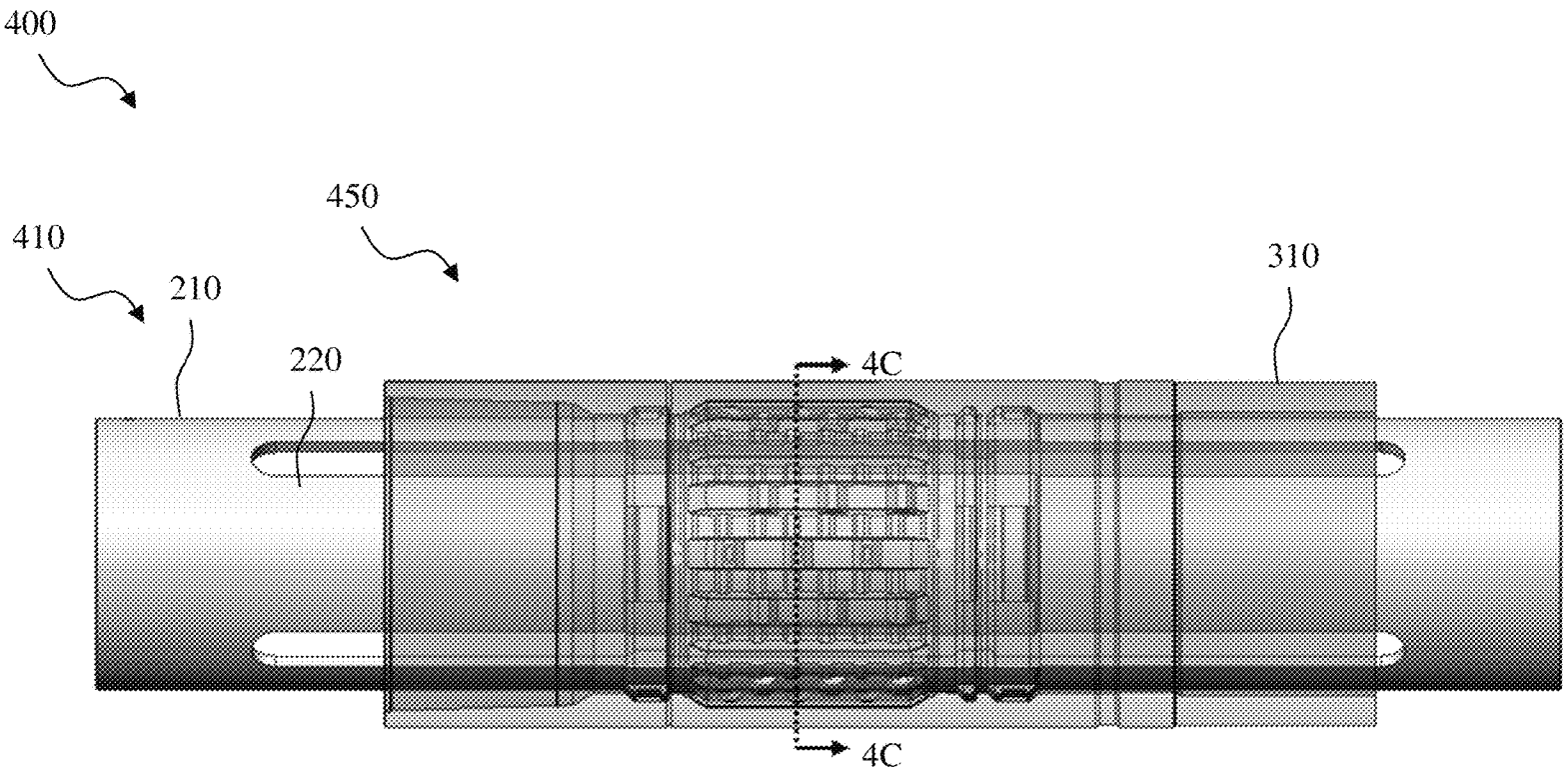
Figure 4C:
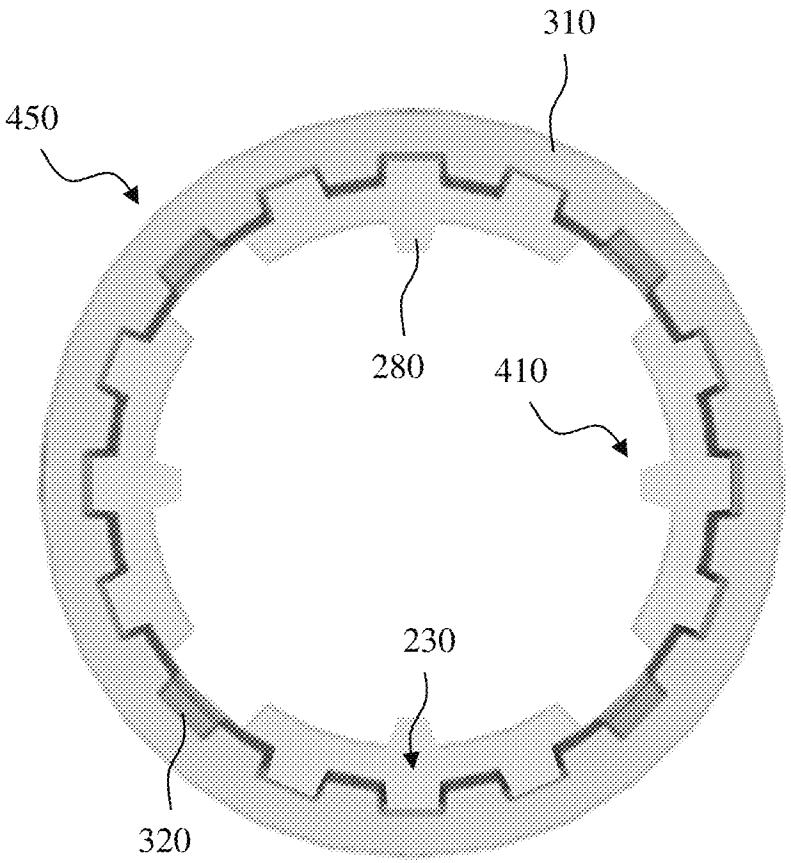

One embodiment of the adaptive orienting latch is shown in FIGS. 4A through 4C. As shown, the adaptive orienting latch has two main components, the latch coupling, with the inner plurality of axial alignment slots, and the mating latch collet. The latch coupling will be made up to the casing sting and run in hole. The latch collet will be made up as a subcomponent to the planned well equipment, such as a whipstock and or a deflector. Depending on operational requirements, an inner mandrel may also be installed to allow for the latch collet to become propped and thereby fully locked into the latch coupling.

Figure 2A:
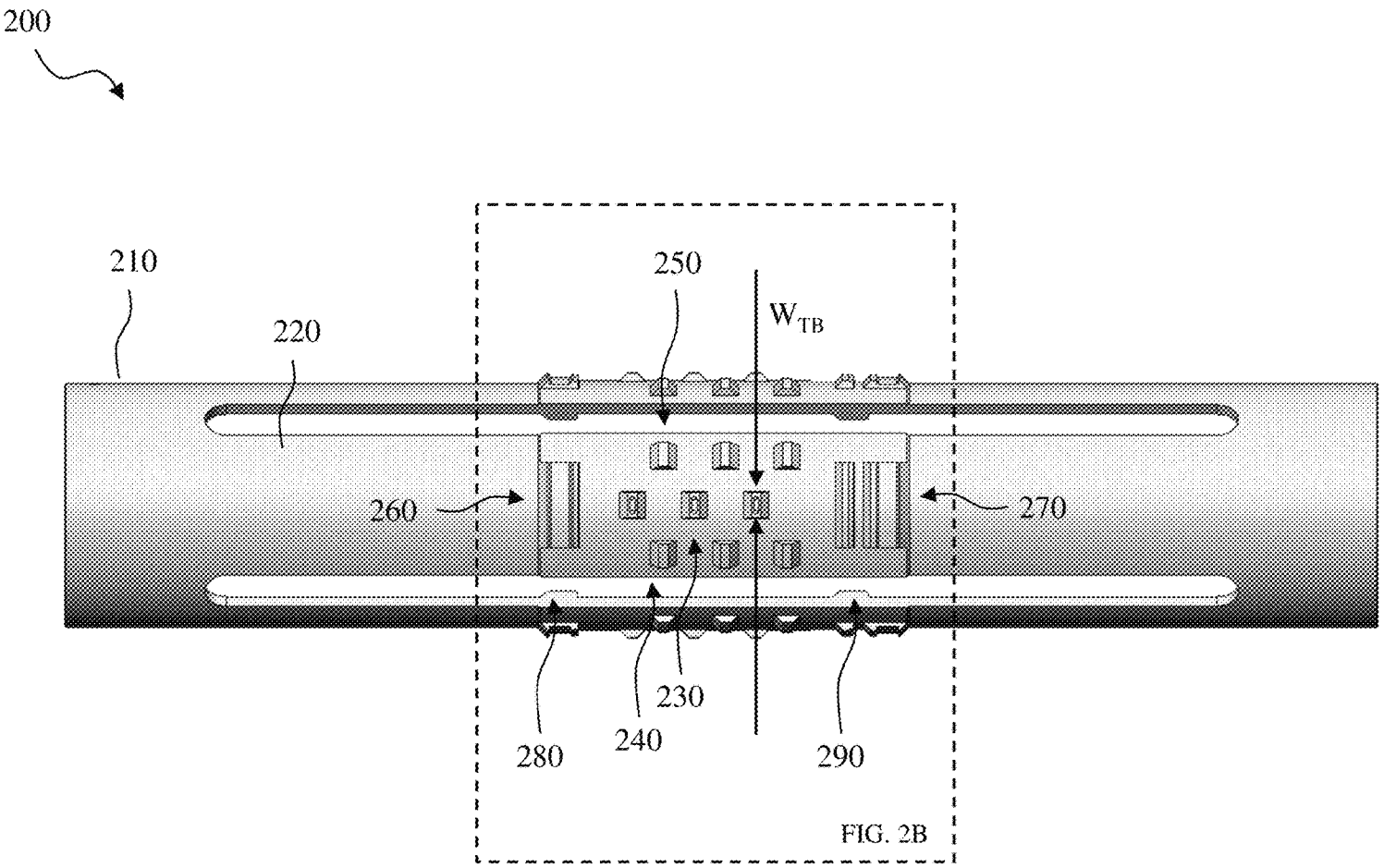
FIGS. 2A and 2B illustrate different views of a latch collet designed, manufactured and/or operated according to one or more embodiments of the disclosure.
Figure 2B:
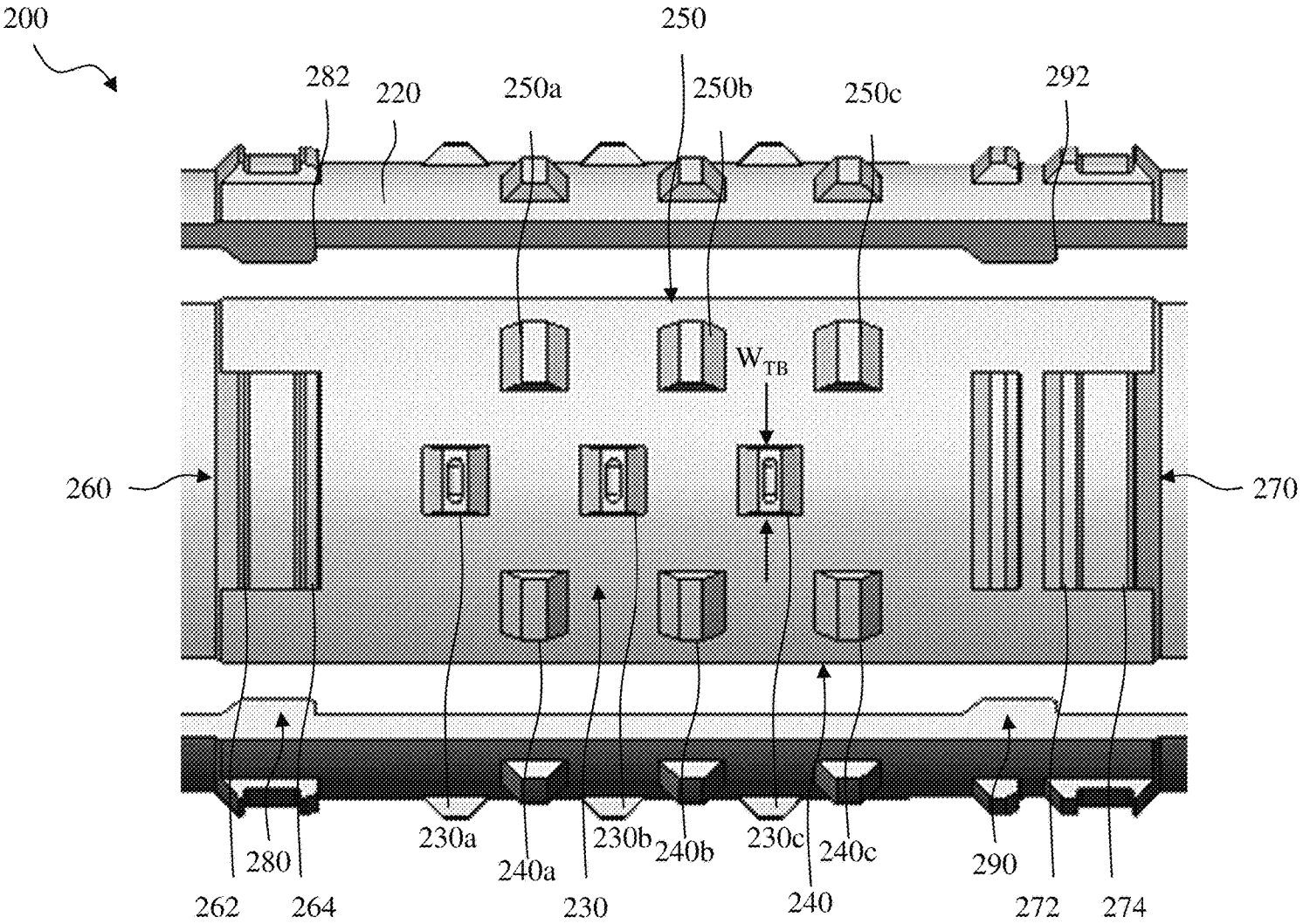

As shown in FIGS. 2A and 2B, the latch collet has multiple torque buttons in combination with the transaxially shoulders. All of these torque buttons hold torsional loading applied after latching in at depth. Again, while the embodiment of FIGS. 2A and 2B illustrate each torque button having a set of torque button portions, other embodiments exist wherein each torque button is a single longitudinal torque button. As the latch collet is run into the latch coupling, the transaxial shoulders will engage and the torque buttons will engage into closest aligned position of the latch couplings axially alignment slots by applying any torsional loading.

In at least one embodiment, each of the torque buttons is substantially similarly shaped. For example, a width ($W_{TB}$) of each of the torque buttons would be within 10% of each other. In yet another embodiment, the torque buttons are ideally similarly shaped, for example having the width ($W_{TB}$) within 5% of each other. In yet another embodiment, the torque buttons are perfectly similarly shaped, for example having the width ($W_{TB}$) within 2% of each other.

Similarly, in at least one embodiment, each of the axial alignment slots in the latch coupling is substantially similarly shaped. For example, a width ($W_{AS}$) of each of the axial alignment slots would be within 10% of each other. In yet another embodiment, the axial alignment slots are ideally similarly shaped, for example having the width ($W_{AS}$) within 5% of each other. In yet another embodiment, the axial alignment slots are perfectly similarly shaped, for example having the width ($W_{AS}$) within 2% of each other.

As will be evident given the disclosure, the similarly sized (e.g., and shaped) torque buttons and axial alignment slots allow for a plurality (e.g., if not 4 or more, 6 or more, 10 or more, 16 or more, etc.) different coupling orientations.

Turning to FIGS. 2A and 2B, illustrated are different views of a latch collet 200 designed, manufactured and/or operated according to one or more embodiments of the disclosure. The latch collet 200, in the illustrated embodiment, includes a collet body 210. In accordance with one or more embodiments, the collet body 210 has a plurality of collet fingers 220. In the illustrated embodiment, the collet body 210 includes four collet fingers 220. Nevertheless, other embodiments may exist wherein less than four collet fingers 220 may be used (e.g., as long as there are at least two), or more than four collet fingers 220 may be used.

The latch collet 200, in one or more additional embodiments, may additionally include a torque button 230 located on a radial exterior of each of the plurality of collet fingers 220. In at least one embodiment, each of the torque buttons 230 is substantially similarly shaped. For example, a width ($W_{TB}$) of each of the torque buttons 230 would be within 10% of each other. In yet another embodiment, the torque buttons 230 are ideally similarly shaped, for example having the width ($W_{TB}$) within 5% of each other. In yet another embodiment, the torque buttons 230 are perfectly similarly shaped, for example having the width ($W_{TB}$) within 2% of each other.

In one or more embodiments, such as illustrated in FIGS. 2A and 2B, each of the torque buttons 230 includes multiple linearly aligned and spaced apart torque button portion 230*a*, 230*b*, 230*c*. While three linearly aligned and spaced apart torque button portion 230*a*, 230*b*, 230*c* are illustrated in FIGS. 2A and 2B, other embodiments exist wherein more or less than three linearly aligned and spaced apart torque button portion 230*a*, 230*b*, 230*c* are used.

In the embodiment of FIGS. 2A and 2B, the torque button 230 is a first torque button located on a radial exterior of each of the plurality of fingers 220, the latch collet 200 further including a second torque button 240 located on the radial exterior of each of the plurality of fingers 220. In accordance with this one embodiment, the width ($W_{TB}$) of each of the second torque buttons 240 is within 10% of each other and the first torque buttons 230. Further to this embodiment, each of the second torque buttons 240 may include multiple (e.g., three) linearly aligned and spaced apart second torque button portions 240*a*, 240*b*, 240*c*. In accordance with at least one embodiment, the multiple linearly aligned and spaced apart torque button portions 230*a*, 230*b*, 230*c* and the multiple linearly aligned and spaced apart second torque button portions 240*a*, 240*b*, 240*c* are at least partially axially offset from each other, thereby forming a debris path.

While not required, in the embodiment of FIGS. 2A and 2B, a third torque button 250 may be located on the radial exterior of each of the plurality of fingers 220. In accordance with this one embodiment, the width ($W_{TB}$) of each of the third torque buttons 250 is within 10% of each other, of the second torque buttons 240, and the first torque buttons 230. Further to this embodiment, each of the third torque buttons 250 includes multiple (e.g., three) linearly aligned and spaced apart third torque button portions 250*a*, 250*b*, 250*c*. In accordance with at least one embodiment, the multiple linearly aligned and spaced apart torque button portions 230*a*, 230*b*, 230*c*, the multiple linearly aligned and spaced apart second torque button portions 240*a*, 240*b*, 240*c*, and the multiple linearly aligned and spaced apart third torque button portions 250*a*, 250*b*, 250*c* are at least partially axially offset from each other, thereby forming the debris path.

The number of torque buttons may vary depending on the design of the latch collet 200, as well as the rotational accuracy necessary for the latch collet 200. For example, if:

- two torque buttons 230 were used, the accuracy would be ±90 degrees;
- four torque buttons 230 were used, the accuracy would be ±45 degrees;
- six torque buttons 230 were used, the accuracy would be ±30 degrees;
- ten torque buttons 230 were used, the accuracy would be ±18 degrees;
- sixteen torque buttons 230 were used, the accuracy would be ±11.25 degrees;
- twenty torque buttons 230 were used, the accuracy would be ±9 degrees; and
- Etc. . . .

The latch collet 200 of FIGS. 2A and 2B additionally includes a coupling selector button 260 located on the radial exterior of each of the plurality of fingers 220, the coupling selector button 260 configured to engage with a selector profile in a latch coupling. In the embodiment of FIGS. 2A and 2B, the coupling selector button 260 is an uphole coupling selector button located uphole of the torque buttons 230, and the latch collet 200 further includes a downhole coupling selector button 270 located on the radial exterior of each of the plurality of fingers 220 and downhole of the torque buttons 230.

In one or more embodiments, each of the uphole coupling selector buttons 260 and the downhole coupling selector buttons 270 has a width ($W_{SP}$) greater than the width ($W_{TB}$). In at least one embodiment, the width ($W_{SP}$) is at least 2 times greater than the width ($W_{TB}$). In one other embodiment, each of the uphole coupling selector buttons 260 has tensile and compressive shoulders 262, 264, respectively, and each of the downhole coupling selector buttons 270 has tensile and compressive shoulders 272, 274, respectively.

The latch collet 200, in one or more embodiments, may additionally include a collet prop button 280 located on a radial interior of each of the plurality of collet fingers 220. In one or more embodiments, the collet prop button 280 is configured to engage with a profile of a mandrel for running the latch collet 200 downhole. Thus, in one embodiment, the collet prop button 280 is configured to be propped radially outward by the mandrel to cause torque buttons (e.g., 230, 240, 250) located on a radial exterior of each of the plurality of fingers 220 to remain engaged with associated alignment profiles in a latch coupling when positioned at an acceptable position downhole.

In the embodiment of FIGS. 2A and 2B, the collet prop button 280 located on the radial interior of each of the plurality of fingers 220 is a first collet prop button, and the latch collet 200 further includes a second collet prop button 290 located on the radial interior of each of the plurality of fingers 220. In one or more embodiments, the first collet prop buttons 280 and the second collet prop buttons 290 are similarly shaped (e.g., within 10 percent of each other). In one or more other embodiments, the first collet prop buttons 280 and the second collet prop buttons 290 are located within a center 50 percent of the plurality of fingers 220.

Furthermore, in one or more embodiments, the first collet prop buttons 280 include compression shoulders 282, and the second collet prop buttons 290 include compression shoulders 292. In yet another embodiment, neither the first collet prop buttons 280 nor the second collet prop buttons 290 include tensile shoulders.

Figure 3A:
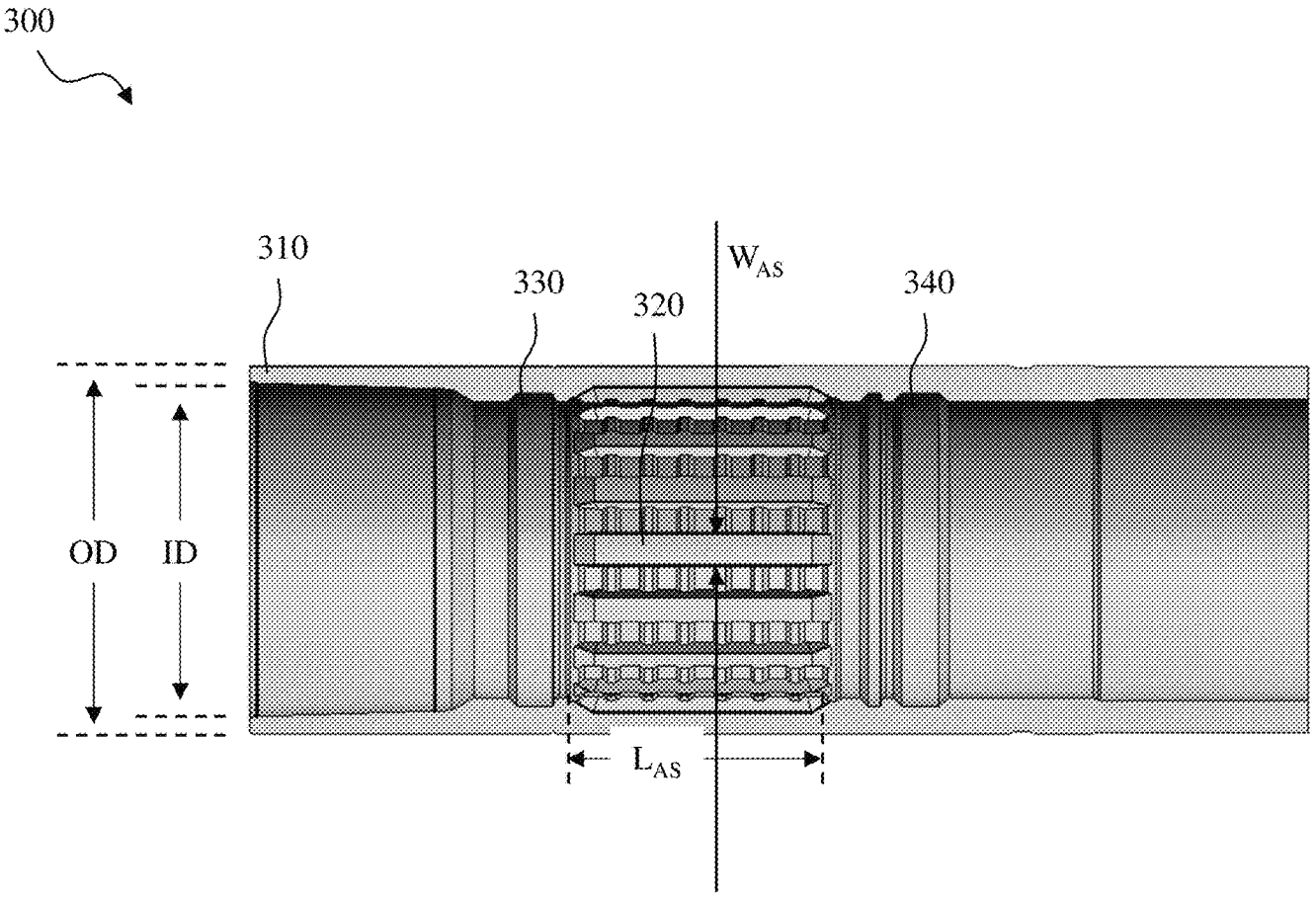
FIGS. 3A and 3B illustrate different views of a latch coupling designed, manufactured and/or operated according to one or more alternative embodiments of the disclosure.
Figure 3B:
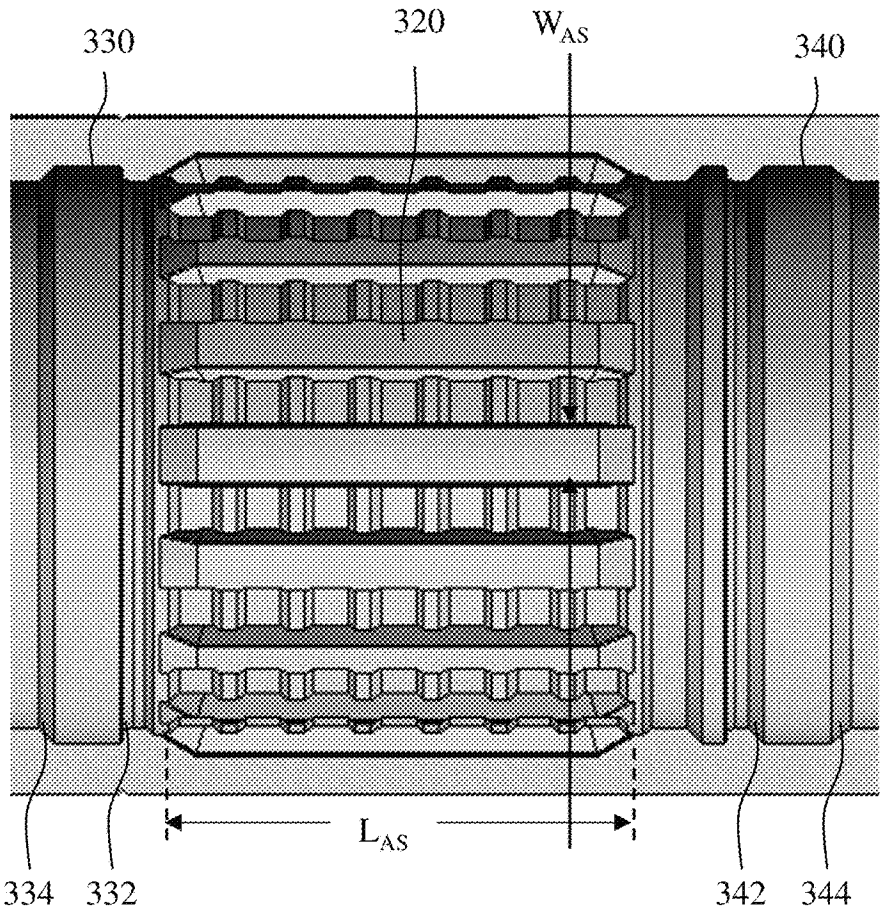

Turning to FIGS. 3A and 3B, illustrated is a latch coupling 300 designed, manufactured and/or operated according to one or more embodiments of the disclosure. The latch coupling 300, in one or more embodiments, may be positioned inline with wellbore tubing, such as wellbore casing. In the illustrated embodiment of FIGS. 3A and 3B, the latch coupling 300 includes a housing 310. The housing 310, in one embodiment, has an outside diameter (OD) and an inside diameter (ID).

In accordance with one embodiment of the disclosure, the latch coupling 300 further includes a plurality of axial alignment slots 320 located along the inside diameter (ID) of the housing 310. The plurality of axial alignment slots 320, in one or more embodiments, are configured to engage with related torque buttons of an associated latch collet (e.g., latch collet 200 of FIGS. 2A and 2B). In one or more embodiments, each of the axial alignment slots 320 in the latch coupling 300 is substantially similarly shaped. For example, a width ($W_{AS}$) of each of the axial alignment slots 320 would be within 10% of each other. In yet another embodiment, the axial alignment slots 320 are ideally similarly shaped, for example having the width ($W_{AS}$) within 5% of each other. In yet another embodiment, the axial alignment slots 320 are perfectly similarly shaped, for example having the width ($W_{AS}$) within 2% of each other. In one or more embodiments, the plurality of axial alignment slots 320 each have a length ($L_{AS}$), and further wherein the length ($L_{AS}$) is at least 3 times the width ($W_{AS}$).

The number of axial alignment slots 320 may vary depending on the design of the latch coupling 300, as well as the rotational accuracy necessary for the latch coupling 300. For example, if:

- two axial alignment slots 320 were used, the accuracy would be ±90 degrees;
- four axial alignment slots 320 were used, the accuracy would be ±45 degrees;
- six axial alignment slots 320 were used, the accuracy would be ±30 degrees;
- ten axial alignment slots 320 were used, the accuracy would be ±18 degrees;
- sixteen axial alignment slots 320 were used, the accuracy would be ±11.25 degrees;
- twenty axial alignment slots 320 were used, the accuracy would be ±9 degrees; and Etc. . . .

In at least one embodiment, the plurality of axial alignment slots 320 is at least ten axial alignment slots 320, and further wherein the width ($W_{AS}$) of each of the at least ten axial alignment slots 320 is within 10% of each other. Nevertheless, in one or more embodiments, the plurality of axial alignment slots 320 is at least ten axial alignment slots 320, and further wherein the width ($W_{AS}$) of each of the at least ten axial alignment slots 320 is within 10% of each other. In yet another embodiment, the plurality of axial alignment slots 320 is at least sixteen axial alignment slots 320, and further wherein the width ($W_{AS}$) of each of the at least sixteen axial alignment slots 320 is within 10% of each other.

The latch coupling 300, in one or more embodiments, may additionally include a radial extending latch collet selector profile 330 located along the inside diameter (ID) of the housing 310. For example, in one or more embodiments, the radial extending latch collet selector profile 330 is an uphole radial extending latch collet selector profile located uphole of the plurality of axial alignment slots 320, and the latch coupling 300 further includes a downhole radial extending latch collet selector profile 340 located along the inside diameter (ID) of the housing 310 and downhole of the plurality of axial alignment slots 320. In one or more embodiments, the uphole radial extending latch collet selector profile 330 and the downhole radial extending latch collet selector profile 340 are configured to engage with related coupling selector buttons (e.g., coupling selector buttons 260, 270) of a latch collet.

In one or more embodiments, the uphole radial extending latch collet selector profile 330 and the downhole radial extending latch collet selector profile 340 each extends 360 degrees around the housing. In yet other embodiments, the uphole radial extending latch collet selector profile 330 and the downhole radial extending latch collet selector profile 340 each include tensile shoulders 332, 342, respectively, or compressive shoulders 334, 344, respectively. In even yet another embodiment, the uphole radial extending latch collet selector profile 330 and the downhole radial extending latch collet selector profile 340 each include tensile shoulders 332, 342, respectively, and compressive shoulders 334, 344, respectively.

Turning to FIGS. 4A through 4C, illustrated is one embodiment of how a latch collet 410 designed, manufactured and/or operated according to one or more embodiments of the disclosure engages with a latch coupling 450 designed, manufactured and/or operated according to one or more embodiments of the disclosure to form an anchor assembly 400. The latch collet 410 is similar in many respects to the latch collet 200 of FIGS. 2A and 2B. Similarly, the latch coupling 450 is similar in many respects to the latch coupling 300 of FIGS. 3A and 3B. Accordingly, like reference numbers have been used to indicate similar, if not identical features. In the illustrated embodiments, the torque buttons 230 are engaged with the axial alignment slots 320. Similarly, the uphole coupling selector buttons 260 and the downhole coupling selector buttons 270 are engaged with the uphole radial extending latch collet selector profile 330 and the downhole radial extending latch collet selector profile 340, respectively. Furthermore, if the uphole coupling selector buttons 260 and the downhole coupling selector buttons 270 are too large to engage with the uphole radial extending latch collet selector profile 330 and the downhole radial extending latch collet selector profile 340, the latch collet 410 may continue downhole until it finds a situation wherein the uphole coupling selector buttons 260 and the downhole coupling selector buttons 270 are correctly sized to engage with the uphole radial extending latch collet selector profile 330 and the downhole radial extending latch collet selector profile 340. Accordingly, multiple latch couplings 450 may be positioned downhole, and the size or shape of the uphole coupling selector buttons 260, the downhole coupling selector buttons 270, the uphole radial extending latch collet selector profile 330 and the downhole radial extending latch collet selector profile 340 may be tailored to select which latch coupling 450 a given latch collet 410 will ultimately engage with.

Turning to FIG. 5A, illustrated is a downhole tool 500 designed, manufactured and/or operated according to one or more embodiments of the disclosure. The downhole tool 500, in one or more embodiments, includes a latch collet 510, the latch collet 510 including a collet body 512 having a plurality of collet fingers 514, the latch collet 510 having a mandrel 520 positioned therein. The latch collet 510 is similar in many respects to the latch collet 200 of FIGS. 2A and 2B. The downhole tool 500, in one or more embodiments, further includes a bore sensor 540 and a shear feature 590 for preventing the latch collet 510 and the mandrel 520 from sliding relative to one another. Also, while not shown in the embodiment of FIG. 5A, the downhole tool 500 additionally includes a locking dog, as will be discussed in detail below.

Figure 5B:
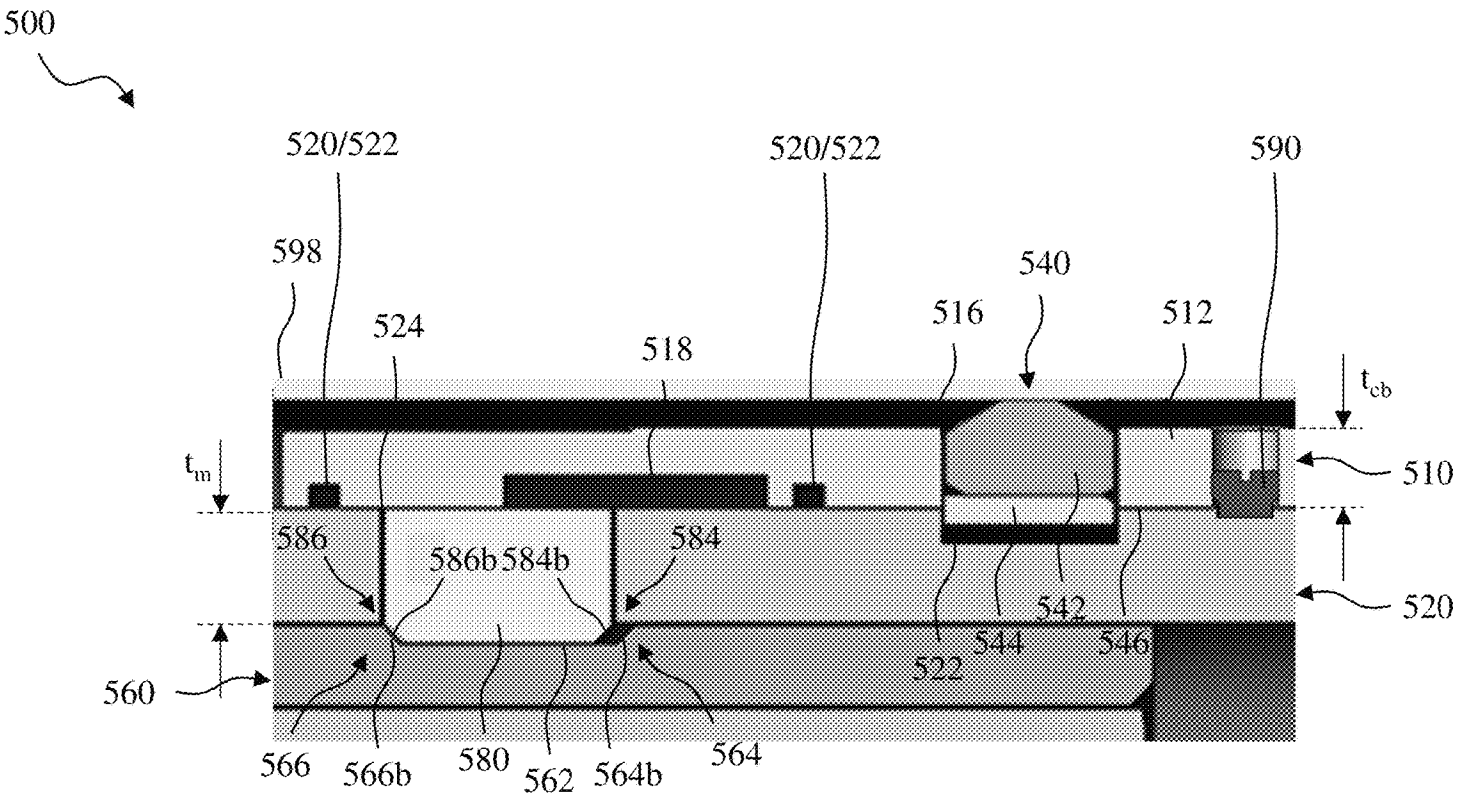

Turning now to FIG. 5B, illustrated is a cross-sectional view of the downhole tool 500 of FIG. 5A (e.g., taken through the line 5B-5B) designed, manufactured and/or operated in accordance with one embodiment of the disclosure. As shown, the downhole tool 500 includes the latch collet 510 having the collet body 512. In the illustrated embodiment, the collet body 512 has a collet body opening 516 extending through a thickness ($t_{cb}$) thereof. While not shown in FIG. 5B embodiment, the latch collet 510 further includes the plurality of collet fingers 514. As further shown in the embodiment of FIG. 5B, the downhole tool 500 includes the mandrel 520 positioned within the collet body 512, the mandrel having a mandrel slot 522 therein. In at least one embodiment, the collet body opening 516 and the mandrel slot 522 are axially aligned when the bore sensor 540 is in the radially extended state.

Figure 5C:
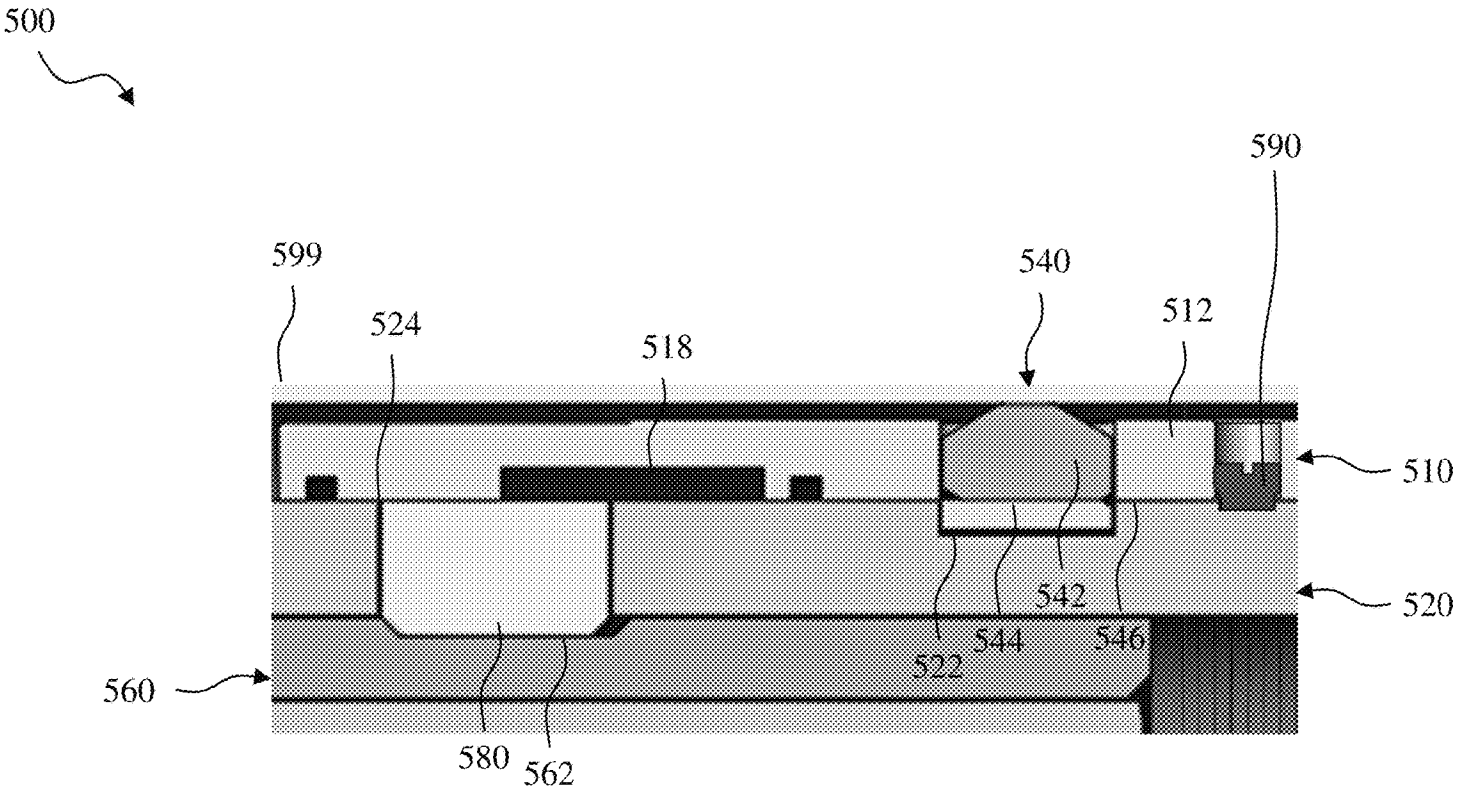

In accordance with one embodiment of the disclosure, the bore sensor 540 is positioned within the collet body opening 516 and the mandrel slot 522. In accordance with this embodiment, the bore sensor 540 is configured remain in a radially extended state (e.g., as shown in FIG. 5B) when the latch collet 510 is in too large size casing 598 and thereby prevent the collet body 512 and the mandrel 520 from sliding relative to one another. In accordance with this embodiment, the bore sensor 540 is also configured to be pushed to a radially compressed state (e.g., as shown in FIG. 5C) when the latch collet 510 is in the correct size casing 599 and thereby not prevent the collet body 512 and the mandrel 520 from sliding relative to one another.

In at least one embodiment, the bore sensor 540 includes a radially exterior push key 542 and a snap feature 544 positioned between the radially exterior push key 542 and the mandrel 520. In at least one embodiment, the radially exterior push key 542 is configured to sense for the too large size casing 598 or the correct size casing 599. For example, in at least one embodiment, the bore sensor 540 is configured such that when it is in the too large size casing 598 the snap feature 544 is positioned within a shear plane 546 between the collet body 512 and the mandrel 520 to prevent the collet body 512 and the mandrel 520 from sliding relative to one another. In at least this one embodiment, the bore sensor 540 is also configured such that when it is in the correct size casing 598 the snap feature 544 is positioned outside of the shear plane 546, and thus not prevent the collet body 512 and the mandrel 520 from sliding relative to one another. For example, in one or more embodiments, the radially exterior push key 542 is configured to allow the snap feature 544 to be in a radially outward state and positioned within the shear plane 546 when the bore sensor 540 is in the too large size casing 598 and is configured to push the snap feature 544 to a radially inward state and positioned outside of the shear plane 546 when the bore sensor 540 is in the correct size casing 599. In at least one embodiment, the snap feature 544 is a snap ring.

In one or more embodiments, the bore sensor 540 is a first bore sensor, and further including a second bore sensor 550 positioned within a second collet body opening in the collet body 512 and a second mandrel slot in the mandrel 520, the second bore sensor 550 configured to remain in a second radially extended state when the latch collet 510 is in the too large size casing 598 and thereby prevent the collet body 512 and the mandrel 520 from sliding relative to one another, and configured to be pushed to a second radially compressed state when the latch collet 510 is in the correct size casing 599 and thereby not prevent the collet body 512 and the mandrel 520 from sliding relative to one another. In at least one embodiment, the downhole tool further includes one or more additional bore sensors 555 positioned within additional collet body openings in the collet body 512 and additional mandrel slots in the mandrel 520, the first, second, and additional bore sensors 540, 550, 555 substantially equally circumferentially placed about the latch collet 510.

Further to the embodiment of FIG. 5B, the collet body 512 has a collet body slot 518 on a radial interior surface thereof, and the mandrel 520 has a mandrel opening 524 extending through a thickness ($t_m$) thereof. In this embodiment, a running tool collet 560 is located within the mandrel 520, the running tool collet 560 having a running tool collet slot 562 on a radial exterior surface thereof. In at least one embodiment, a locking dog 580 is positioned within the mandrel opening 524, the locking dog 580 configured to engage with the running tool collet slot 562 when the downhole tool 500 is in a run-in-hole state and thereby prevent the mandrel 520 and the running tool collet 560 from sliding relative to one another. In at least one other embodiment, the locking dog 580 is configured to disengage from the running tool collet slot 562 and engage with the collet body slot 518 after the collet body 512 and the mandrel 520 have slid relative to one another and thereby allow the mandrel 520 and the running tool collet 560 to slide relative to one another.

In at least one embodiment, the collet body 512 is configured to keep the locking dog 580 engaged with the running tool collet slot 562 when the downhole tool 500 is in the run-in-hole state. In at least one other embodiment, the running tool collet 560 is configured to keep the locking dog 580 engaged with the collet body slot 518 after the collet body 512 and the mandrel 520 have slid relative to one another.

In at least one embodiment, the running tool collet slot 562 has a collet slot downhole edge 564 and a collet slot uphole edge 566, and further wherein the collet slot downhole edge 564 has a collet slot angled ramp profile 564*b*. Further to this embodiment, in at least one instance the collet slot angled ramp profile 564*b* is a first collet slot angled ramp profile, and further wherein the collet slot uphole edge 566 has a second collet slot angled ramp profile 566*b*.

Similarly, in at least one embodiment, the locking dog 580 has a locking dog downhole edge 584 and a locking dog uphole edge 586, and further wherein a radially interior portion of the locking dog downhole edge 584 has locking dog angled ramp profile 584*b*. In at least one embodiment, the locking dog angled ramp profile 584*b* is a first locking dog angled ramp profile, and further wherein a radially interior portion of the locking dog uphole edge 586 has second locking dog angled ramp profile 586*b*. In at least this one embodiment, the first and second collet slot angled ramp profiles 564*b*, 566*b* and the first and second locking dog angled ramp profiles 584*b*, 586*b* are configured to cooperate to force the locking dog 580 into the collet body slot 518.

In one or more embodiments, the bore sensor 540 is located in the collet body 512 between the locking dog 580 and a shear feature 590. In one or more embodiments, first and second seal grooves 520 are located in the collet body 512 and on opposing sides of the collet body slot 518, and furthermore first and second seal members 522 are located in the first and second seal grooves 520.

Figure 5D:
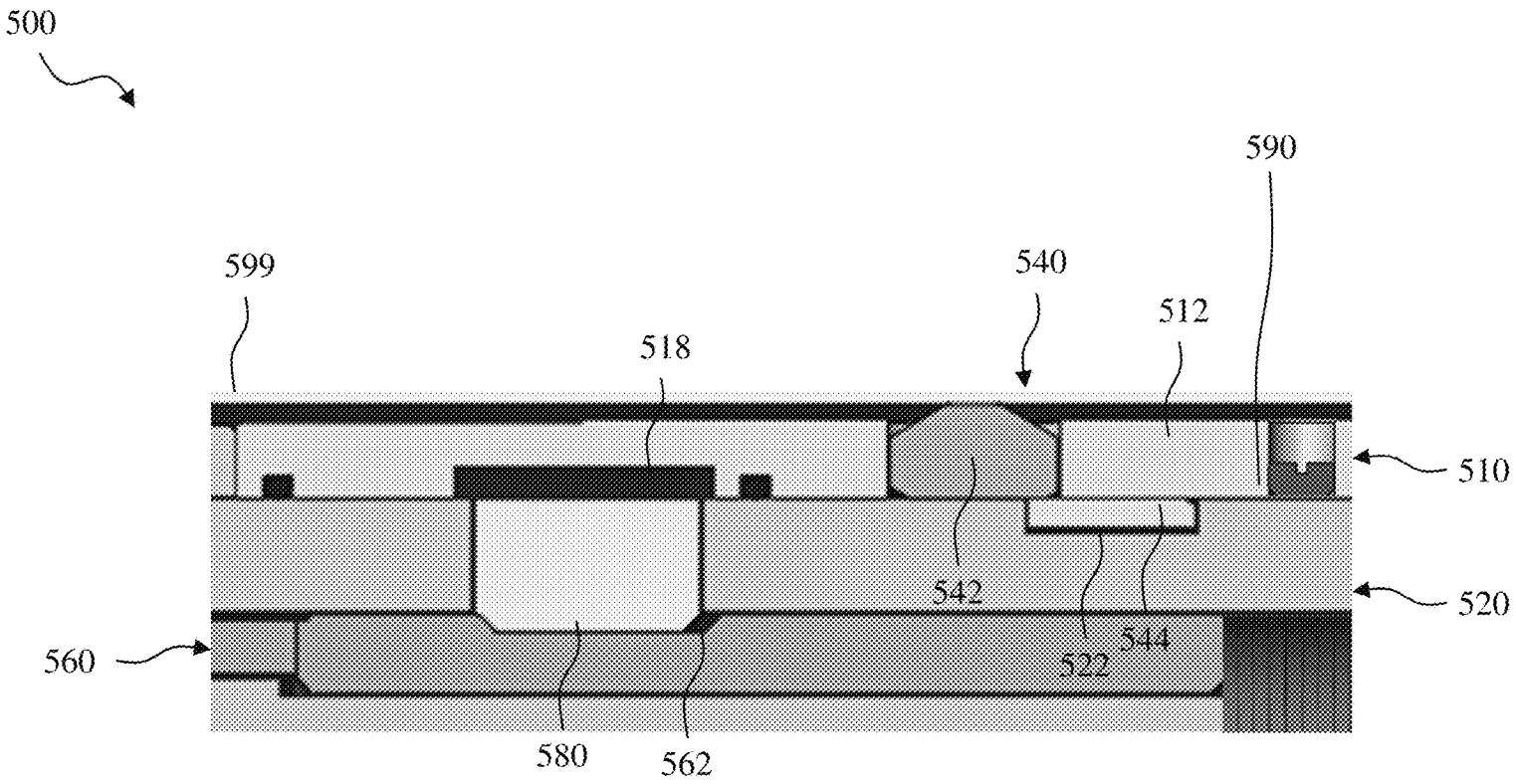

With reference to FIGS. 5B through 5D, and given the foregoing descriptions, an operational sequence of the downhole tool 500 may be understood FIG. 5B illustrated the downhole tool 500 in a run-in-hole state, such as if it were located in too large size casing 598. In the embodiment shown in FIG. 5B, the shear feature 590 couples the collet body 512 of the latch collet 510 with the mandrel 520, thereby preventing the collet body 512 and the mandrel 520 from sliding relative to one another. Similarly, as the downhole tool 500 is located in the too large of casing 598, the bore sensor 540 remains in the radially extended state. Accordingly, the snap feature 544 is positioned within the shear plane 546 between the collet body 512 and the mandrel 520, thereby also preventing the collet body 512 and the mandrel 520 from sliding relative to one another.

Further to the embodiment of FIG. 5B, the locking dog 580 is positioned within the mandrel opening 524, the locking dog 580 further engaging with the running tool collet slot 562 and thereby preventing the mandrel 520 and the running tool collet 560 from sliding relative to one another. Thus, at this stage, the latch collet 510 is axially fixed to the mandrel 520 using a combination of the shear feature 590 and the bore sensor 540, and the mandrel 520 is axially fixed to the running tool collet 560 using the locking dog 580. Accordingly, the latch collet 510 is ultimately axially fixed to the running tool collet 560.

Turning to FIG. 5C, illustrated is the downhole tool 500 of FIG. 5B, after the downhole tool 500 is now located in the correct size casing 599. With the bore sensor 540 now in the correct size casing 599, the bore sensor 540 is pushed to the radially compressed state. With the bore sensor 540 in the radially compressed state, the snap feature 544 is now positioned outside of the shear plane 546 between the collet body 512 and the mandrel 520, and thus does not prevent the collet body 512 and the mandrel 520 from sliding relative to one another. At this stage, the shear feature 590 still couples the collet body 512 of the latch collet 510 with the mandrel 520, thereby preventing the collet body 512 and the mandrel 520 from sliding relative to one another. Similarly, the locking dog 580 is still positioned within the mandrel opening 524, the locking dog 580 still engaging with the running tool collet slot 562 and thereby preventing the mandrel 520 and the running tool collet 560 from sliding relative to one another. Accordingly, the latch collet 510 is still ultimately axially fixed to the running tool collet 560.

Turning to FIG. 5D, illustrated is the downhole tool 500 of FIG. 5C, after weight is placed down on the mandrel 520 (e.g., via the running tool collet 560, and running tool coupled thereto), thereby shearing the shear feature 590. As the shear feature 590 shears, the running tool collet 560 and the mandrel 520 continue to move downhole. As shown, at some point the locking dog 580 aligns with the collet body slot 518, and thus the locking dog 580 is no longer held in engagement with the running tool collet slot 562. Thus, at this stage, the locking dog 580 is free to move radially outward into the collet body slot 518.

Figure 5E:
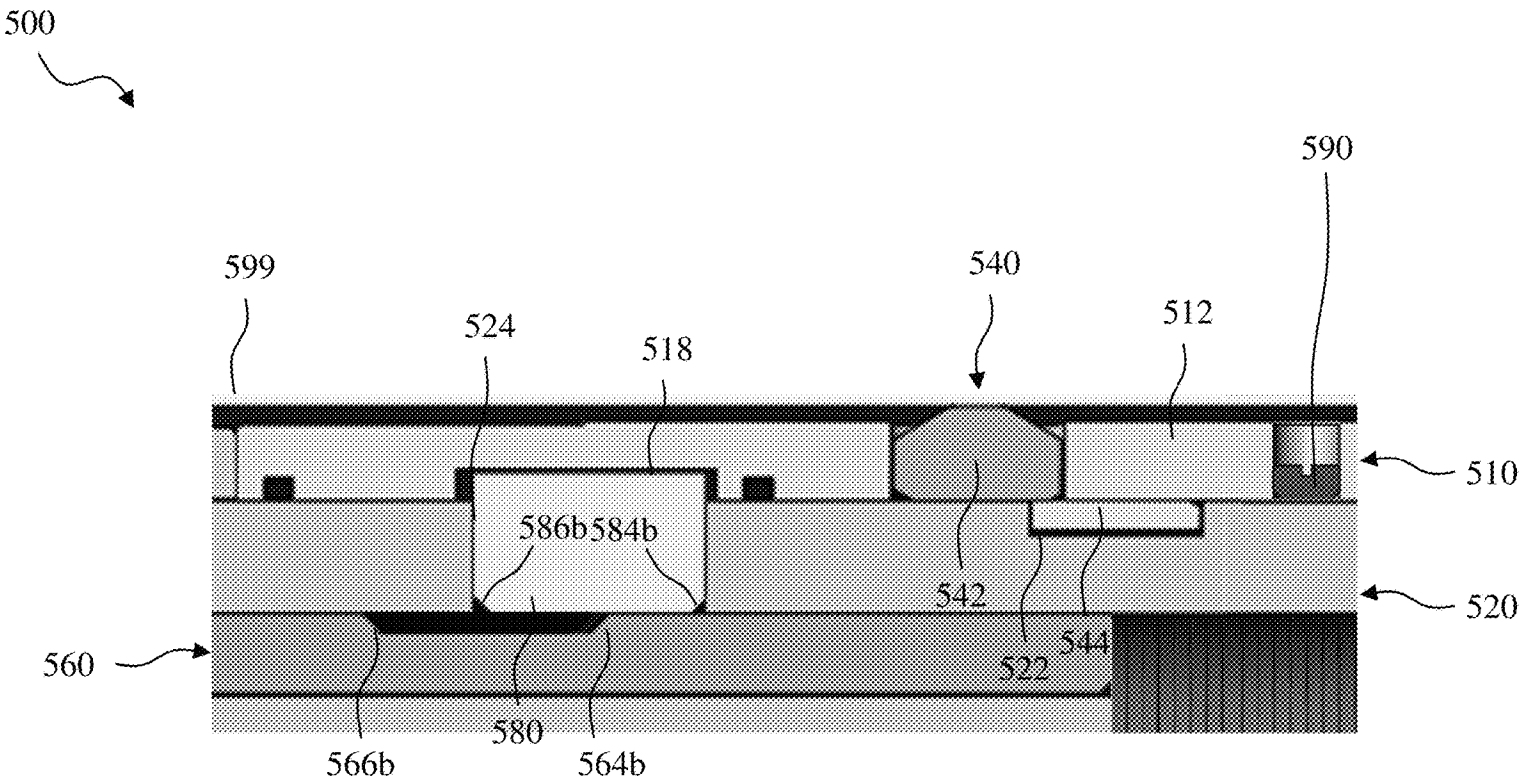

Turning to FIG. 5E, illustrated is the downhole tool 500 of FIG. 5D, after weight continues to be placed down on the mandrel 520. In this embodiment, the collection of the first and second collet slot angled ramp profiles 564*b*, 566*b* and the first and second locking dog angled ramp profiles 584*b*, 586*b* cooperate to force the locking dog 580 into the collet body slot 518. Furthermore, at this point the latch collet 510 may be engaged with the latch coupling (not shown). In at least one embodiment, another snap feature (not shown in this view) may again axially fix the latch collet 510 and the mandrel 520 together. Furthermore, while not shown, the running tool collet 560 is free to slide downhole and uphole relative to the mandrel 520. Accordingly, in at least one embodiment, the running tool automatically decouples from the running tool collet 560, and thus may be drawn uphole.

Turning now to FIGS. 6A and 6B, illustrated are different operational states of a downhole tool 600 designed, manufactured and/or operated according to one or more alternative embodiments of the disclosure. The downhole tool 600, in at least one embodiment, includes a latch collet 610 including a collet body 620, the collet body 620 having a plurality of collet fingers. The downhole tool 600, in accordance with one or more embodiments, further includes a mandrel 630 positioned within the collet body 620.

Further to the embodiment of FIGS. 6A and 6B, the downhole tool 600 includes a packer assembly 640 positioned axially between the collet body 620 and the mandrel 630. In the illustrated embodiment, the packer assembly 640 is configured to move from a radially retracted state (e.g., as shown in FIG. 6A) when the mandrel 630 and collet body 620 are being run-in-hole to a radially extended state (e.g., as shown in FIG. 6B) when the collet body 620 has engaged with a latching profile and weight is placed down upon the packer assembly 640. In one or more embodiments, the packer assembly 640 includes a compressible packer element 642 that is positioned between two slidable packer element rings 644.

In accordance with one embodiment of the disclosure, the collet body 620 has an uphole edge 622 and the mandrel 630 has an inset shoulder 632. In accordance with this embodiment, the packer assembly 640 is positioned axially between the uphole edge 622 of the collet body 620 and the inset shoulder 632. In accordance with another embodiment, the downhole tool 600 includes an anti-preset feature 650, in this embodiment the anti-preset feature 650 configured to prevent the collet body 620 and the mandrel 630 from sliding relative to one another and prematurely setting the packer assembly 640. The anti-present feature 650 may take on a variety of different styles and remain within the scope of the disclosure. In at least one embodiment, the anti-present feature 650 is a shear feature positioned between the collet body 620 and the mandrel 630 (e.g., as shown in FIGS. 5A through 5E). In yet another embodiment, the anti-present feature 650 is a collection of a collet prop button located on a radial interior of each of the plurality of collet fingers and a plurality of profiles on the outer radial surface of the mandrel 630 (e.g., as shown in FIGS. 2A and 2B). In yet even another embodiment, the anti-present feature 650 is a bore sensor positioned within a collet body opening in the collet body 620 and a mandrel slot in the mandrel 630 (e.g., as shown in FIGS. 5A through 5E). In even yet another embodiment, the anti-present feature 650 is any combination of one or more of the shear feature, the collection of collet prop buttons and plurality of profiles on the mandrel, and the bore sensor.

Turning now to FIGS. 7A and 7B, illustrated is a downhole tool 700 designed, manufactured and/or operated according to one or more embodiments of the disclosure. The downhole tool 700, in the embodiment of FIGS. 7A and 7B, includes a whipstock assembly 710 and a completion assembly 730. The downhole tool 700, in the embodiment of FIGS. 7A and 7B, additionally includes a fluid loss device 720 positioned between the whipstock assembly 710 and the completion assembly 730. In one or more alternative embodiments, the downhole tool 700 further includes an anchor assembly 740 (e.g., similar to that in FIGS. 6A and 6B) located between the whipstock assembly 710 and the completion assembly 730, the fluid loss device 720 located between the anchor assembly 740 and the whipstock assembly 710.

In at least one embodiment, the fluid loss device 720 is coupled (e.g., either directly or indirectly) to the whipstock assembly 710. In yet another embodiment, the fluid loss device 720 is rigidly coupled to the whipstock assembly 710, such that removal of the whipstock assembly 710 from a wellbore also removes the fluid loss device 720 from the wellbore. In even another embodiment, the fluid loss device 720 is removably coupled to the whipstock assembly 710, such that removal of the whipstock assembly 710 from a wellbore leaves the fluid loss device 720 within the wellbore.

As shown in the embodiment of FIGS. 7A and 7B, the fluid loss device 720 may be configured to be in an open state when being run in hole, and configured to be in a closed state when the whipstock assembly 710 is being used to drill a lateral wellbore. For example, in at least one embodiment, a running tool 750 extends through the whipstock assembly 710 and the fluid loss device 720, propping the fluid loss device 720 in the open state. In accordance with that discussed above, the running tool 750 may be a two-part drilling and running tool. Further to the embodiment of FIGS. 7A and 7B, a seal assembly 760 may be located along an inner radial surface of the fluid loss device 720. The seal assembly 760, in the illustrated embodiment, seals against the running tool 750. In yet other embodiments, such as when the fluid loss device 720 is left downhole after the lateral wellbore is drilled, the seal assembly 760 may seal against a multilateral junction (not shown).

Turning now to FIGS. 8A through 8D, illustrated is a two-part drilling and running tool 800 designed, manufactured and/or operated according to one or more embodiments of the disclosure. The two-part drilling and running tool 800 includes a conveyance 810. The two-part drilling and running tool 800, in one or more embodiments, further includes a smaller assembly 820 (e.g., smaller bit assembly) coupled to an end of the conveyance 810. In one or more embodiments, the two-part drilling and running tool 800 further includes a larger bit assembly 830 slidably coupled to the conveyance 810, the smaller assembly 820 and larger bit assembly 830 configured to slidingly engage one another downhole to form a combined bit assembly 840.

In accordance with one embodiment, the two-part drilling and running tool 800 includes a one way mechanism 850 coupled between the smaller assembly 820 and the larger bit assembly 830. In accordance with this one embodiment, the one way mechanism 850 is configured to allow the smaller assembly 820 and larger bit assembly 830 to axially slide in one direction relative to one another and prevent the smaller assembly 820 and larger bit assembly 830 from axially sliding in an opposite direction relative to one another.

In at least one embodiment, such as that shown in FIGS. 8A through 8D, the one way mechanism 850 is a wedge feature. For example, the one way mechanism 850 of FIGS. 8A through 8D is a wedge feature located in an annular space 825 between the smaller assembly 820 and the larger bit assembly 830. In this one embodiment, the wedge feature is configured to allow the smaller assembly 820 to slide uphole relative to the larger bit assembly 830 but prevent the smaller assembly 820 from sliding downhole relative to the larger bit assembly 830.

Figure 8A:
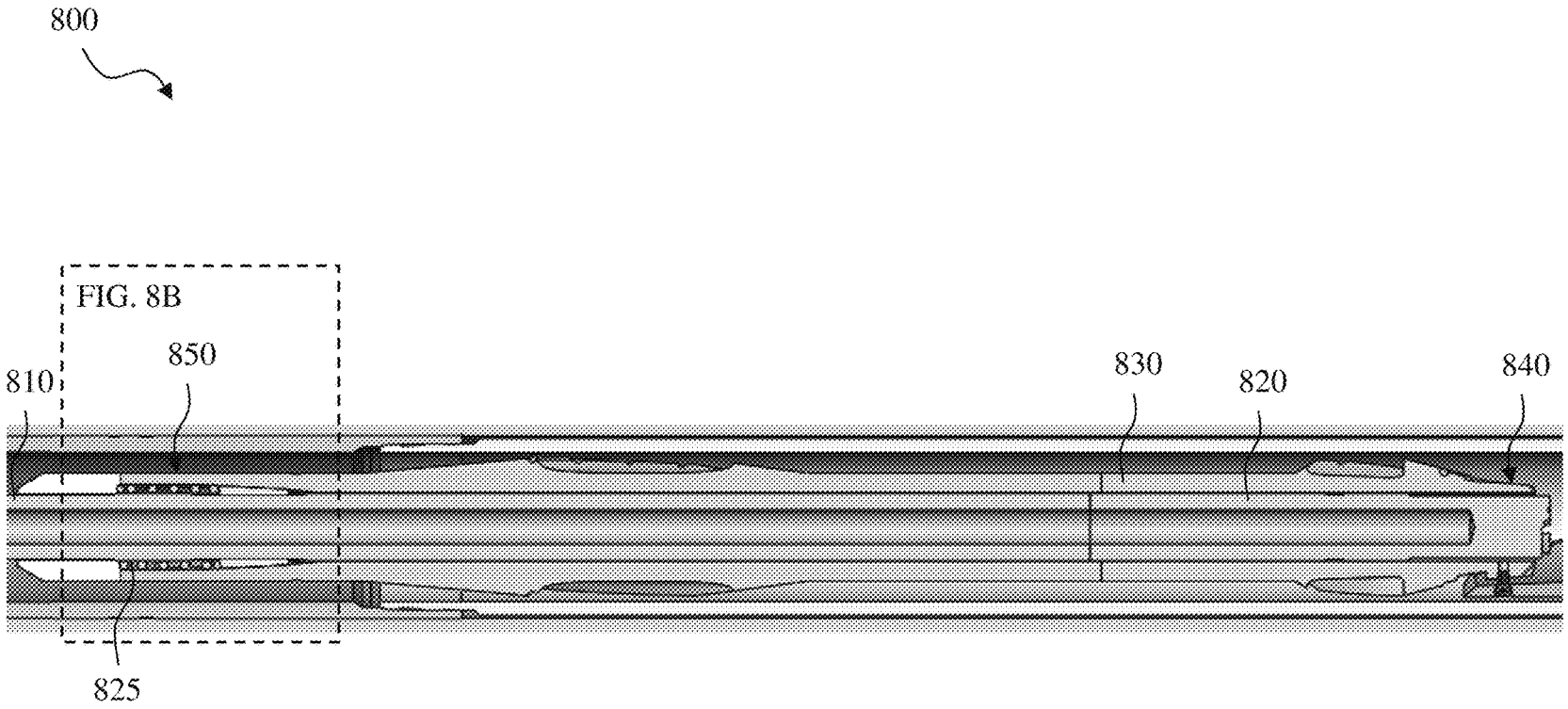
Figure 8B:
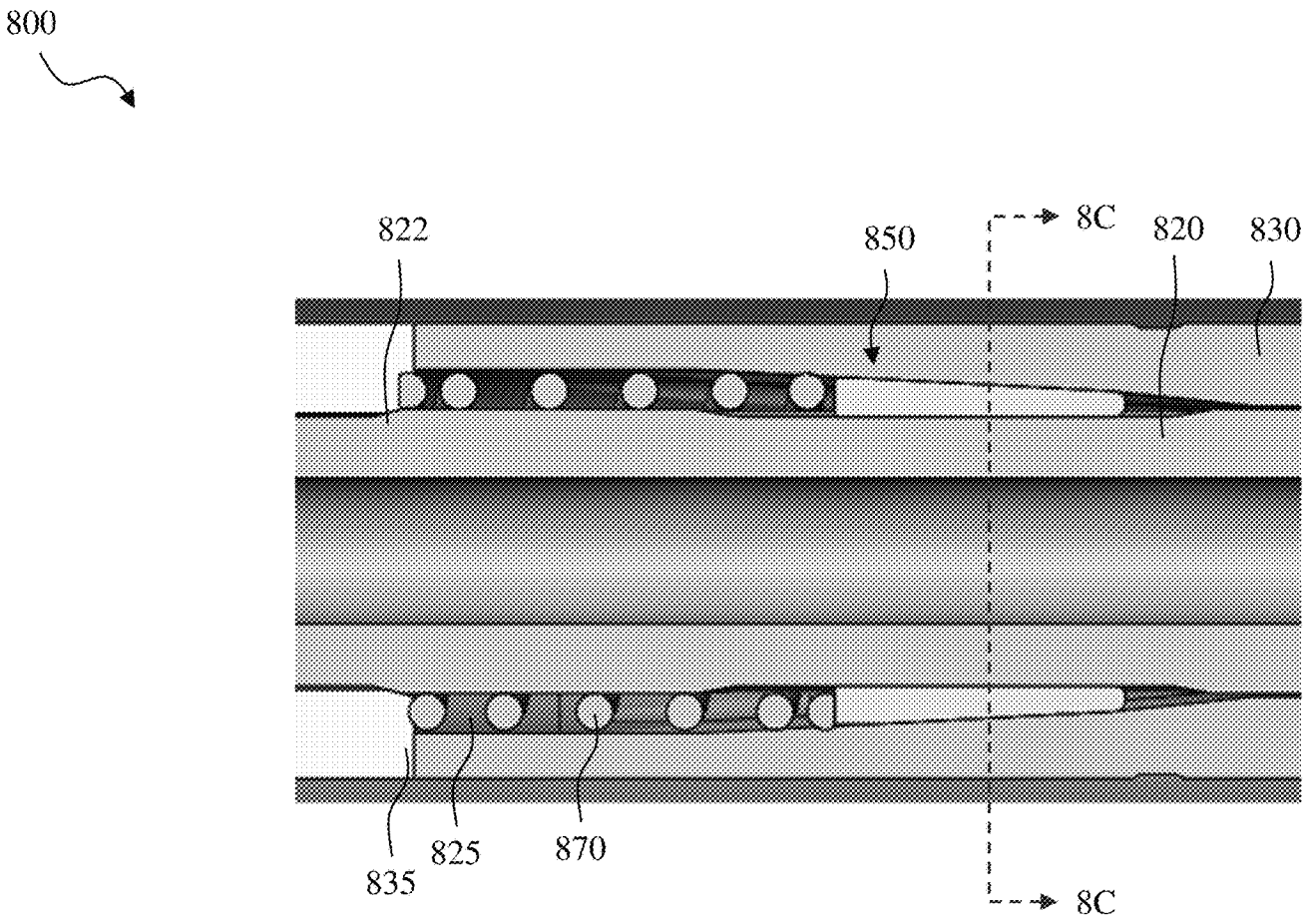
Figure 8C:
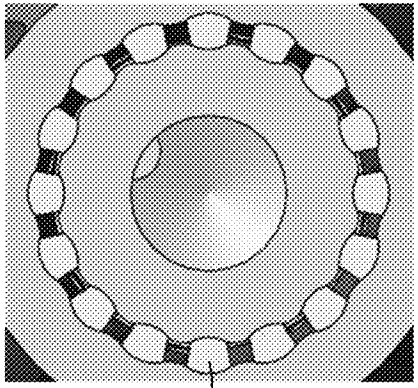
Figure 8D:
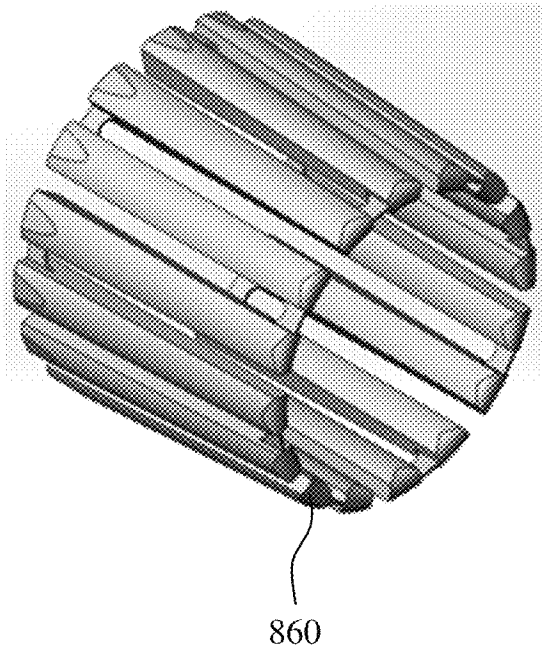
Figure 9A:
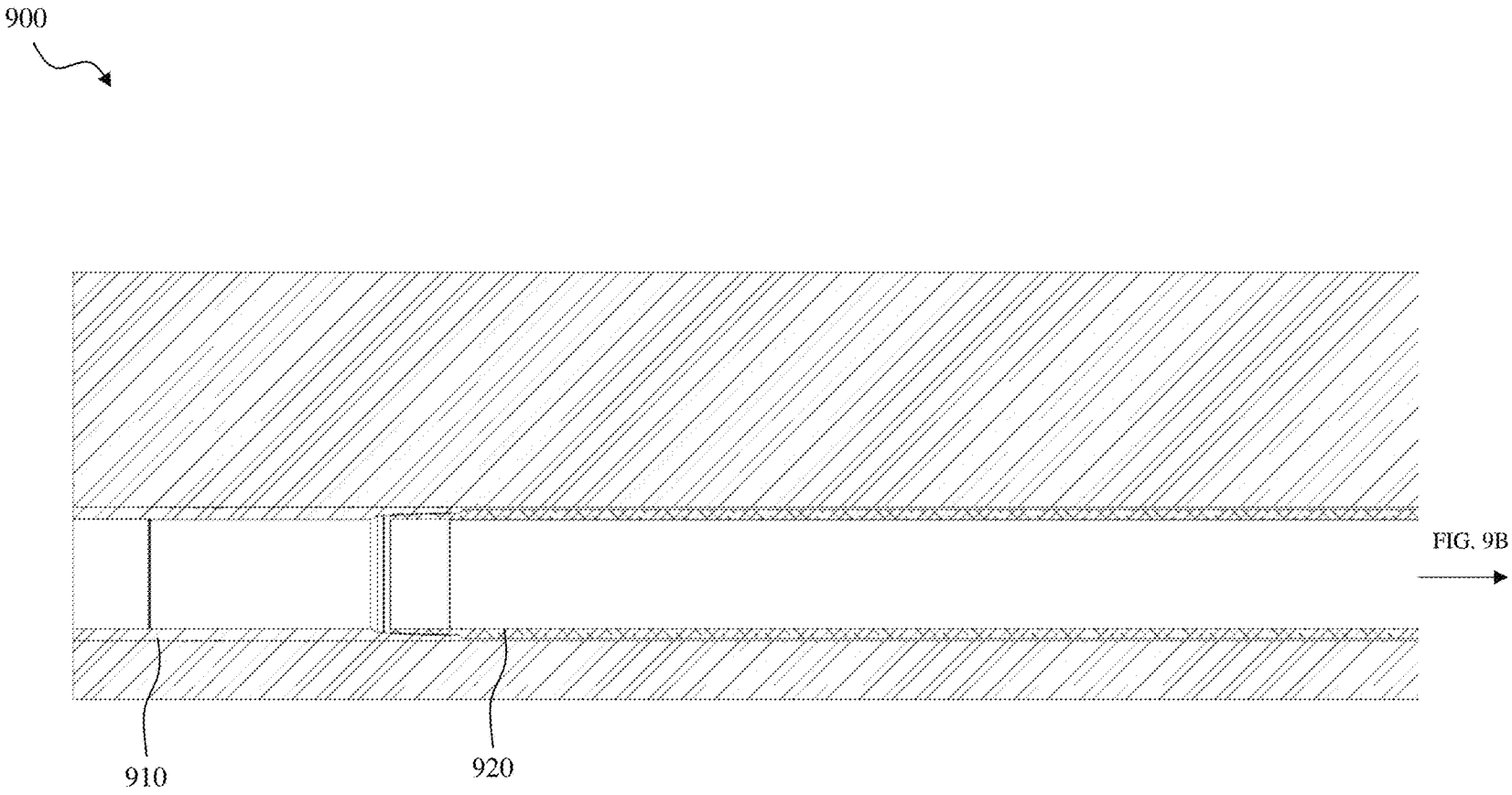
Figure 9B:
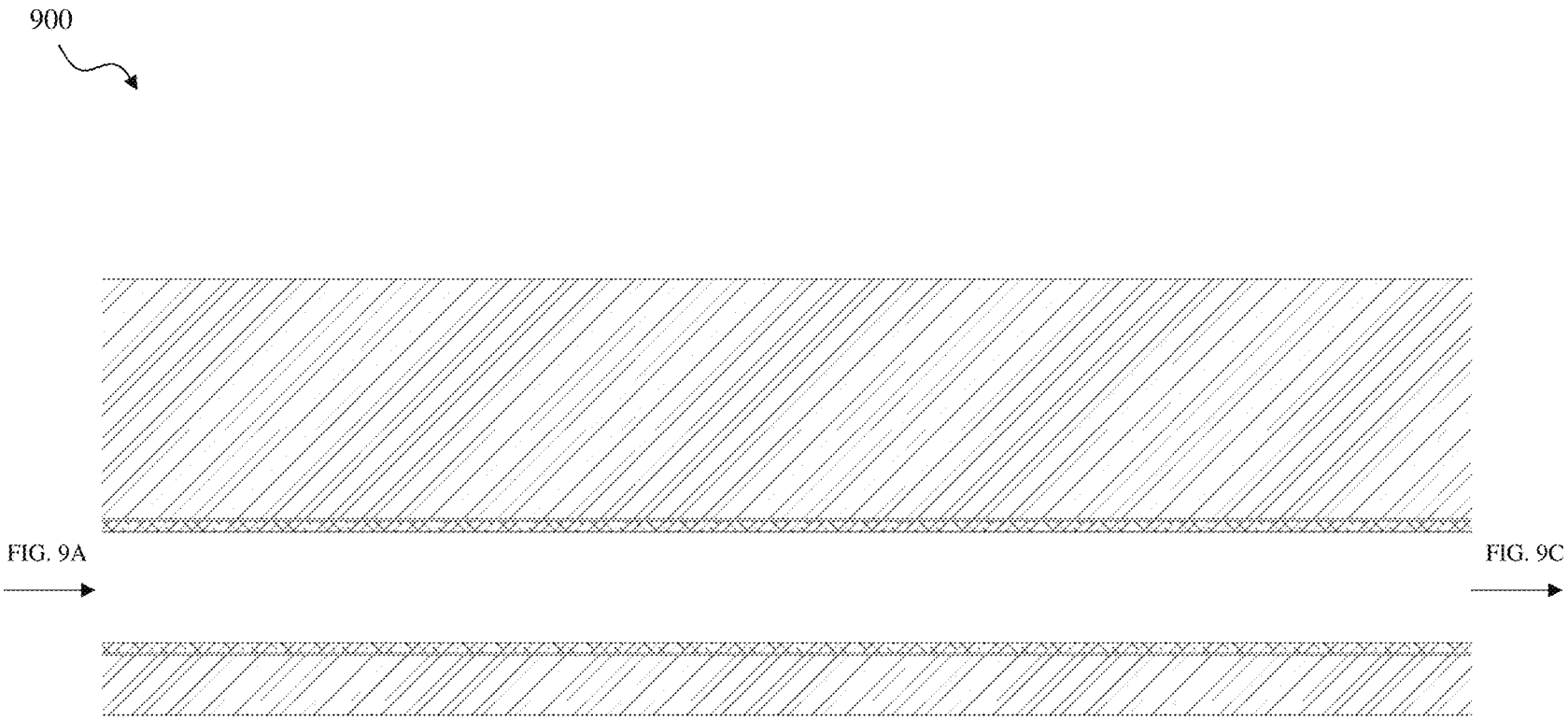
Figure 9C:
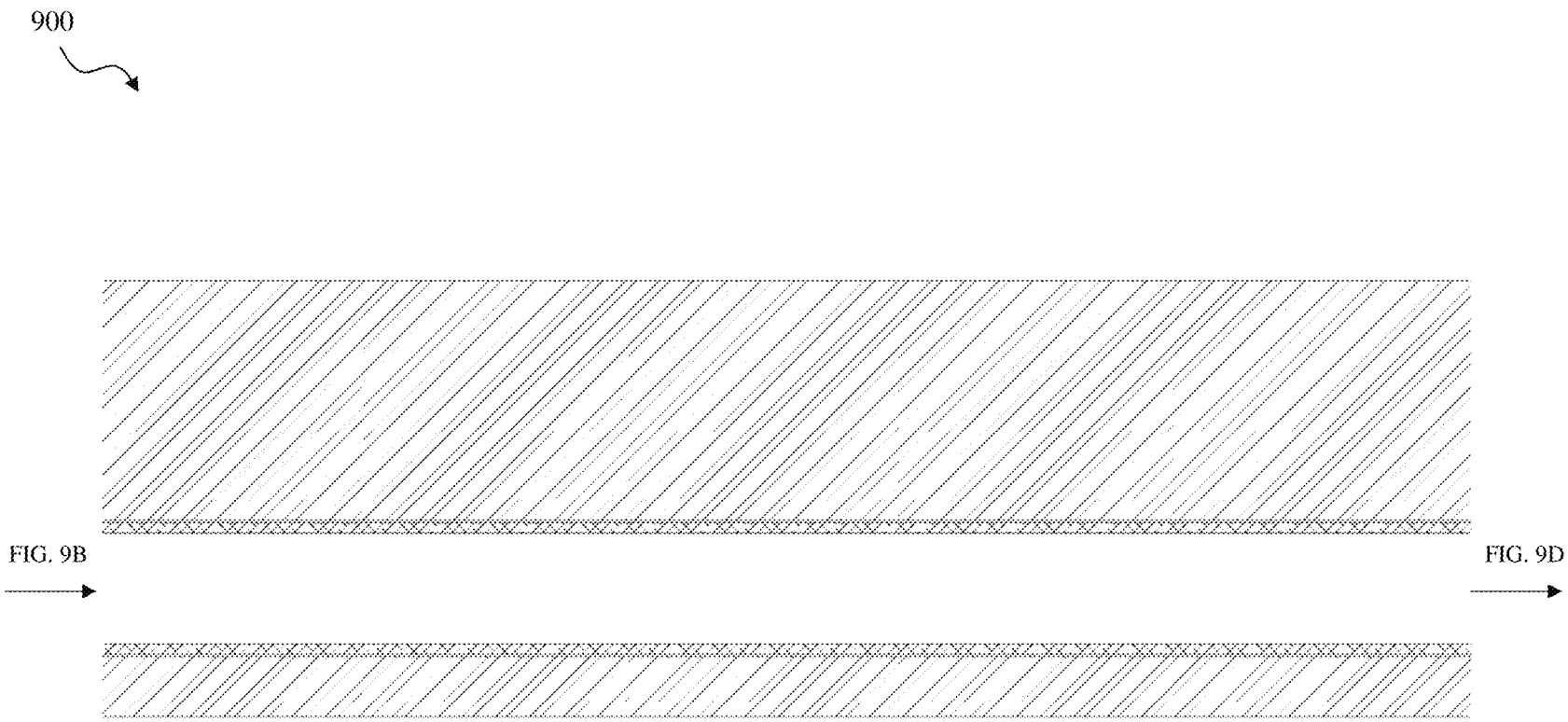
Figure 9D:
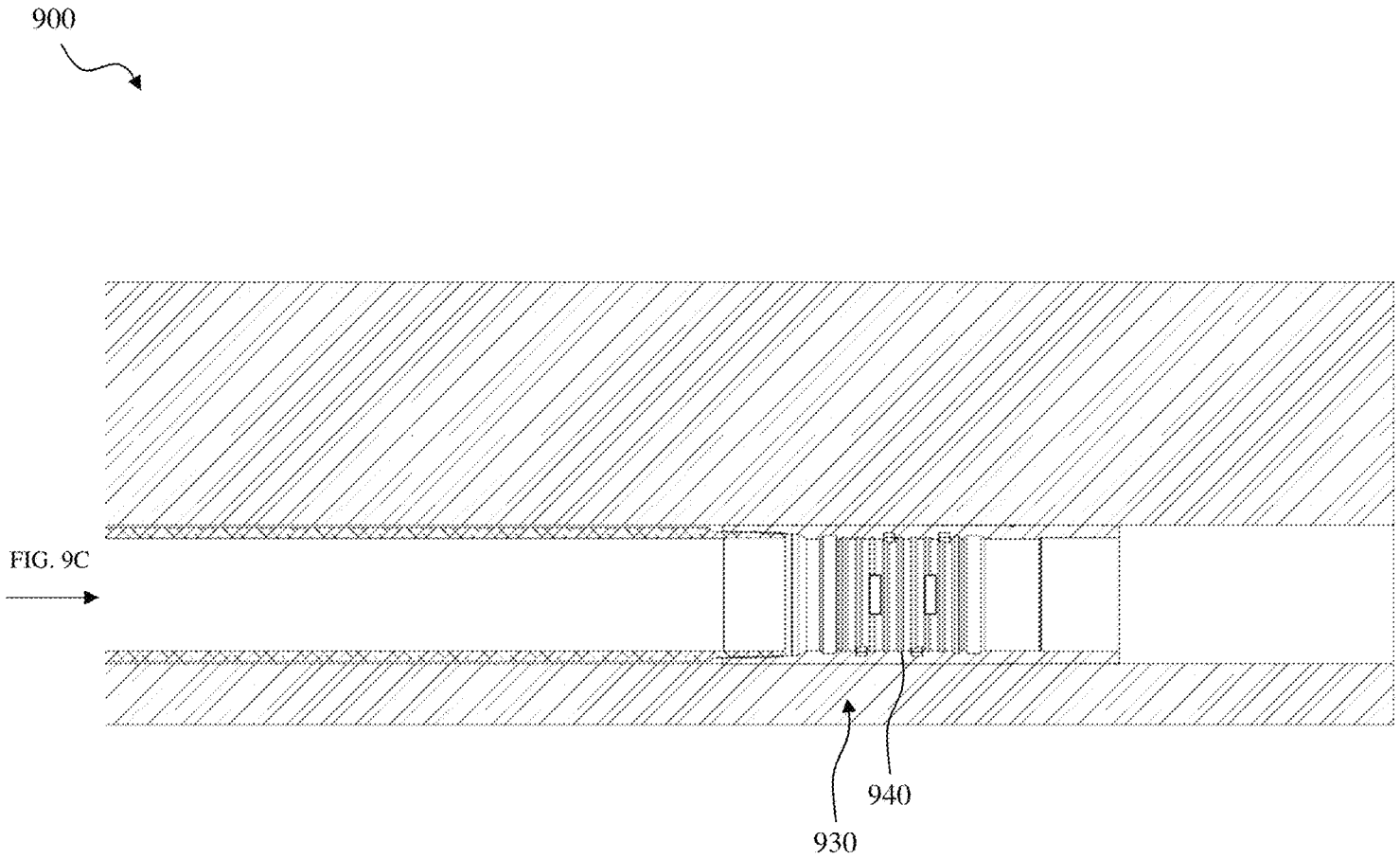
Figure 10A:
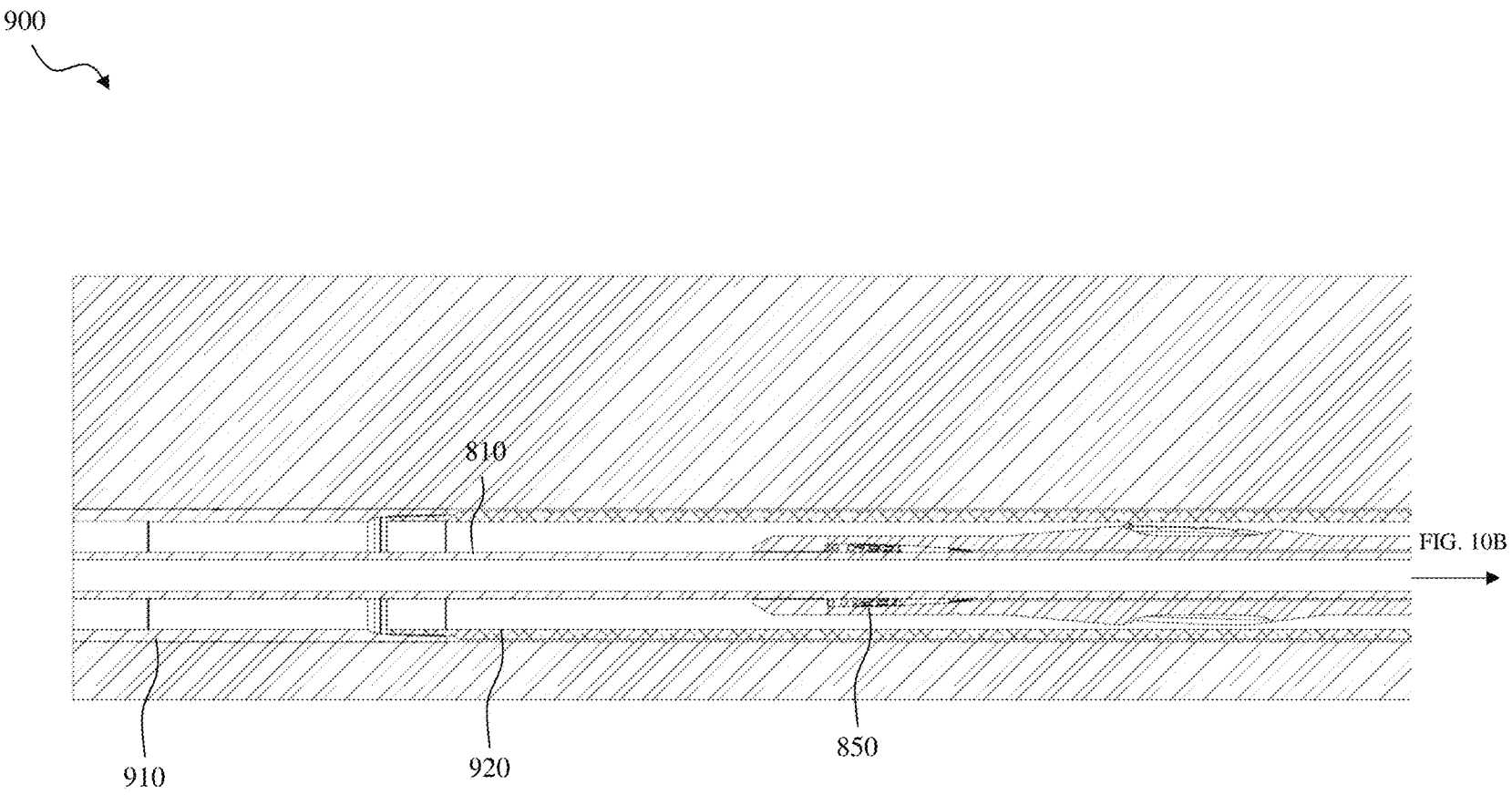
Figure 10B:
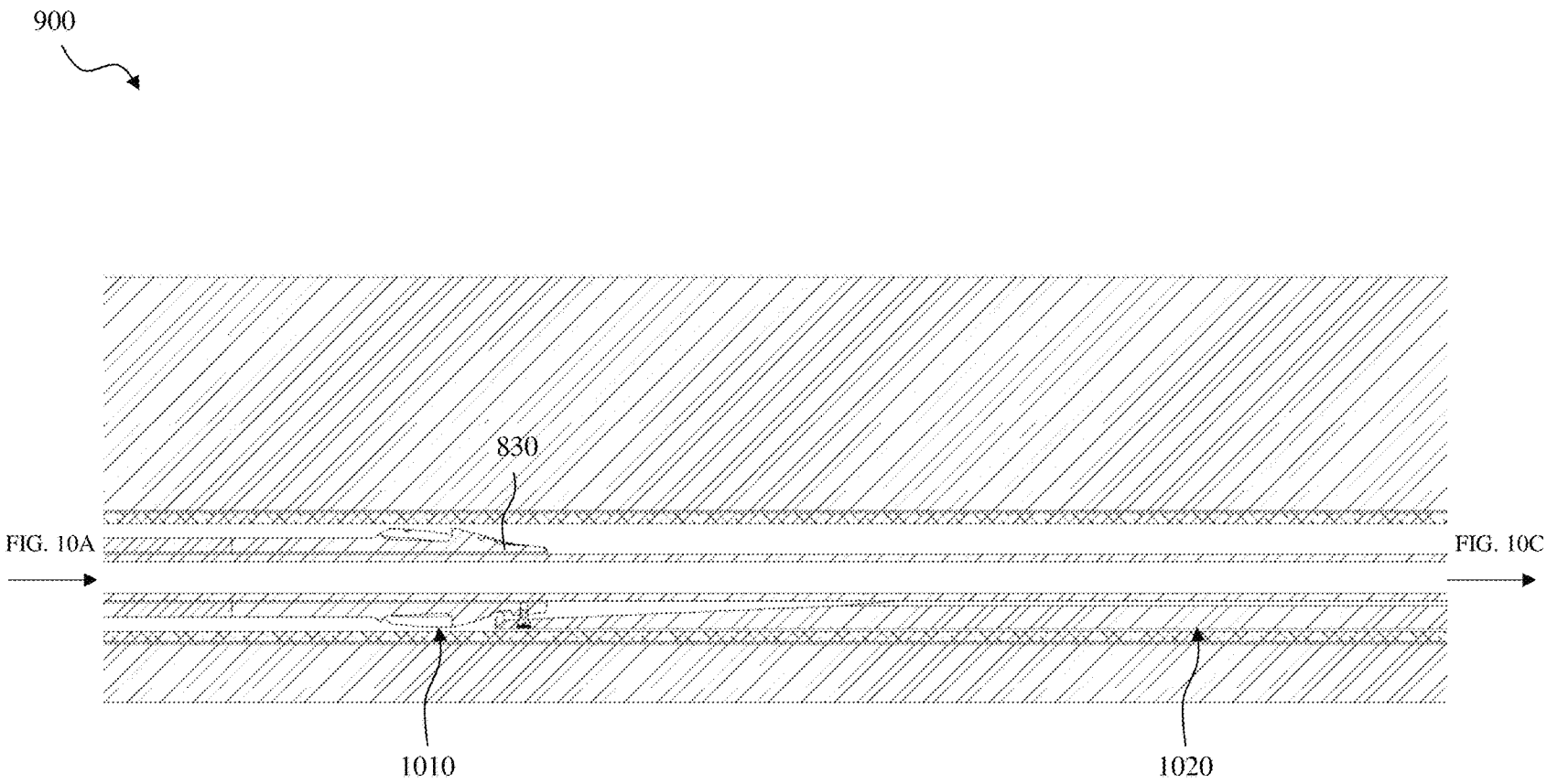
Figure 10C:
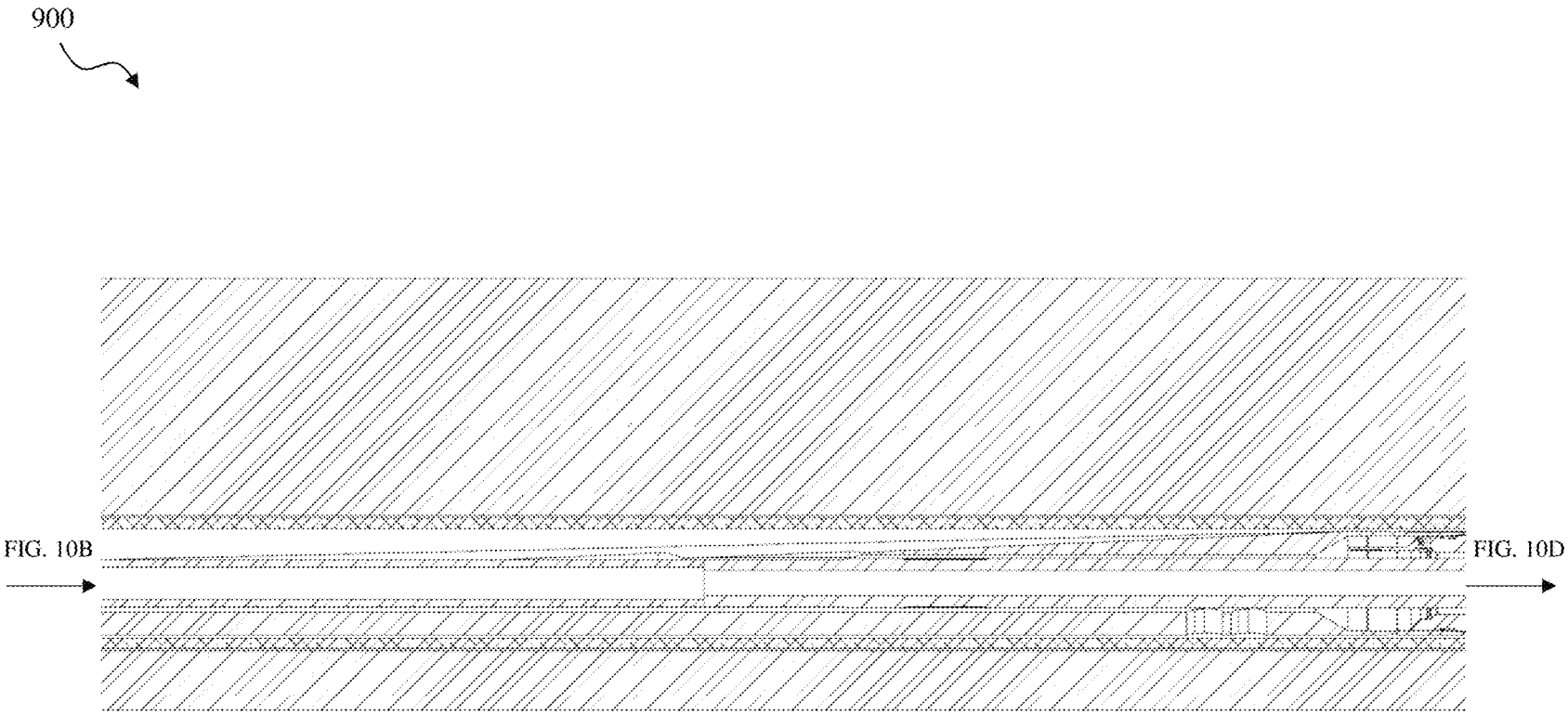
Figure 10D:
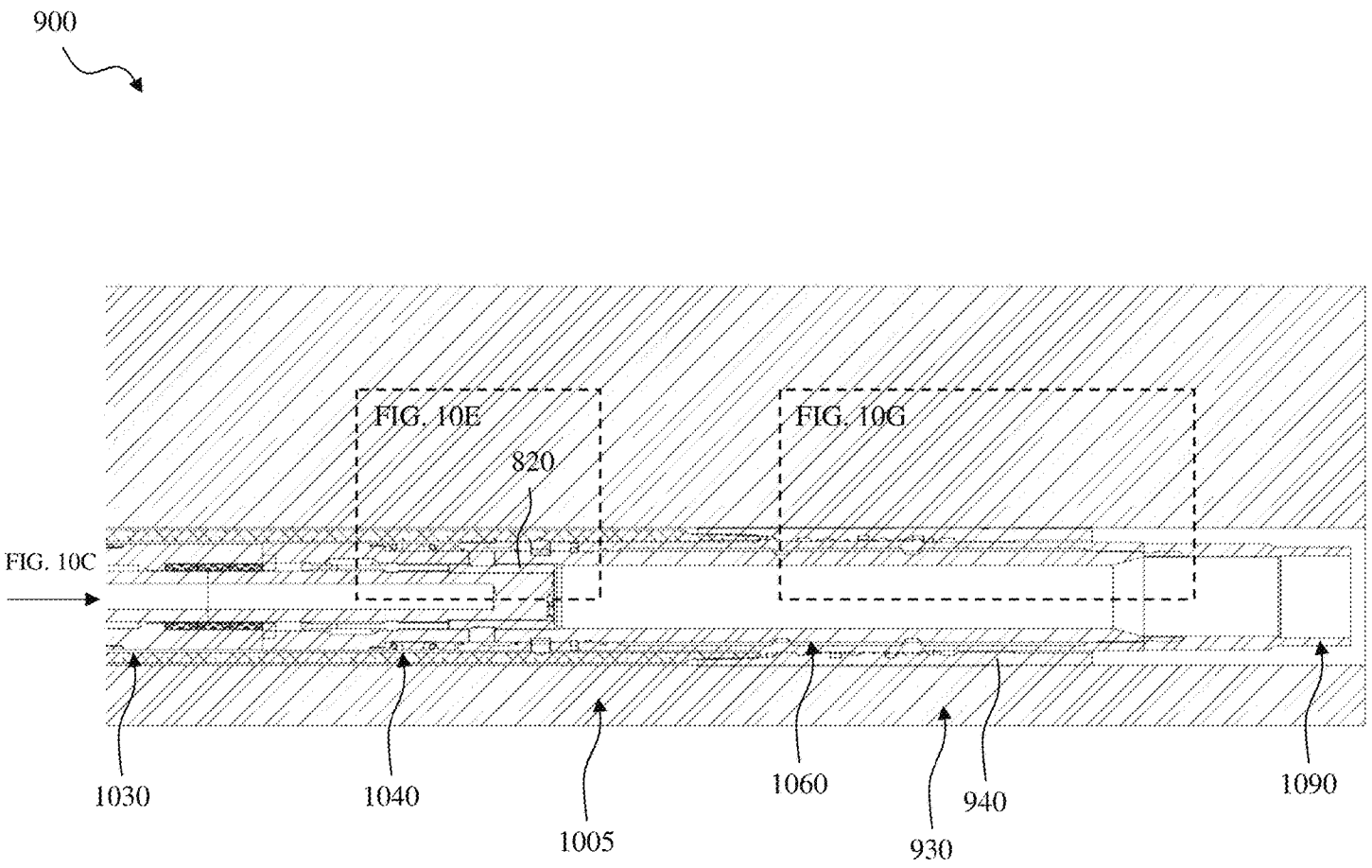
Figure 10E:
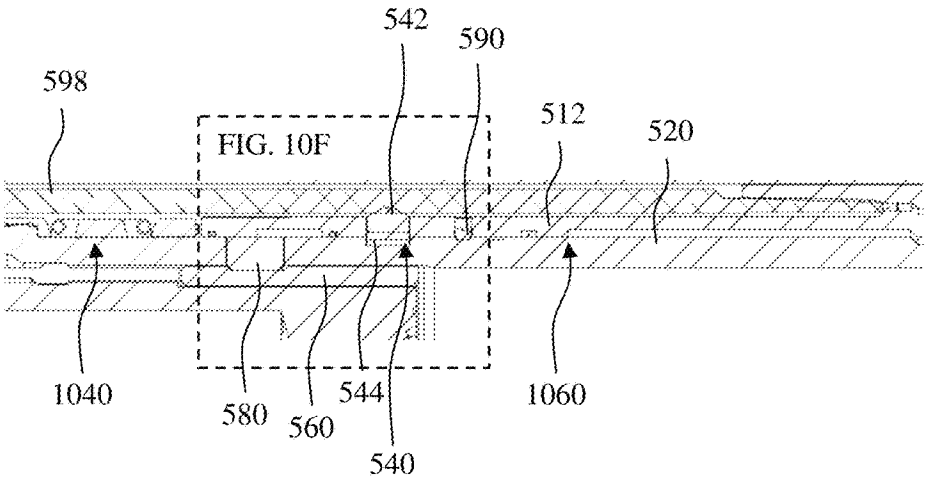
Figure 10F:
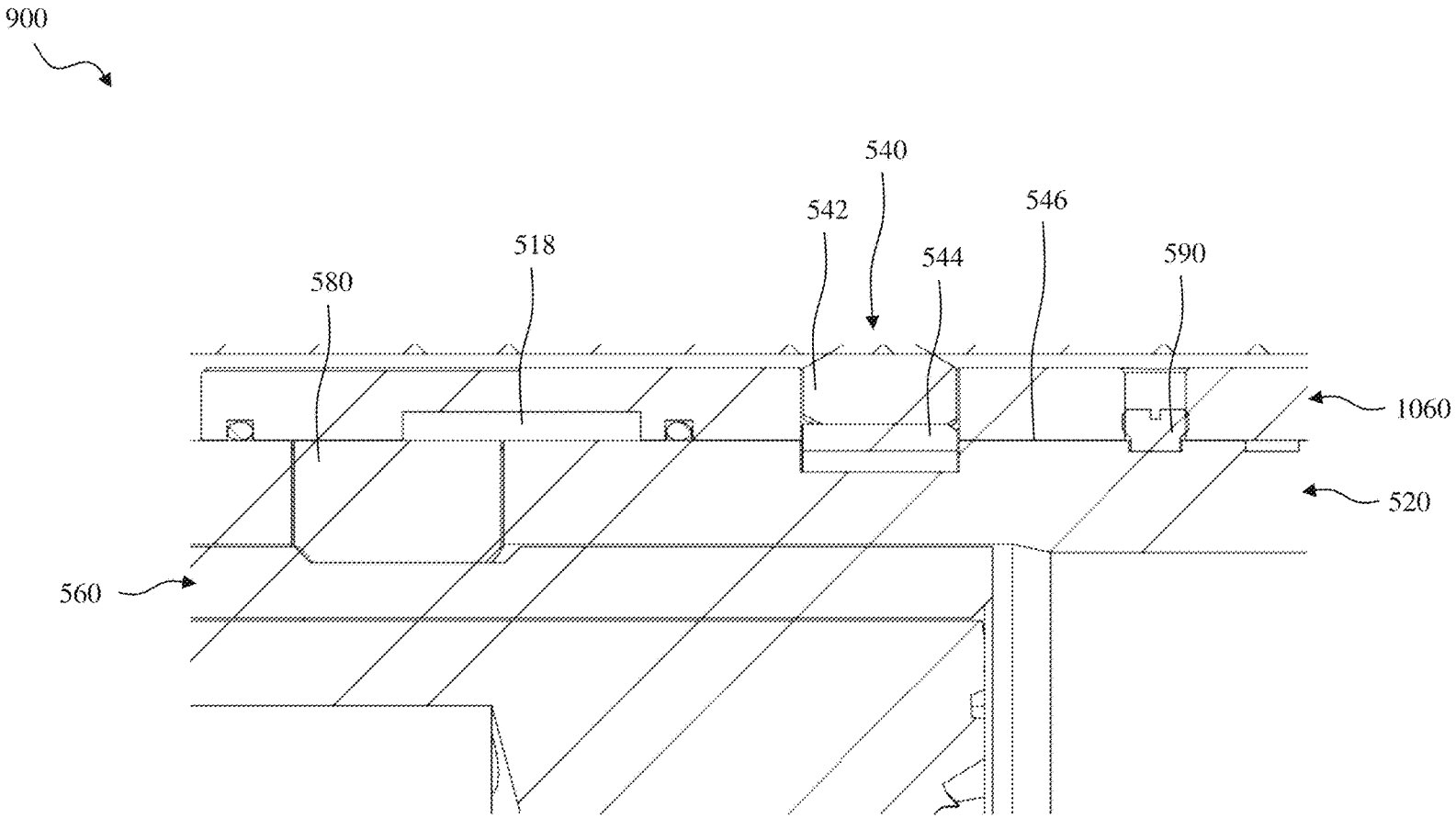
Figure 10G:
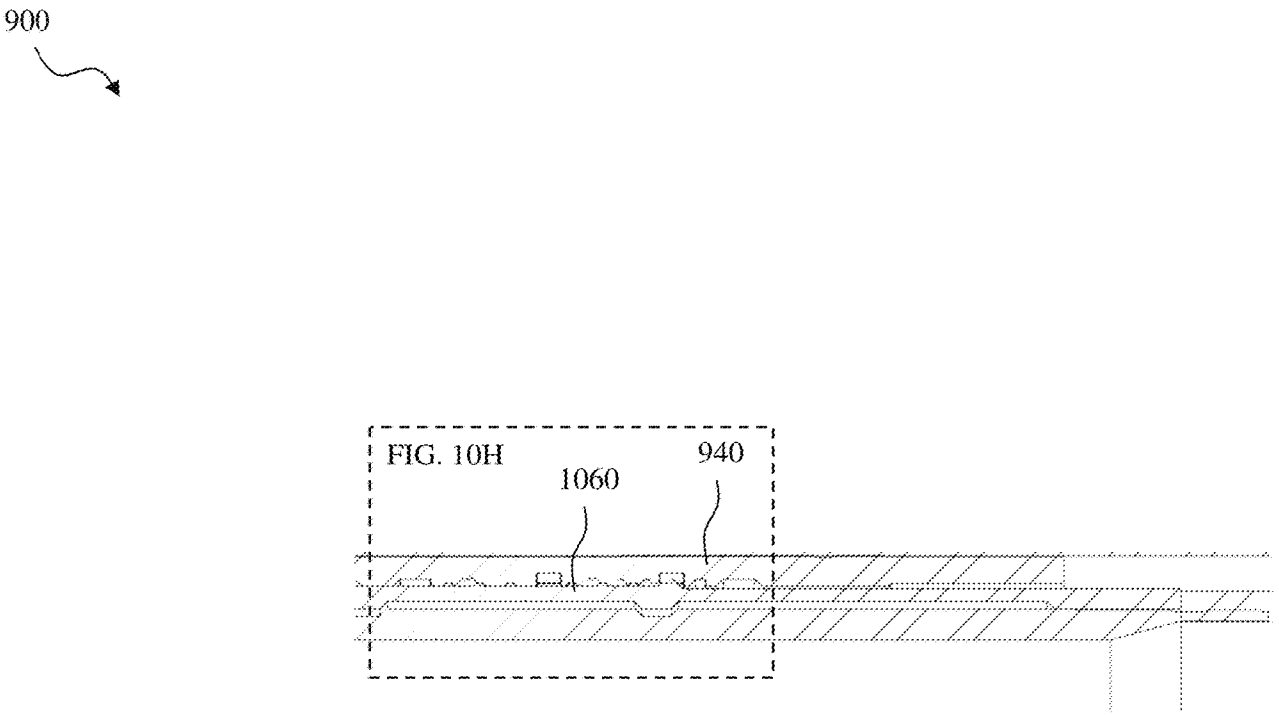
Figure 10H:
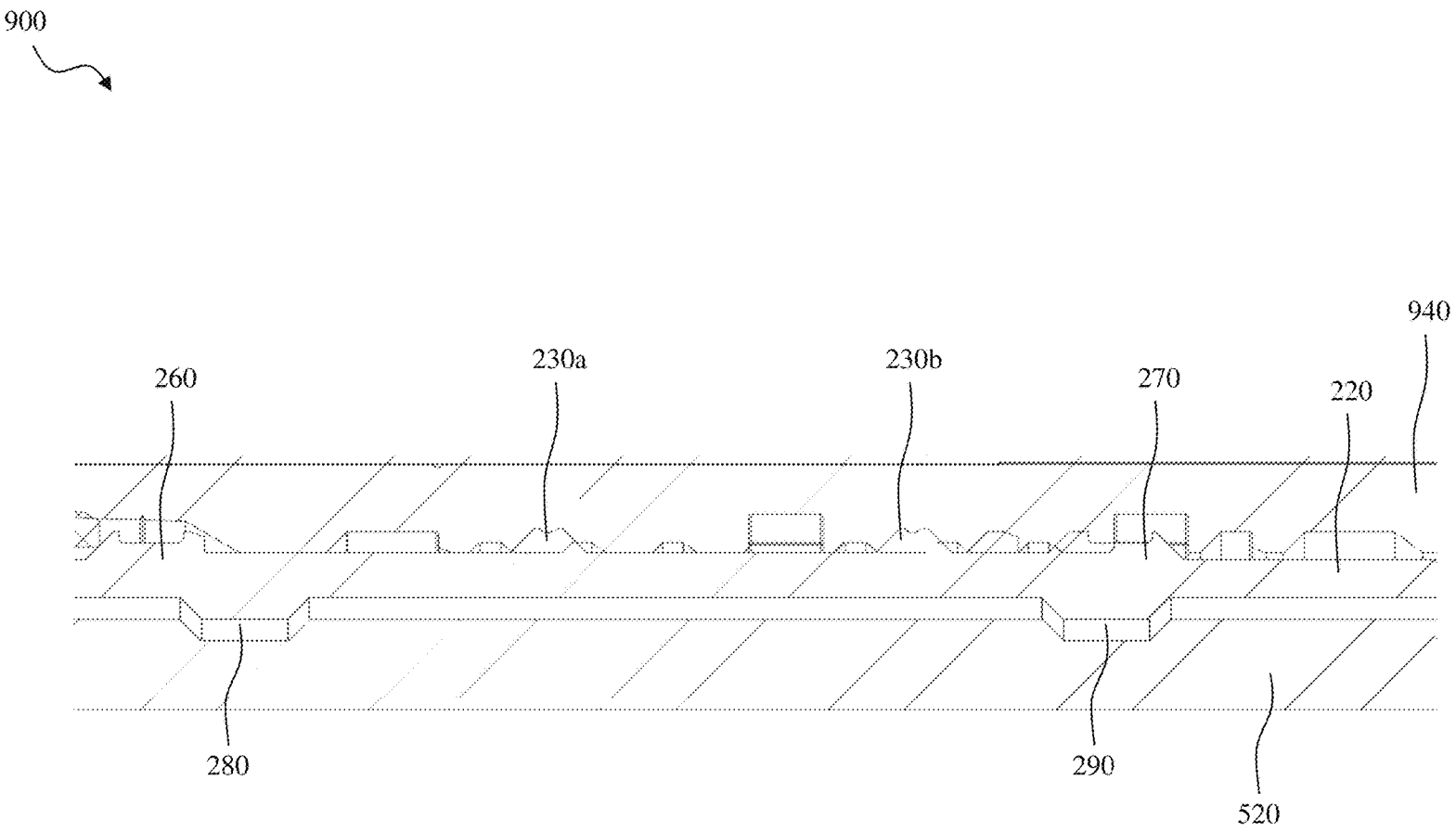
Figure 11A:
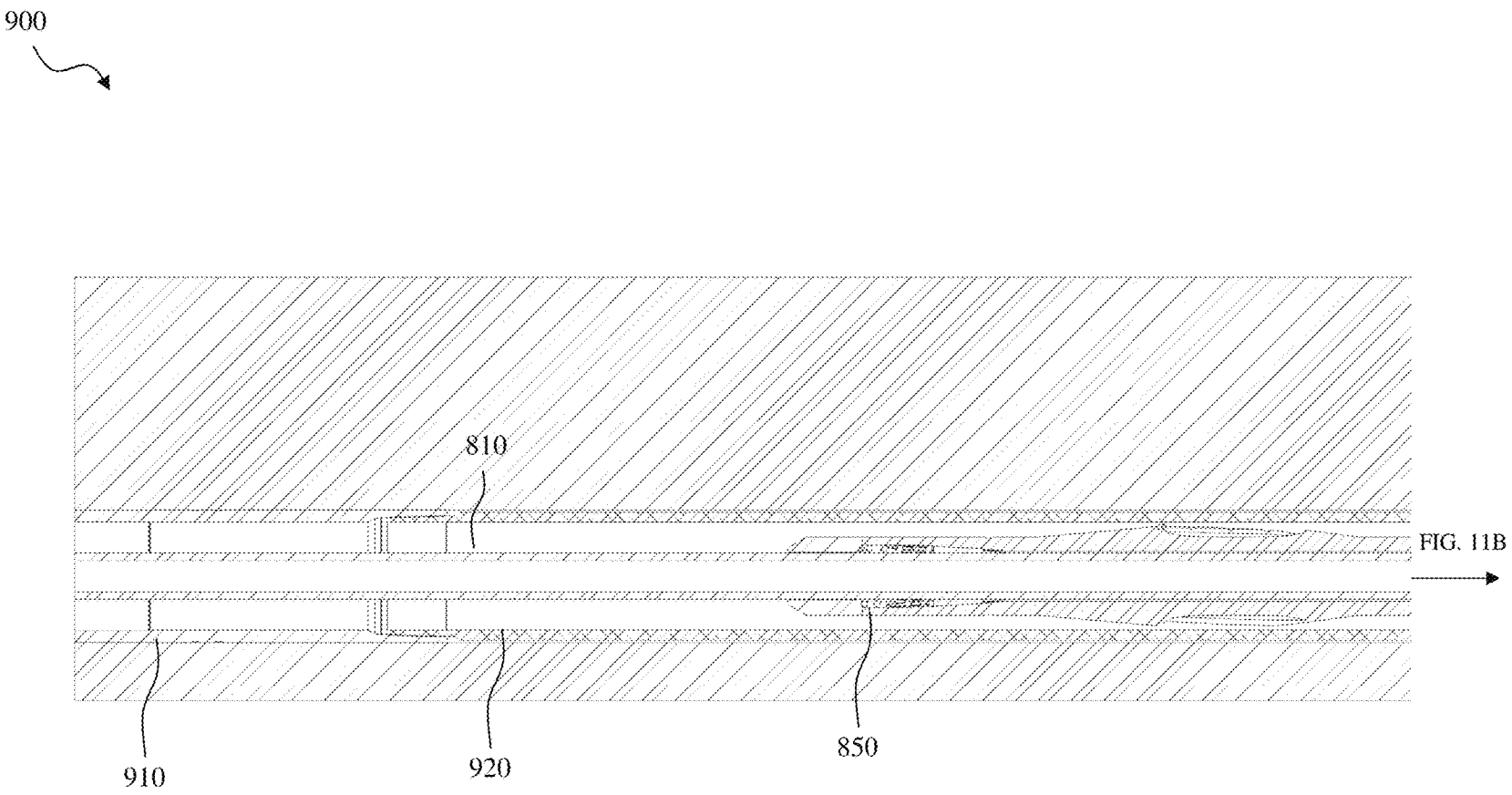
Figure 11B:
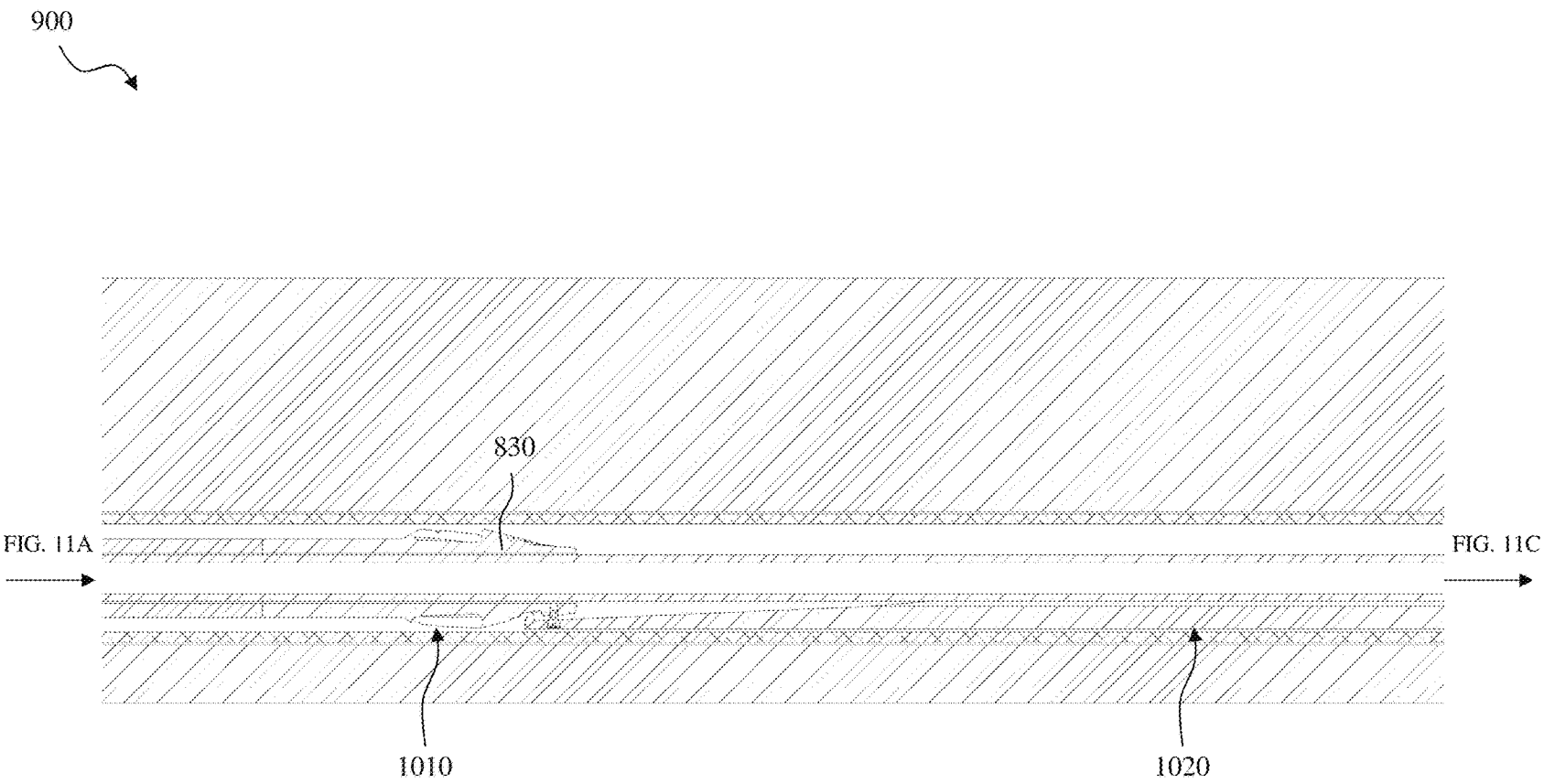
Figure 11C:
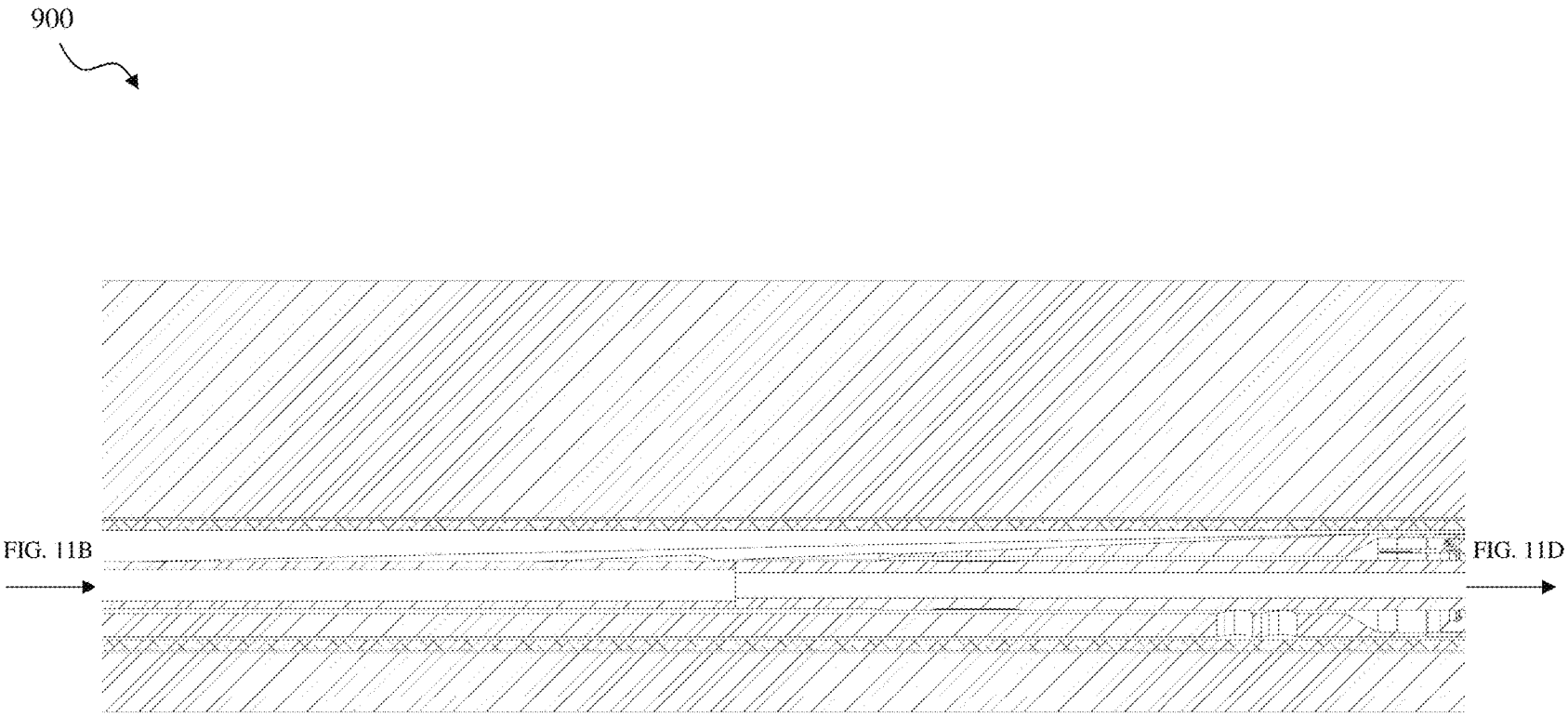
Figure 11D:
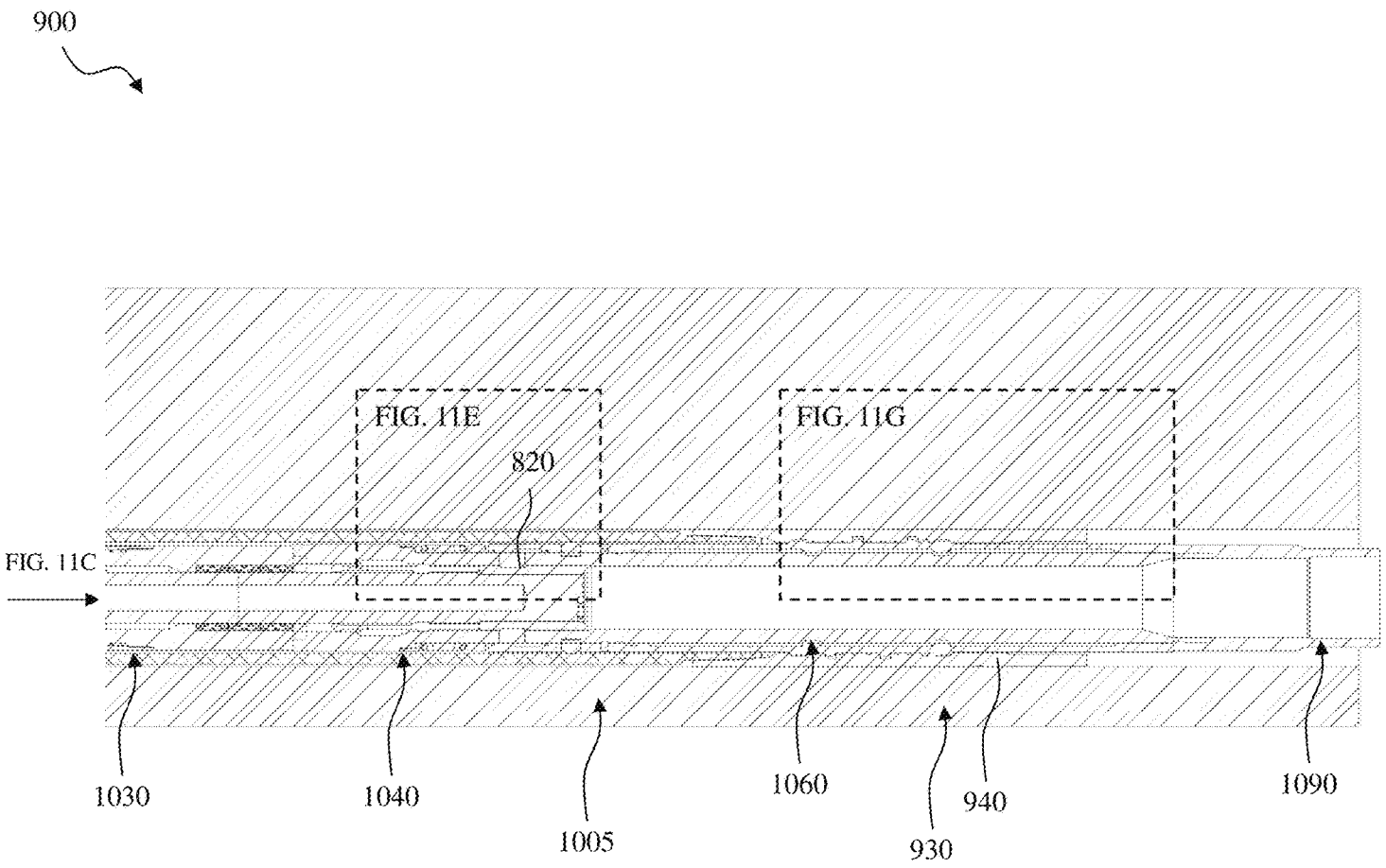
Figure 11E:
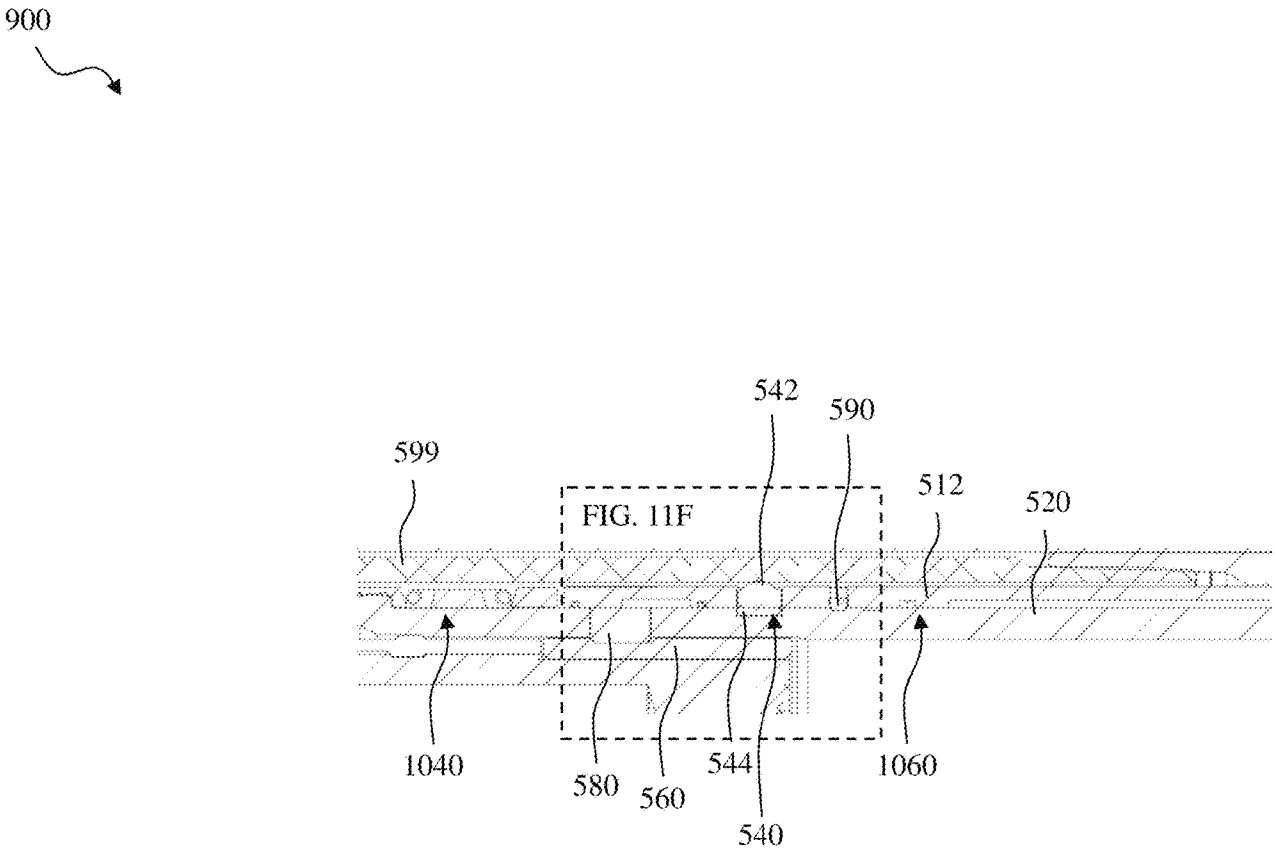
Figure 11F:
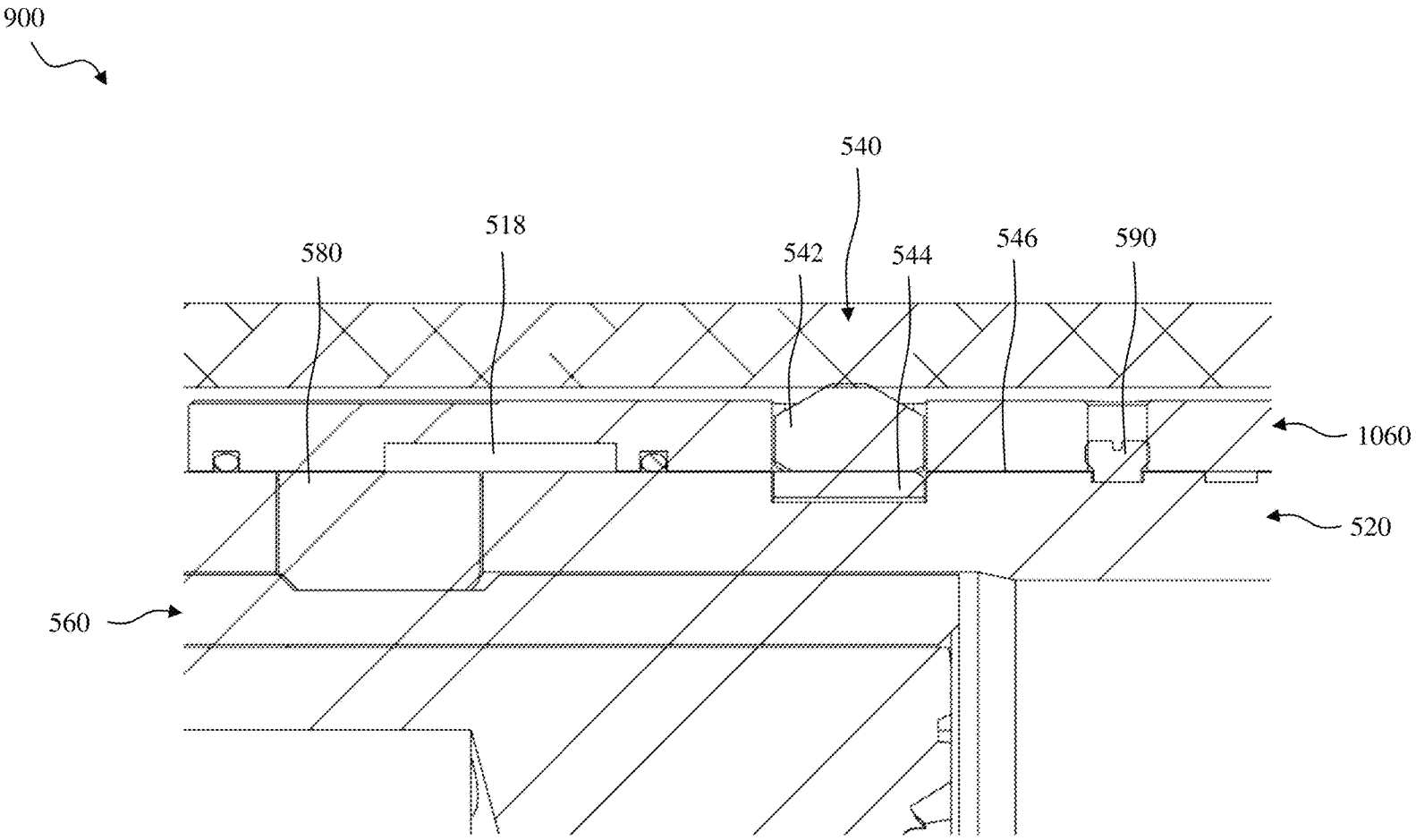
Figure 11G:
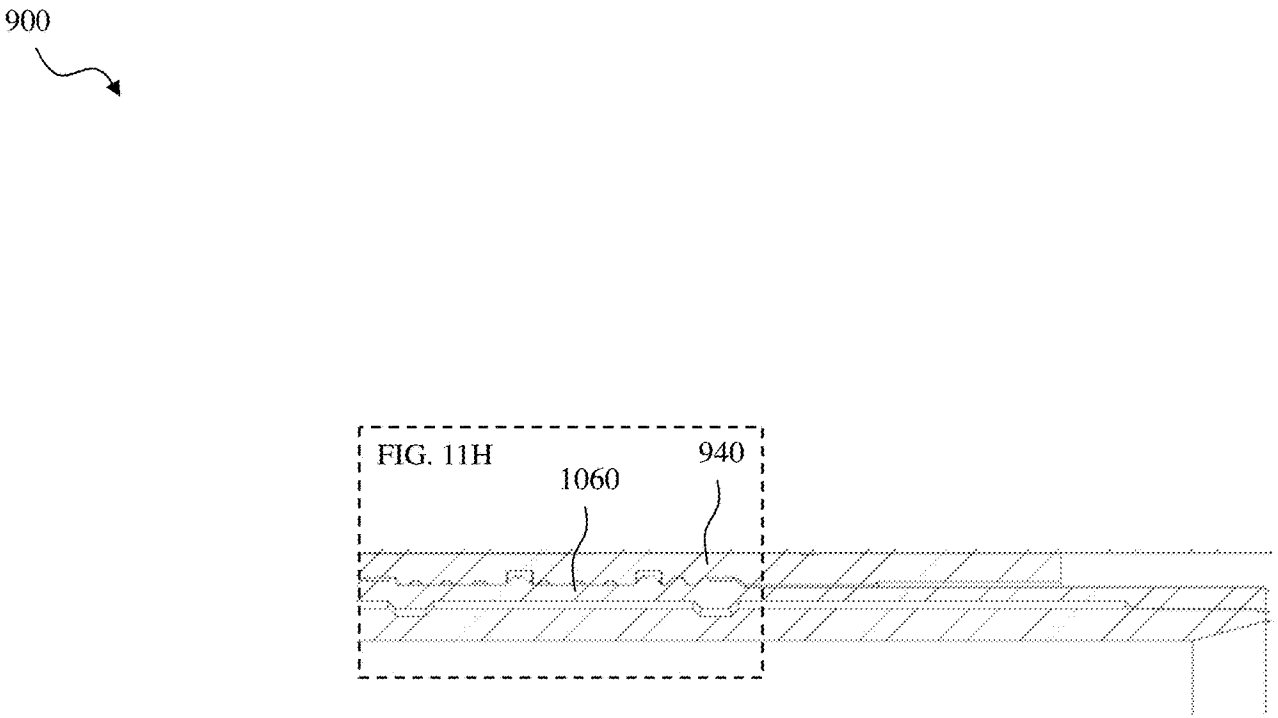
Figure 11H:
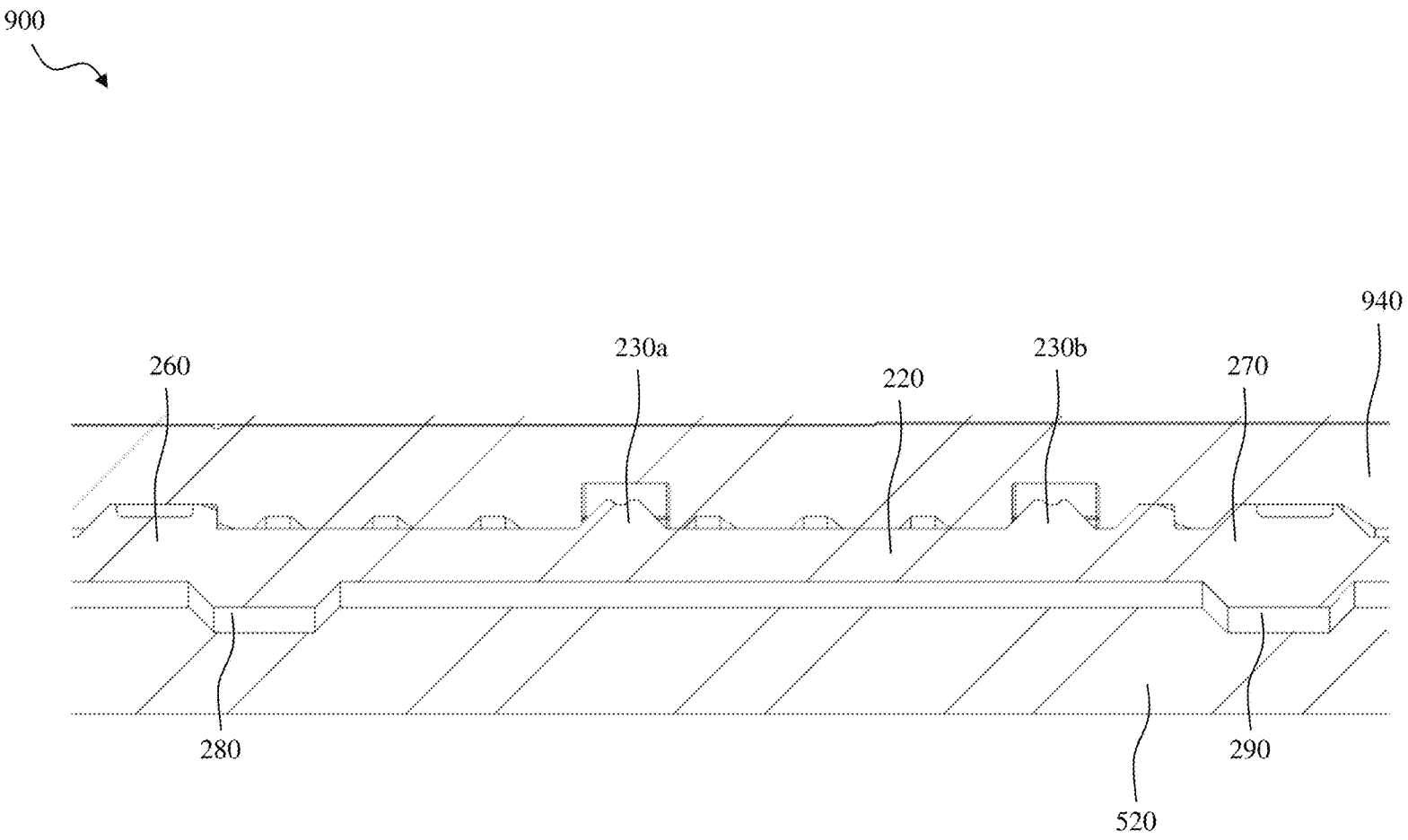
Figure 12A:
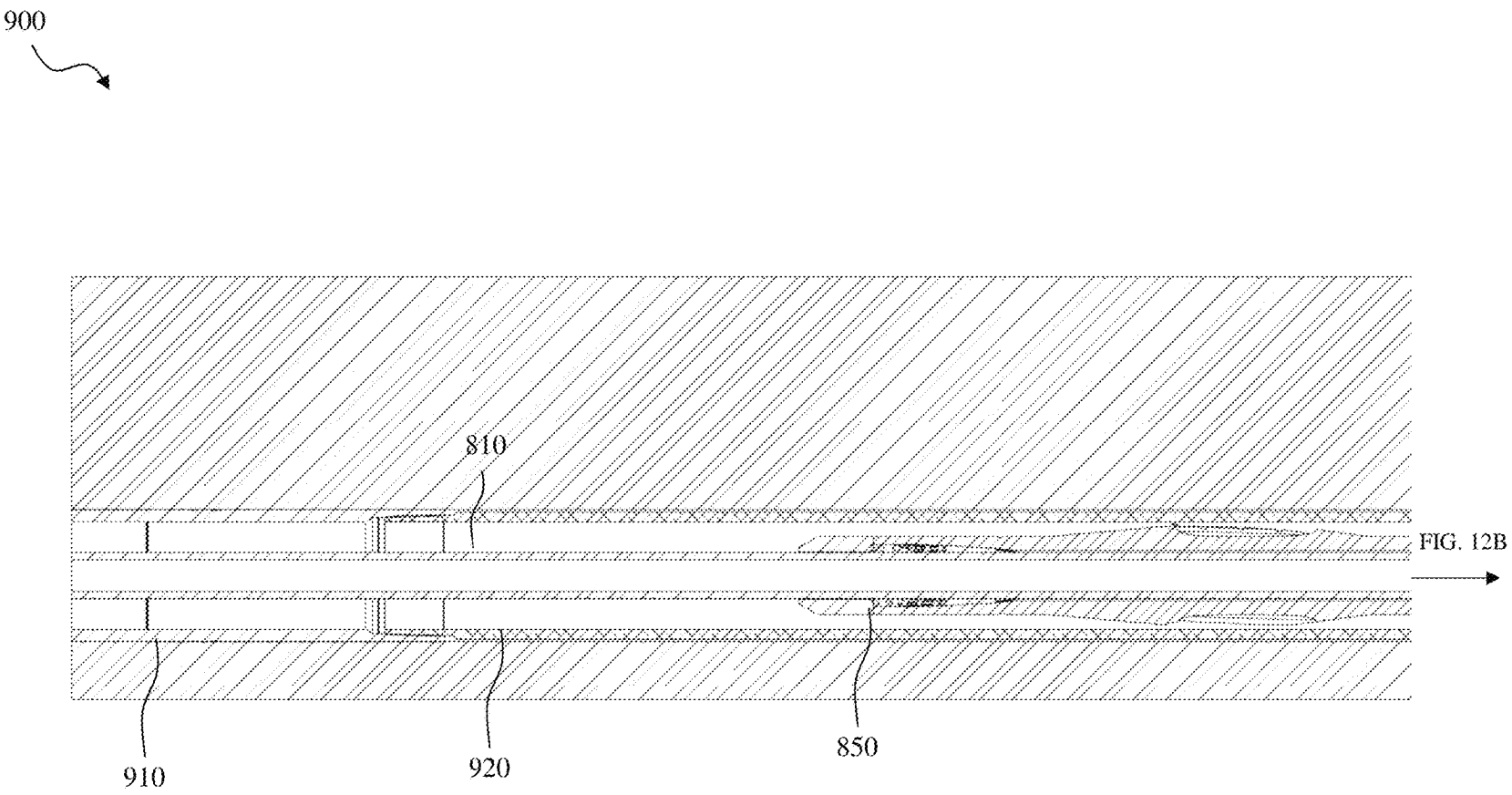
Figure 12B:
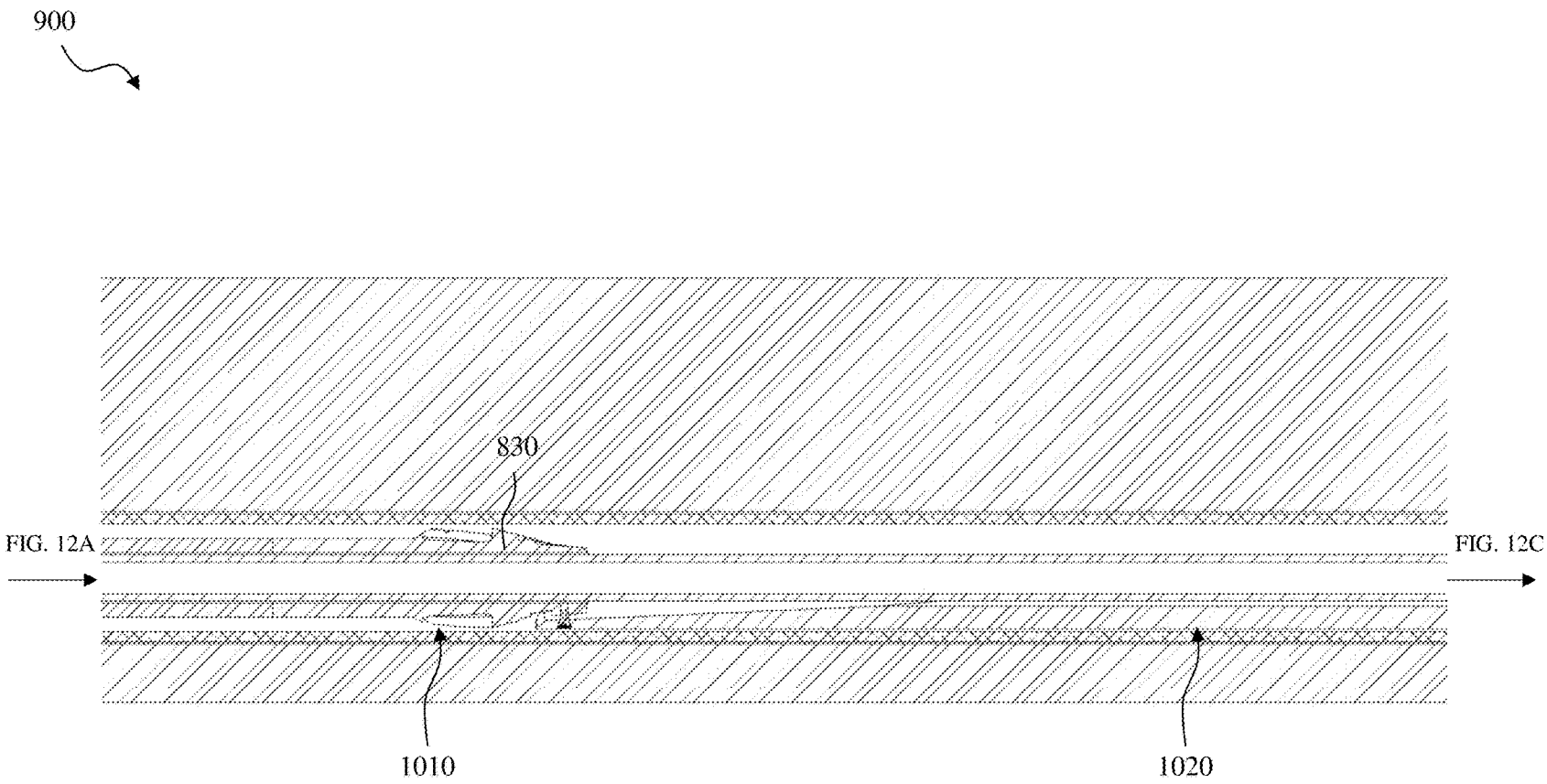
Figure 12C:
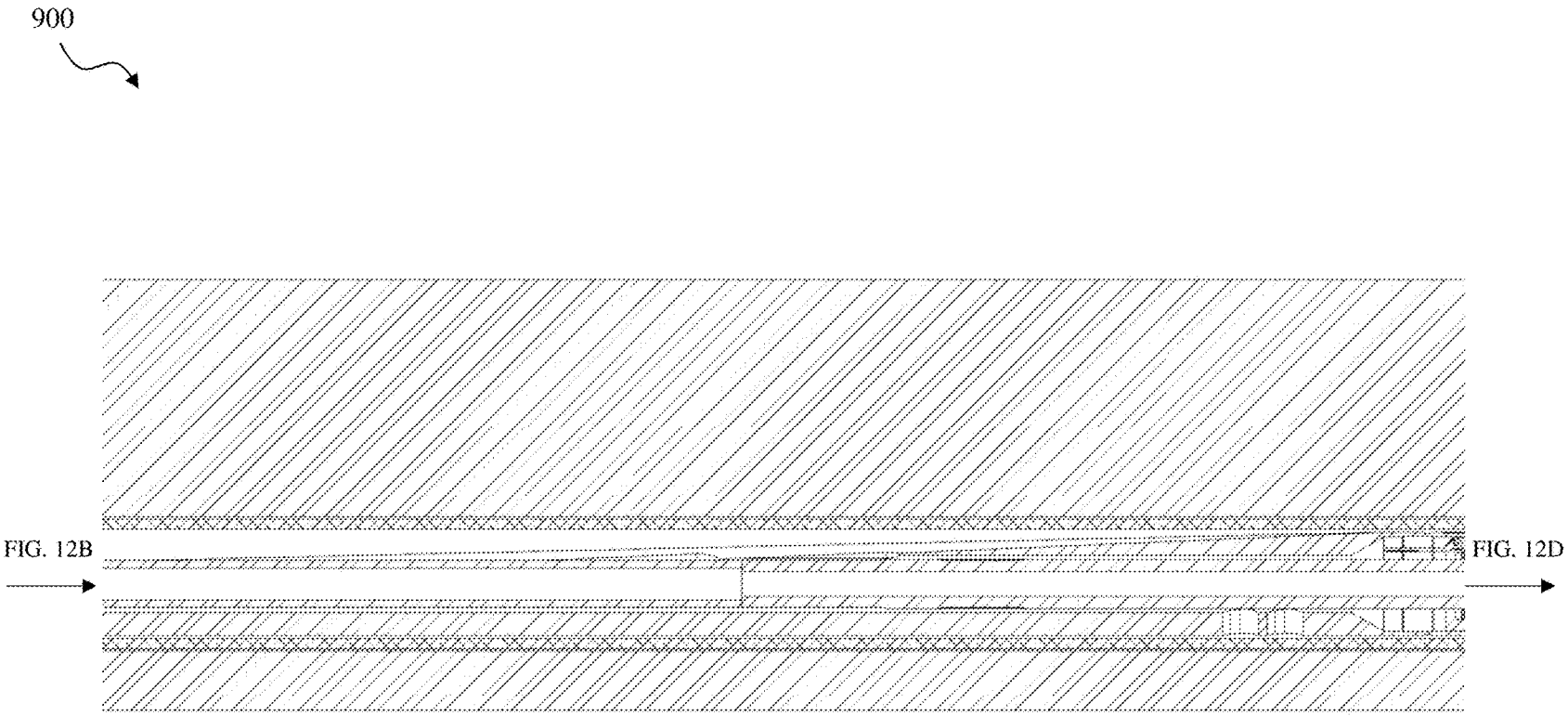
Figure 12D:
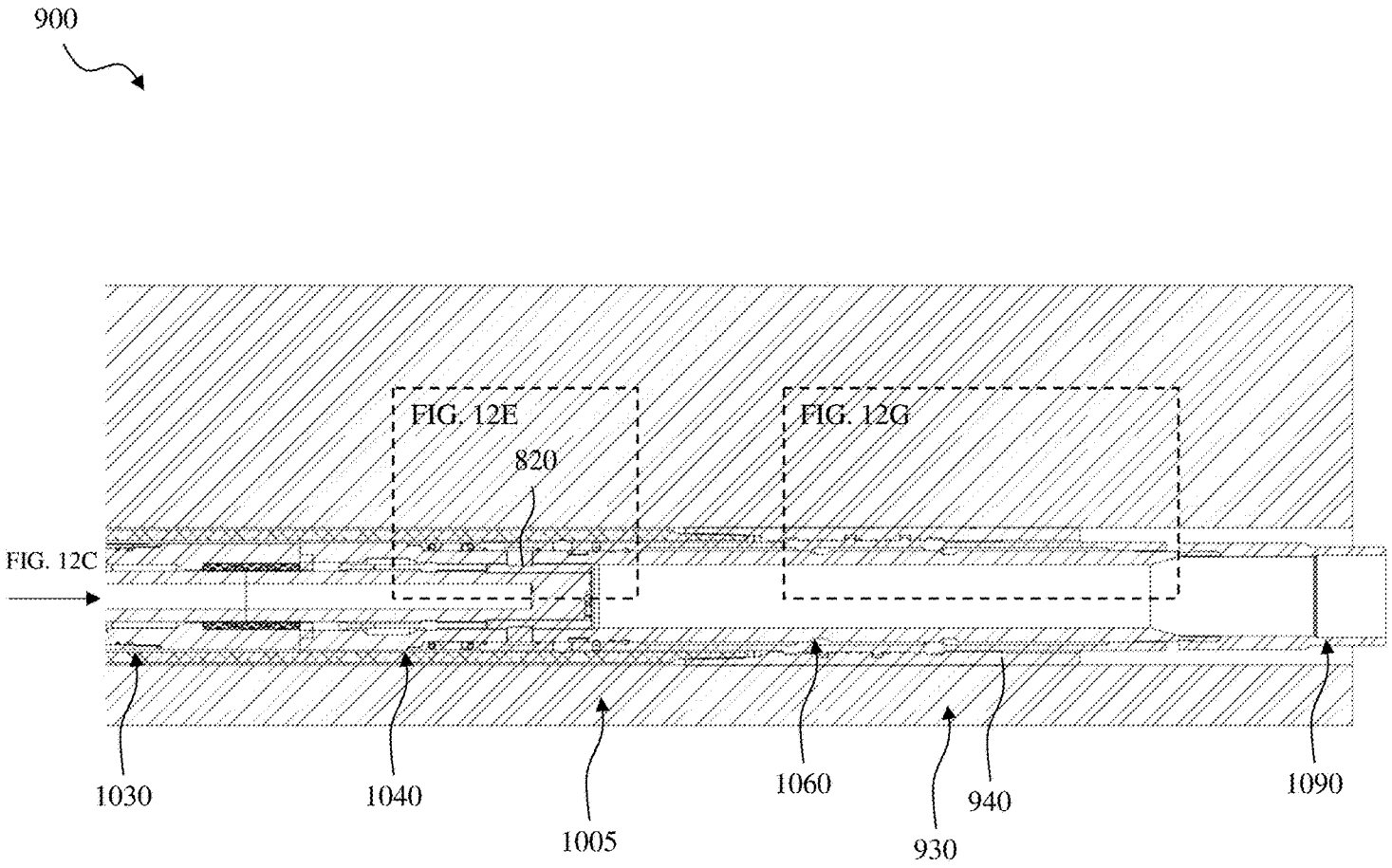
Figure 12E:
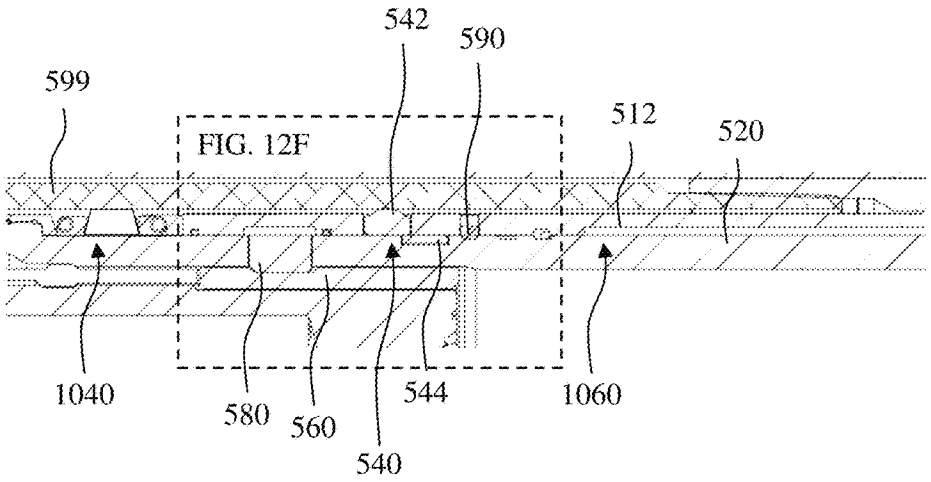
Figure 12F:
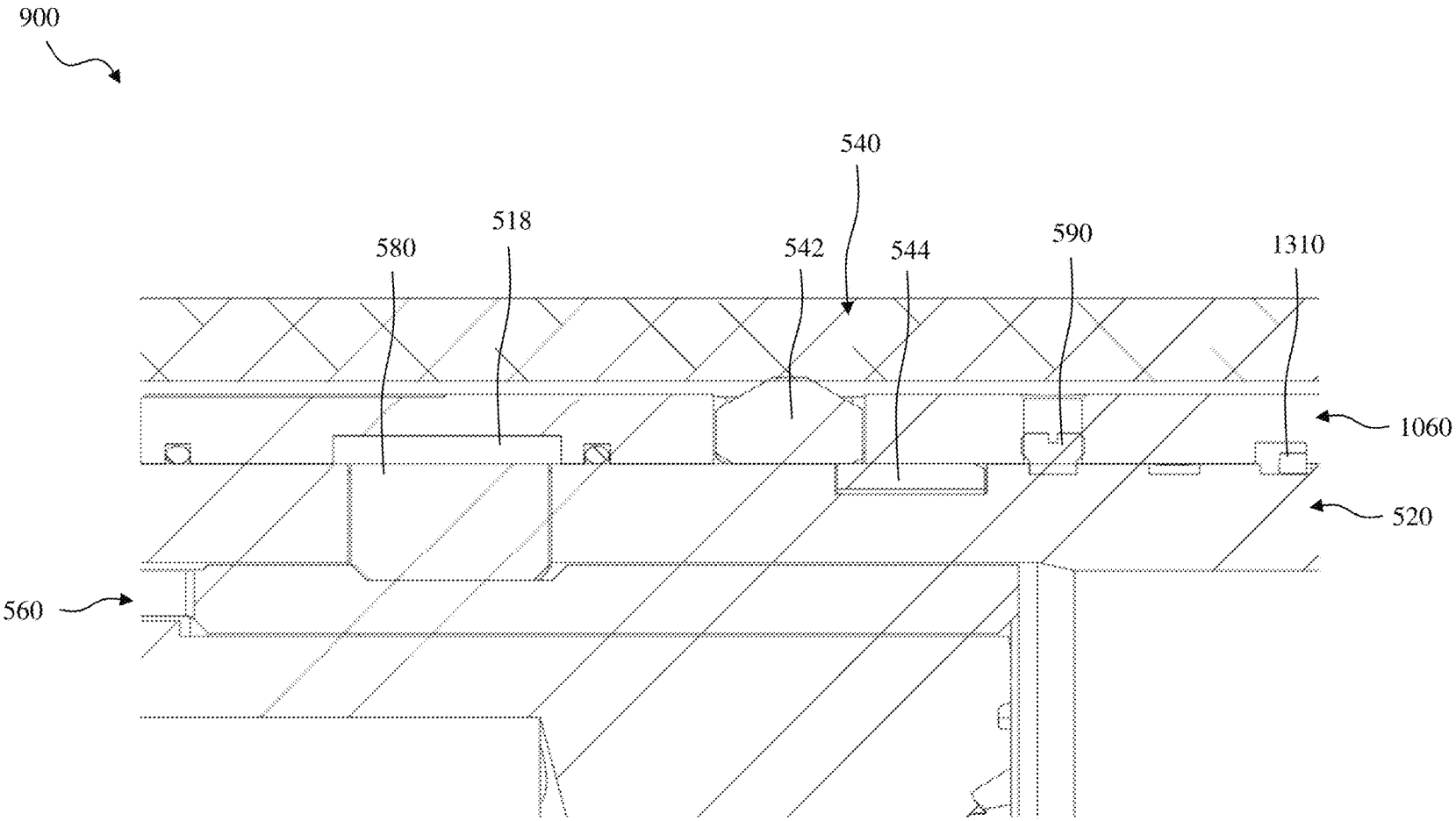
Figure 12G:
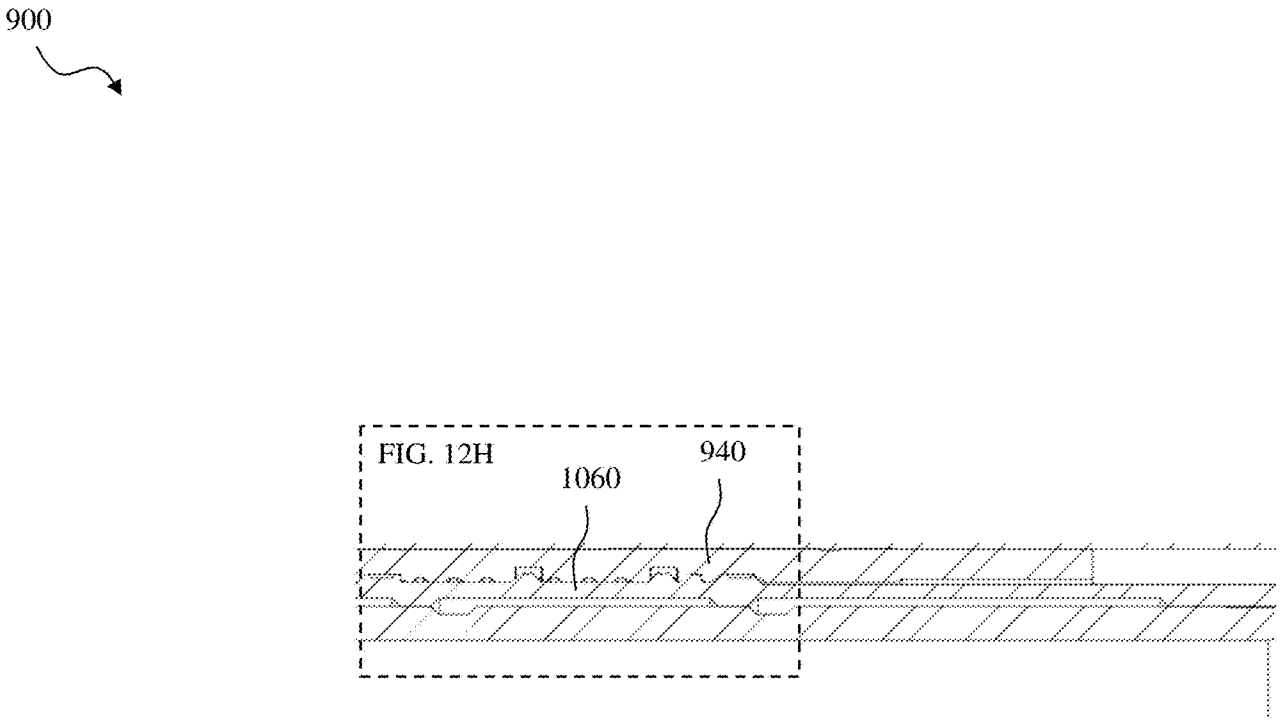
Figure 12H:
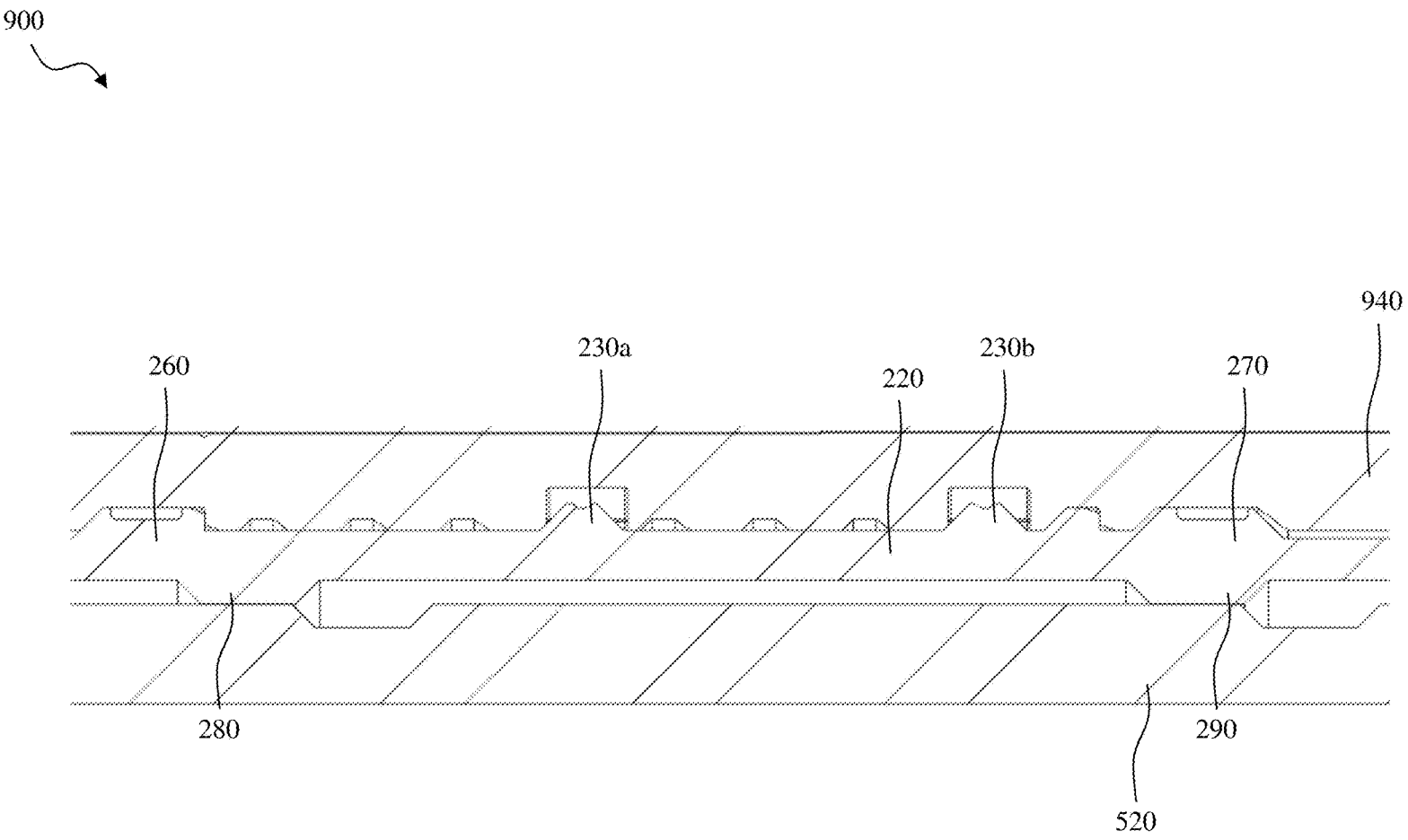
Figure 13A:
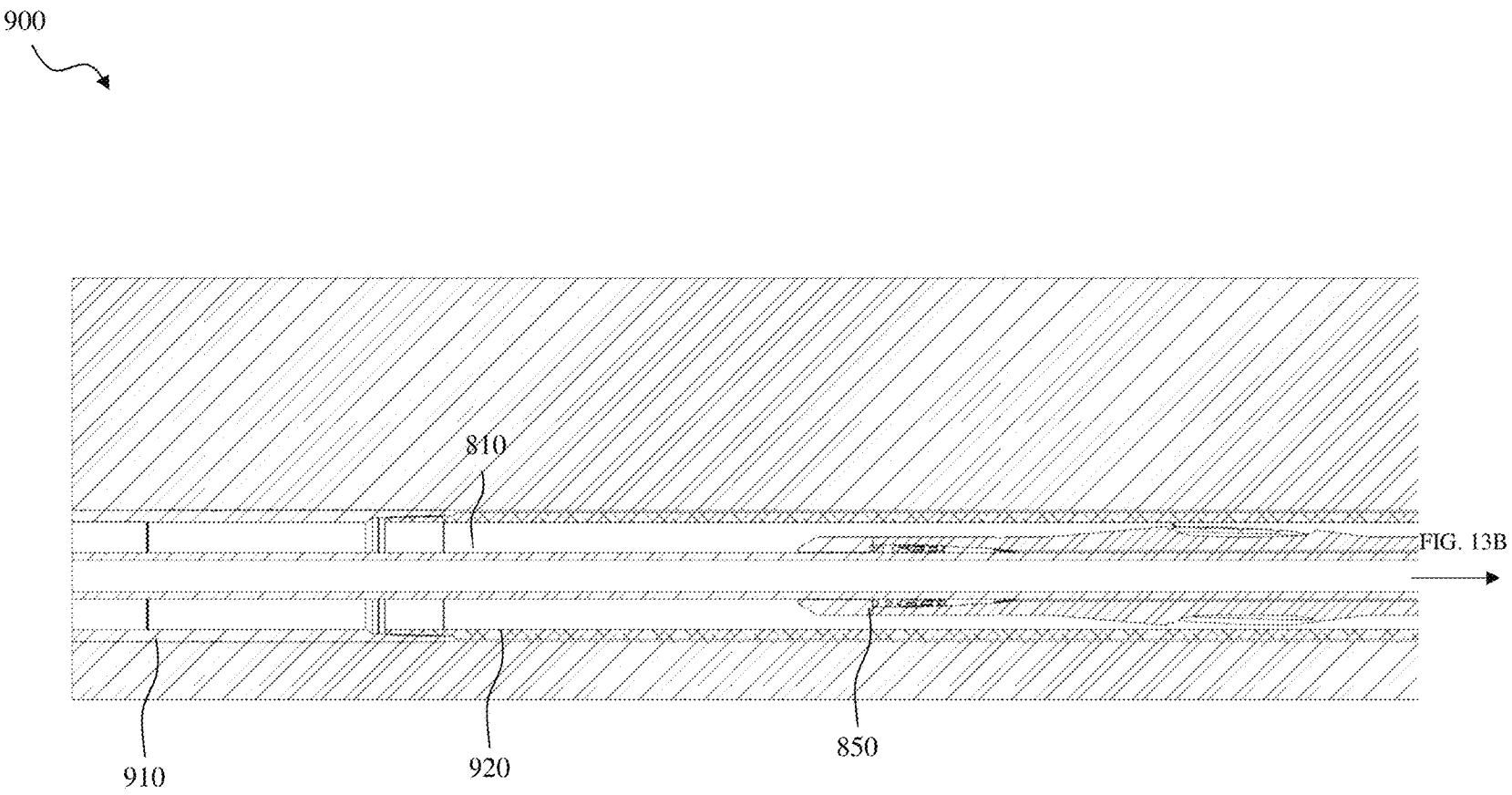
Figure 13B:
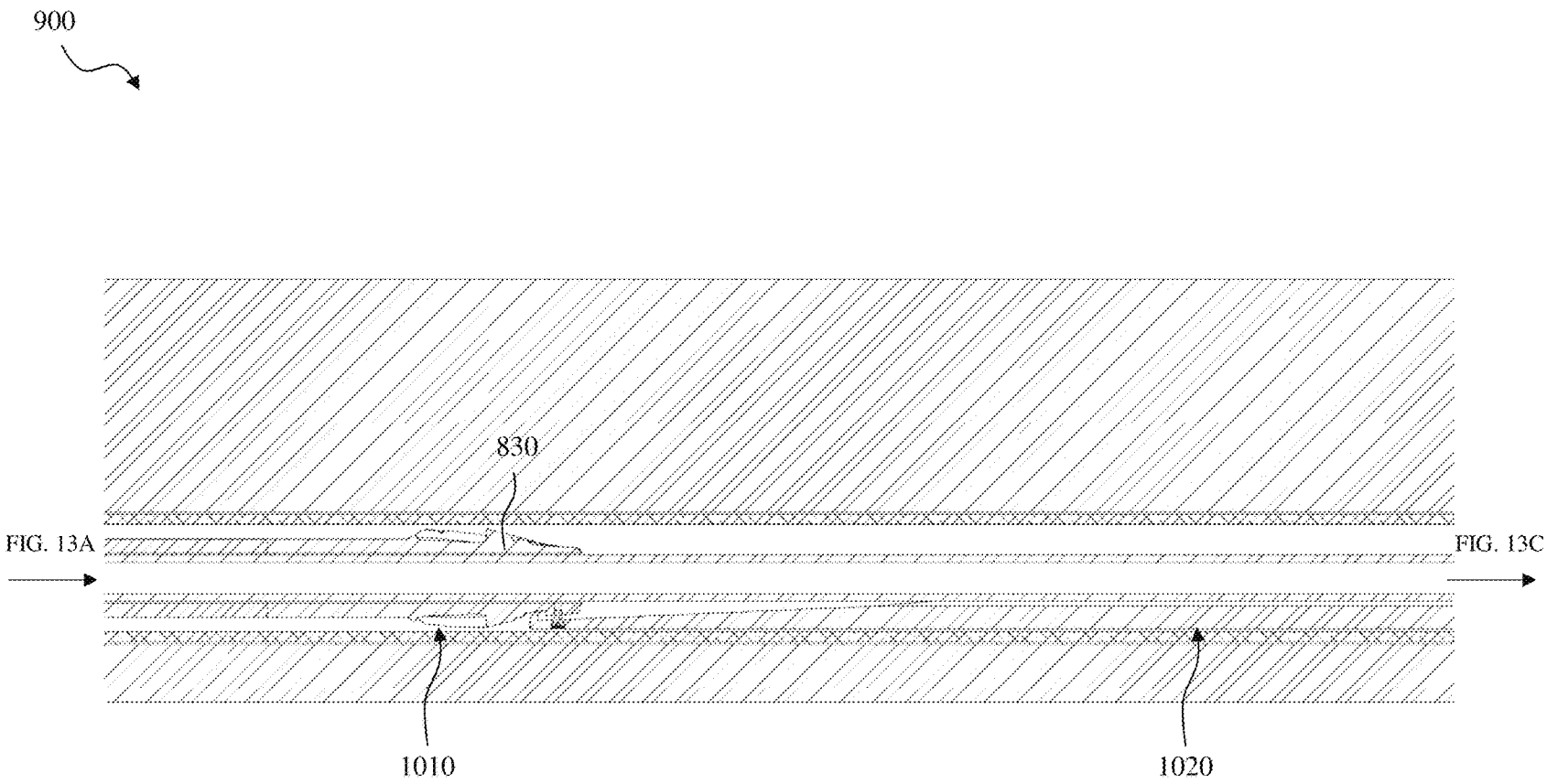
Figure 13C:
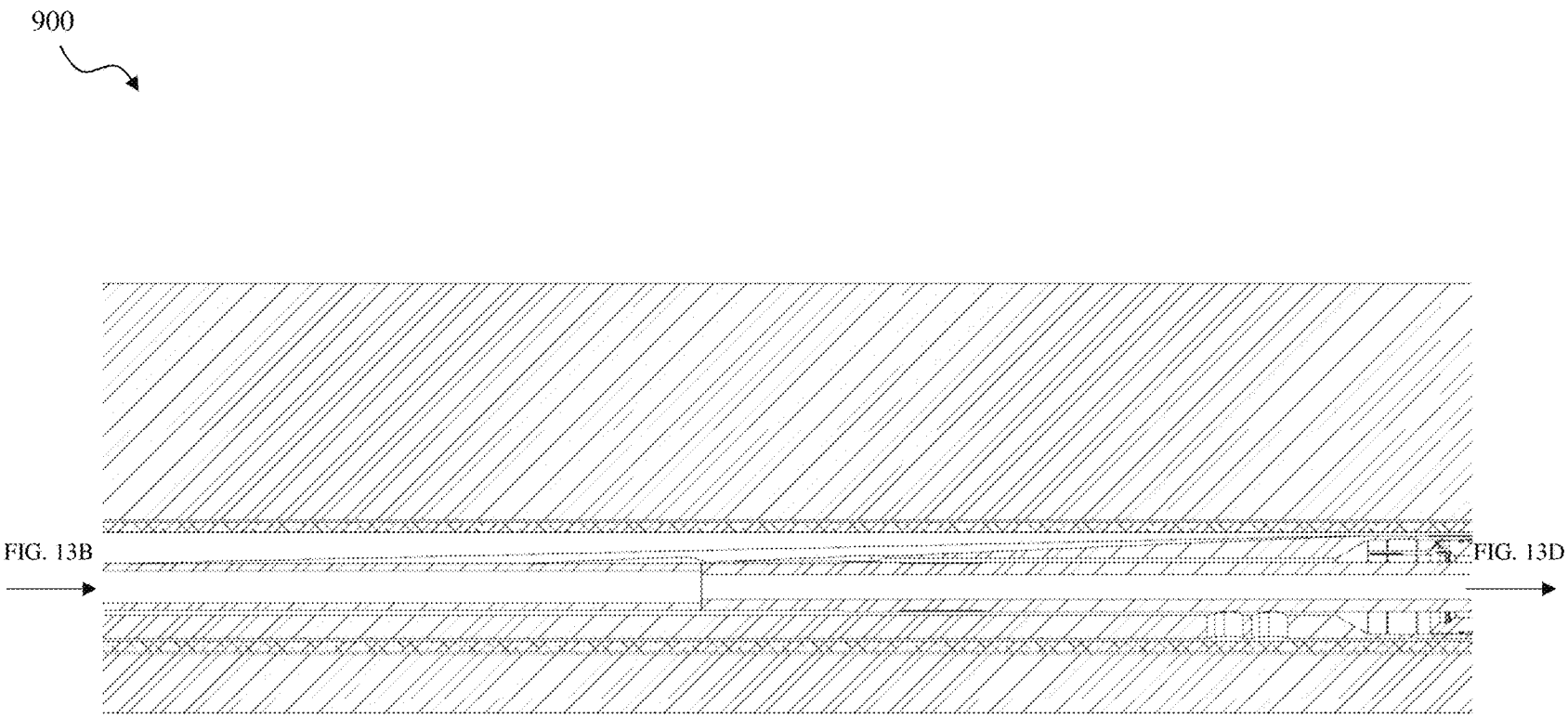
Figure 13D:
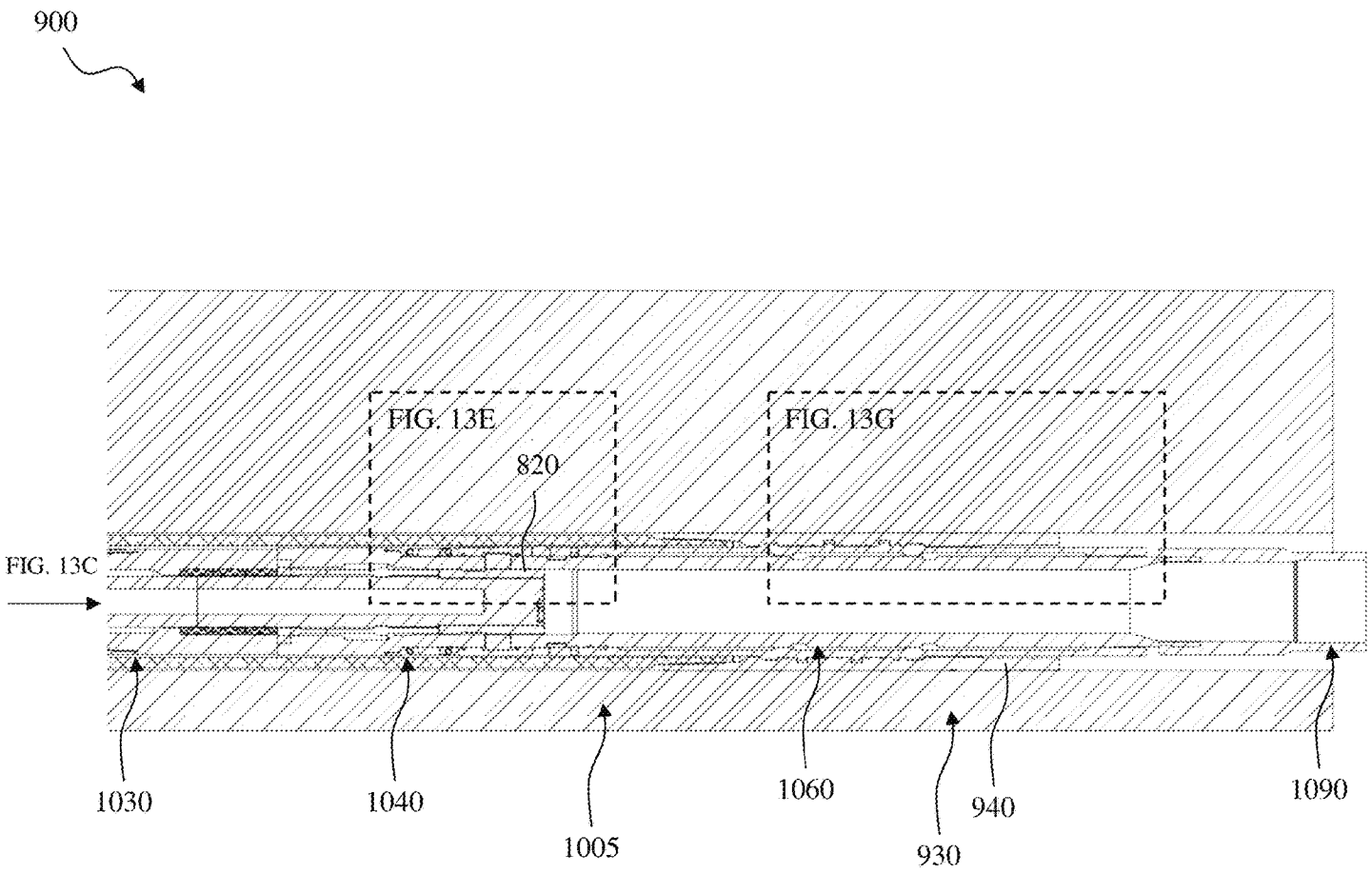
Figure 13E:
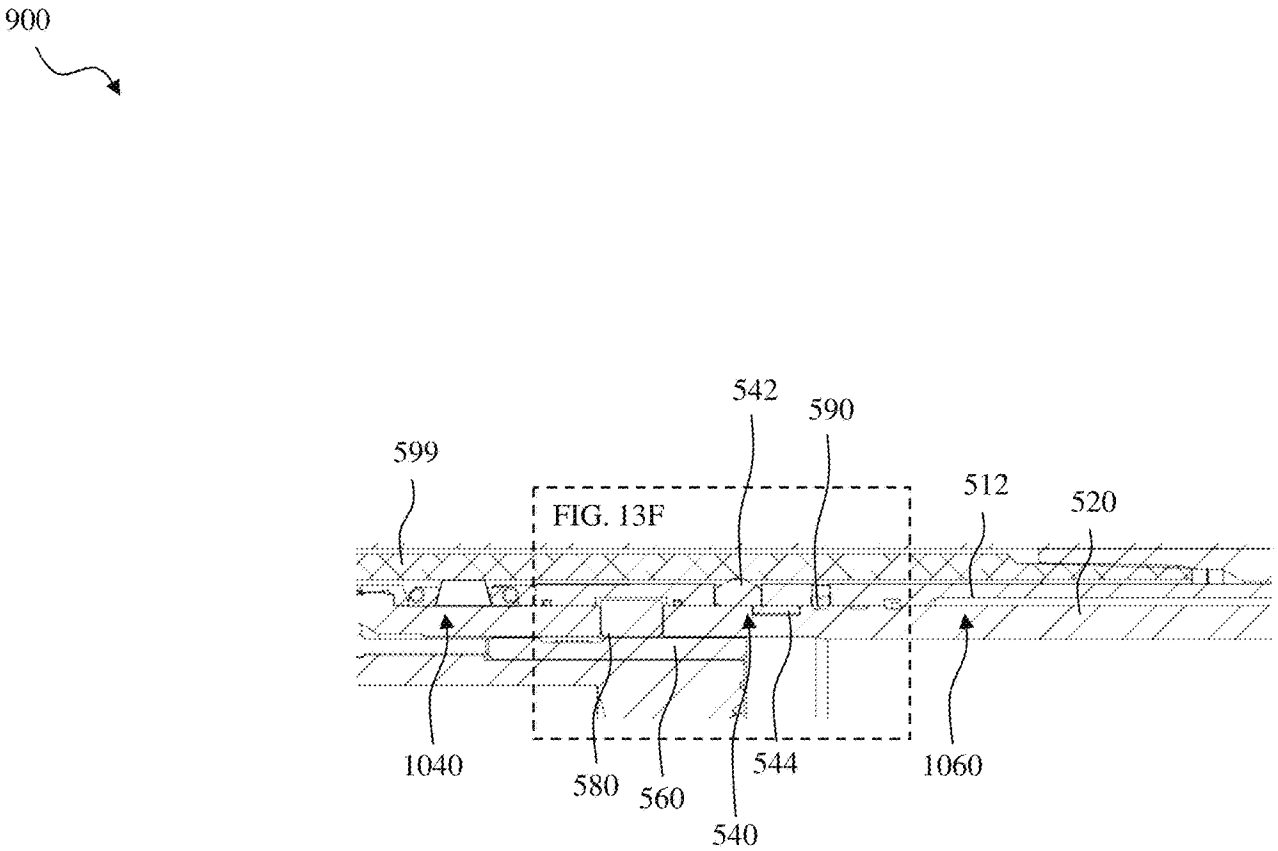
Figure 13F:
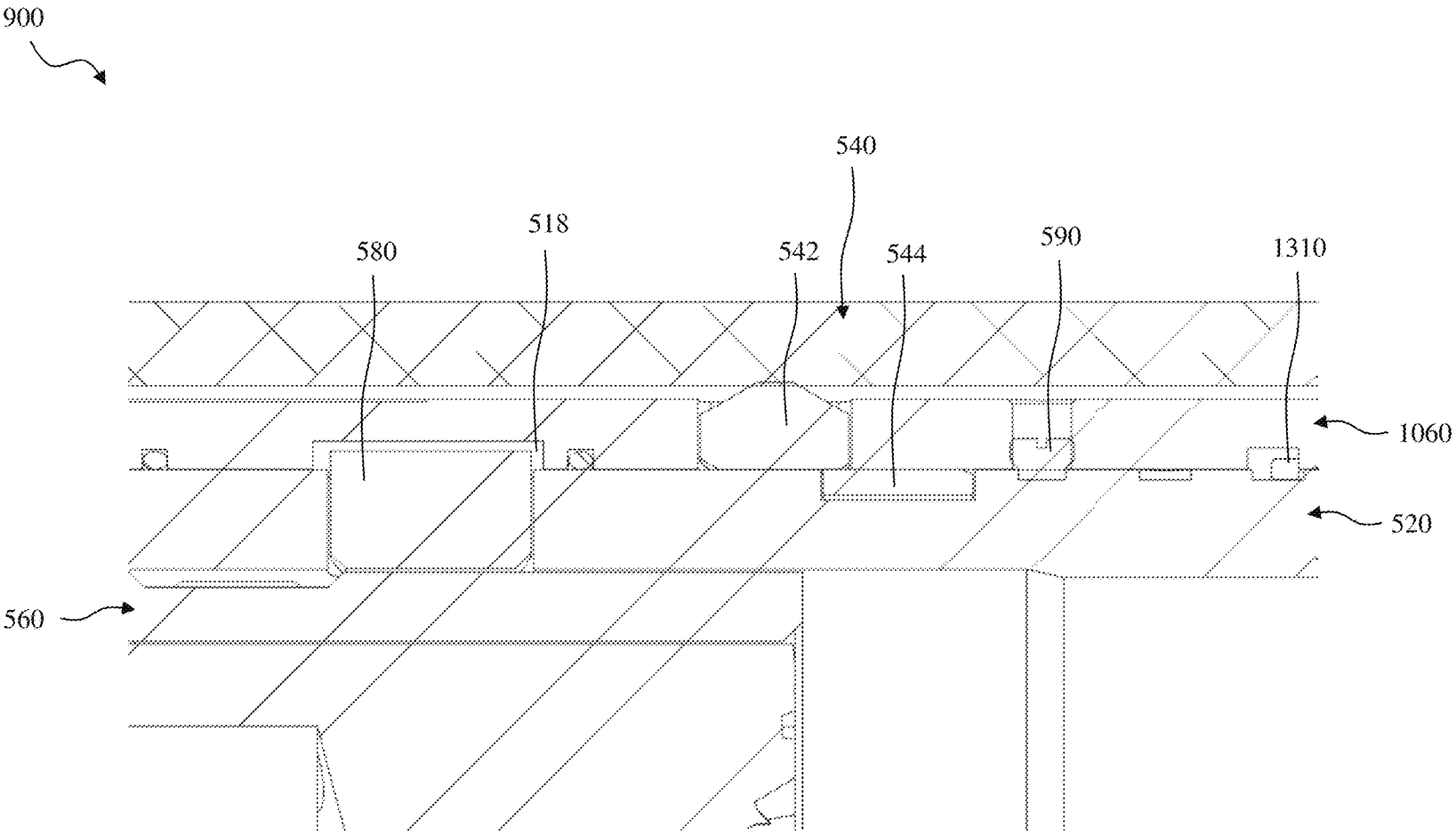
Figure 13G:
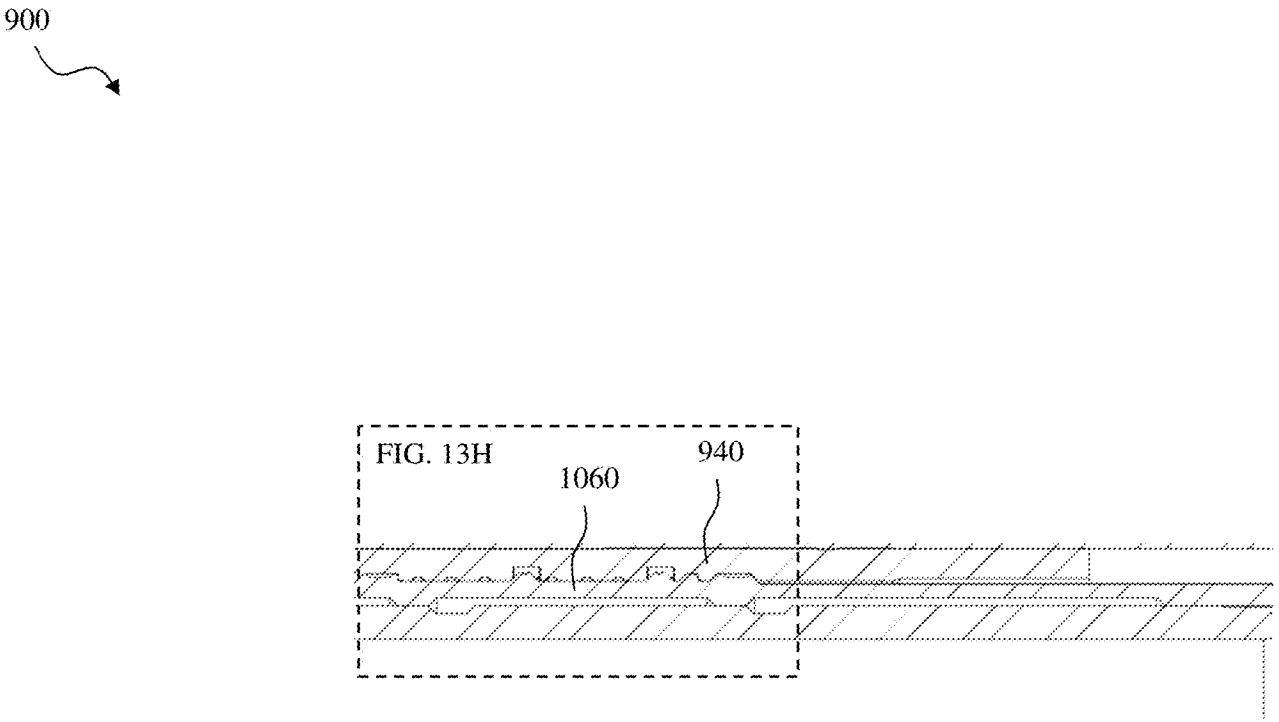
Figure 13H:
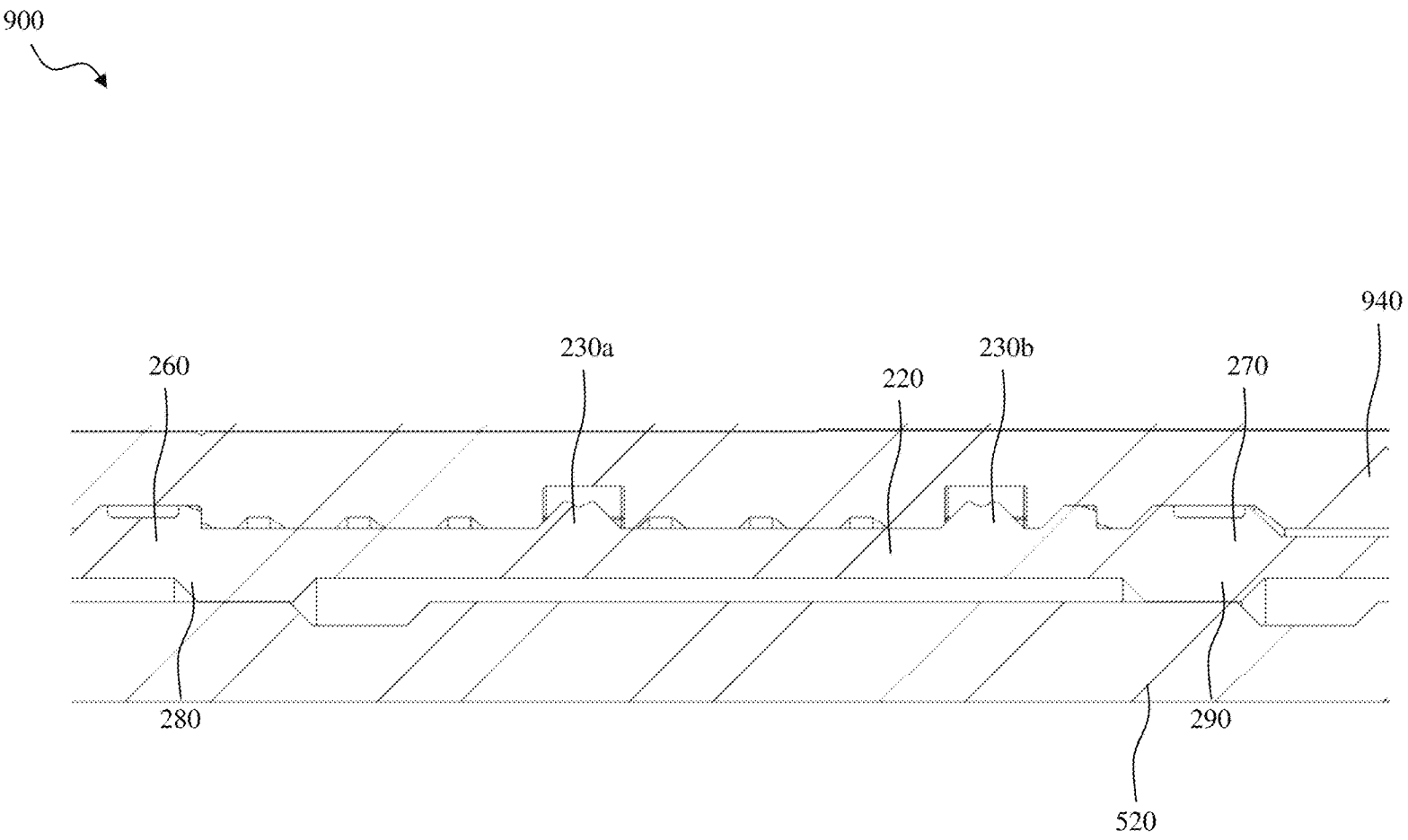
Figure 14A:
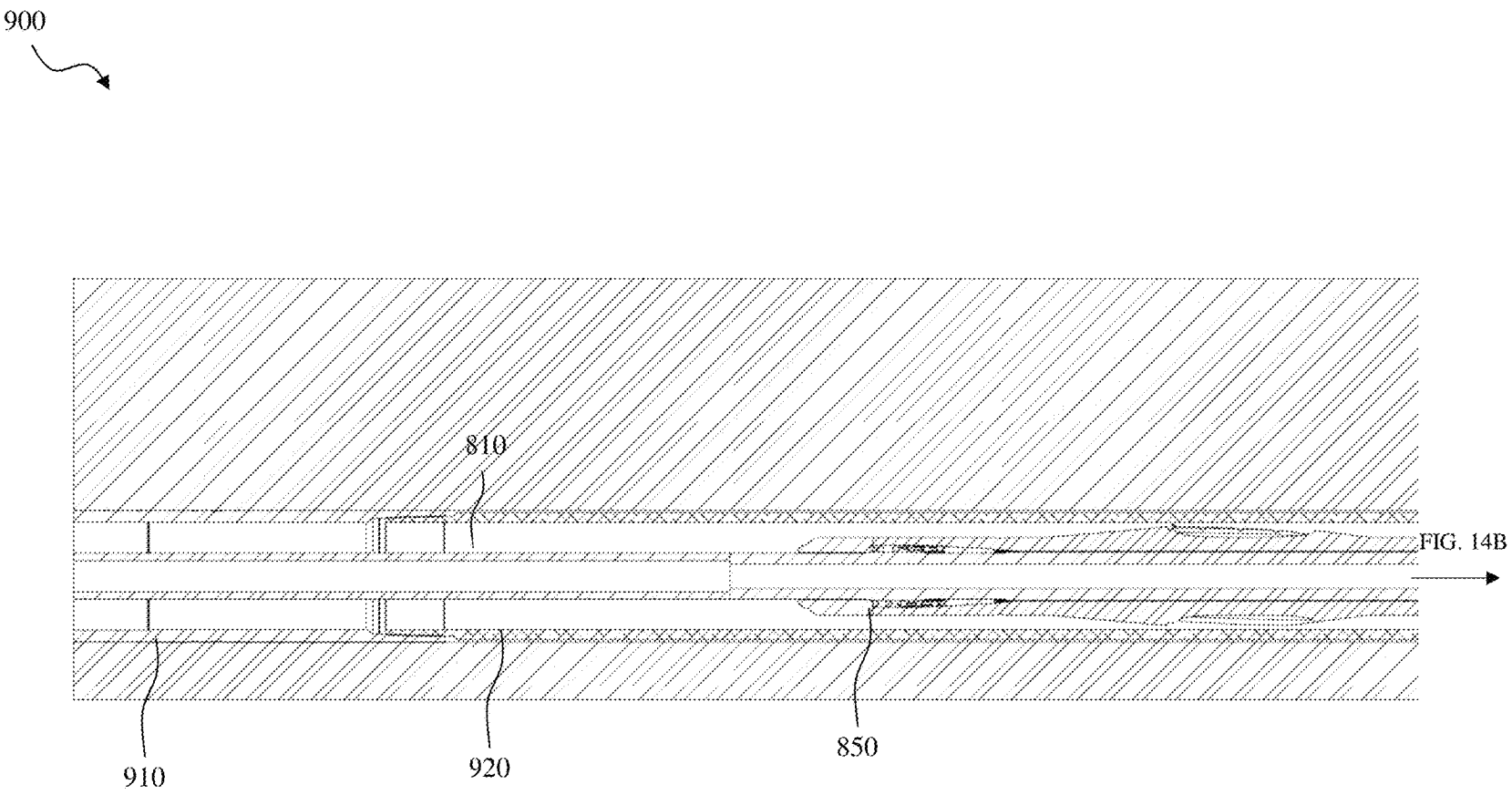
Figure 14B:
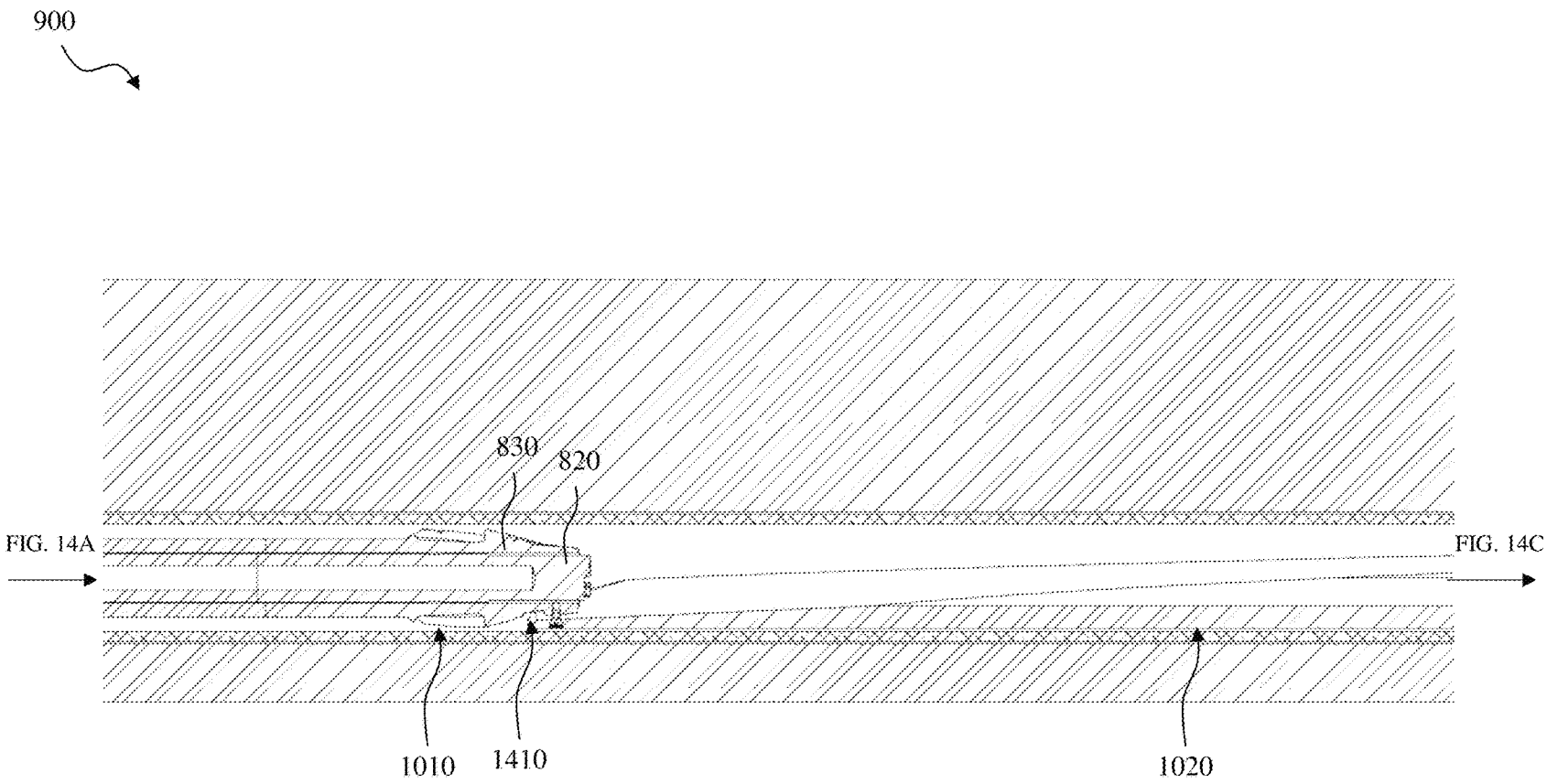
Figure 14C:
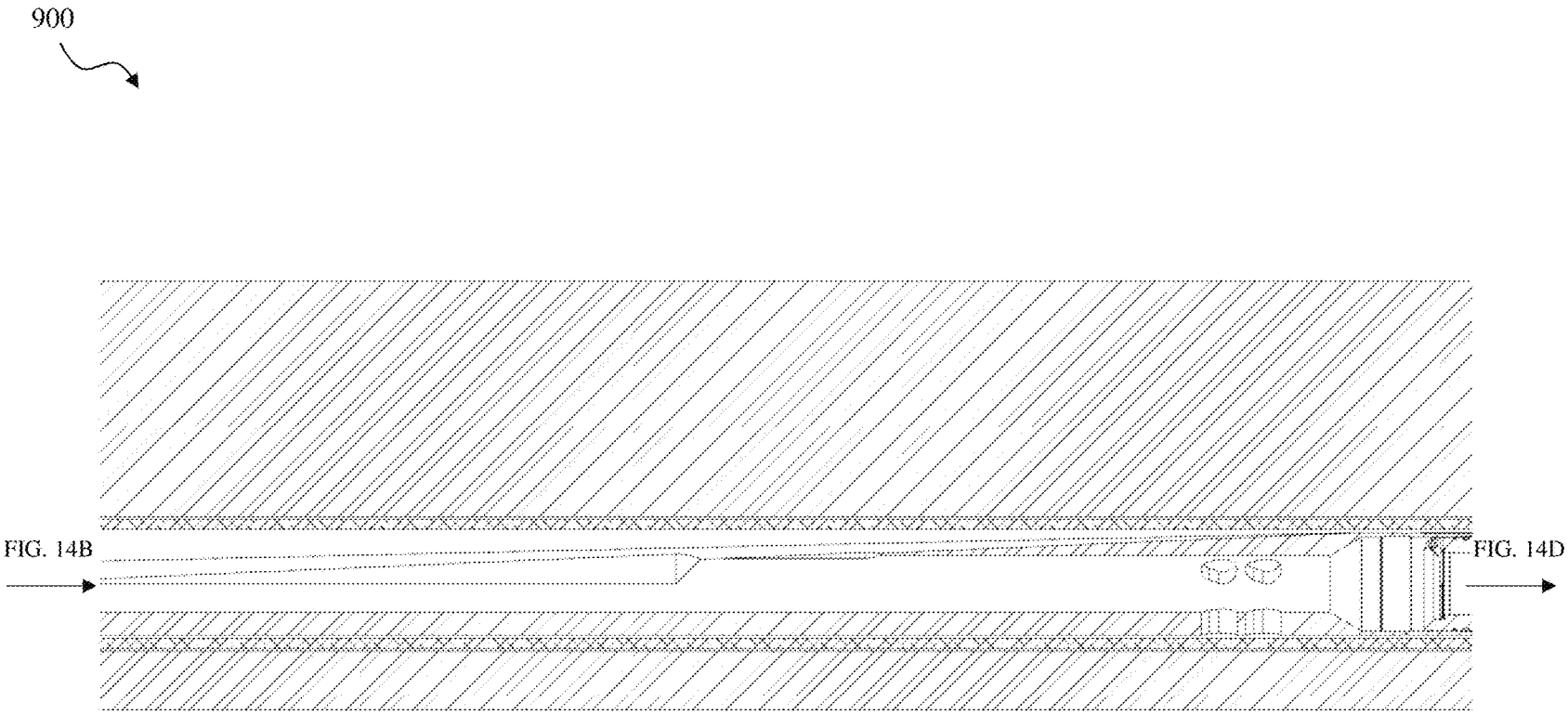
Figure 14D:
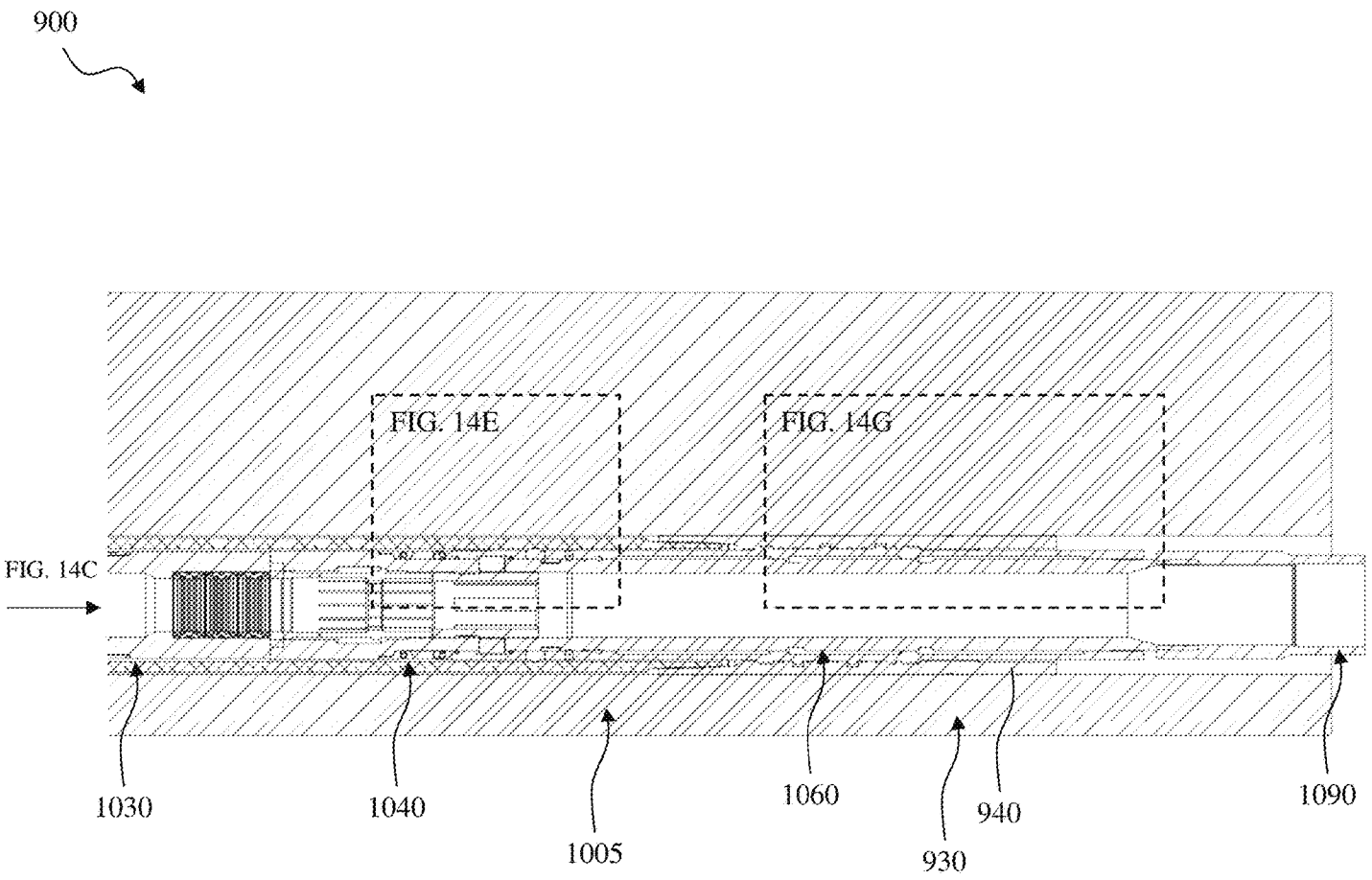
Figure 14E:
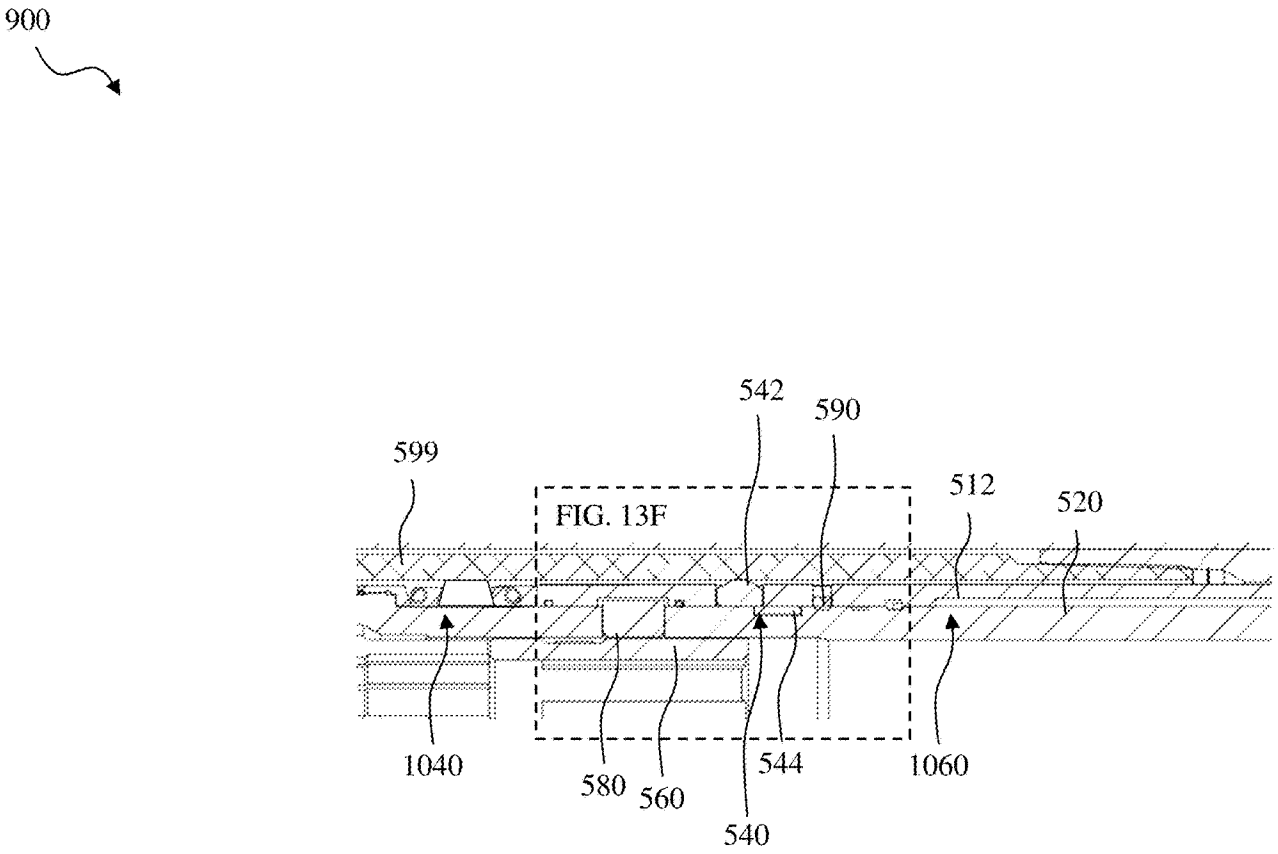
Figure 14F:
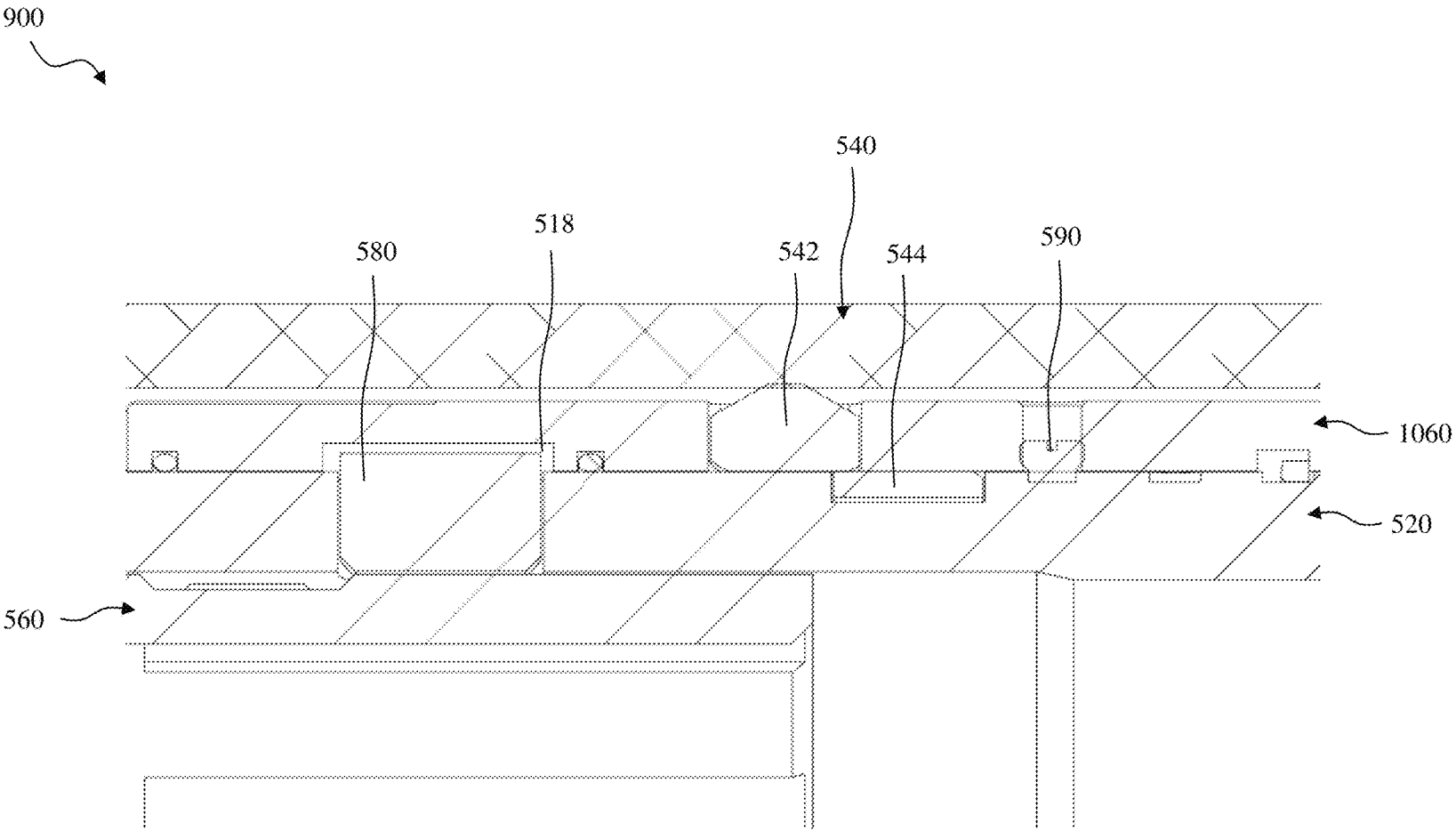
Figure 14G:
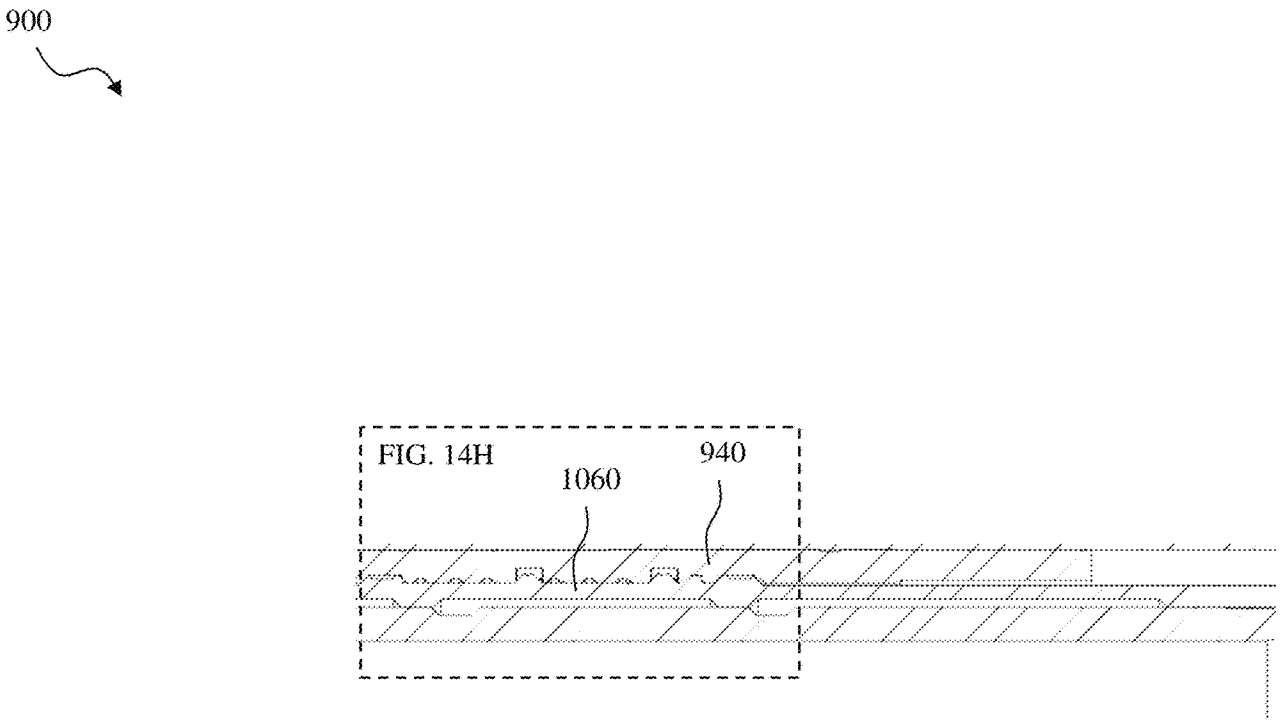
Figure 14H:
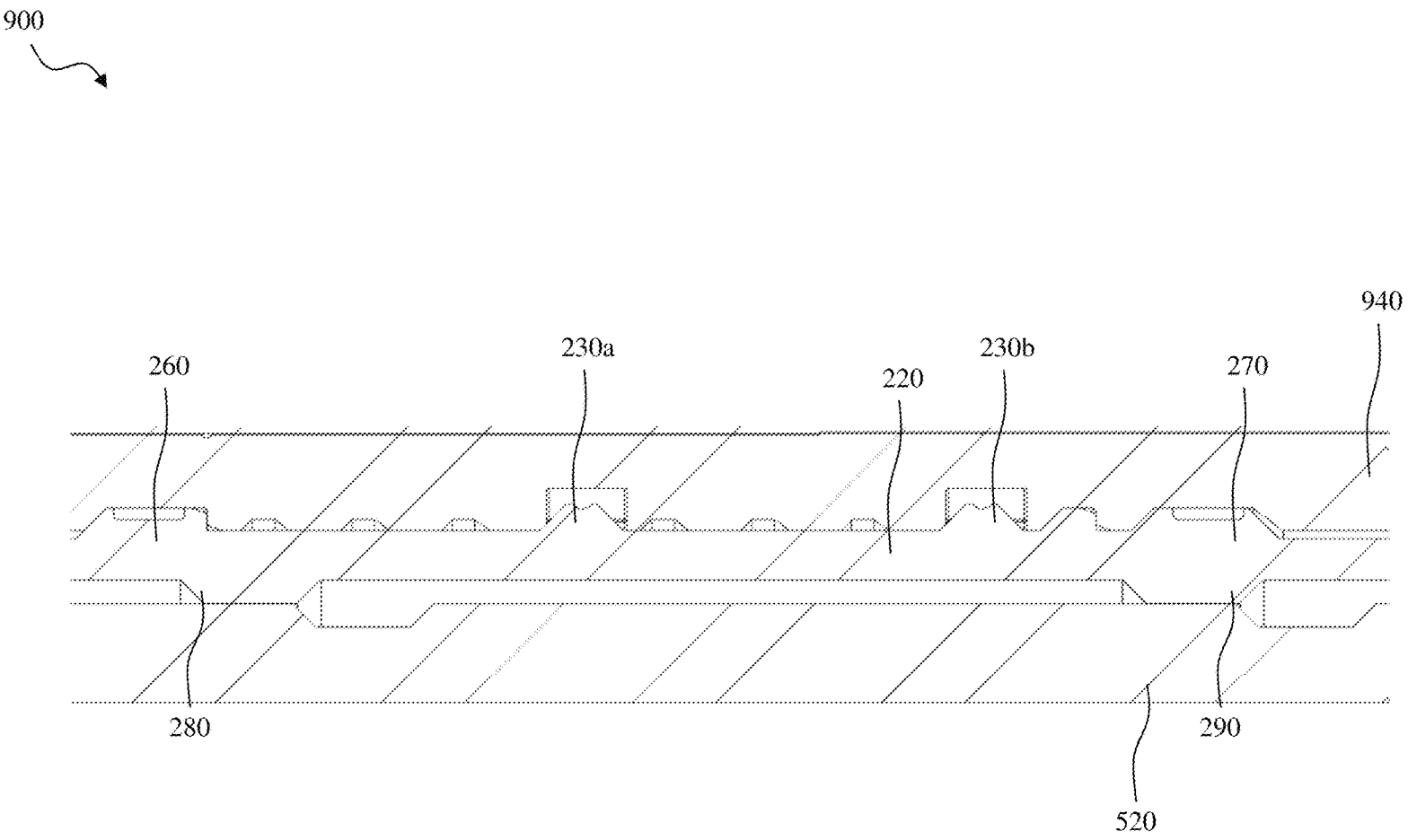
Figure 15A:
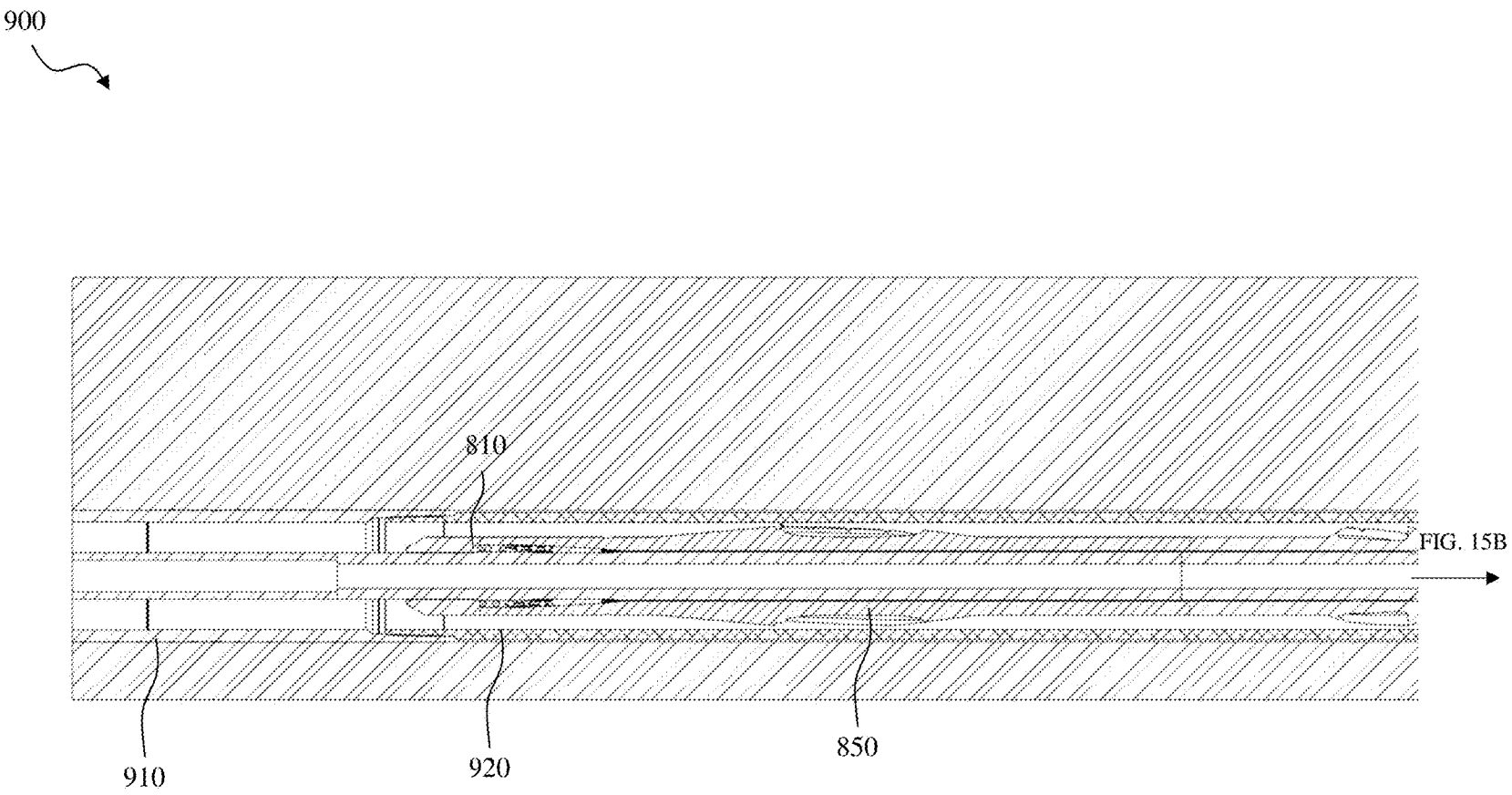
Figure 15B:
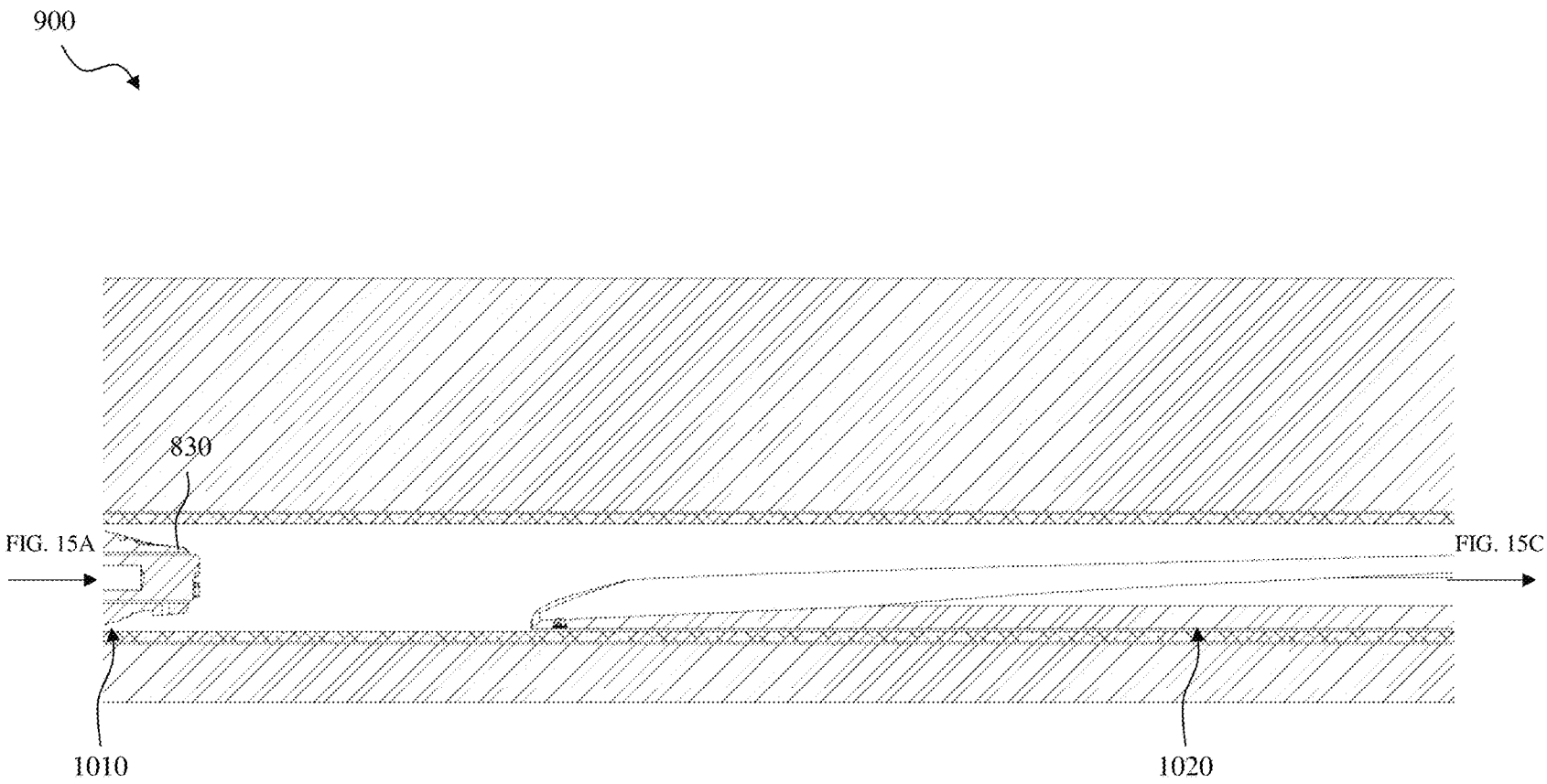
Figure 15C:
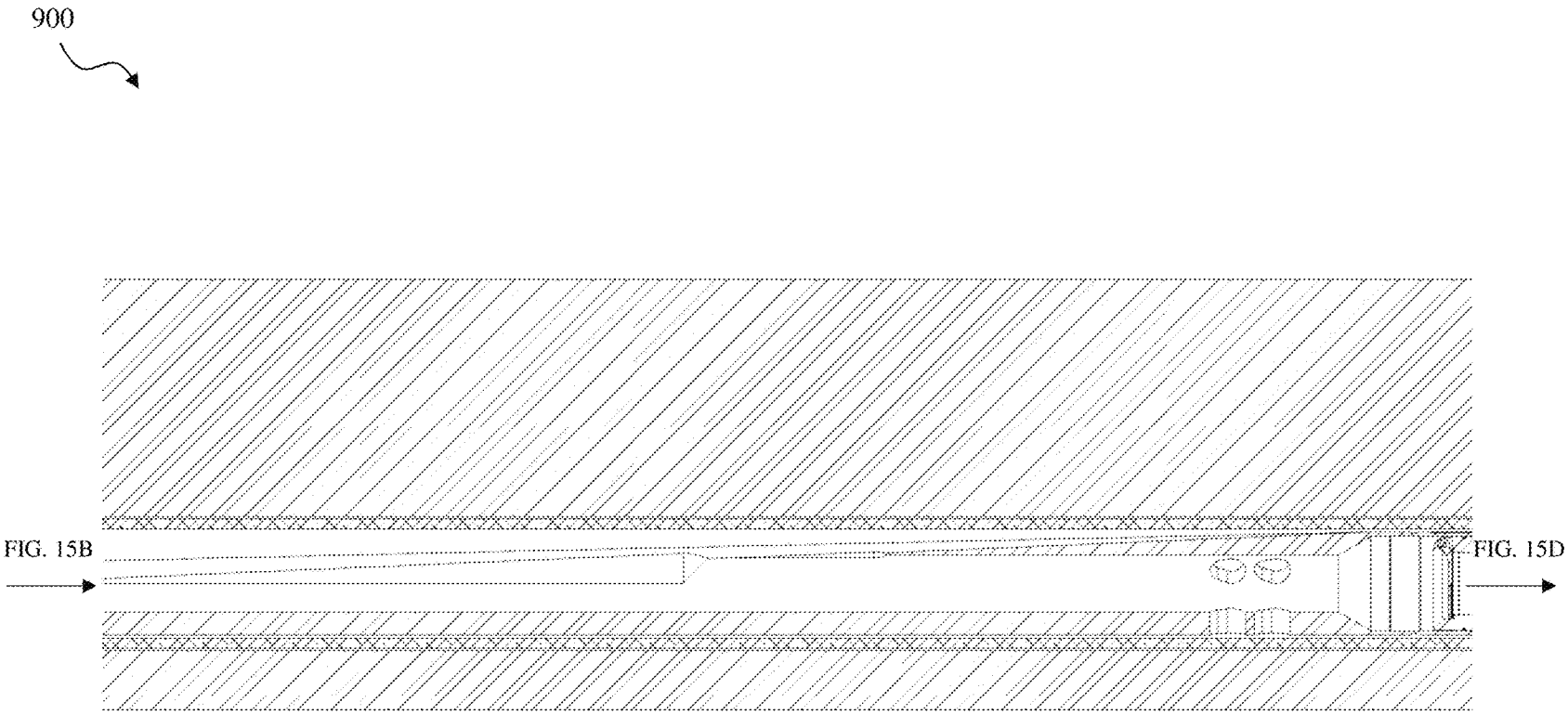
Figure 15D:
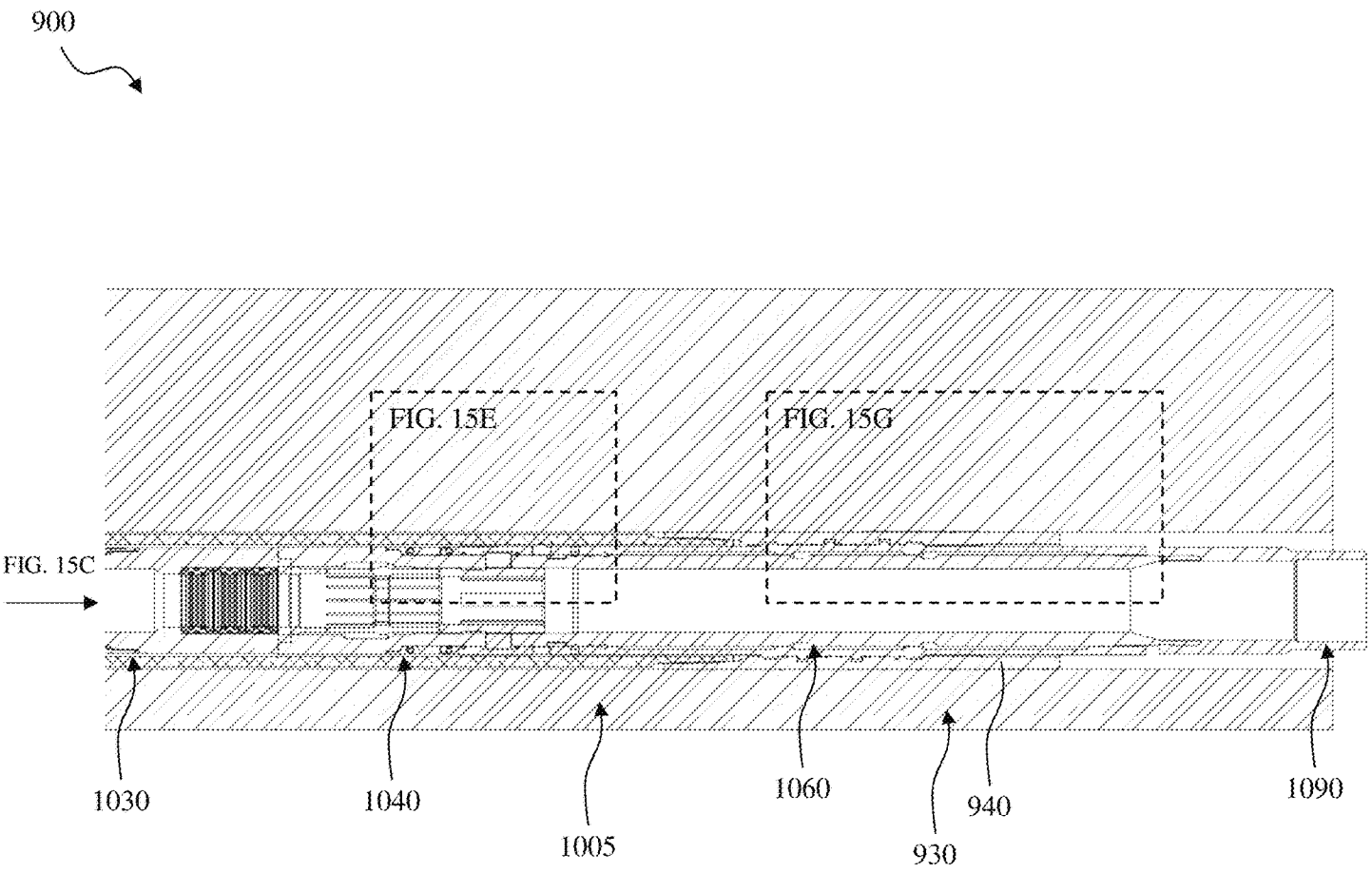
Figure 15E:
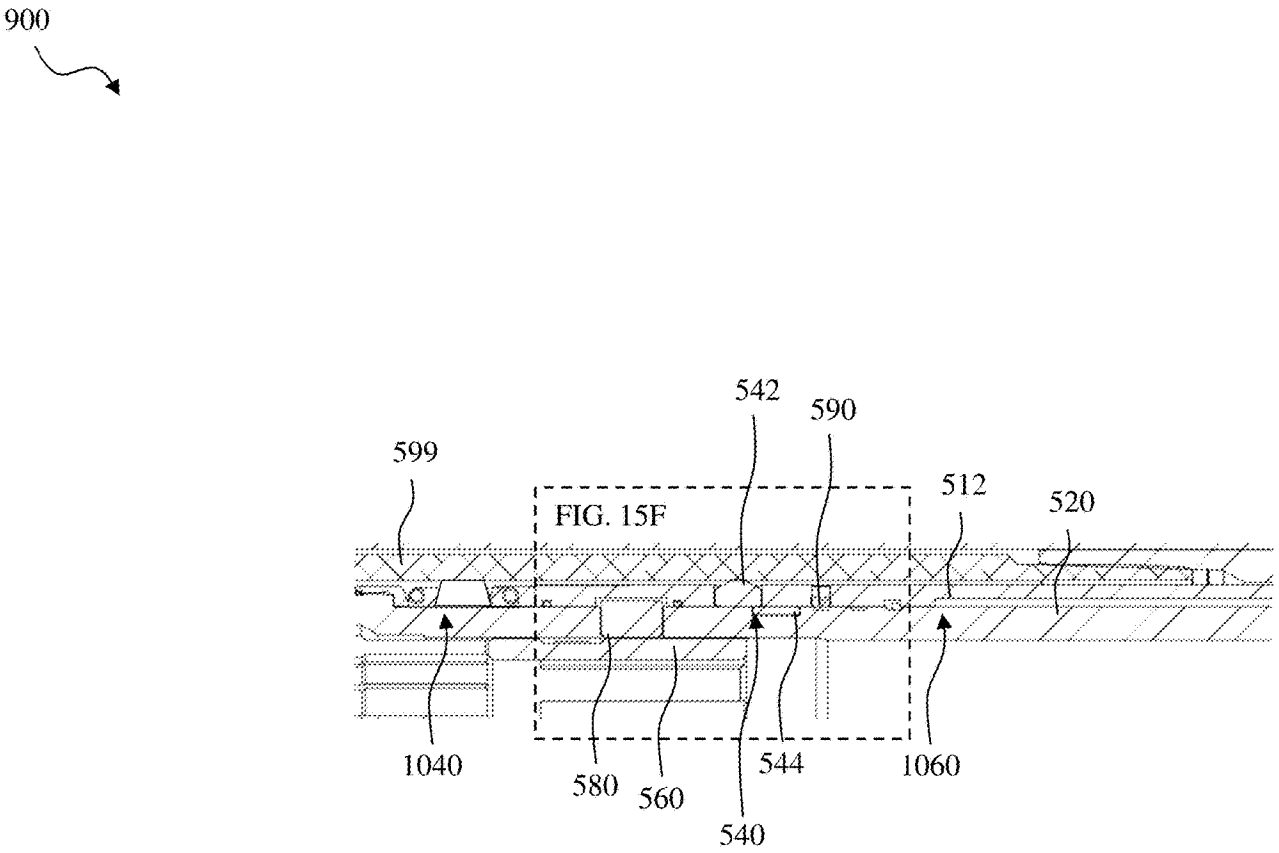
Figure 15F:
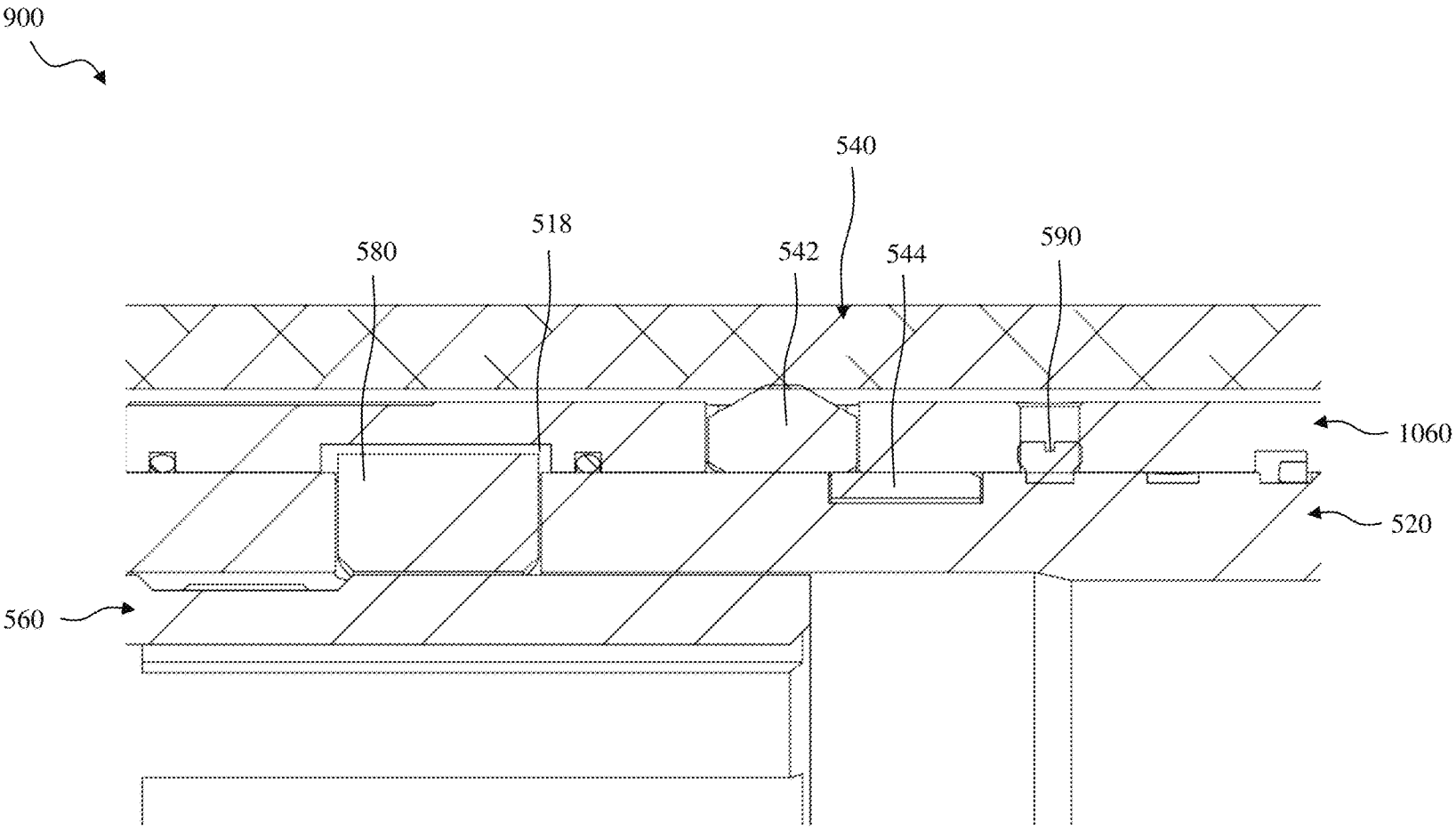
Figure 15G:
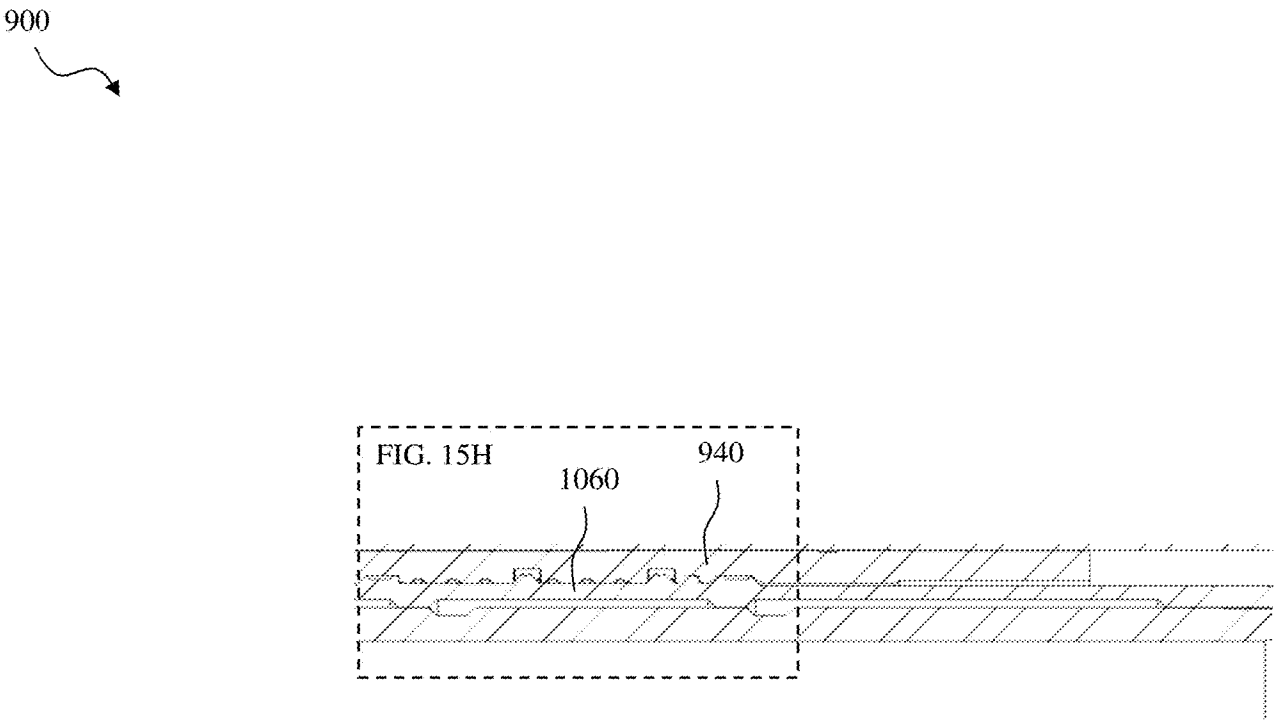
Figure 15H:
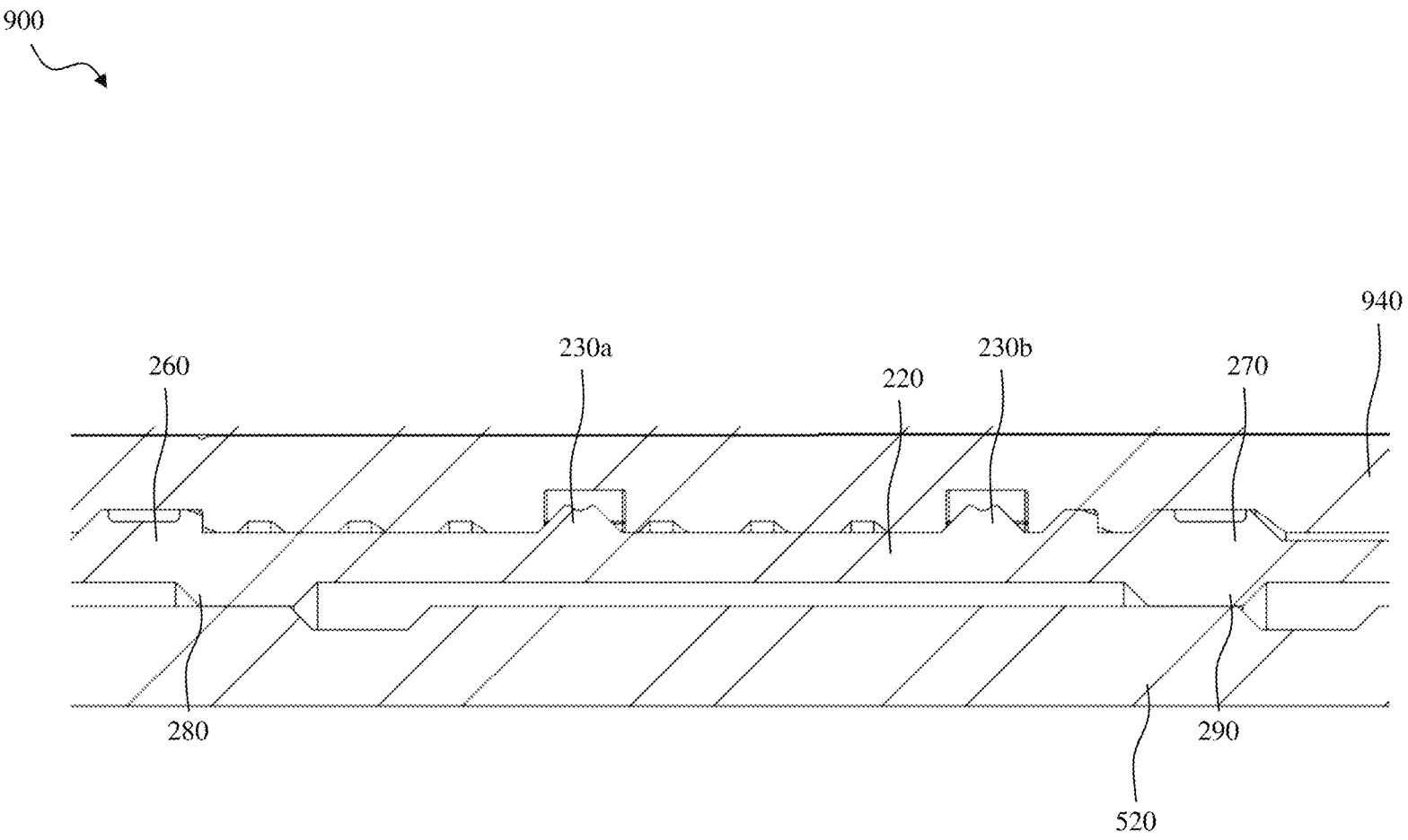
Figure 16A:
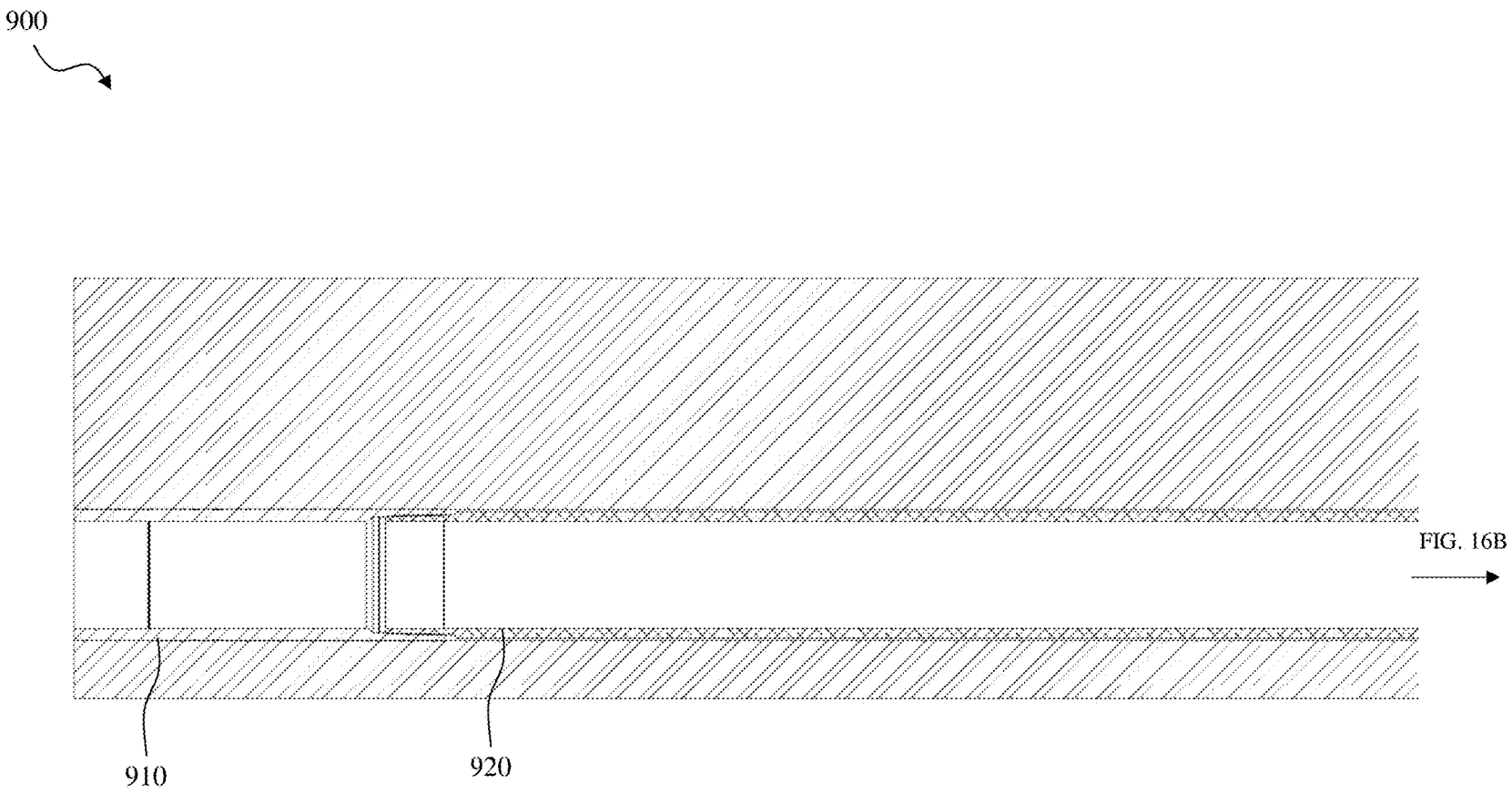
Figure 16B:
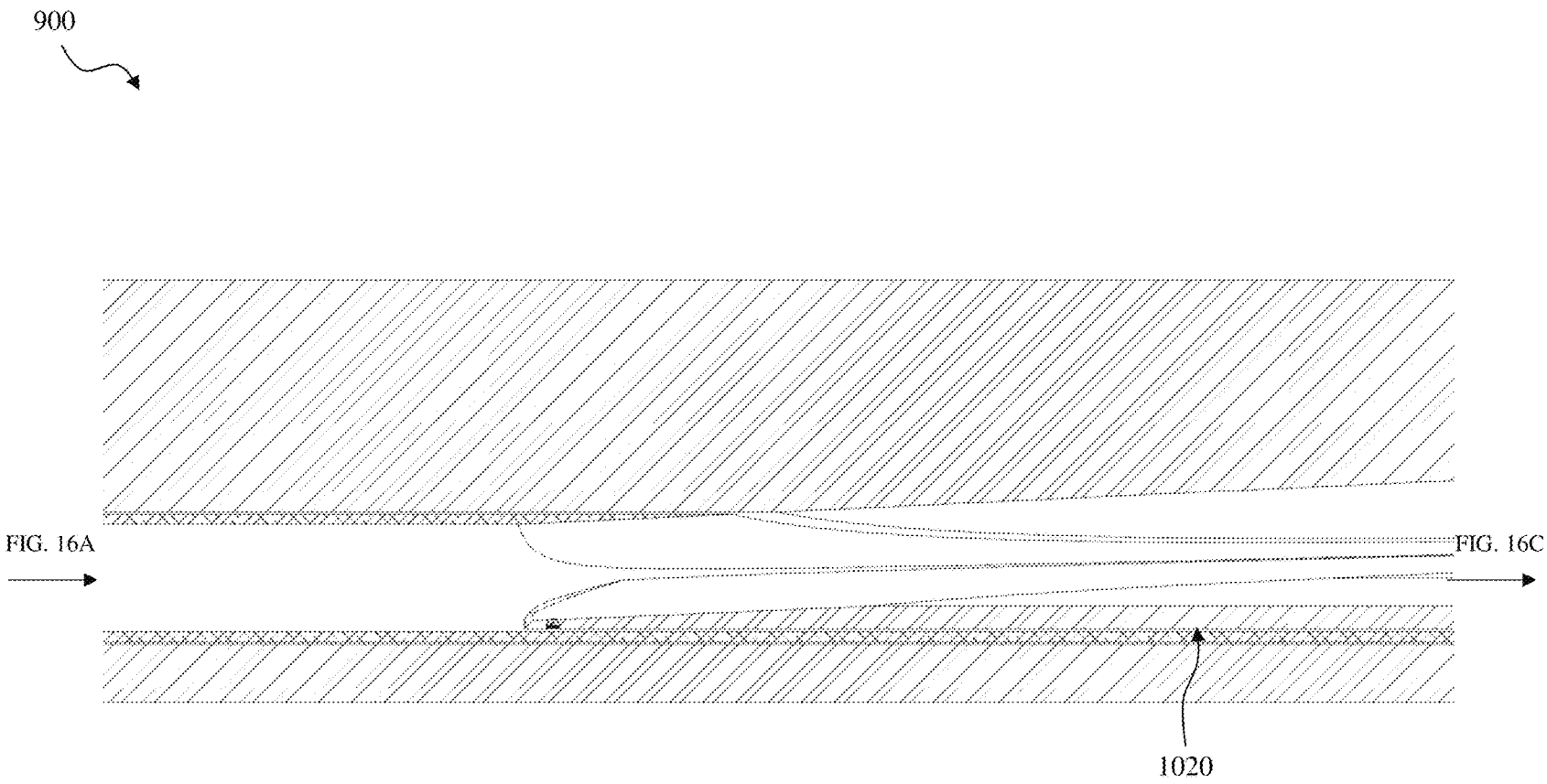
Figure 16C:
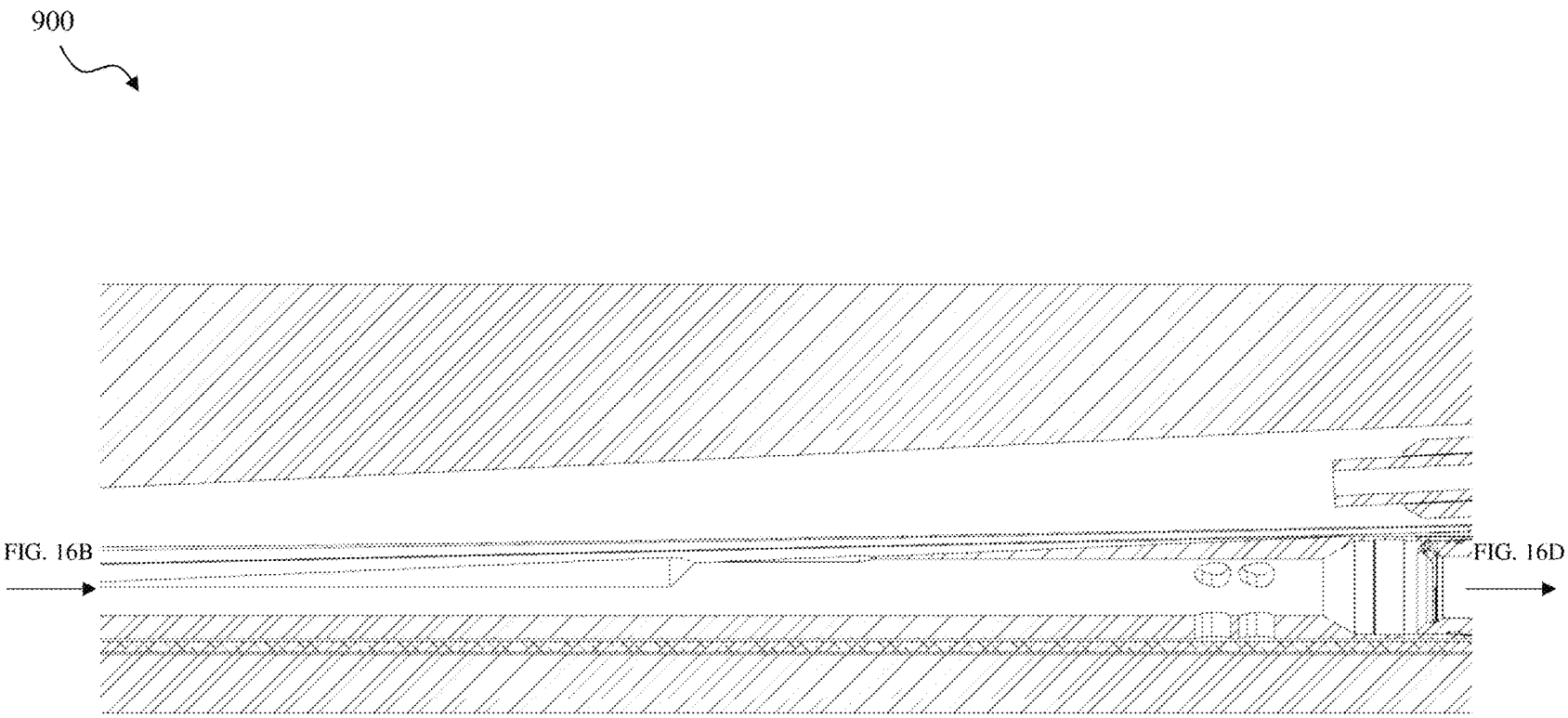
Figure 16D:
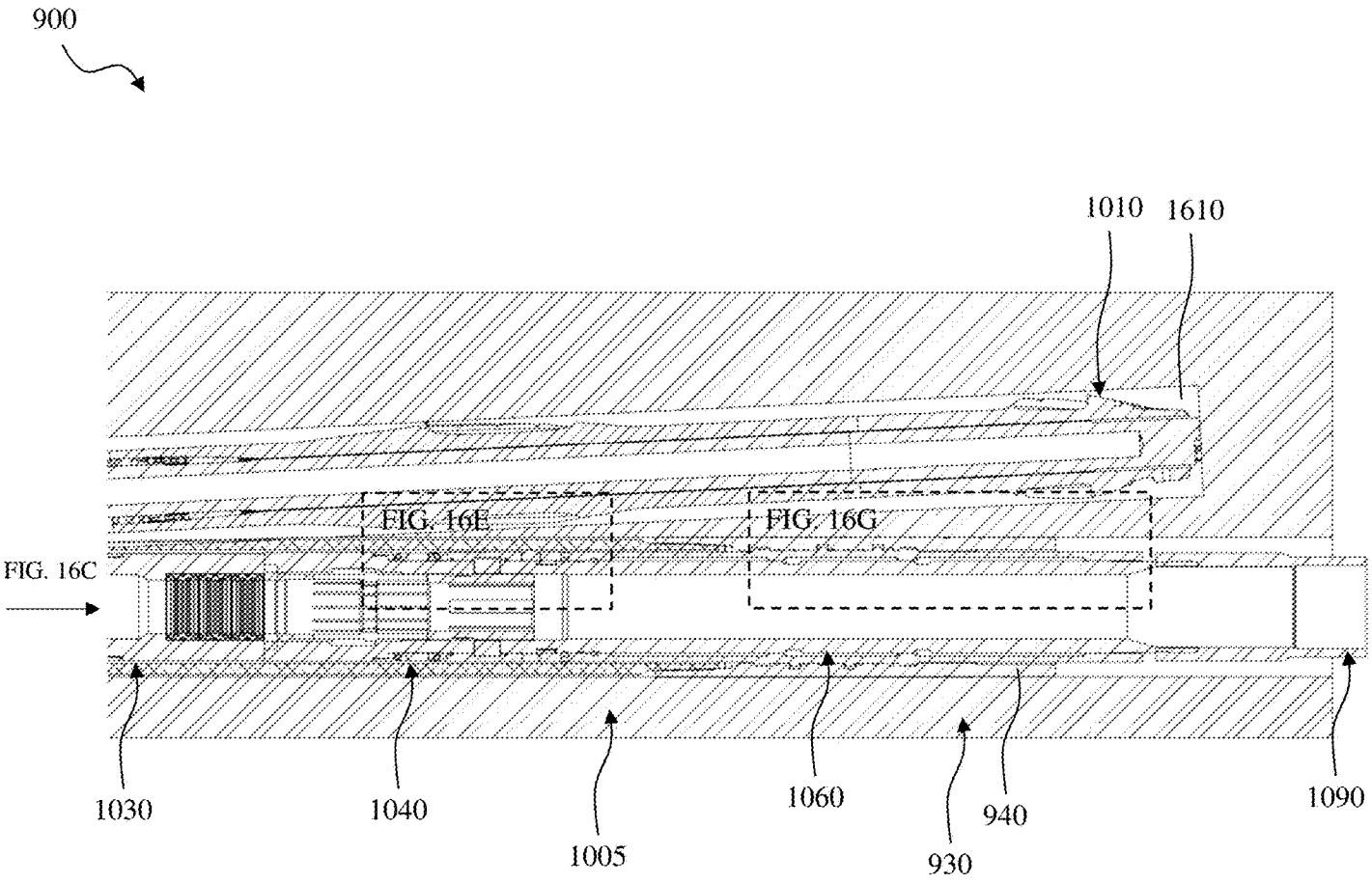
Figure 16E:
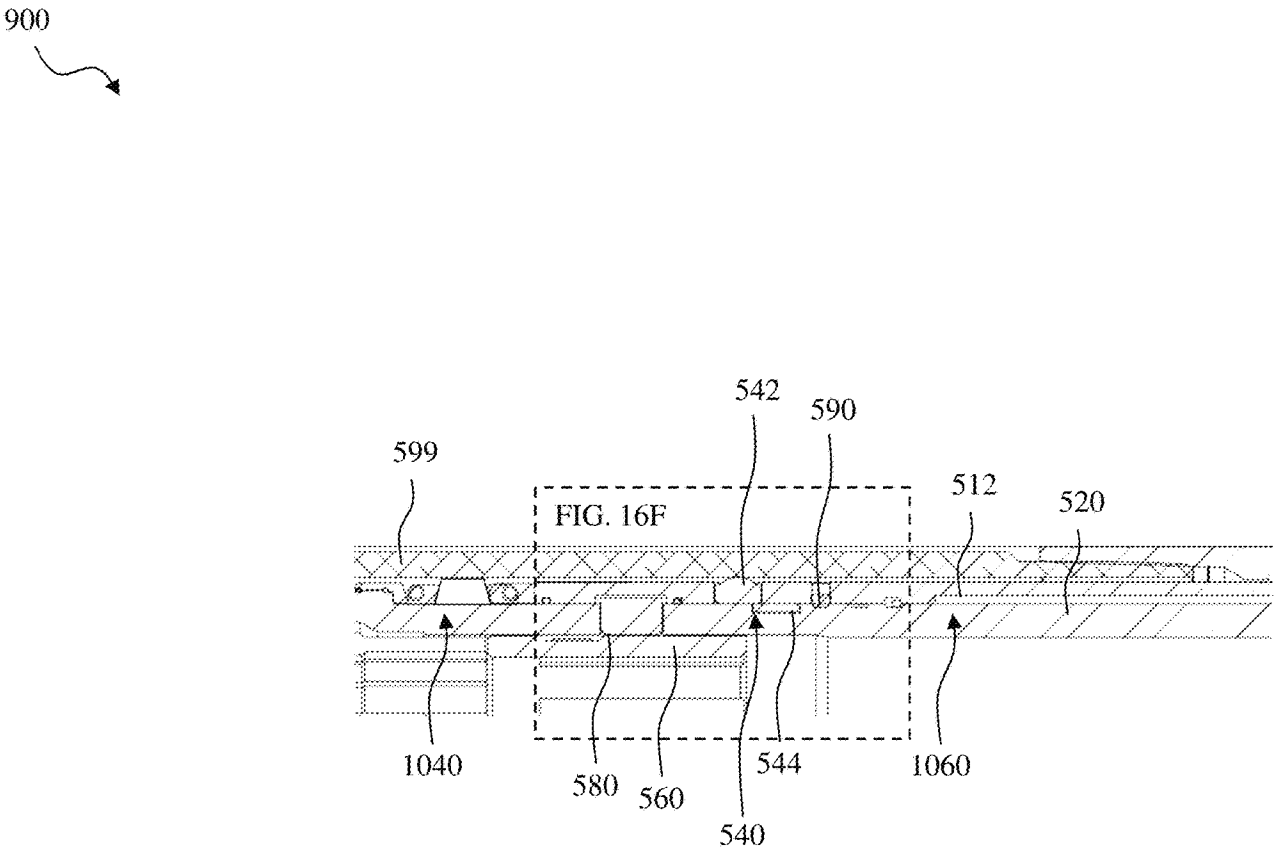
Figure 16F:
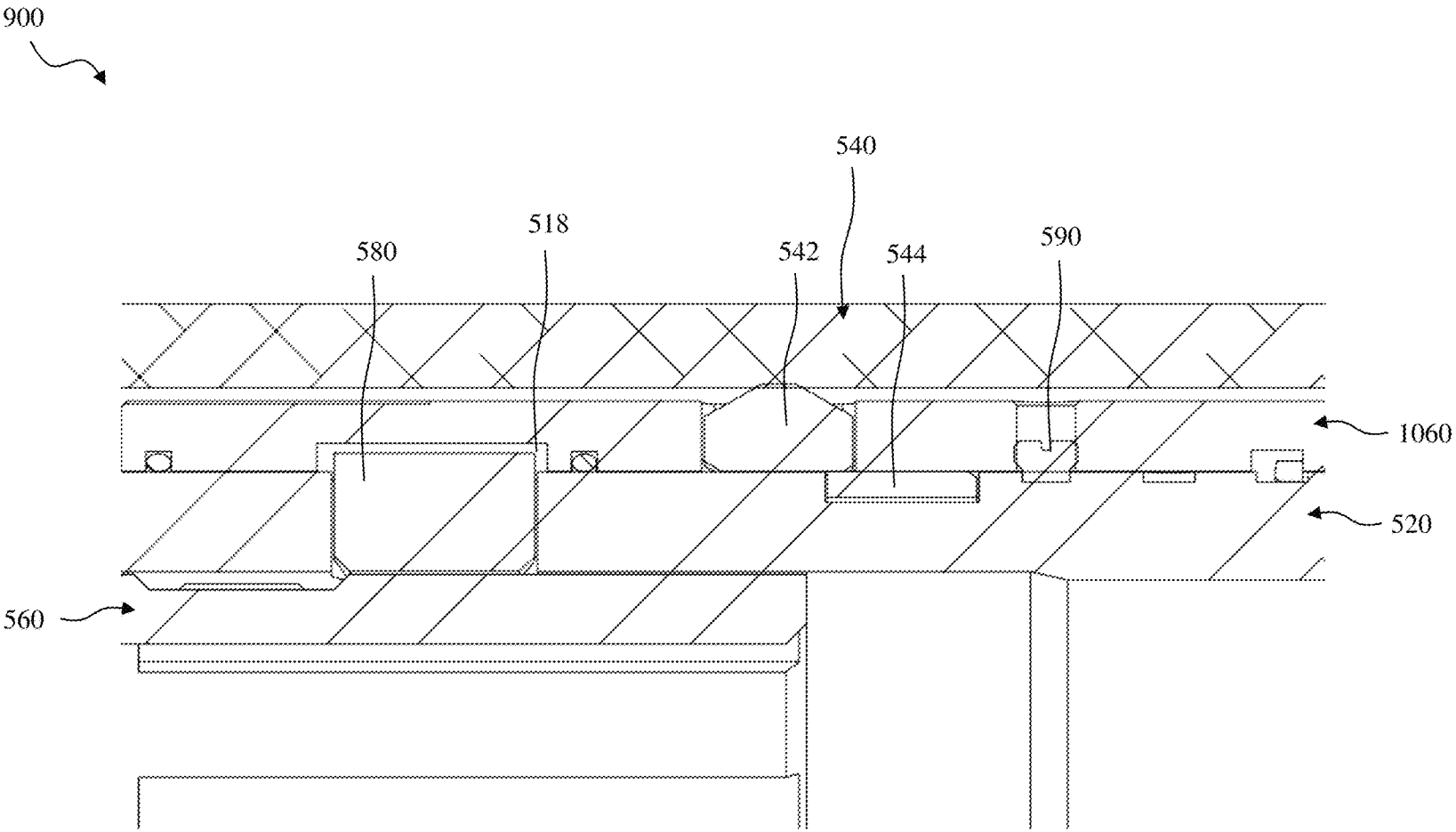
Figure 16G:
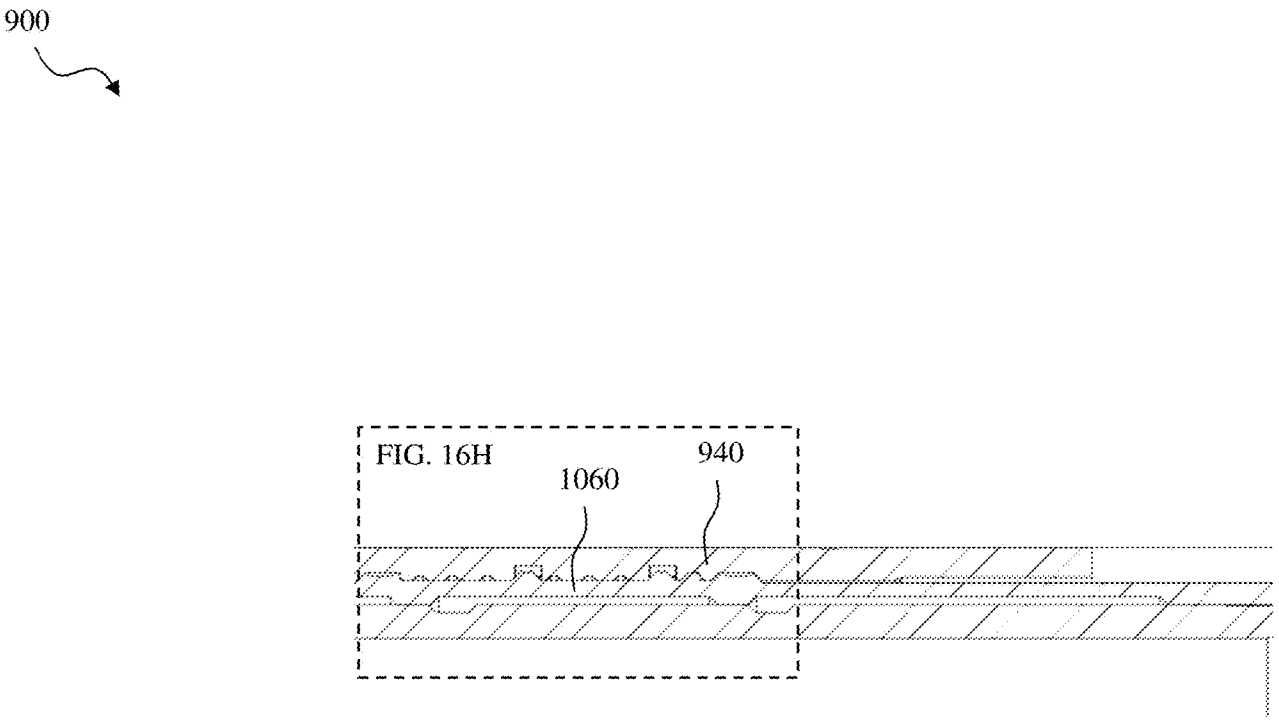
Figure 16H:
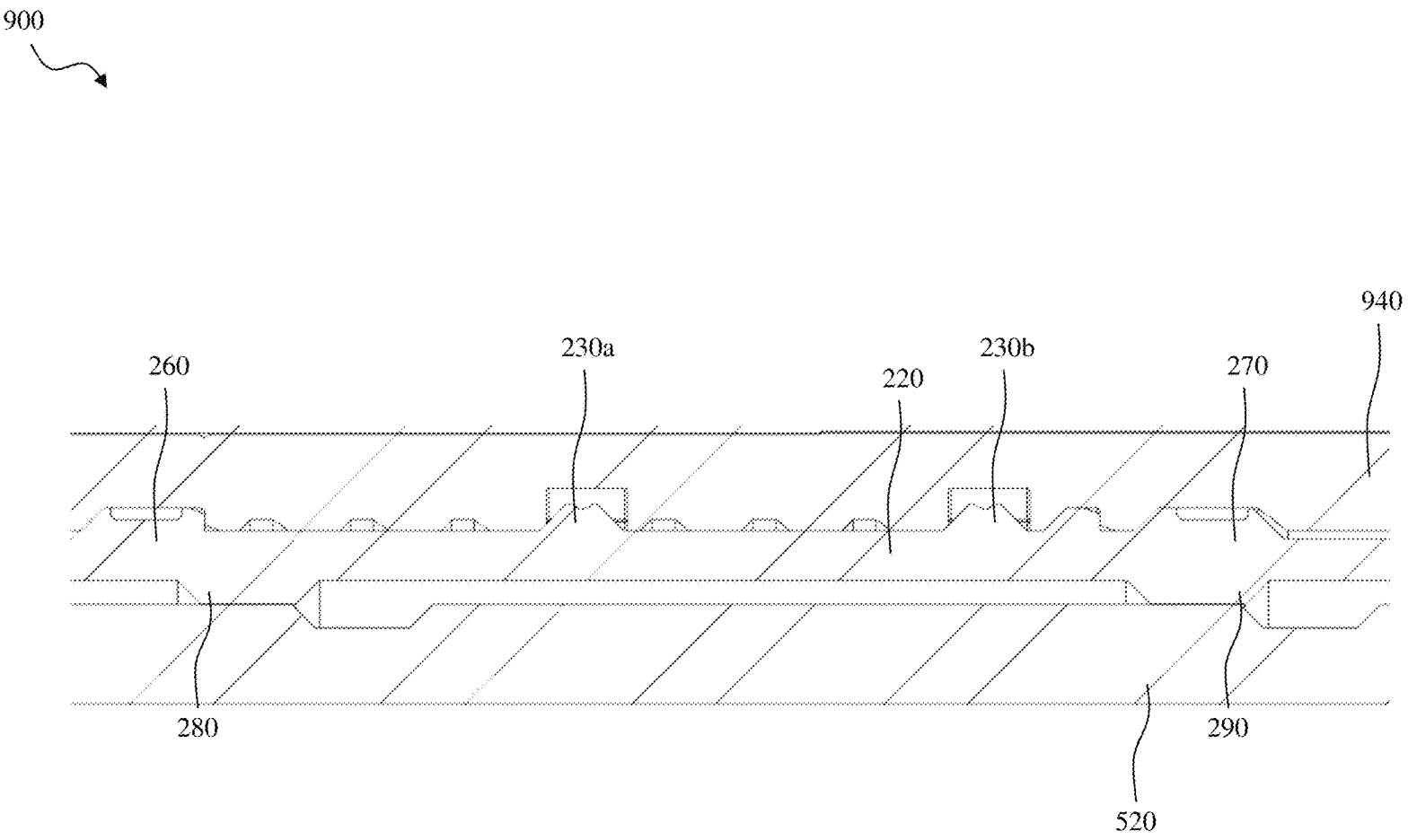
Figure 17A:
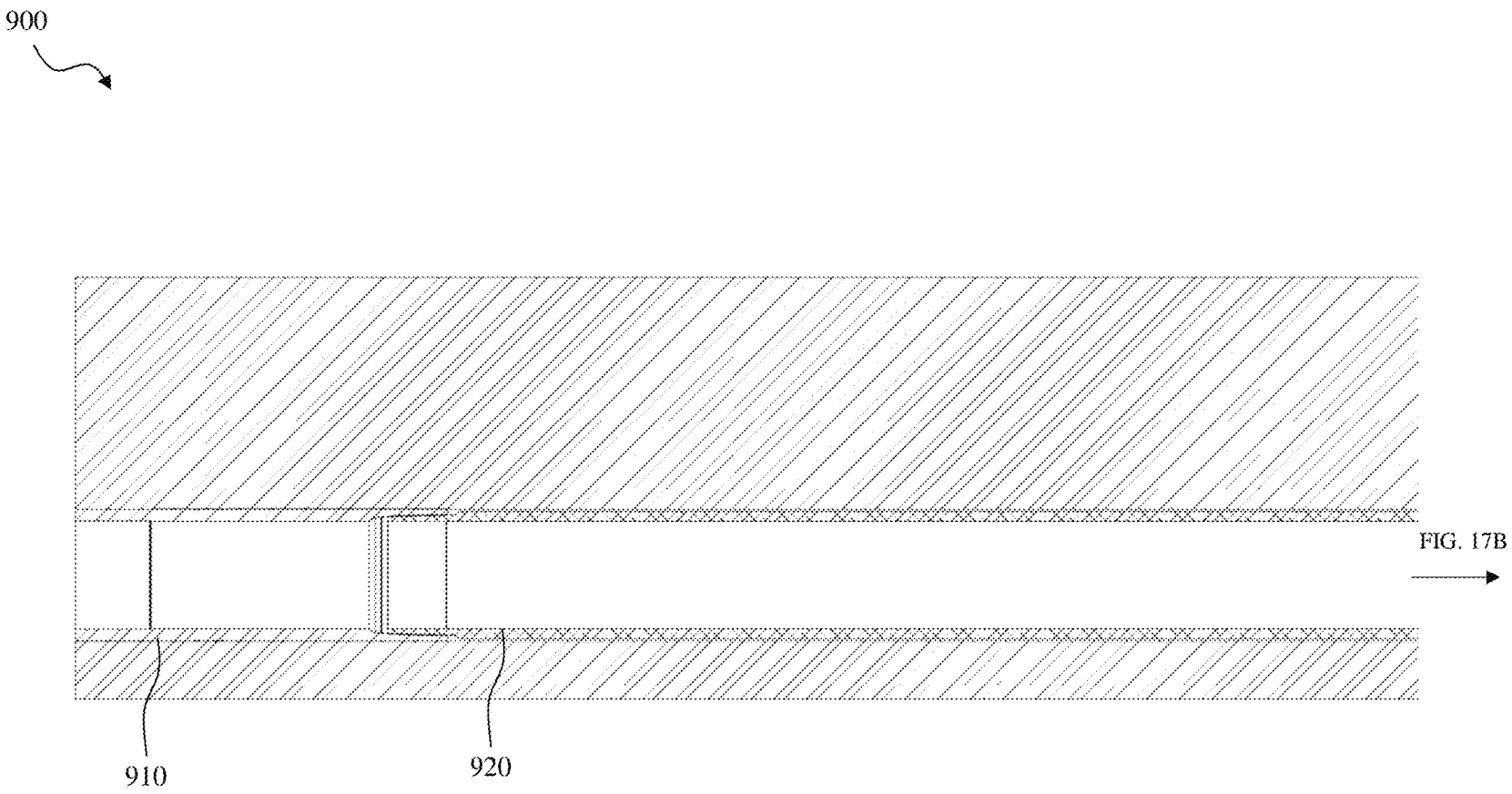
Figure 17B:
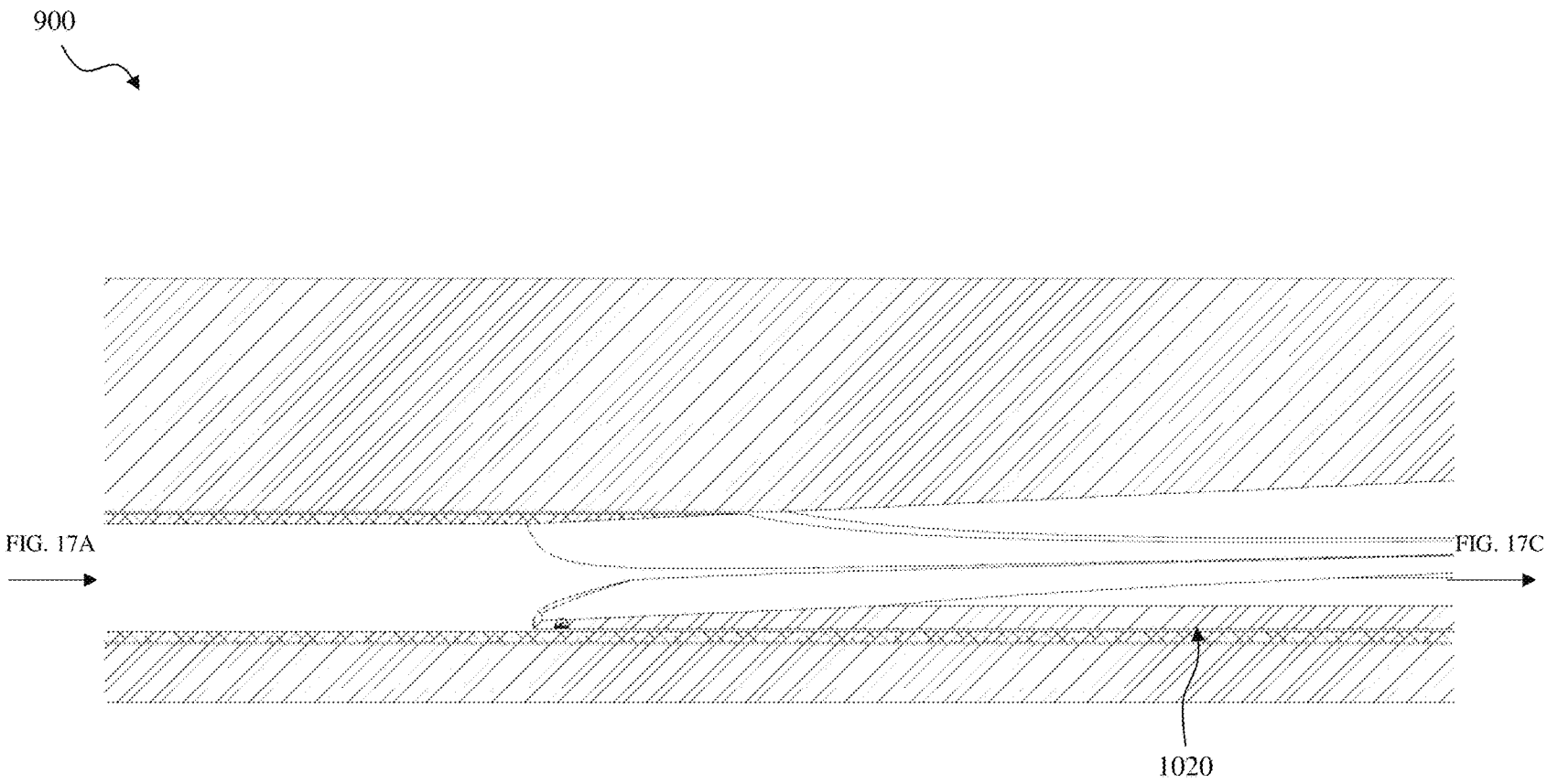
Figure 17C:
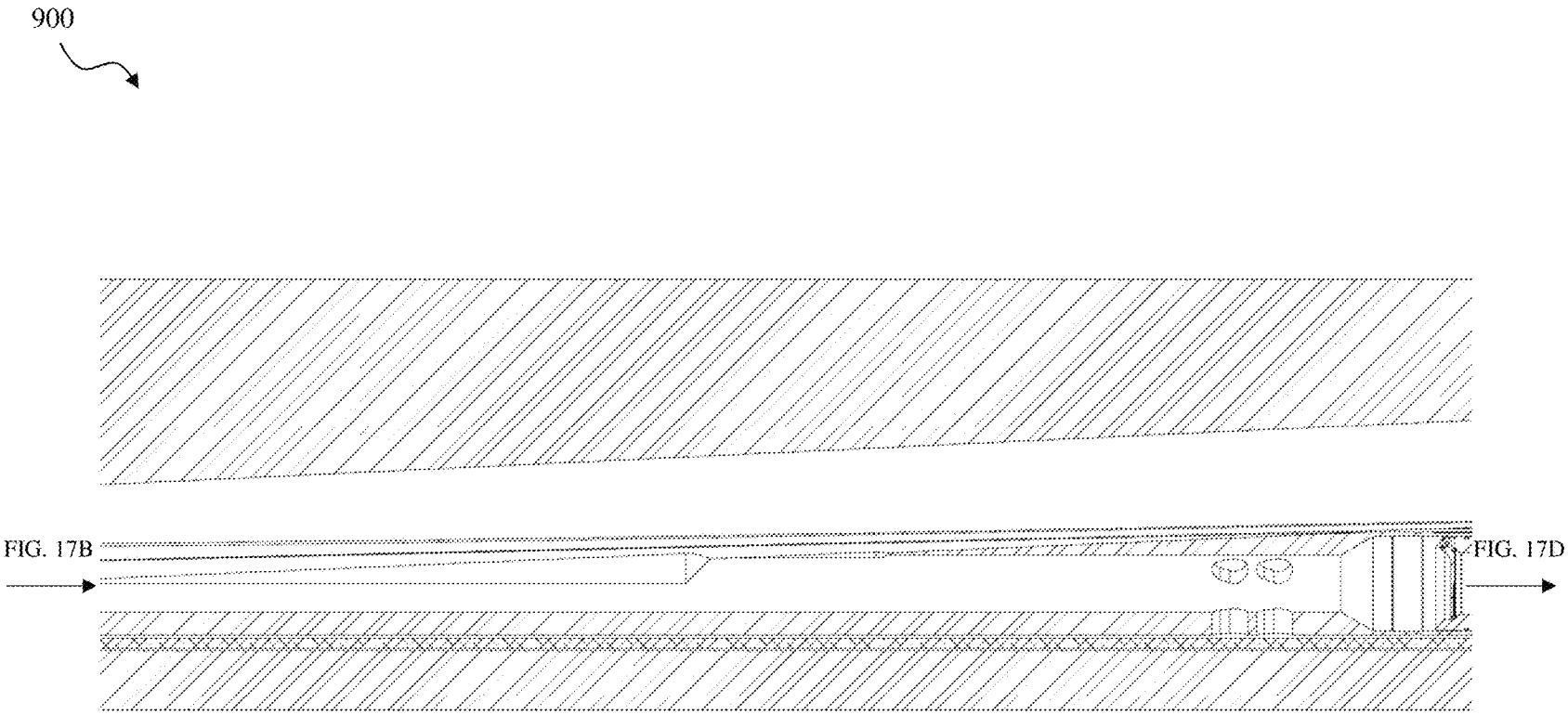
Figure 17D:
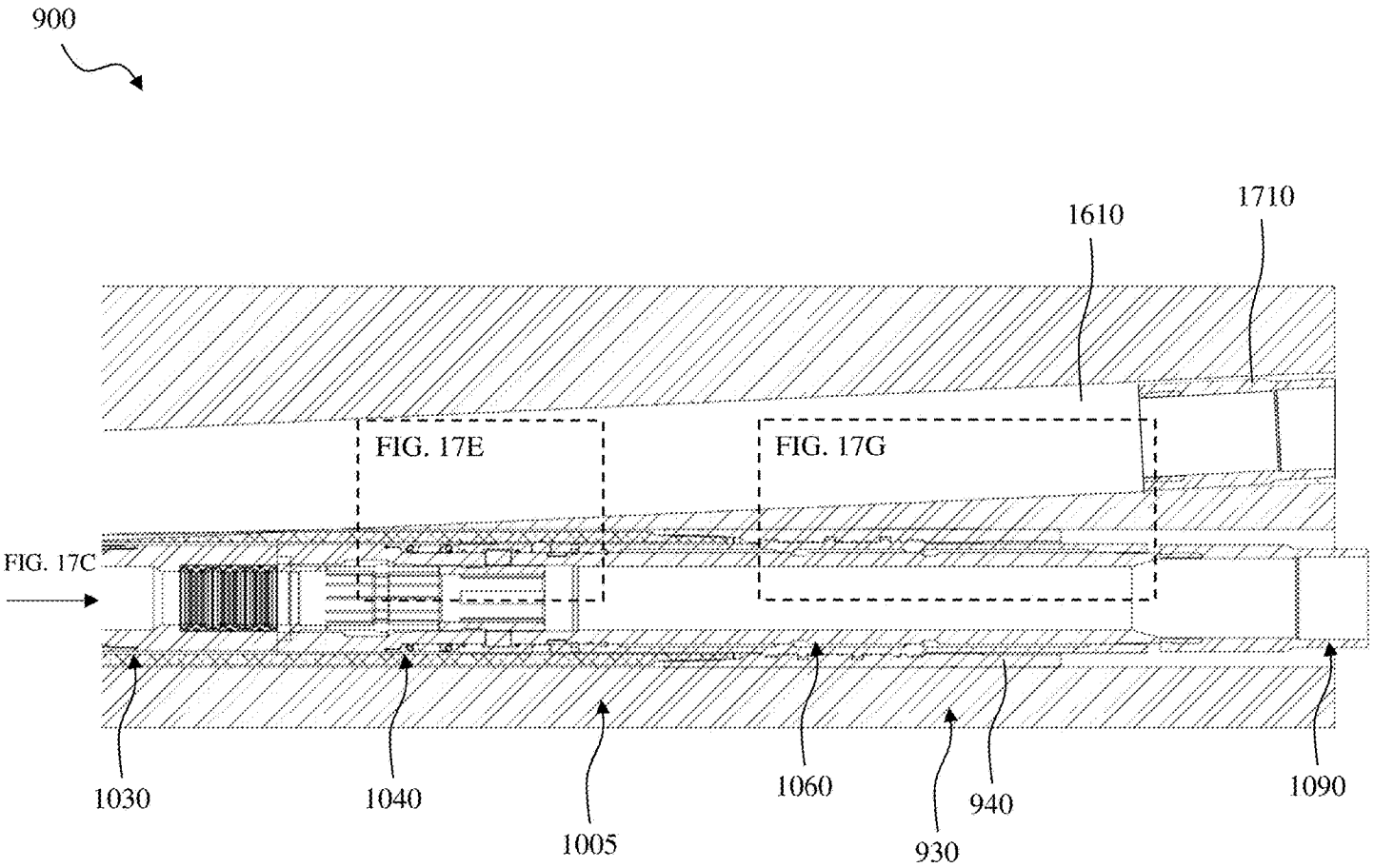
Figure 17E:
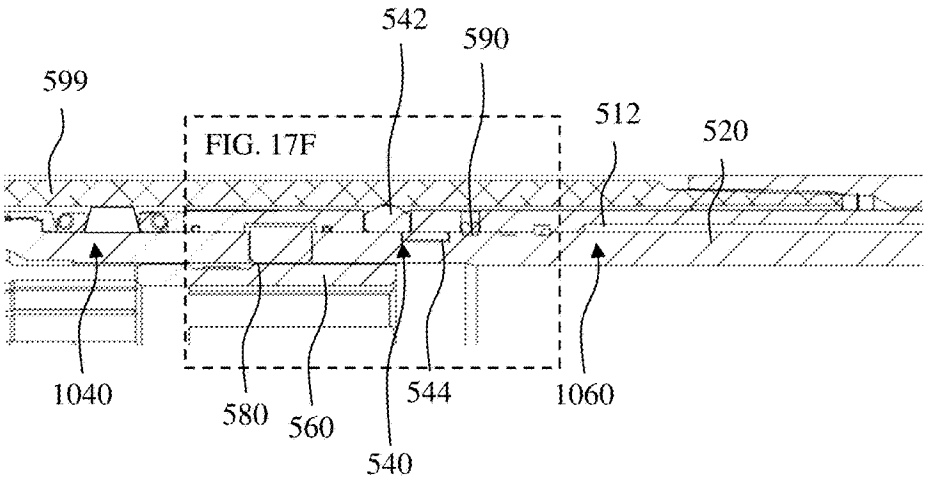
Figure 17F:
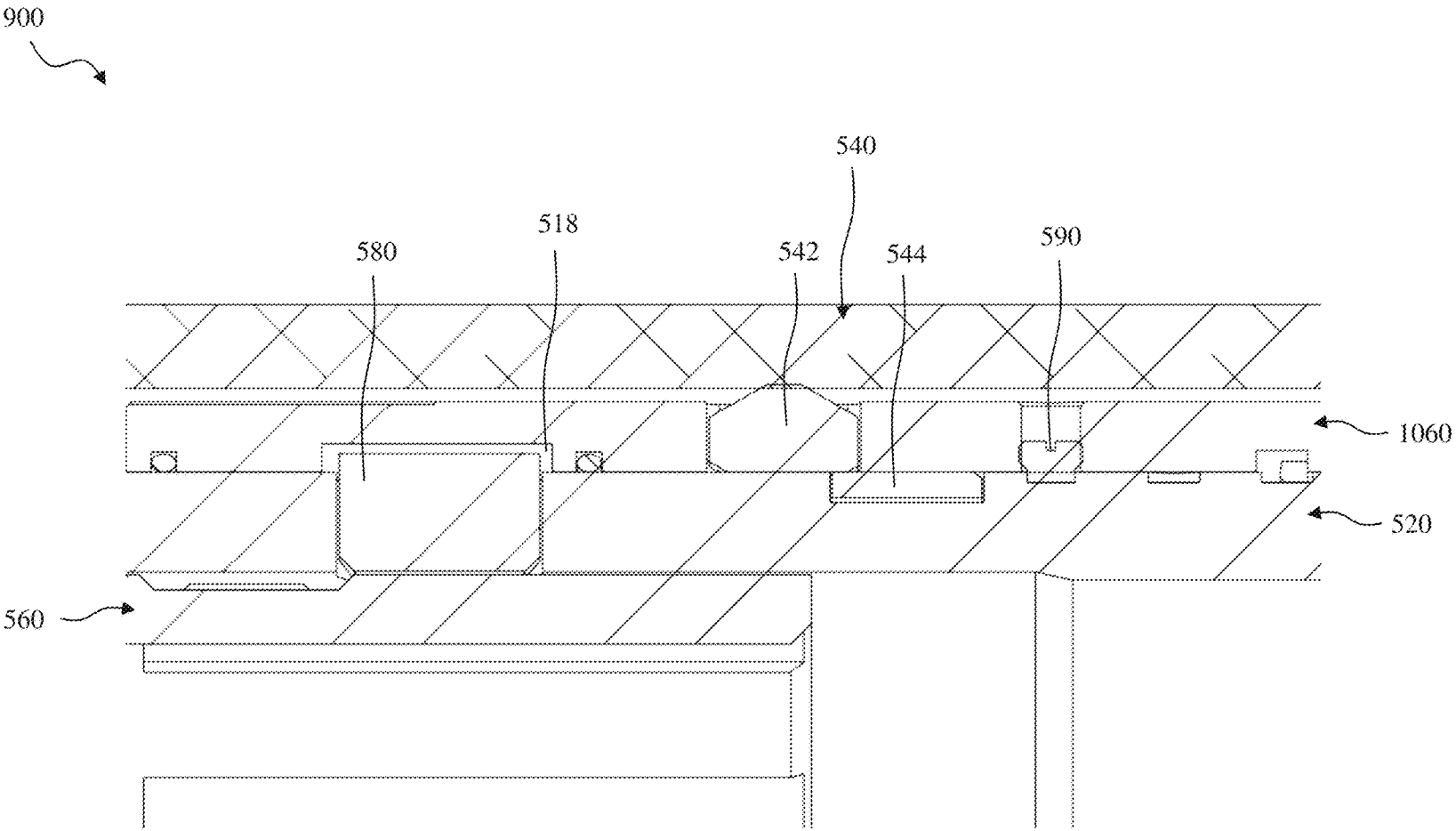
Figure 17G:
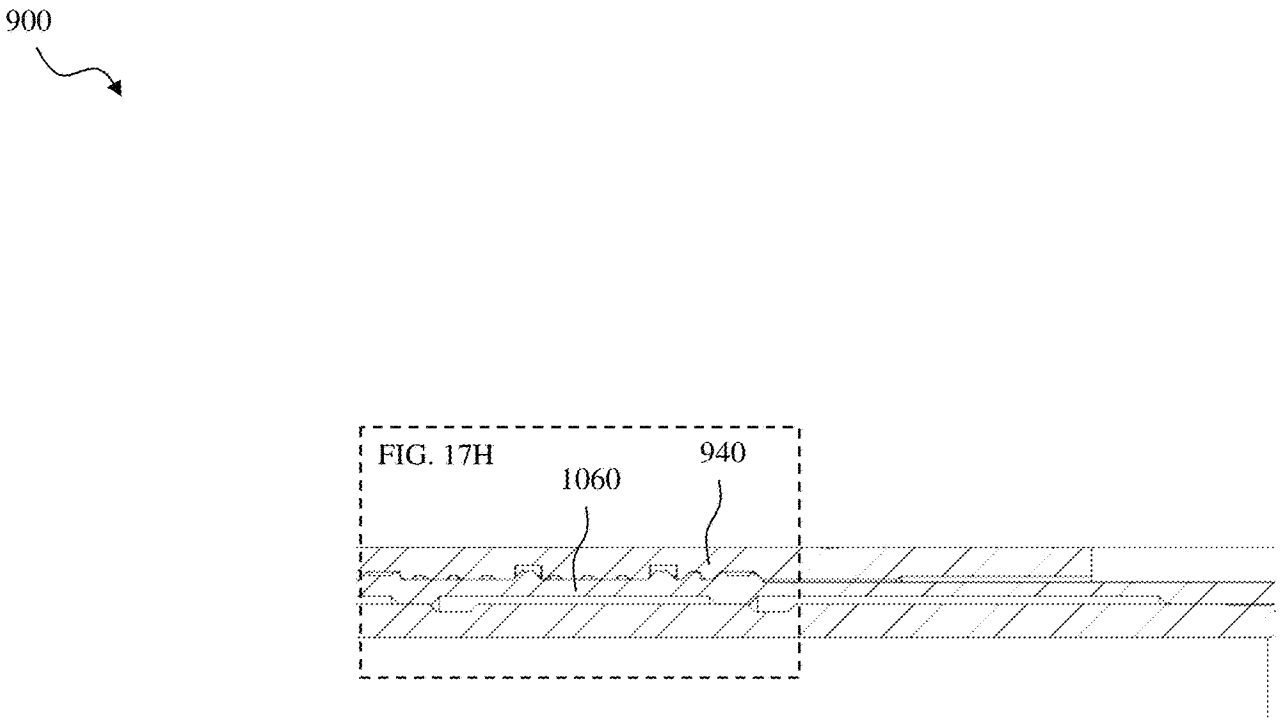
Figure 17H:
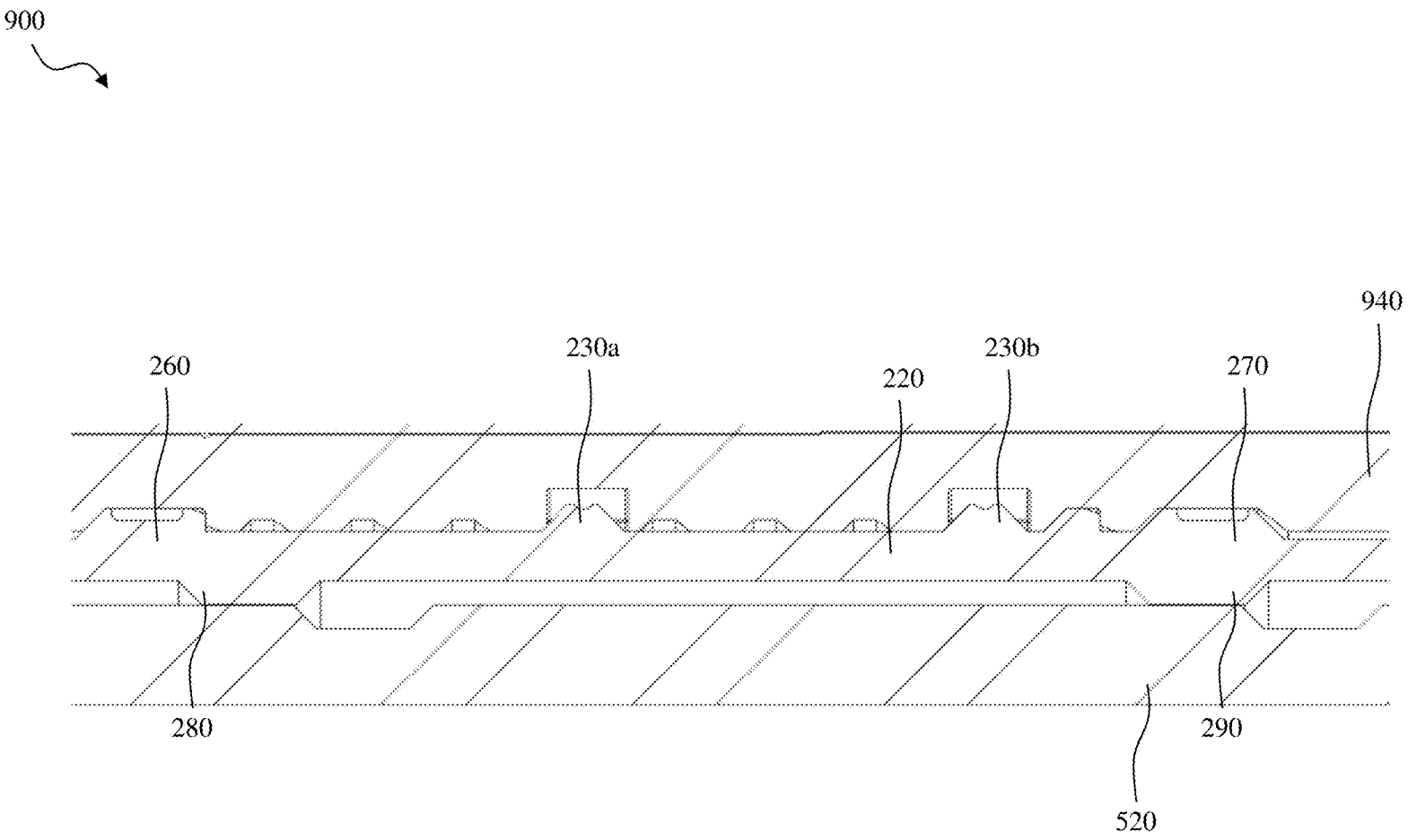
Figure 18A:
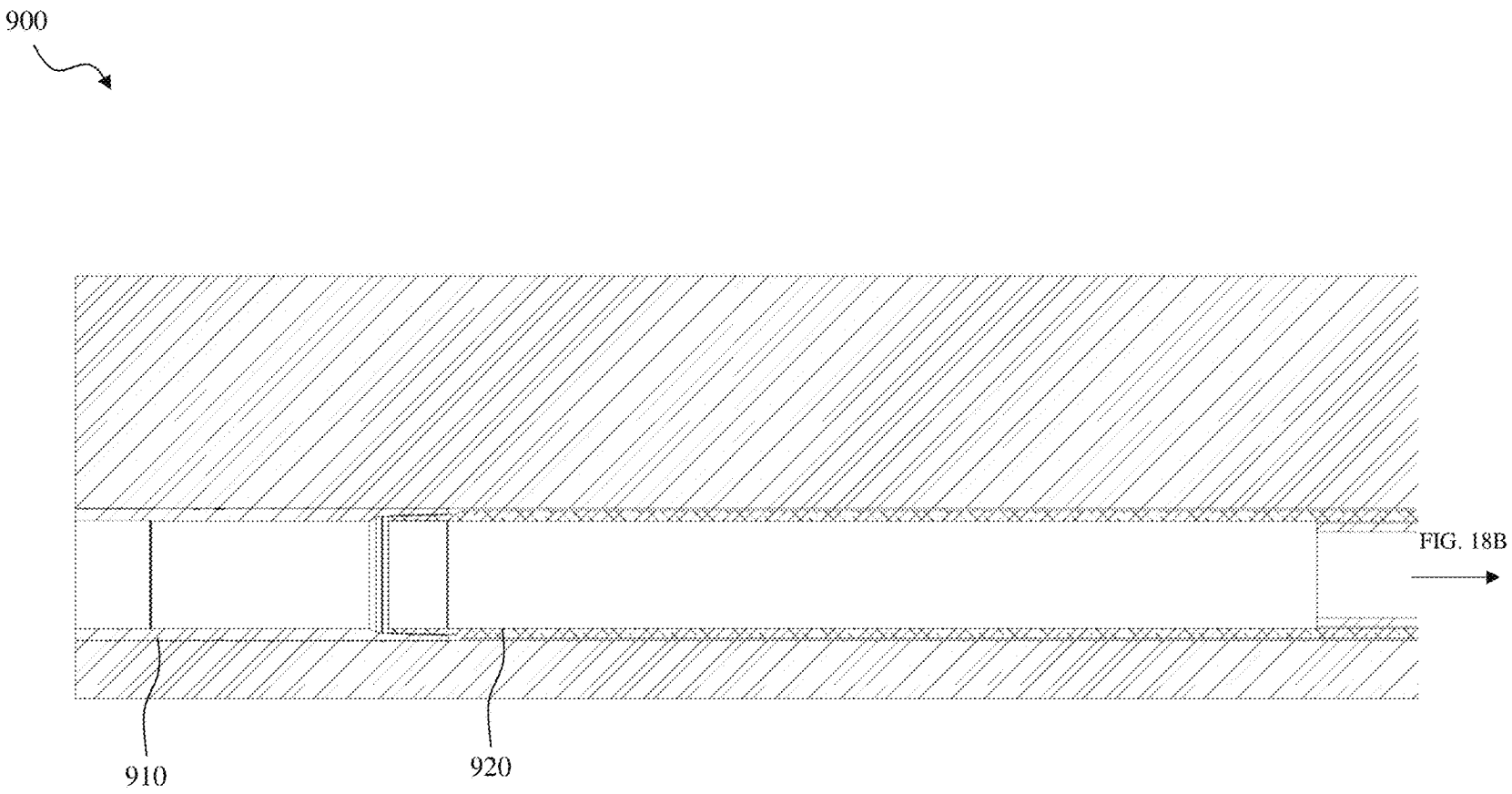
Figure 18B:
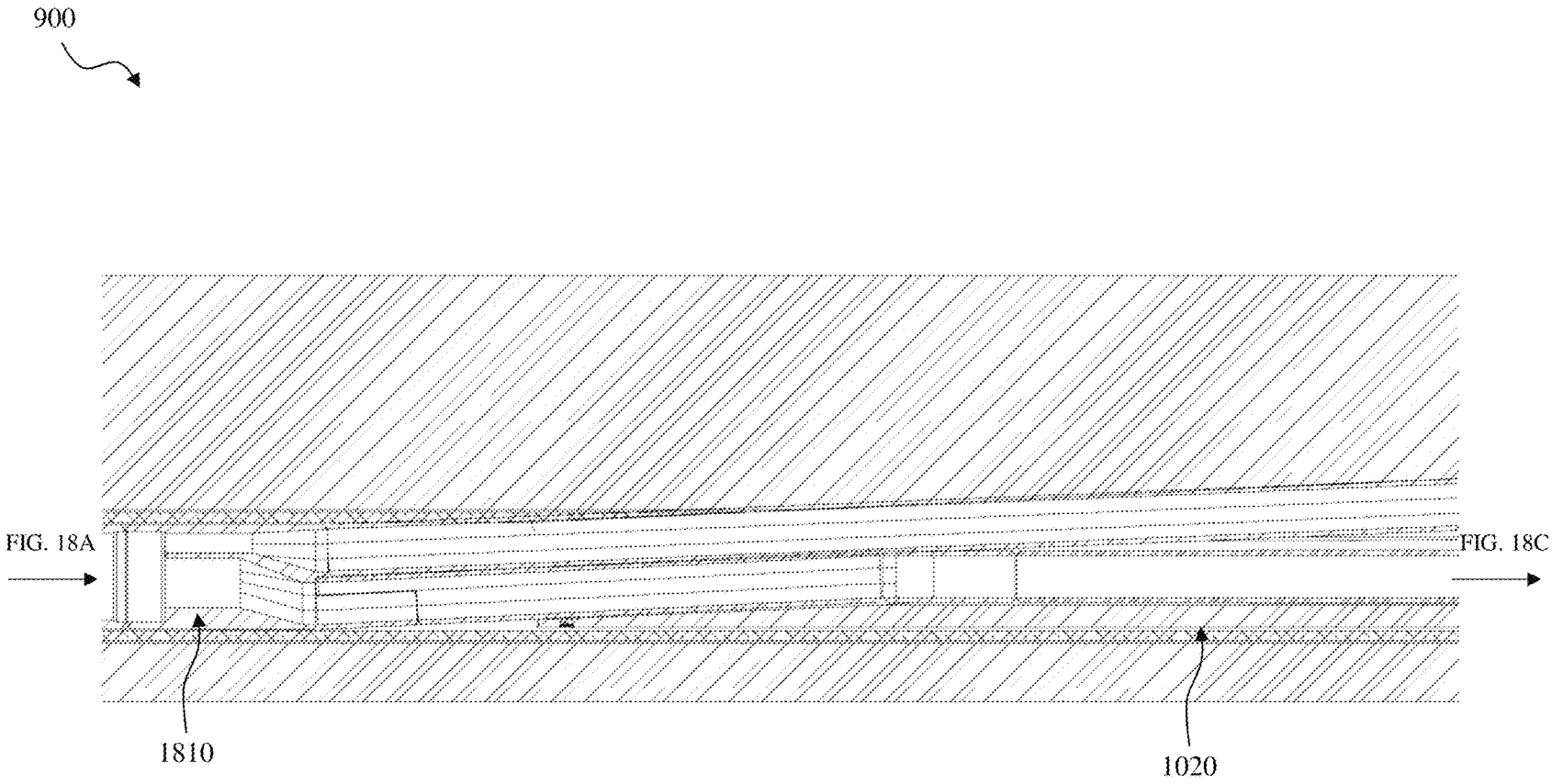
Figure 18C:
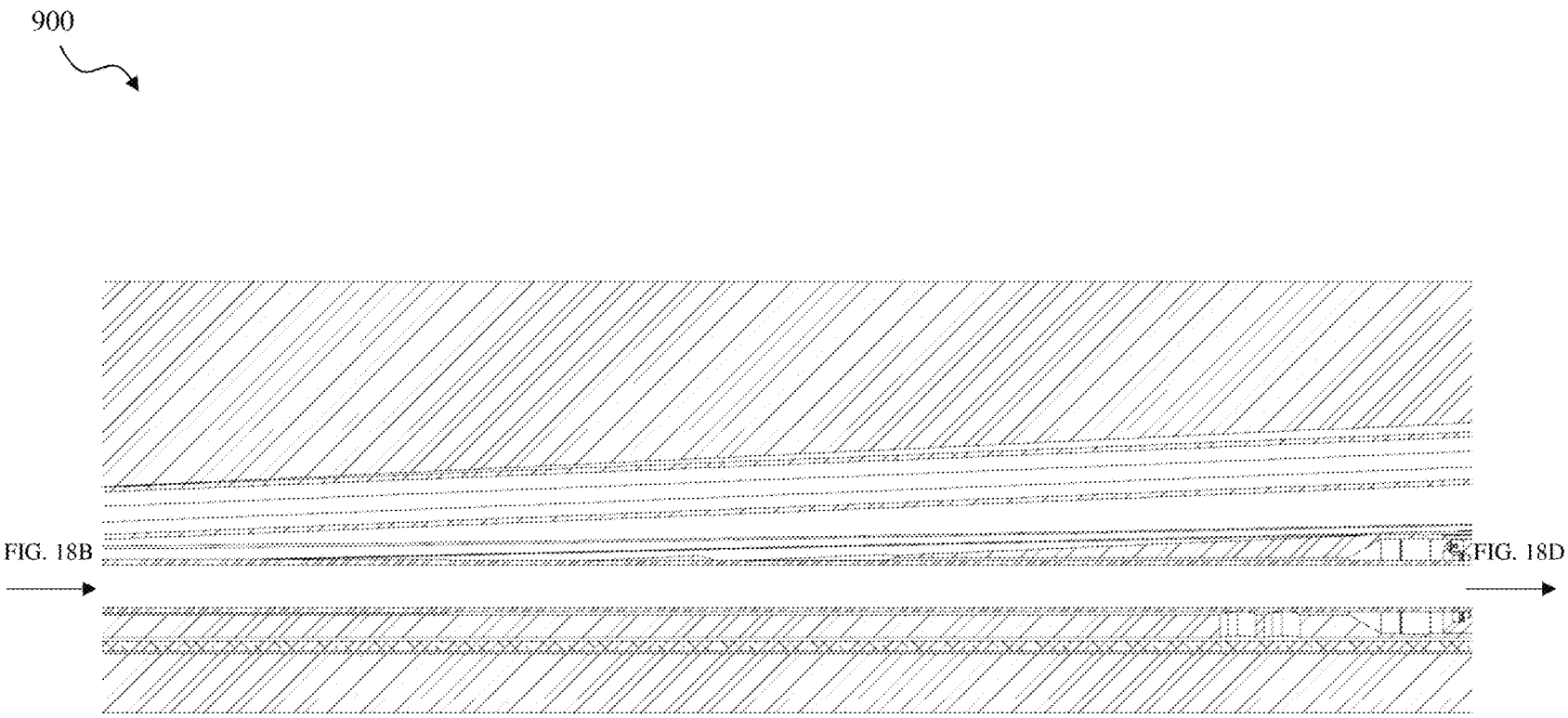
Figure 18D:
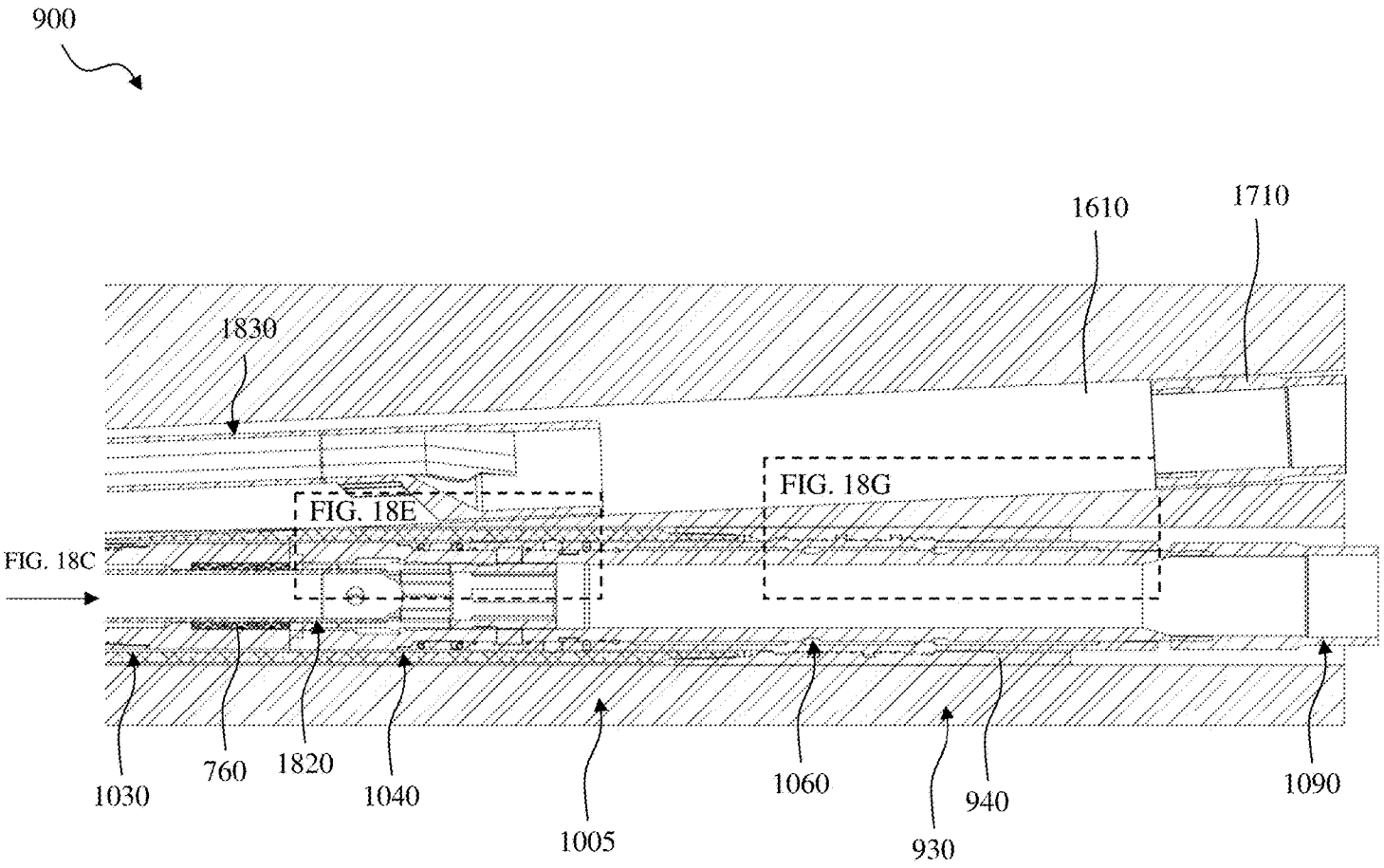
Figure 18E:
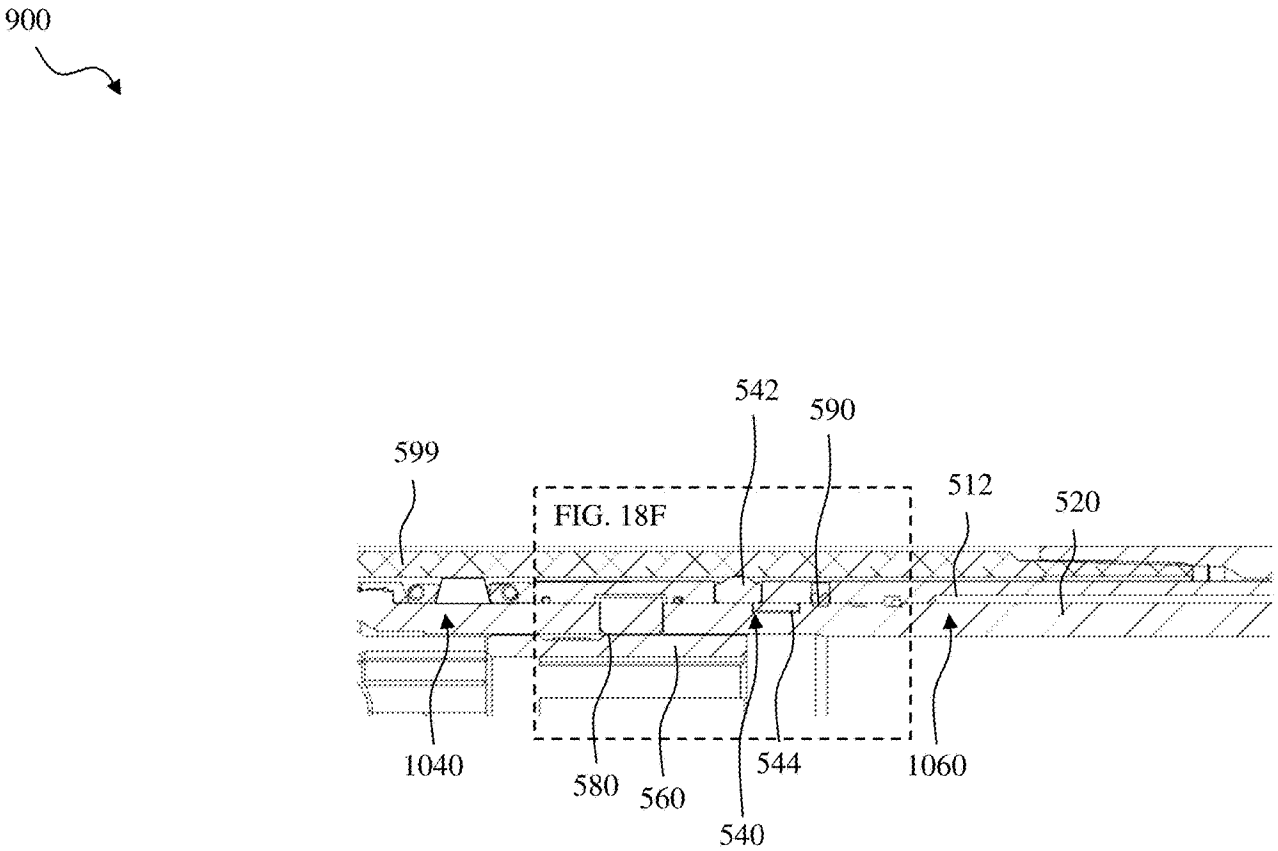
Figure 18F:
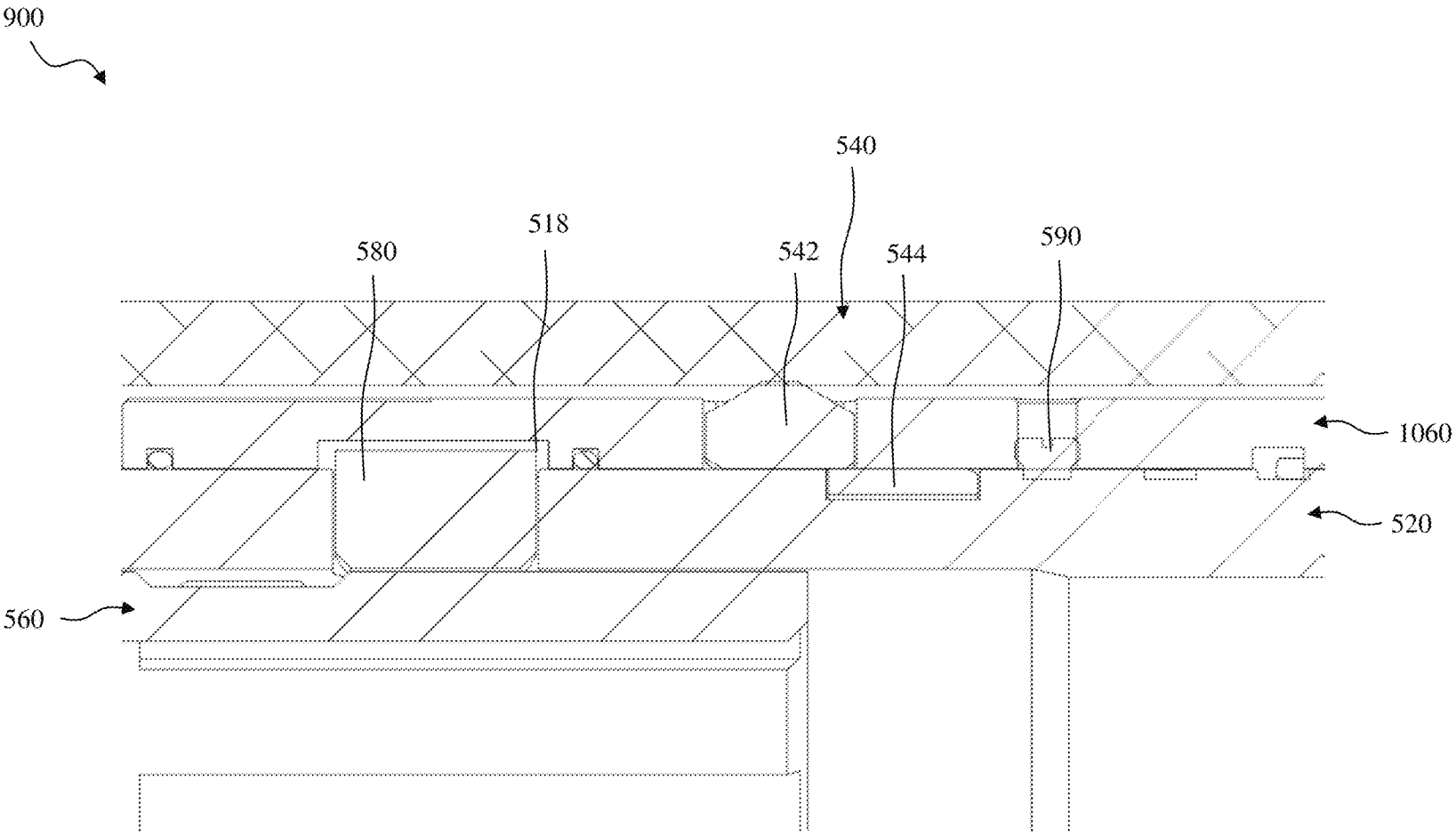
Figure 18G:
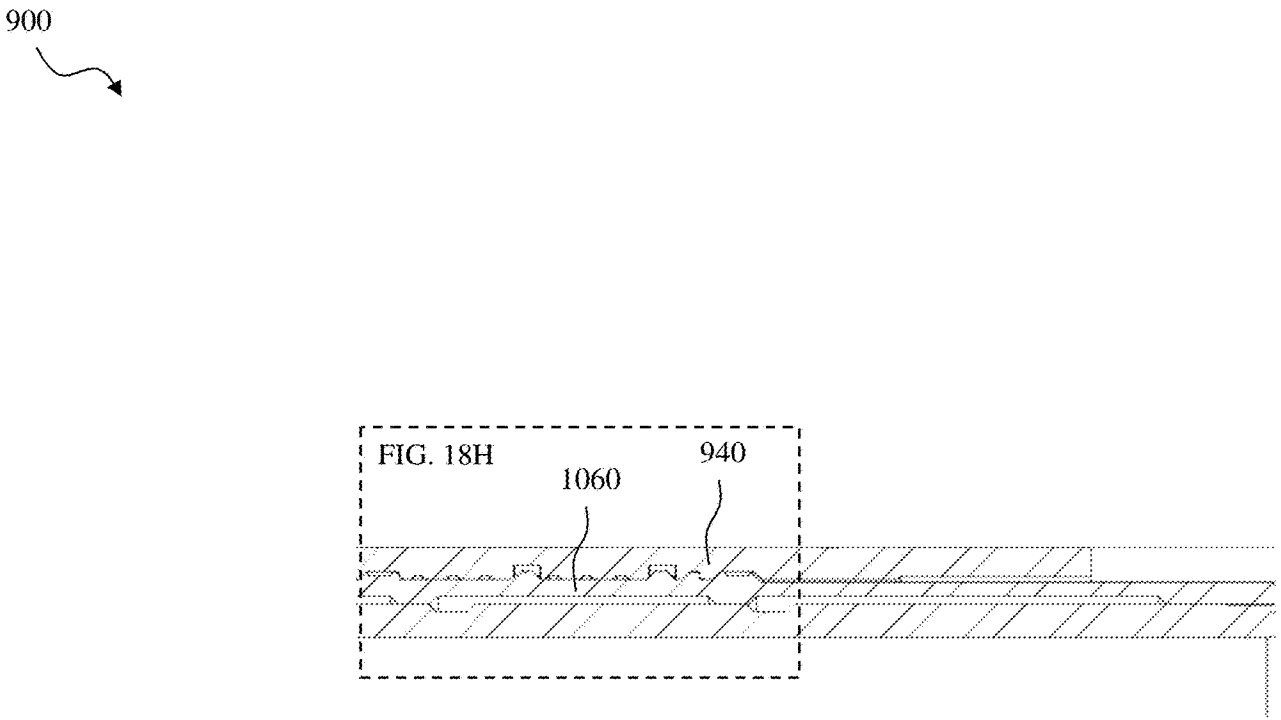
Figure 18H:
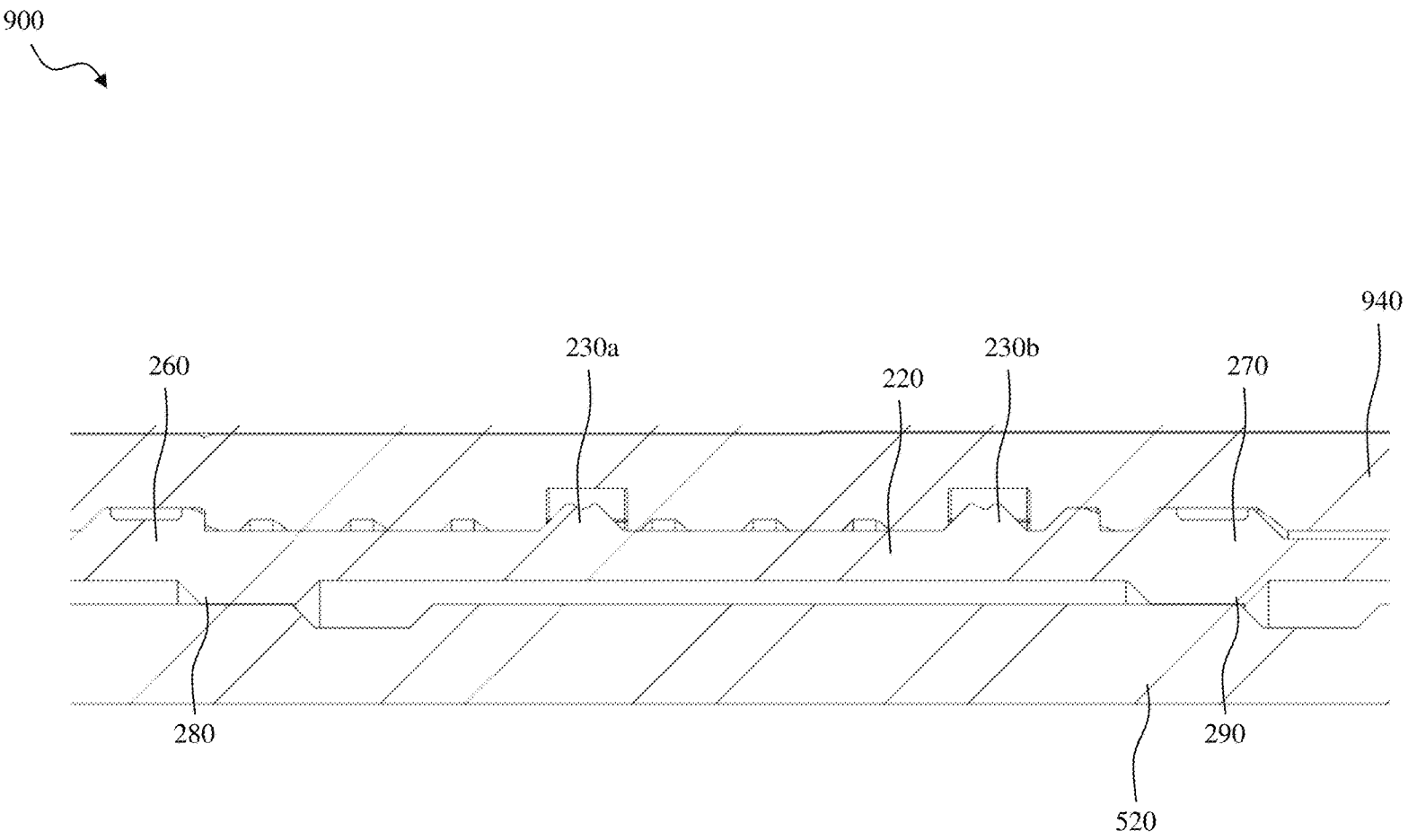
Figure 19A:
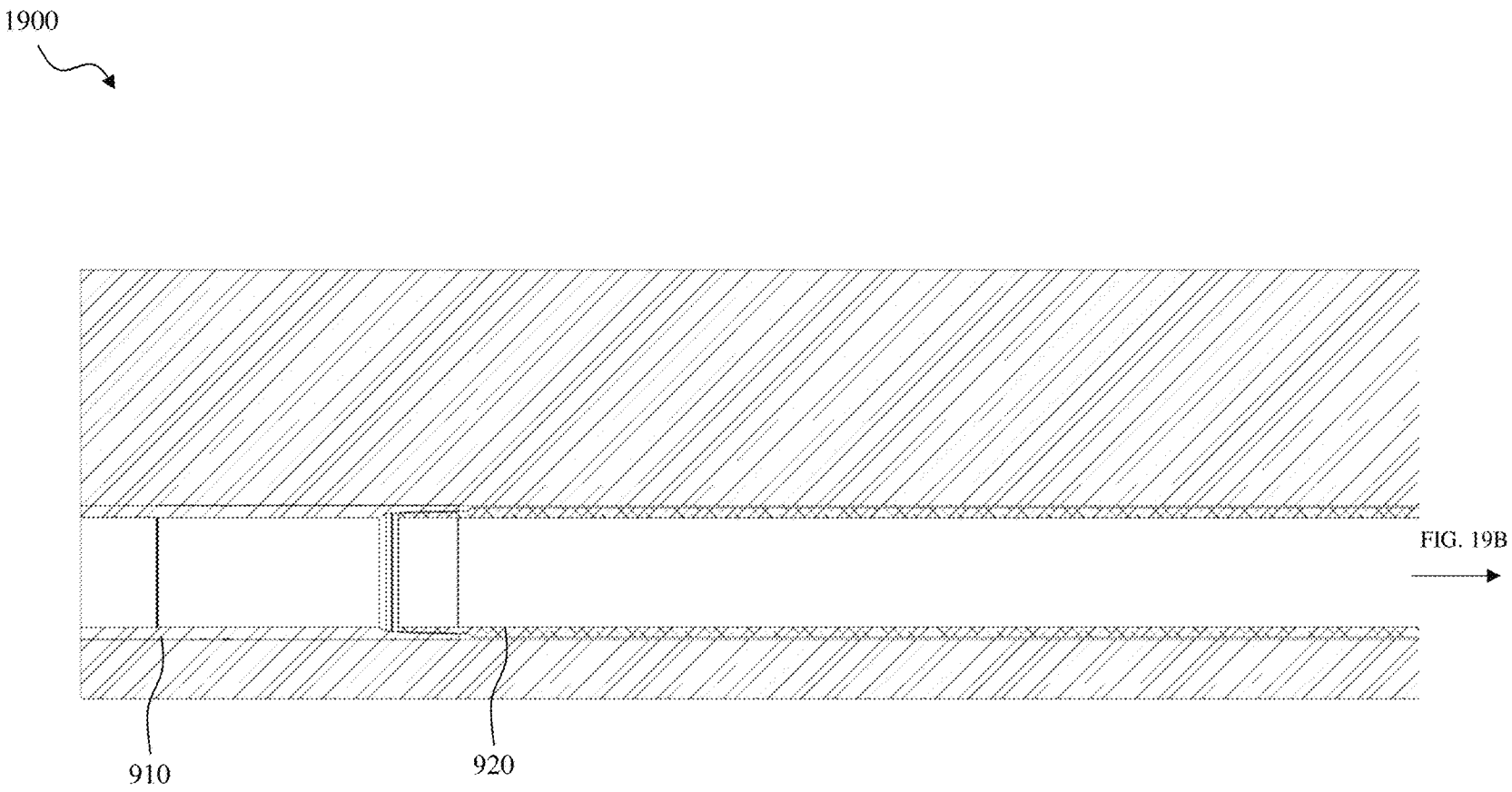
Figure 19B:
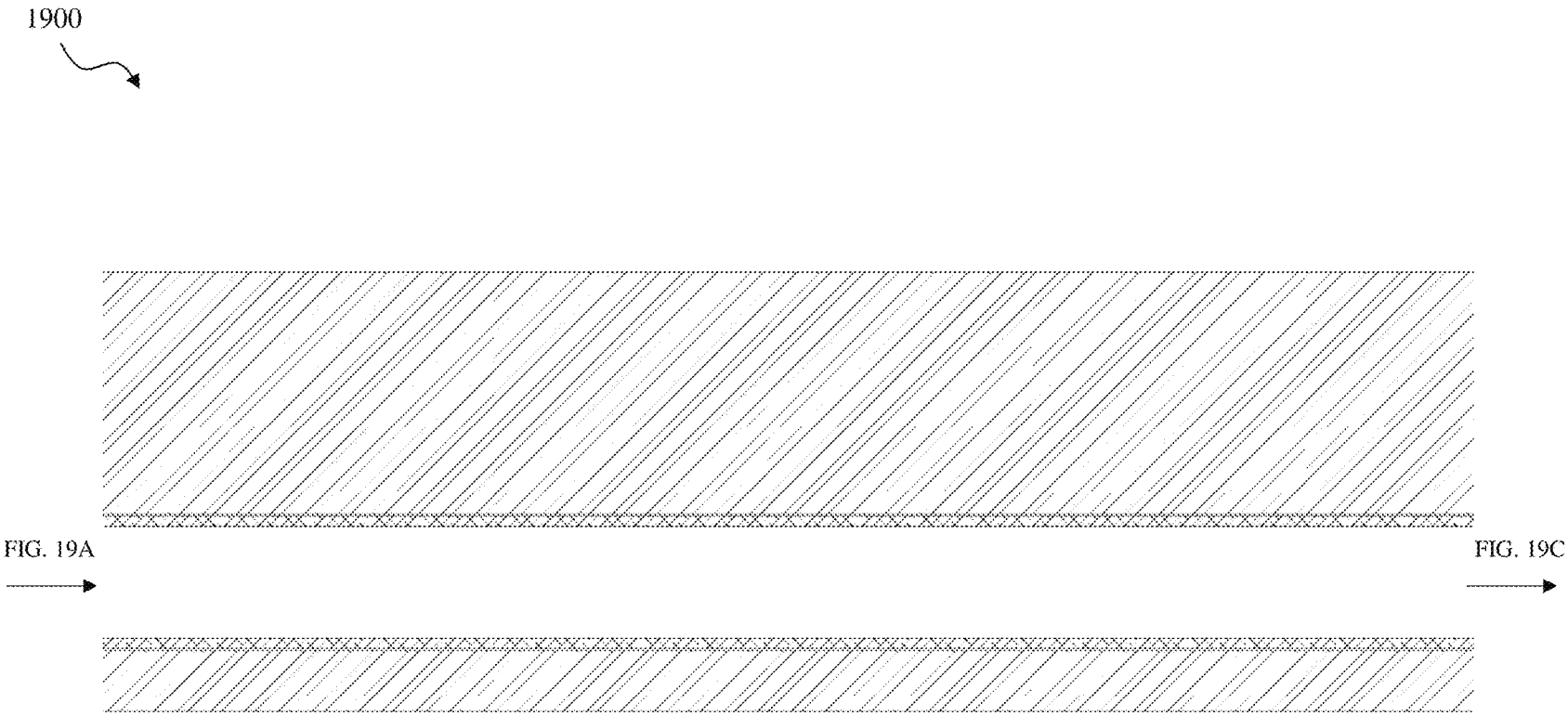
Figure 19C:
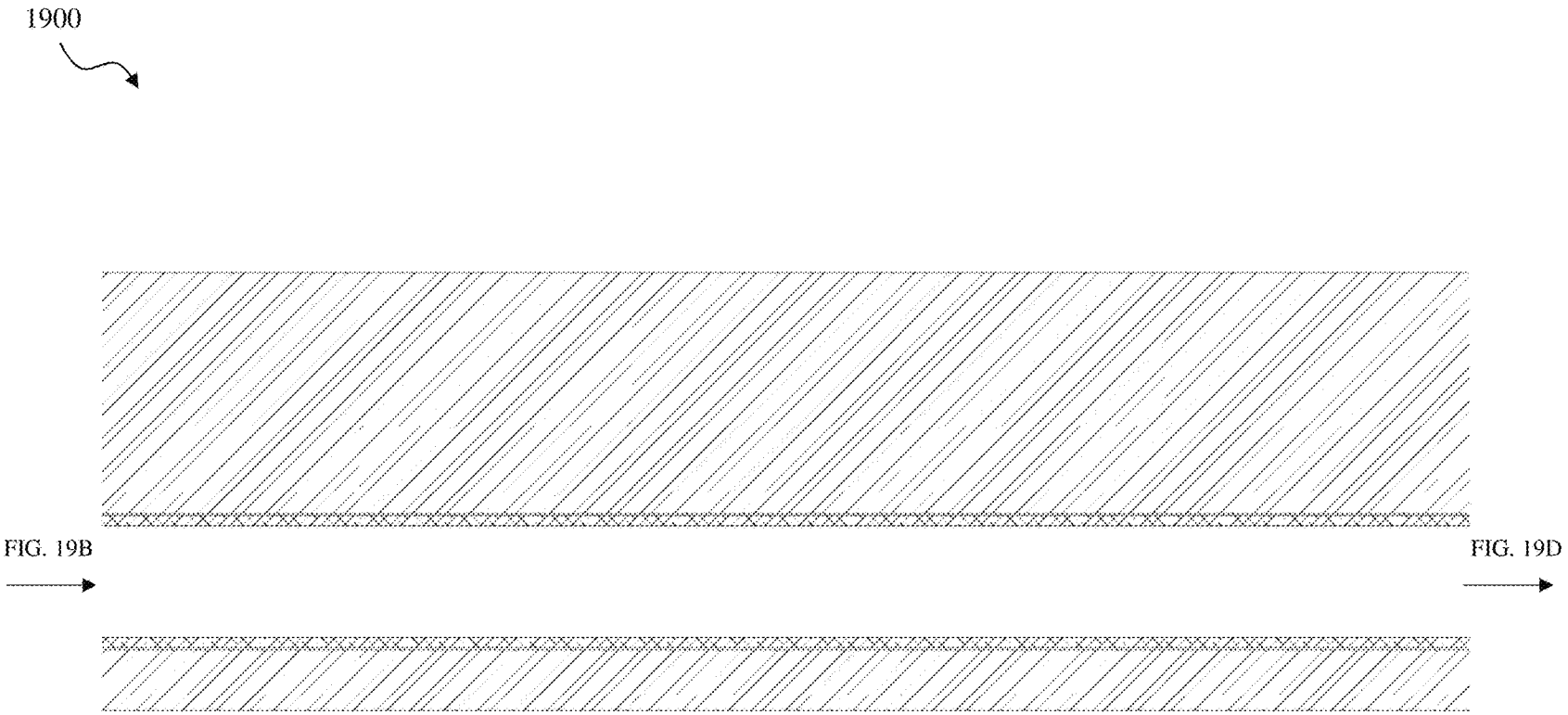
Figure 19D:
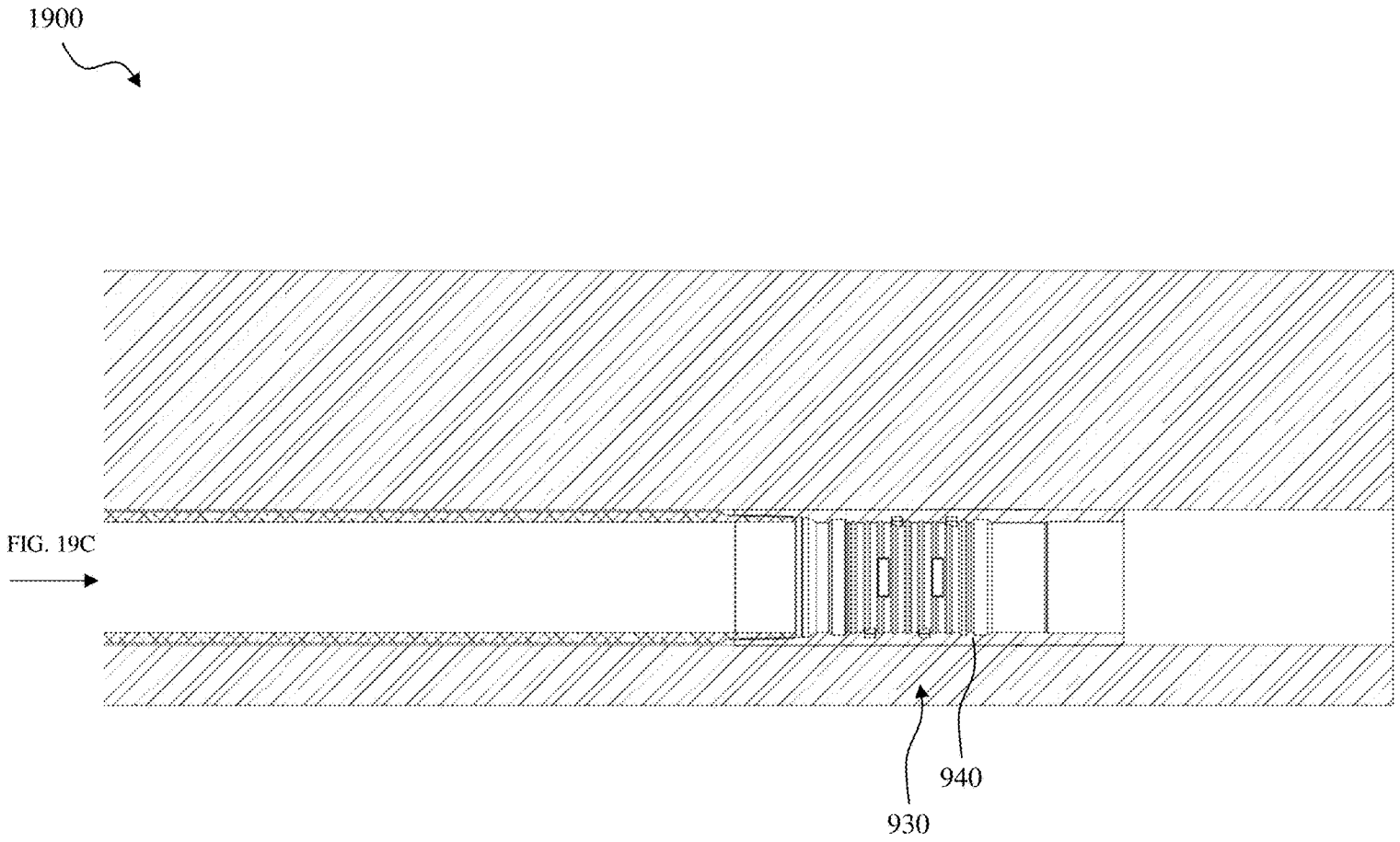
Figure 20A:
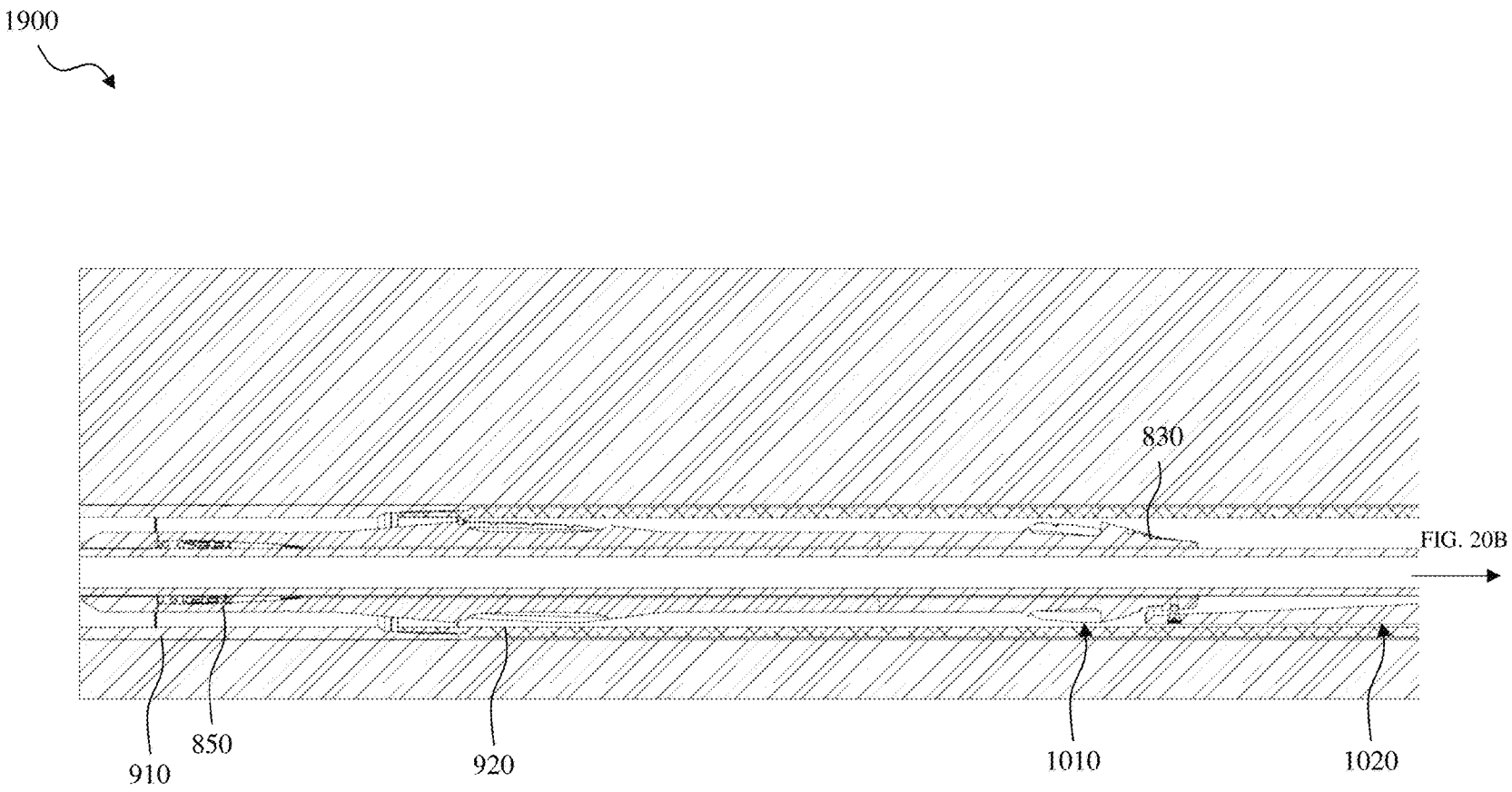
Figure 20B:
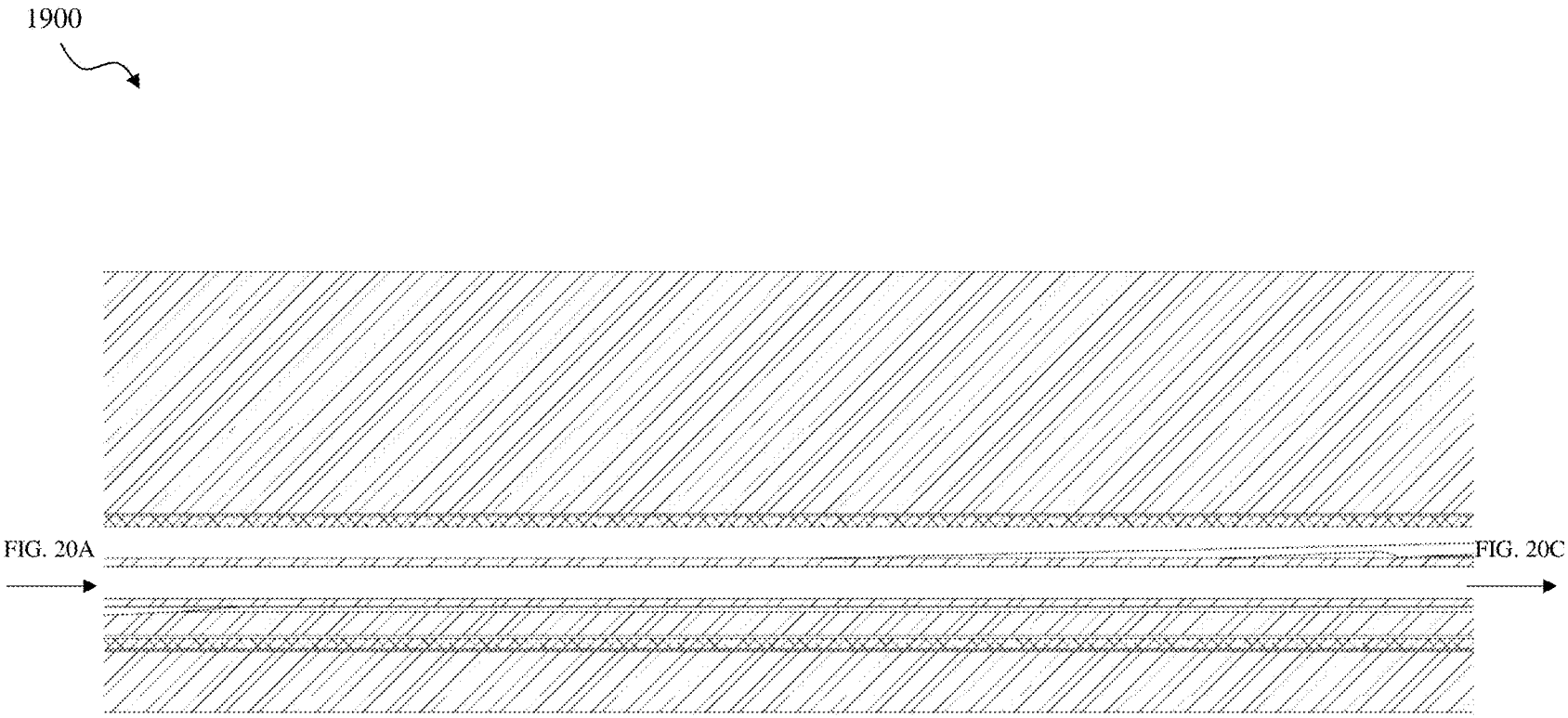
Figure 20C:
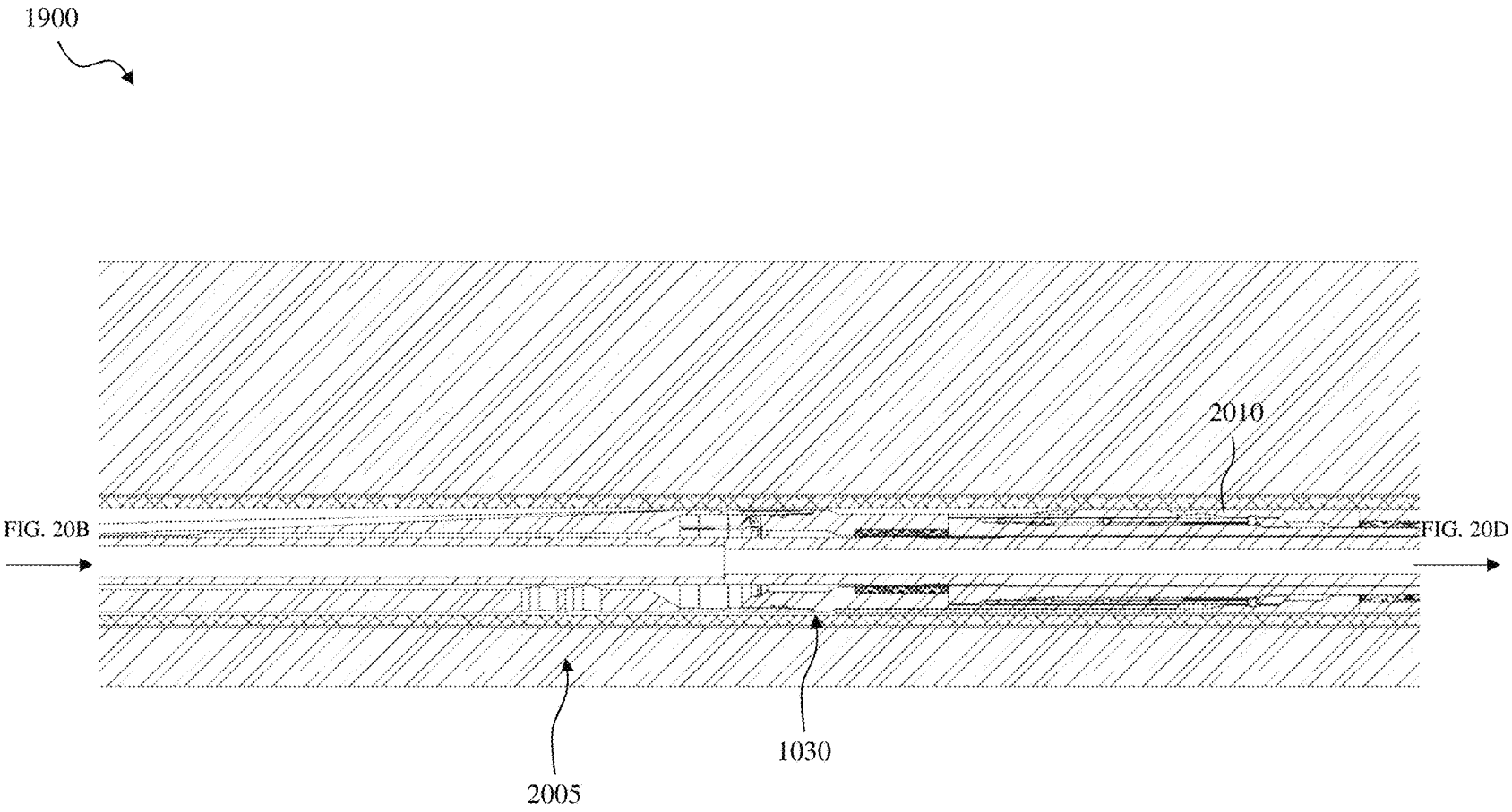
Figure 20D:
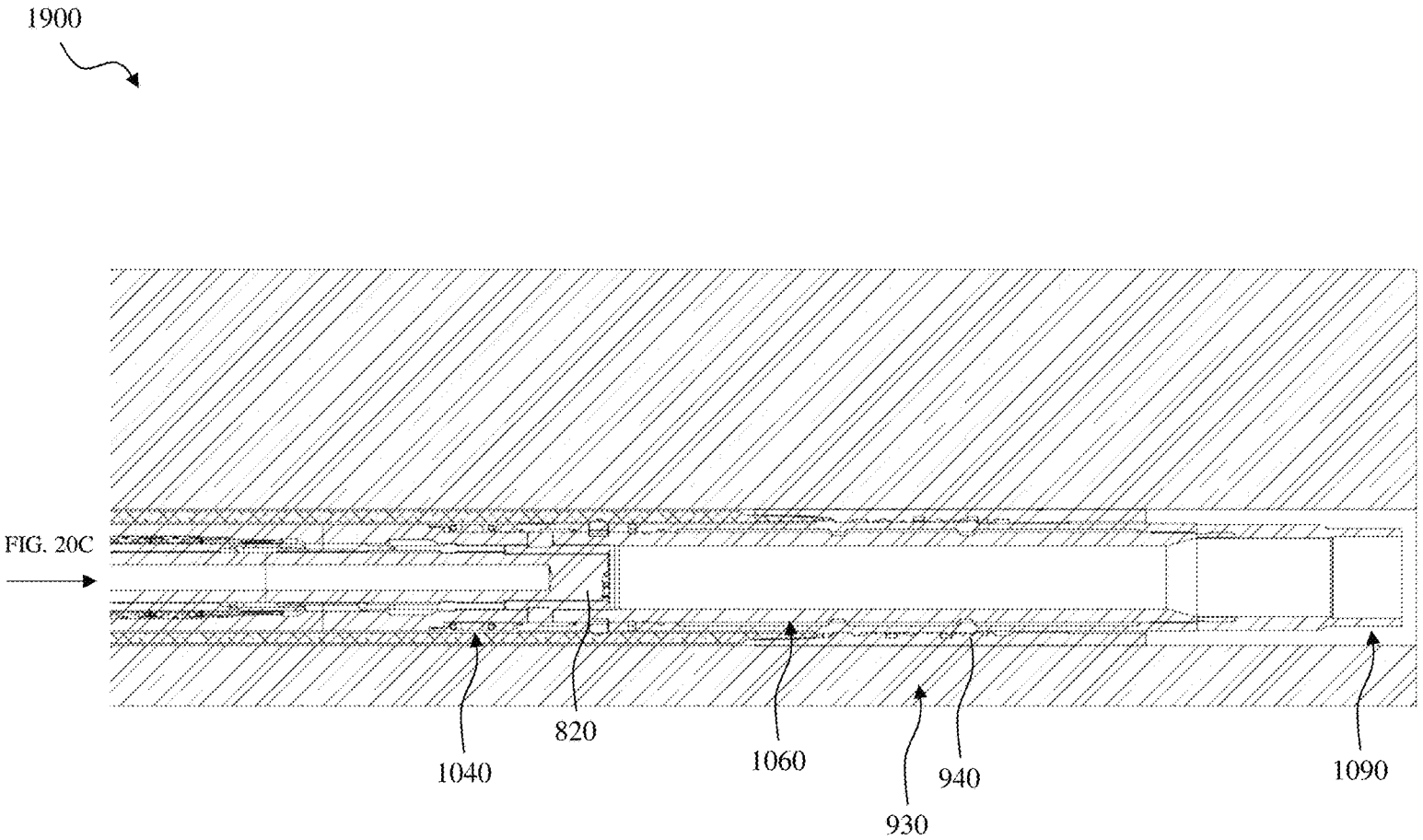
Figure 21A:
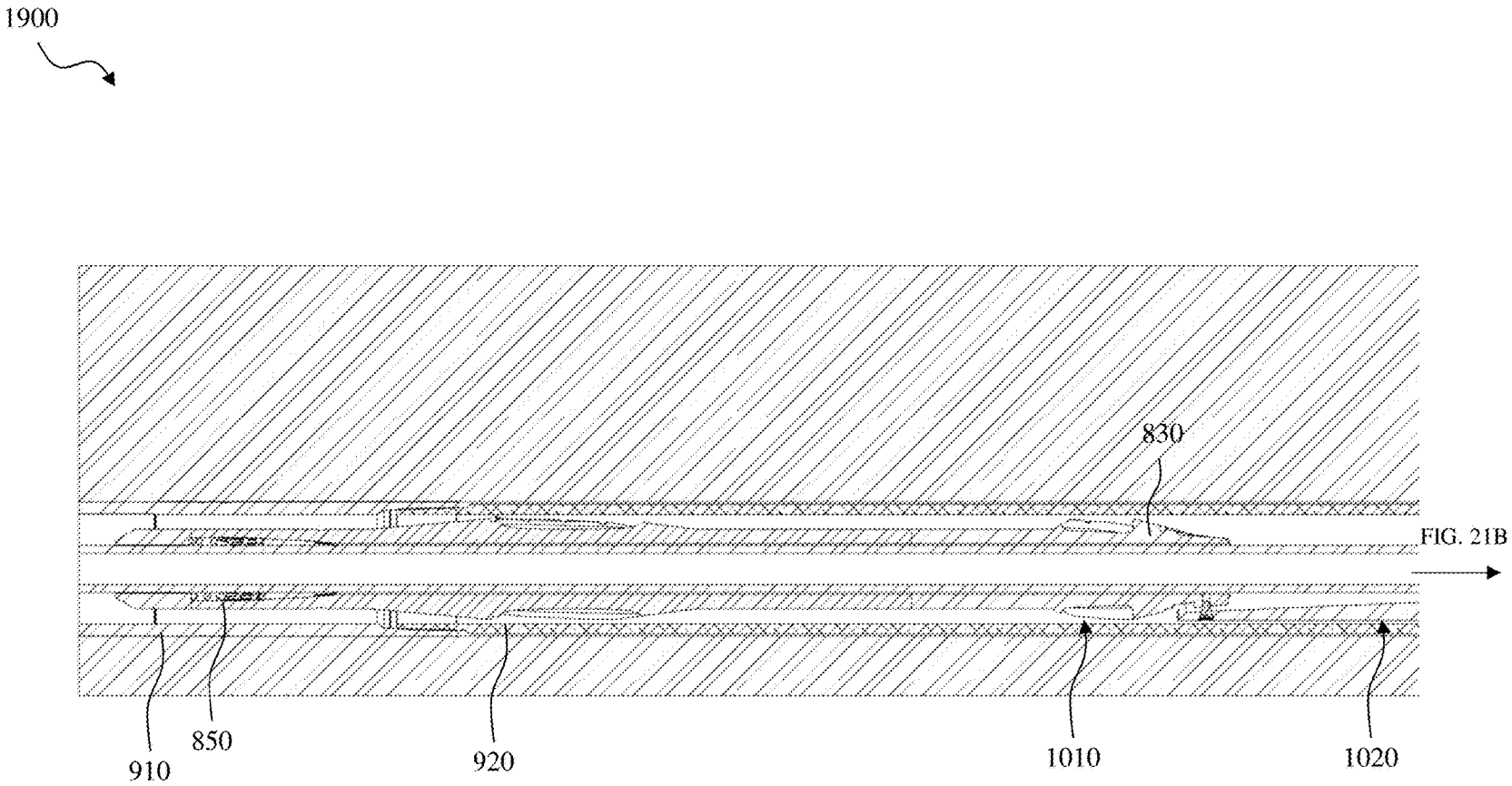
Figure 21B:
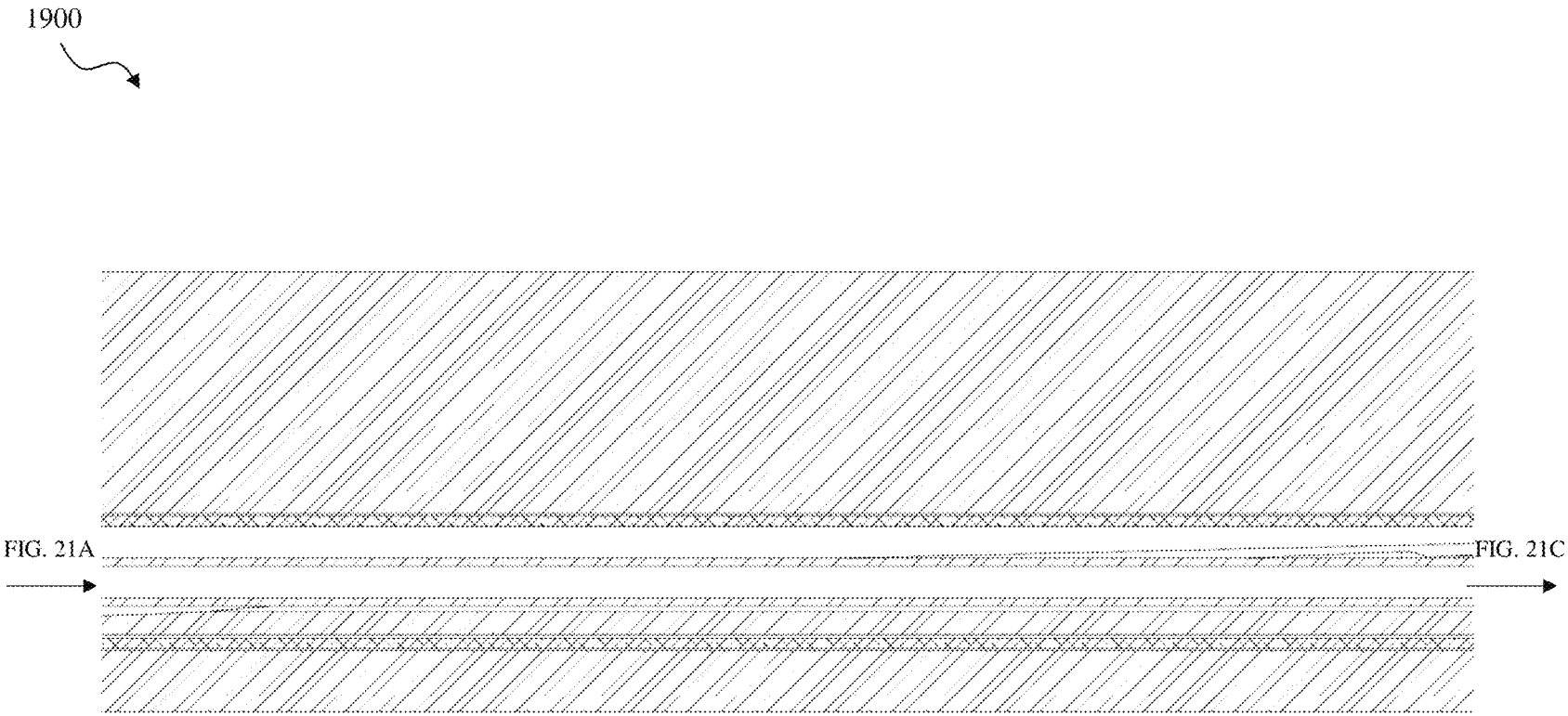
Figure 21C:
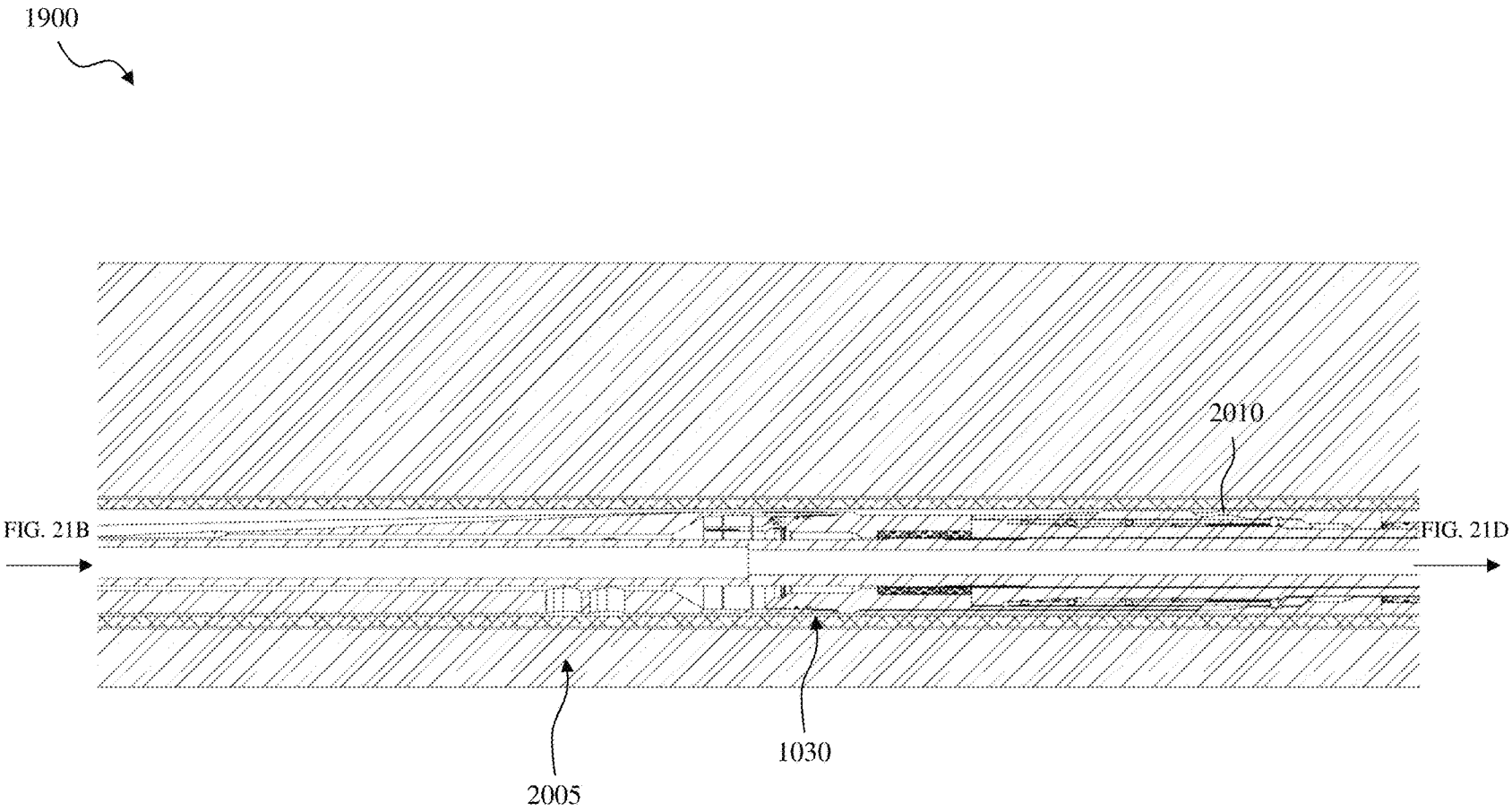
Figure 21D:
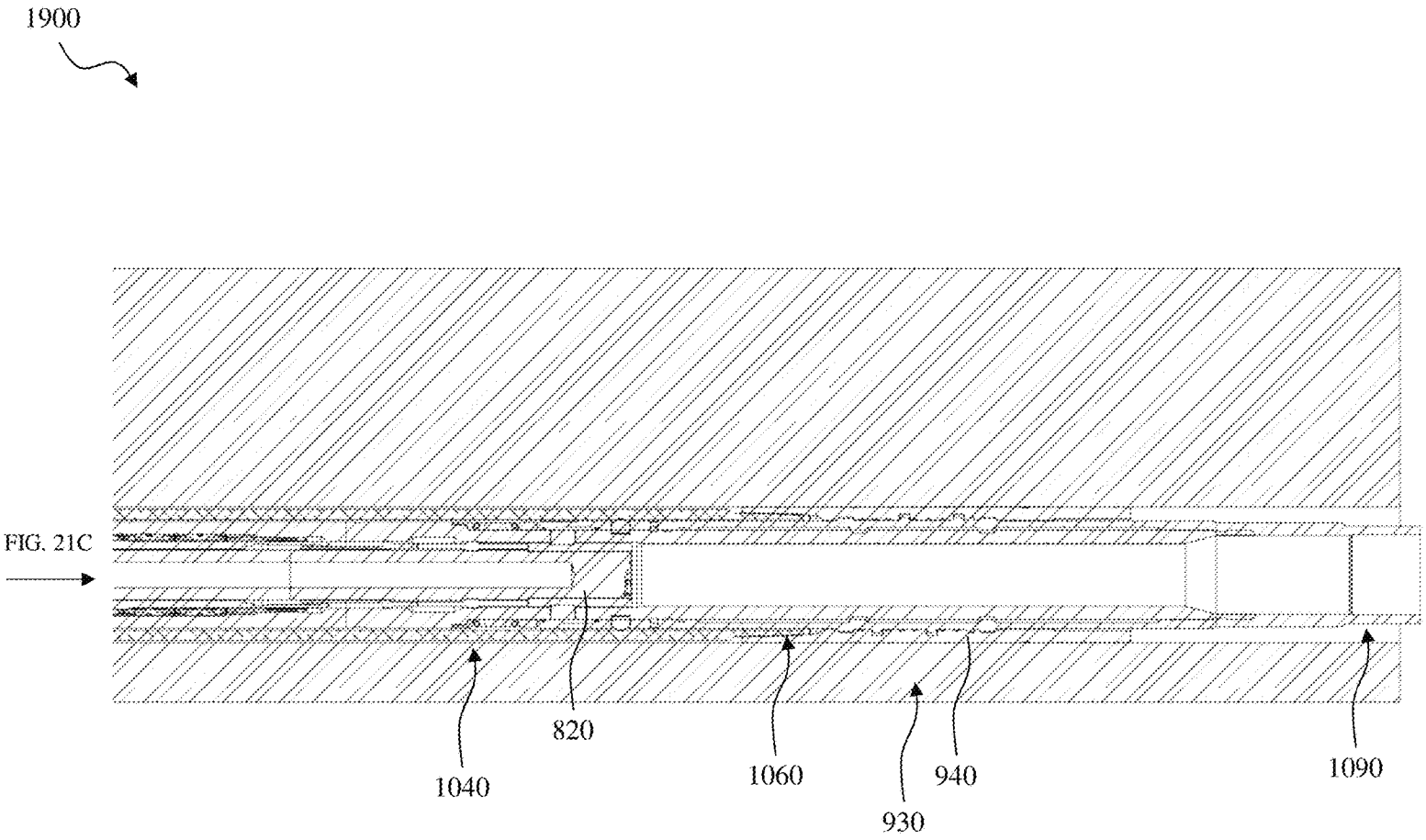
Figure 22A:
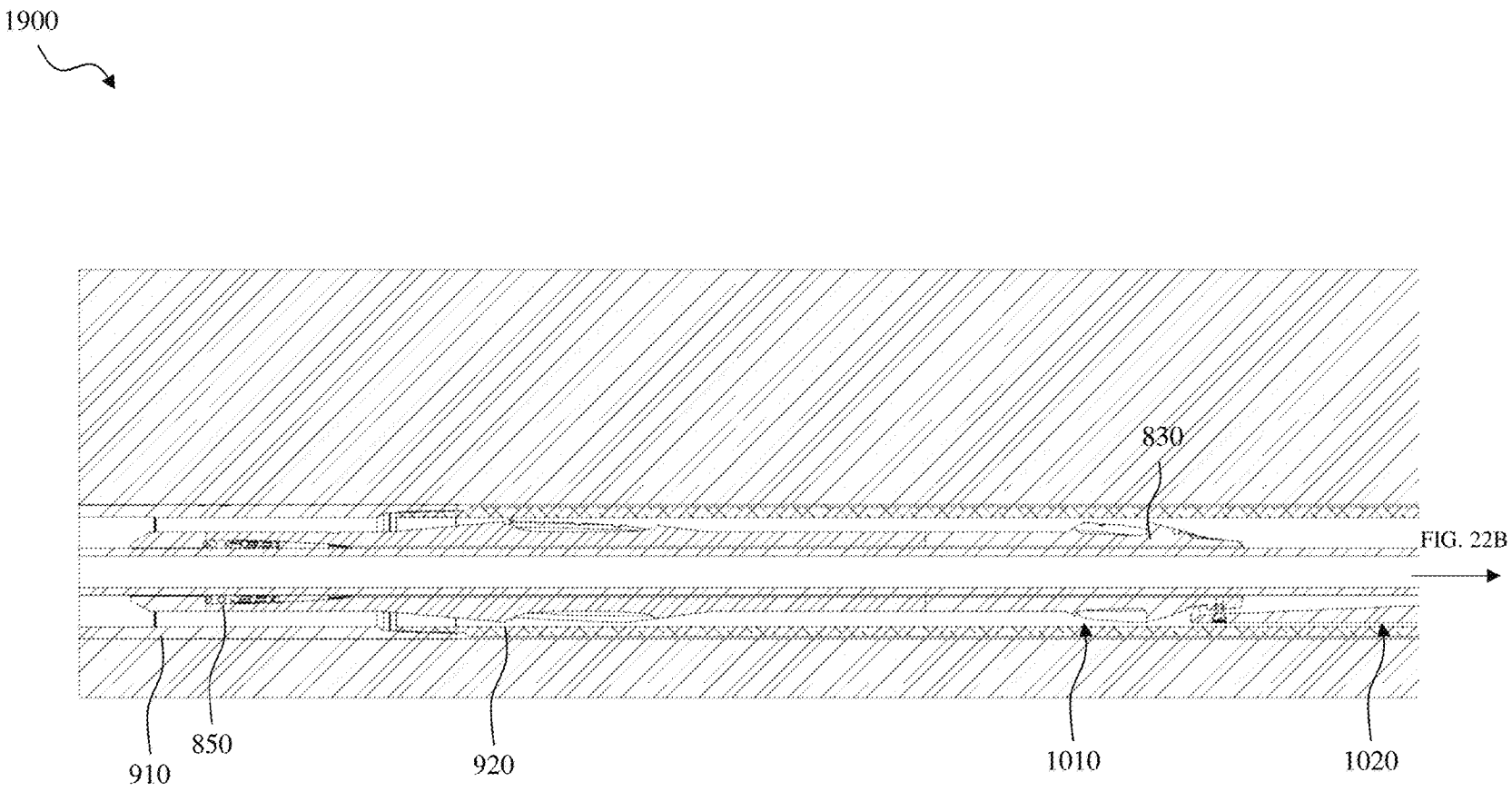
Figure 22B:
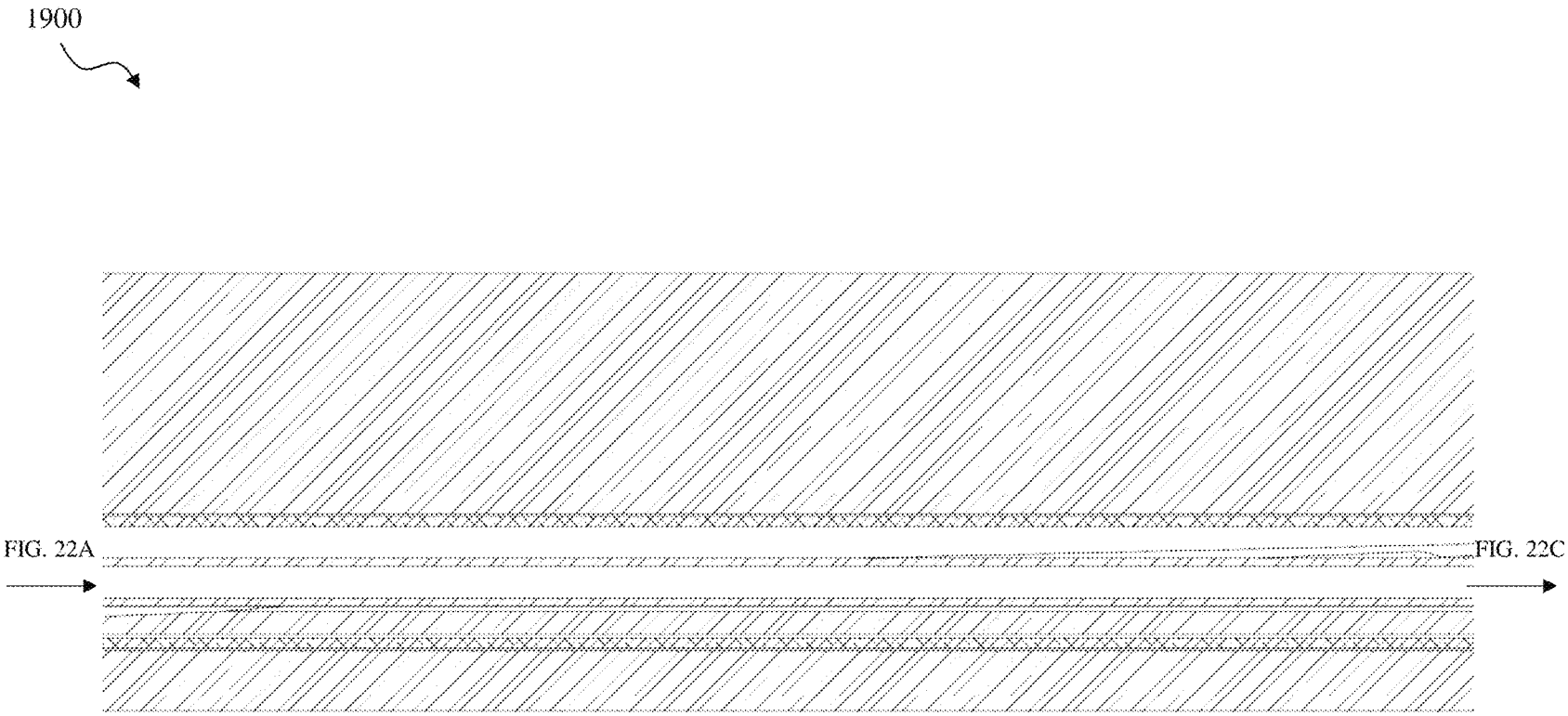
Figure 22C:
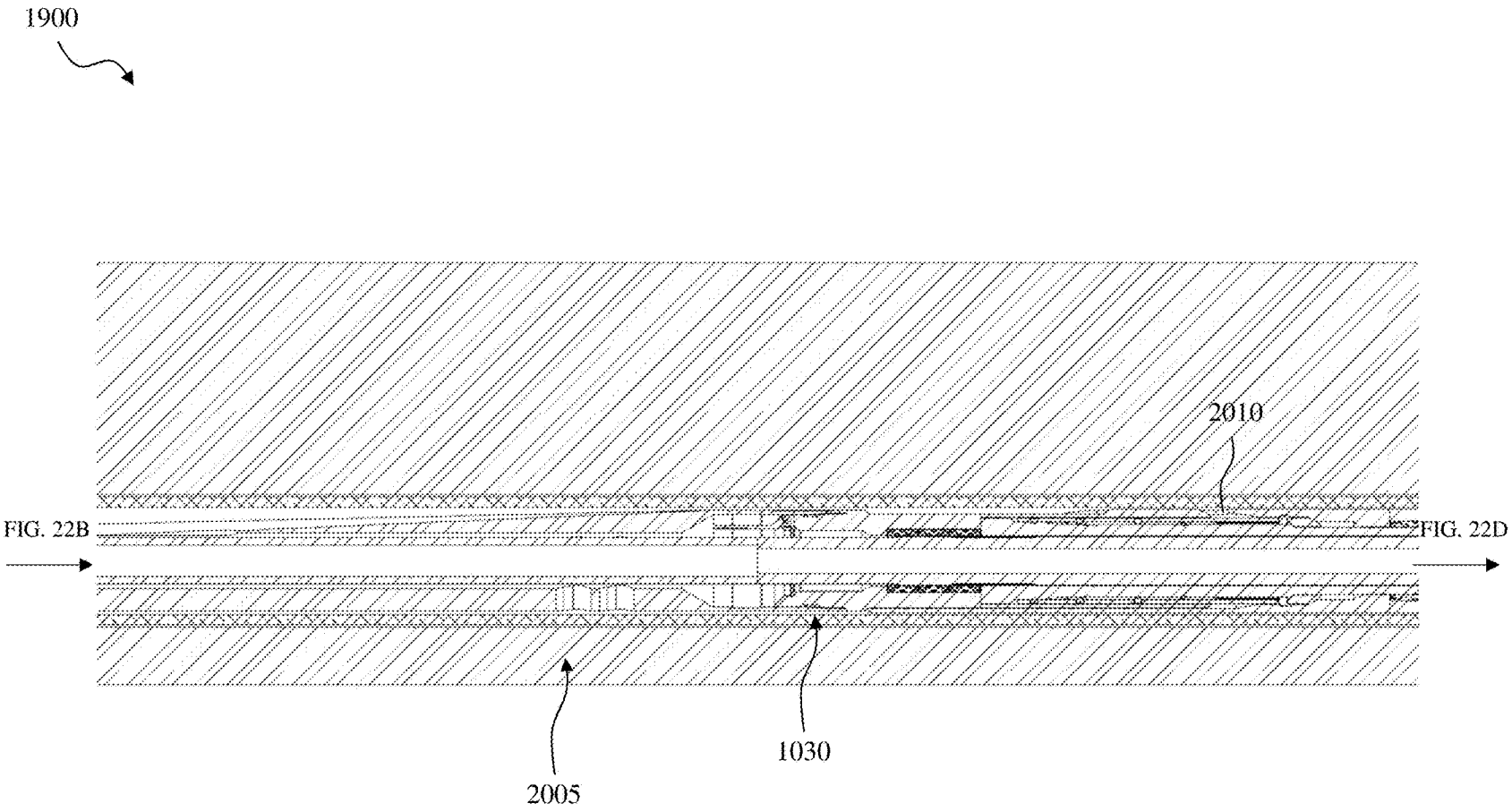
Figure 22D:
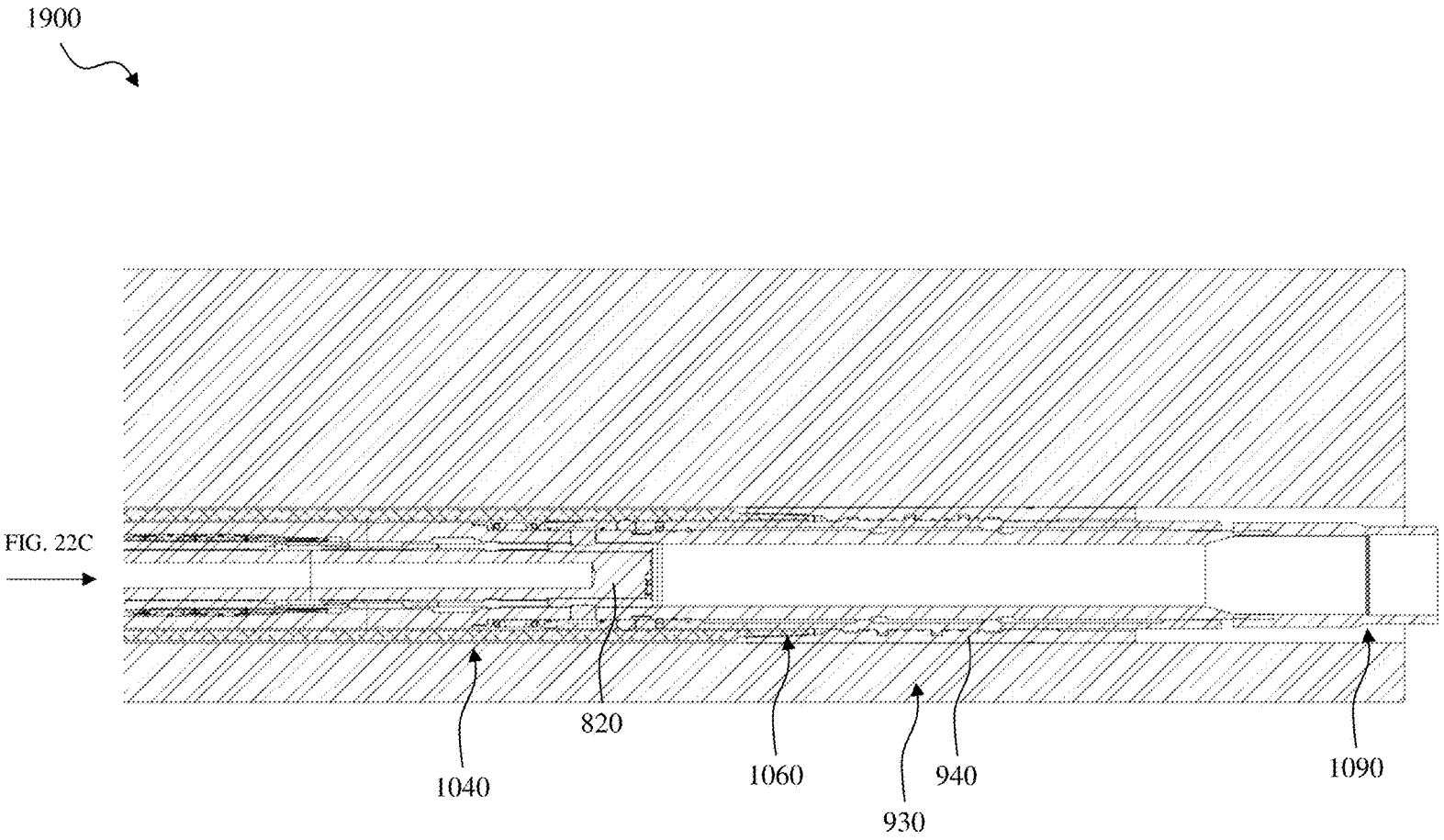
Figure 23A:
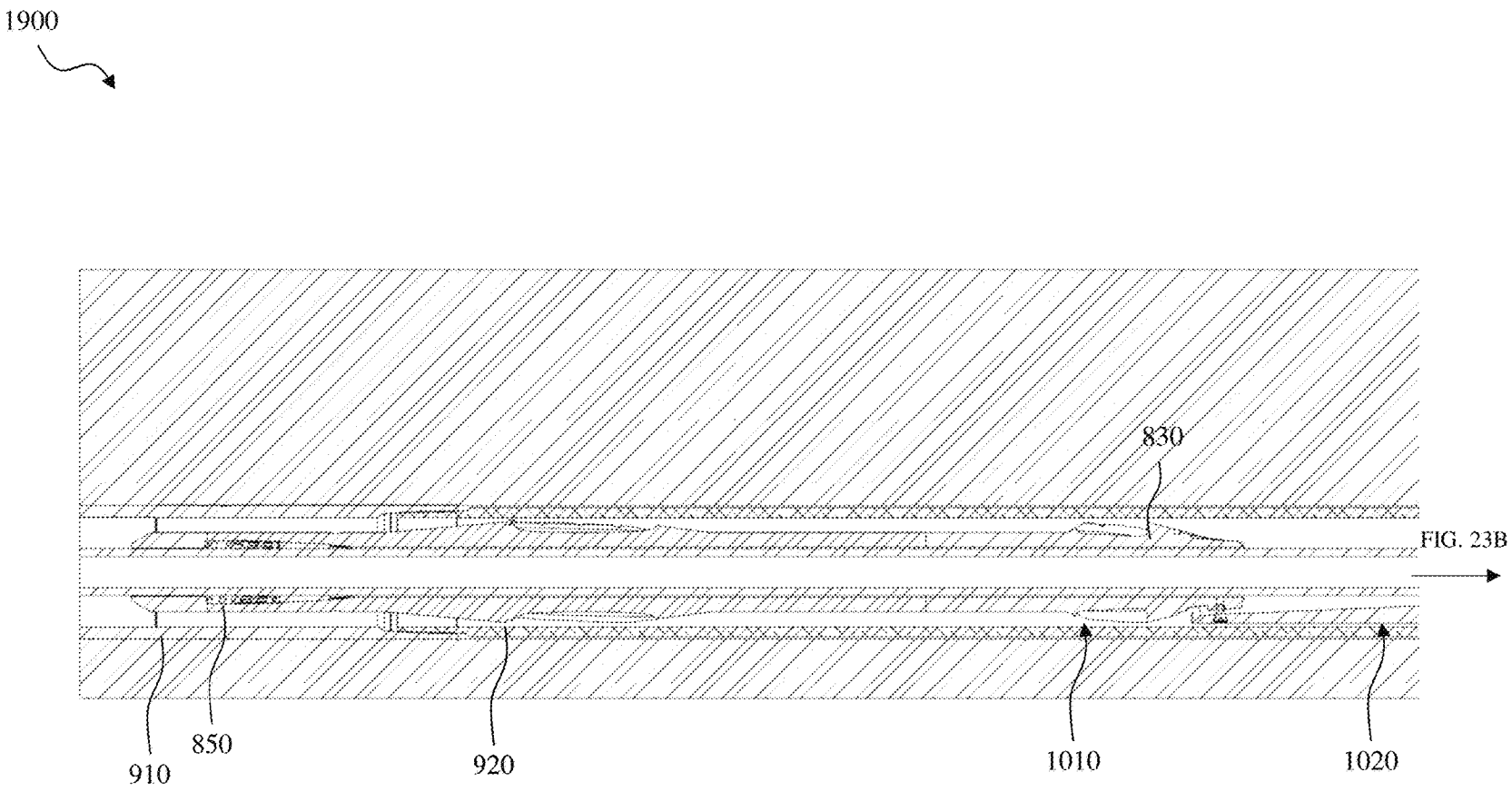
Figure 23B:
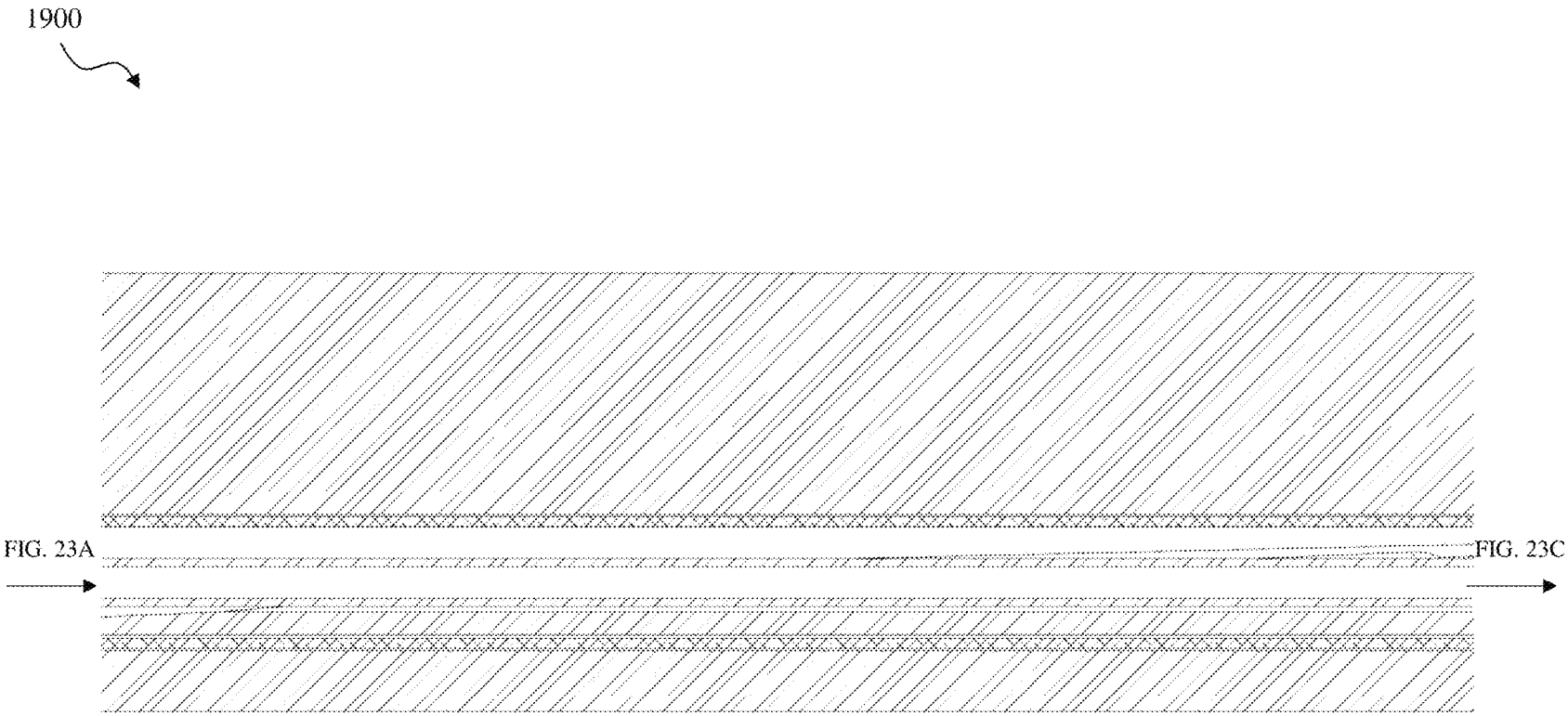
Figure 23C:
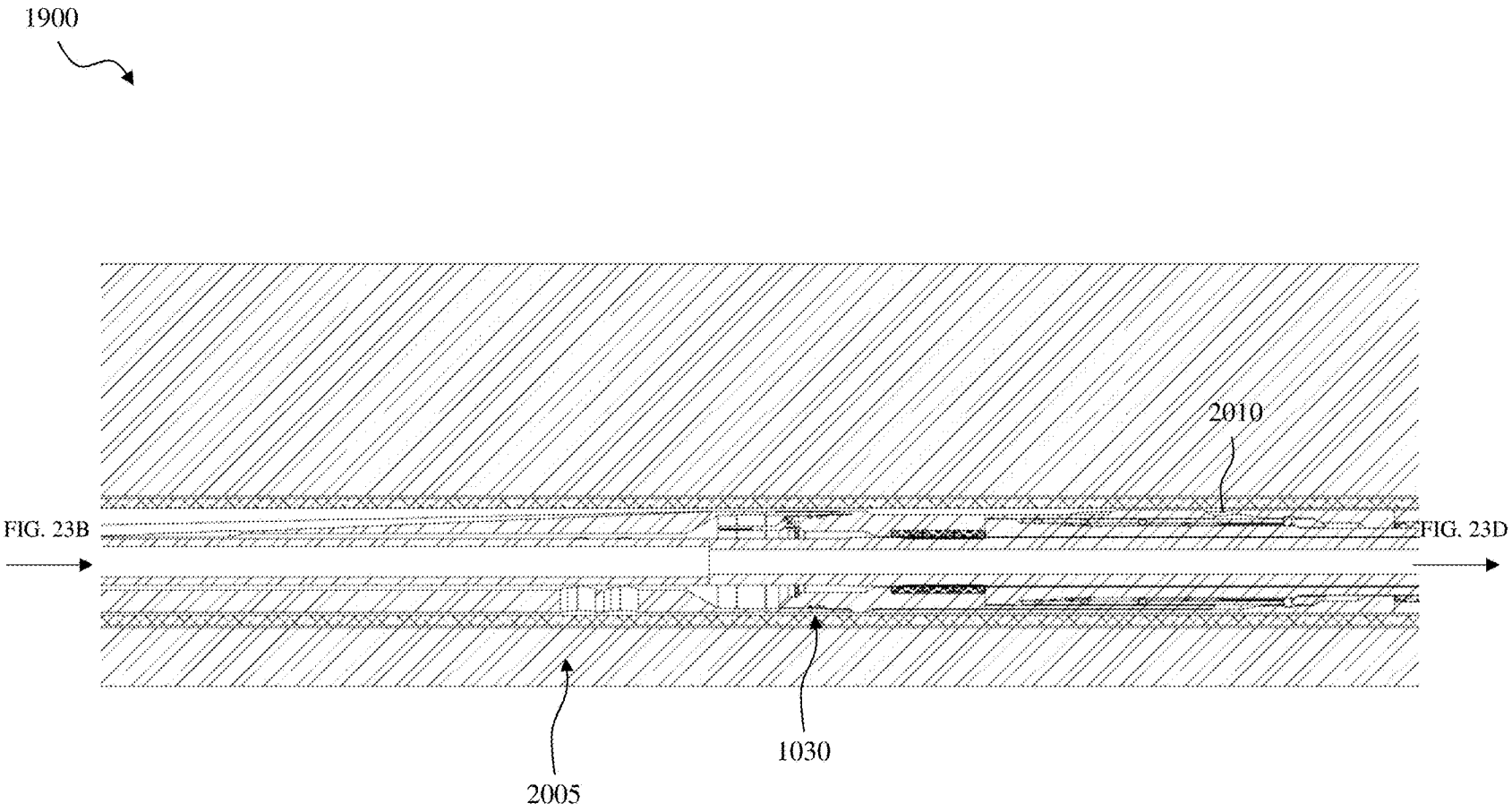
Figure 23D:
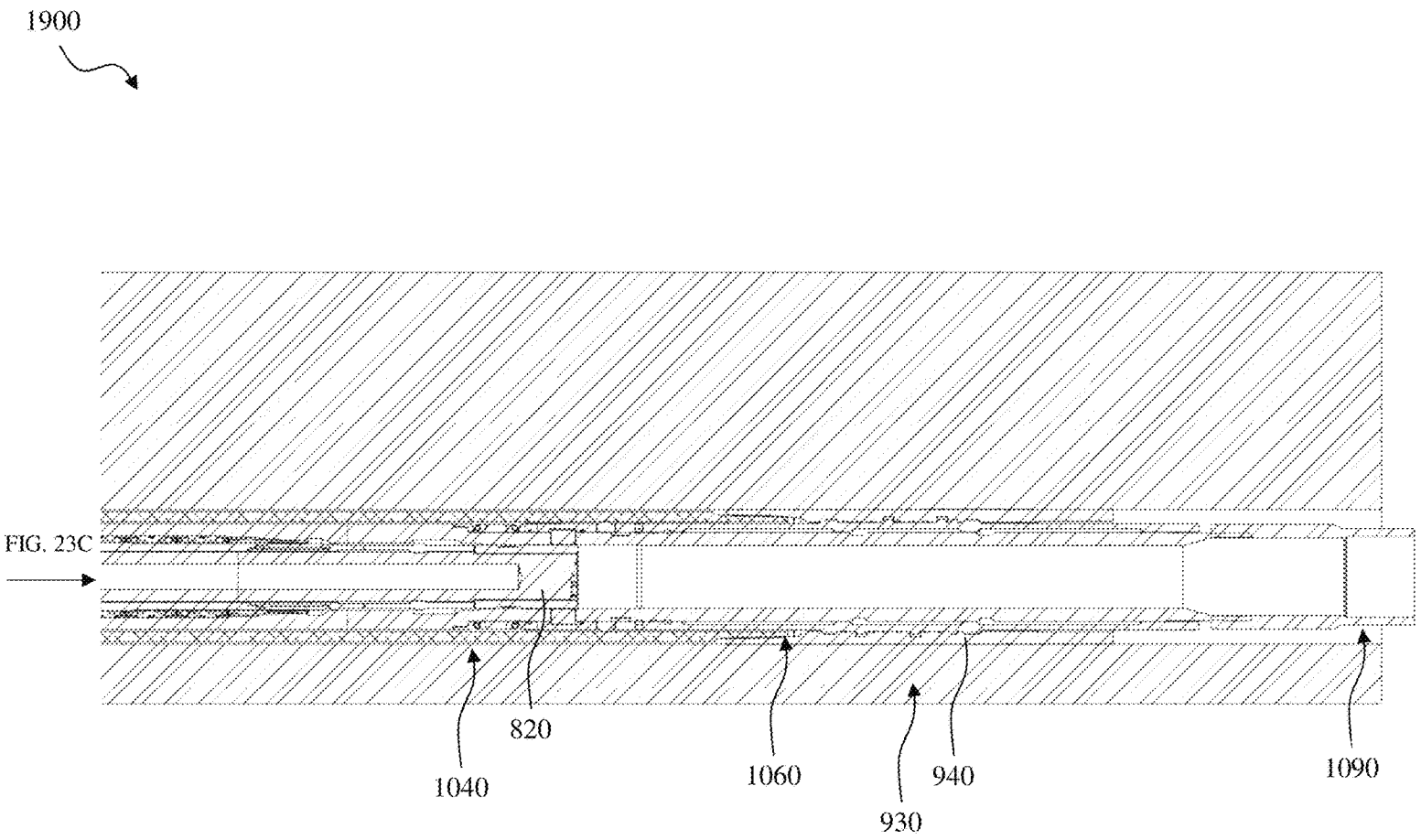
Figure 24A:
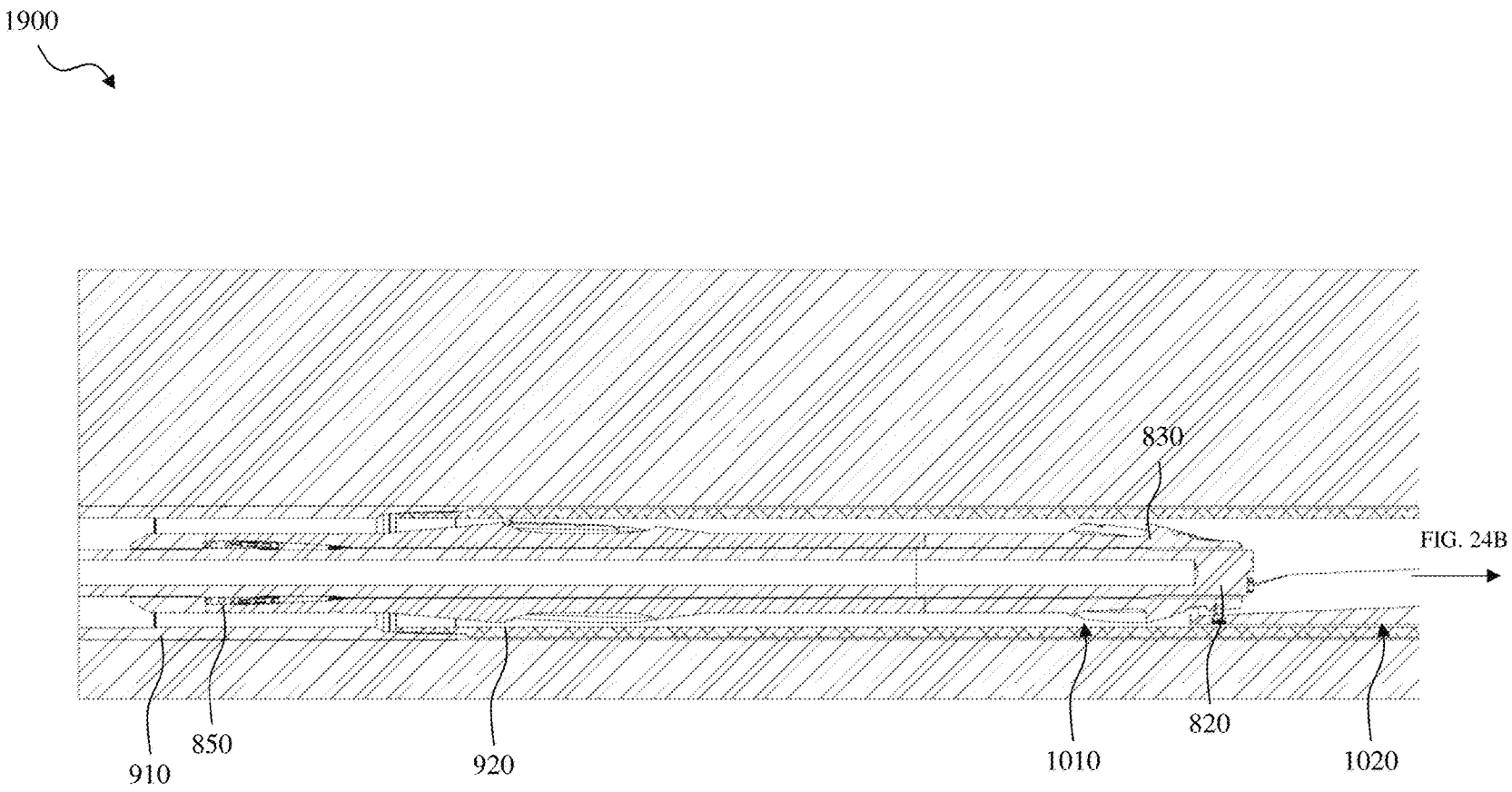
Figure 24B:
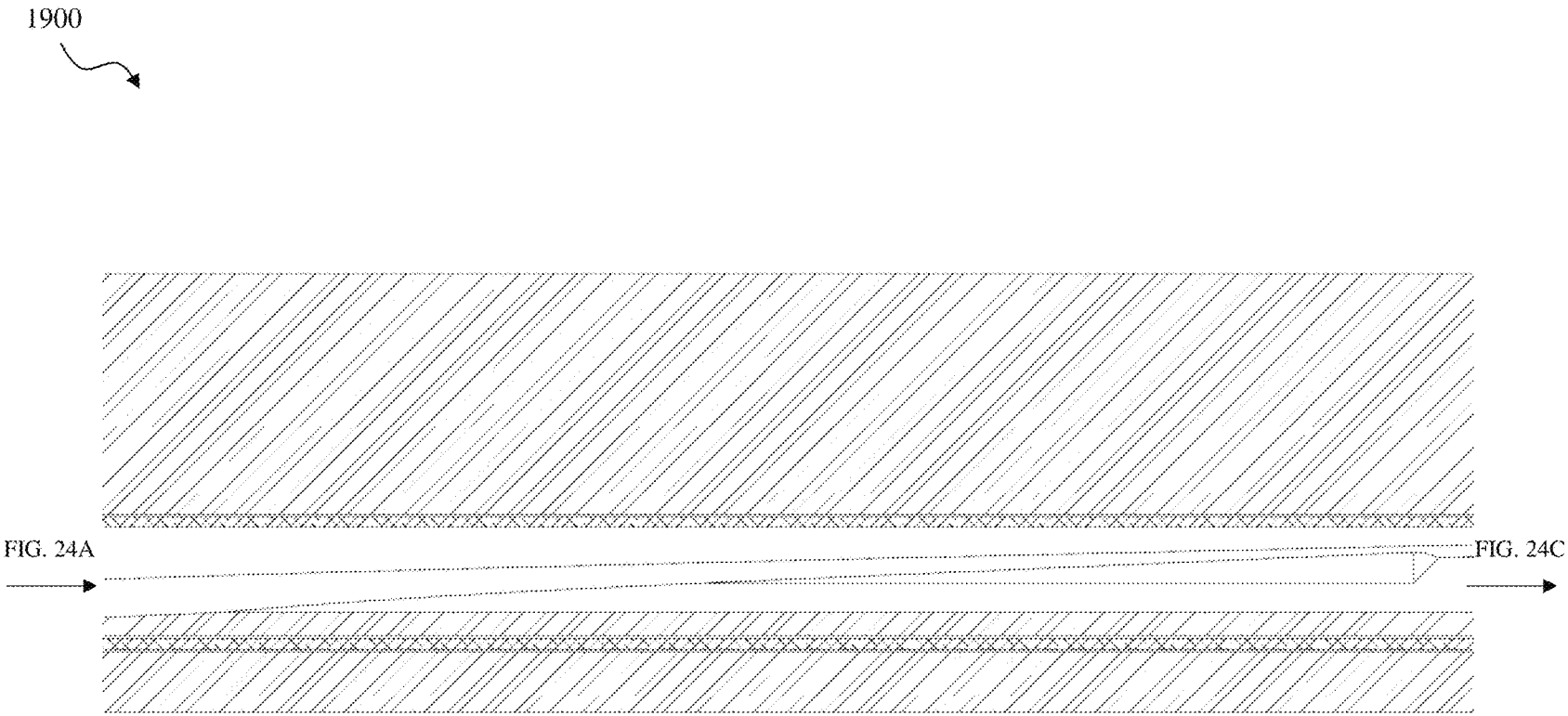
Figure 24C:
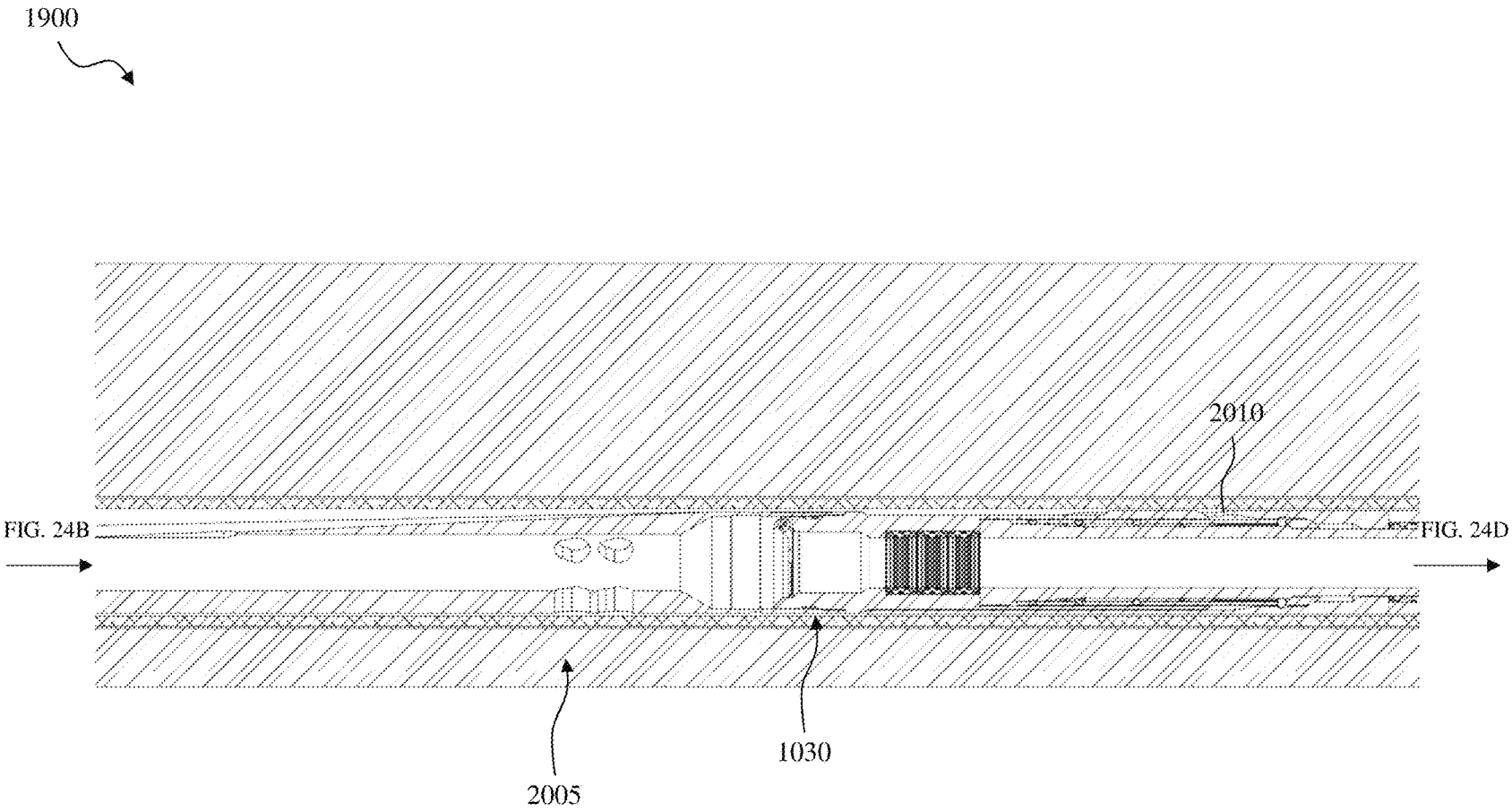
Figure 24D:
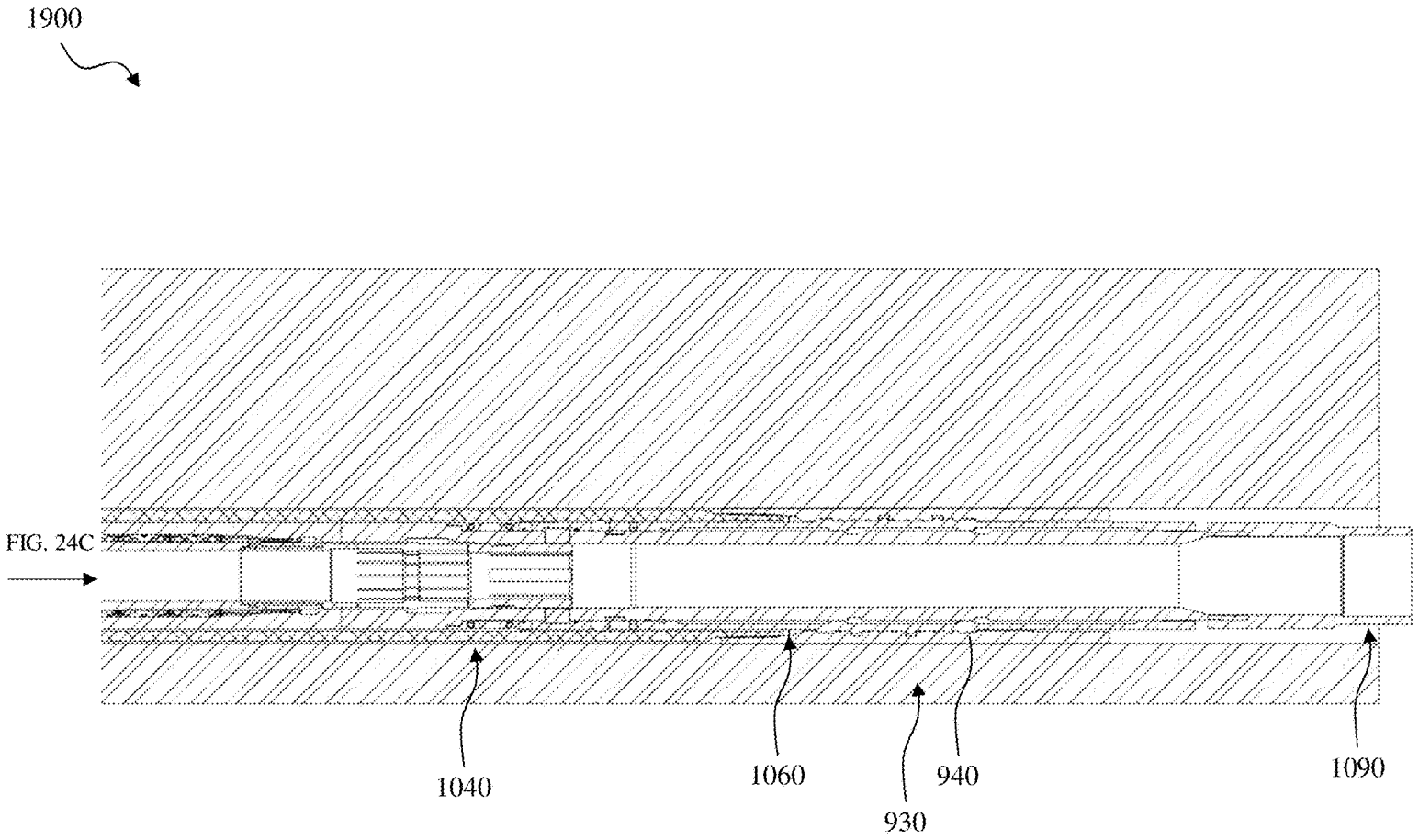
Figure 25A:
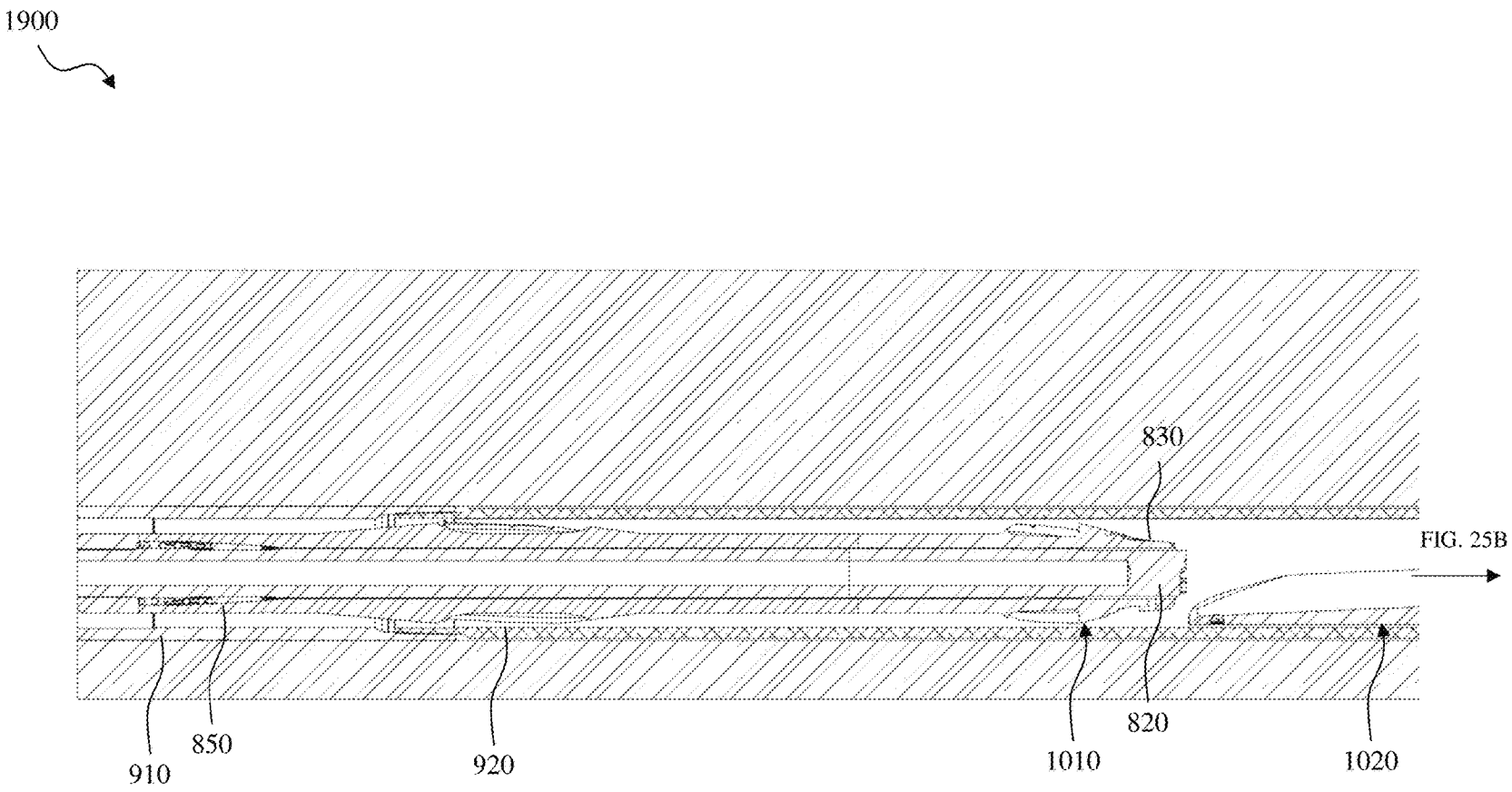
Figure 25B:
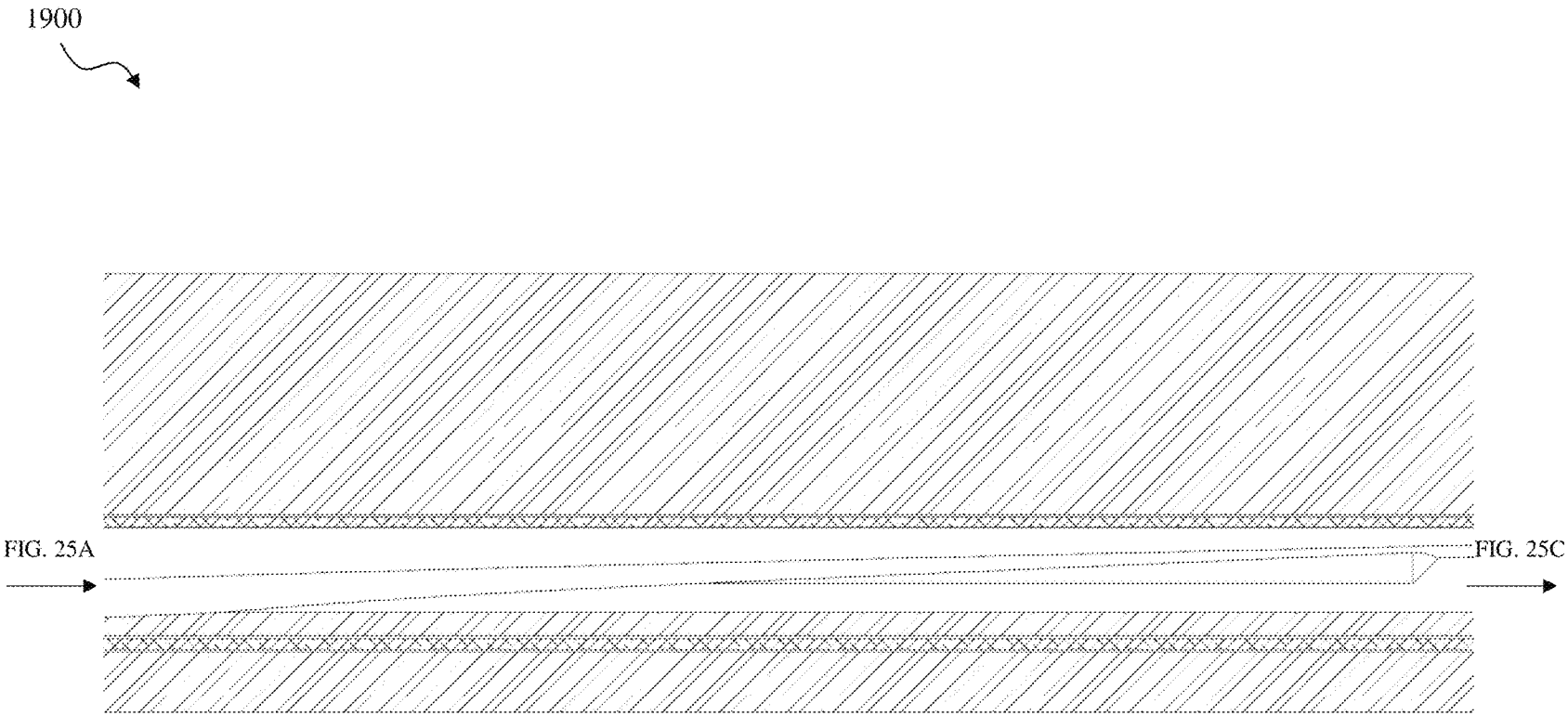
Figure 25C:
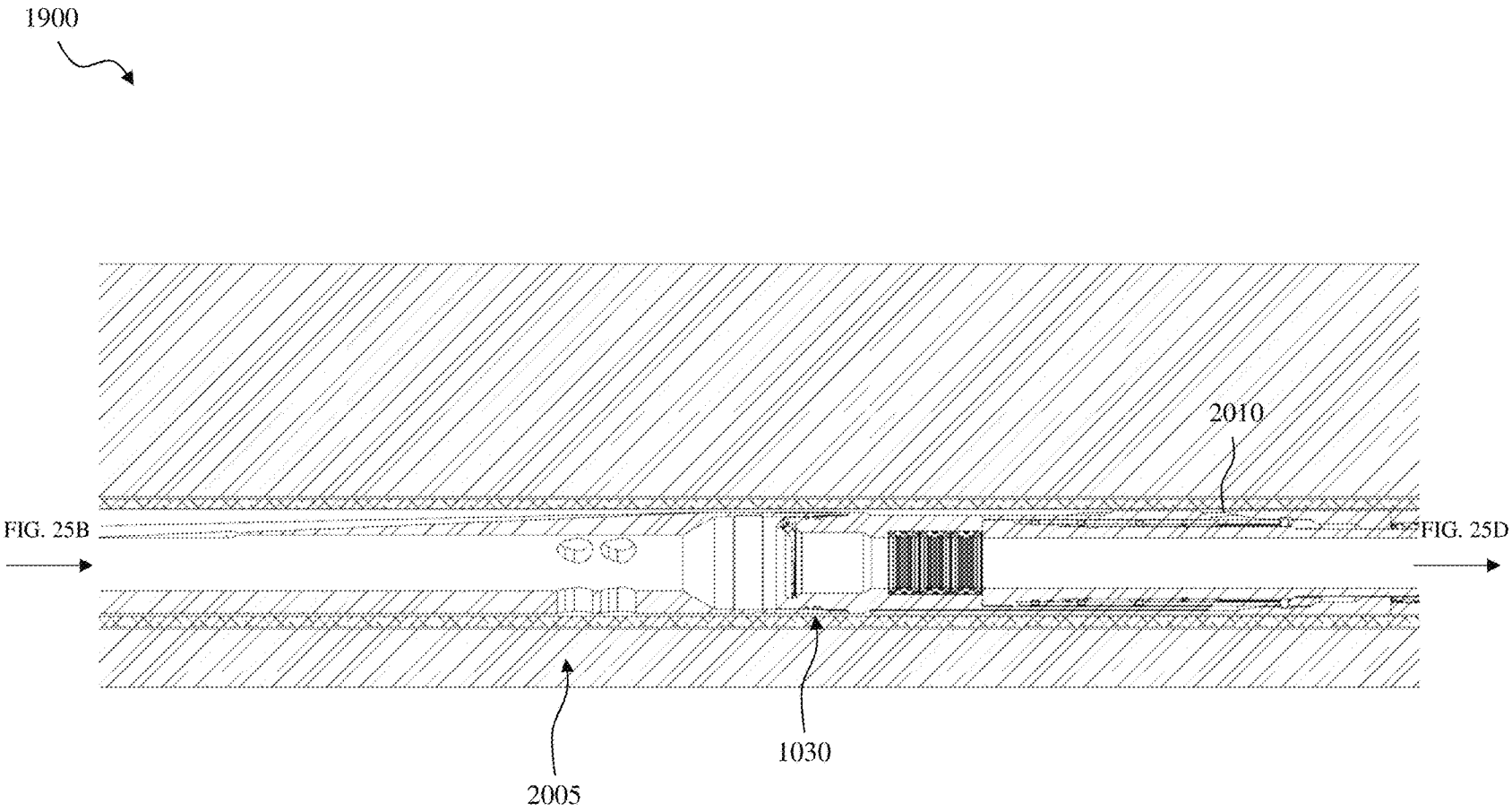
Figure 25D:
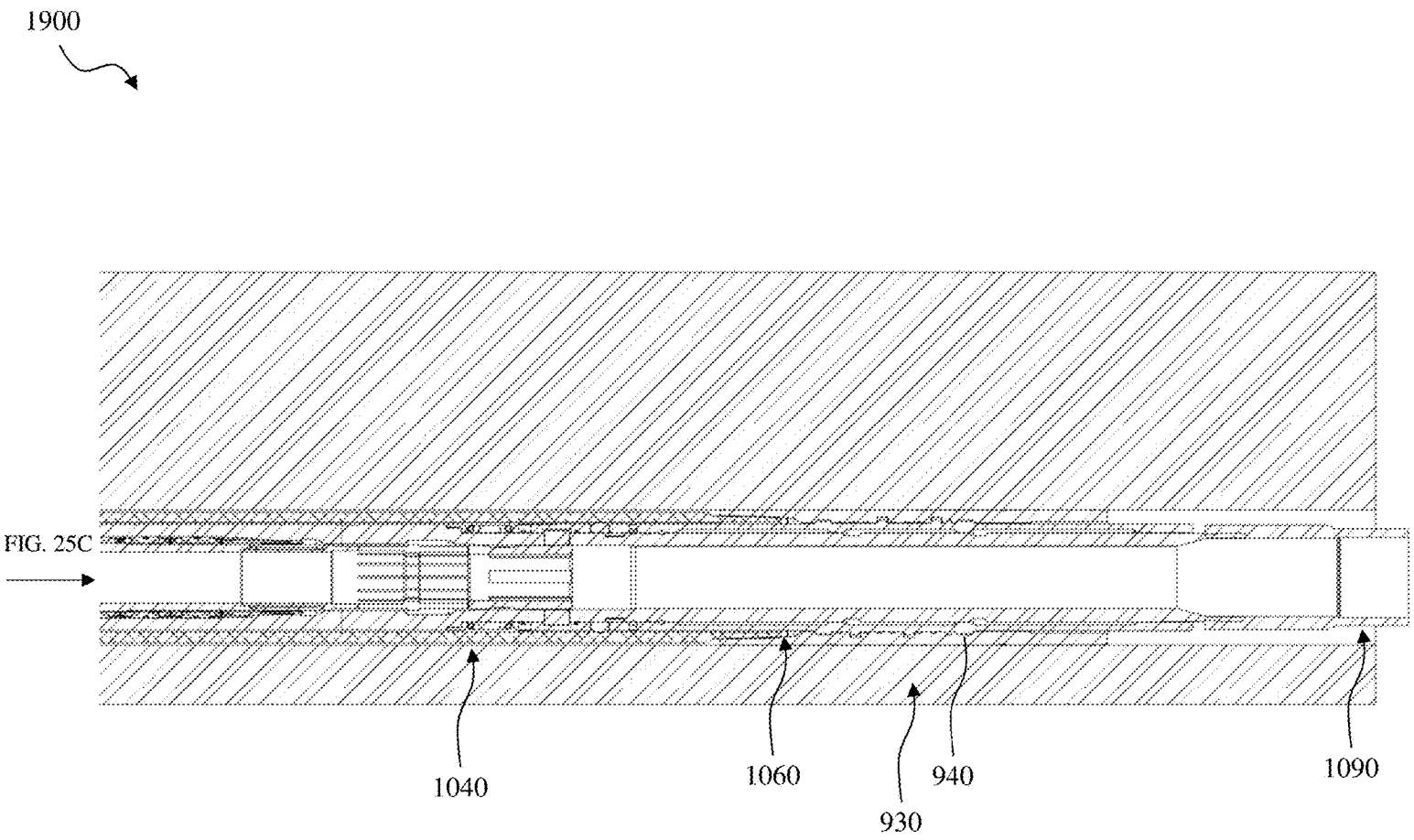
Figure 26A:
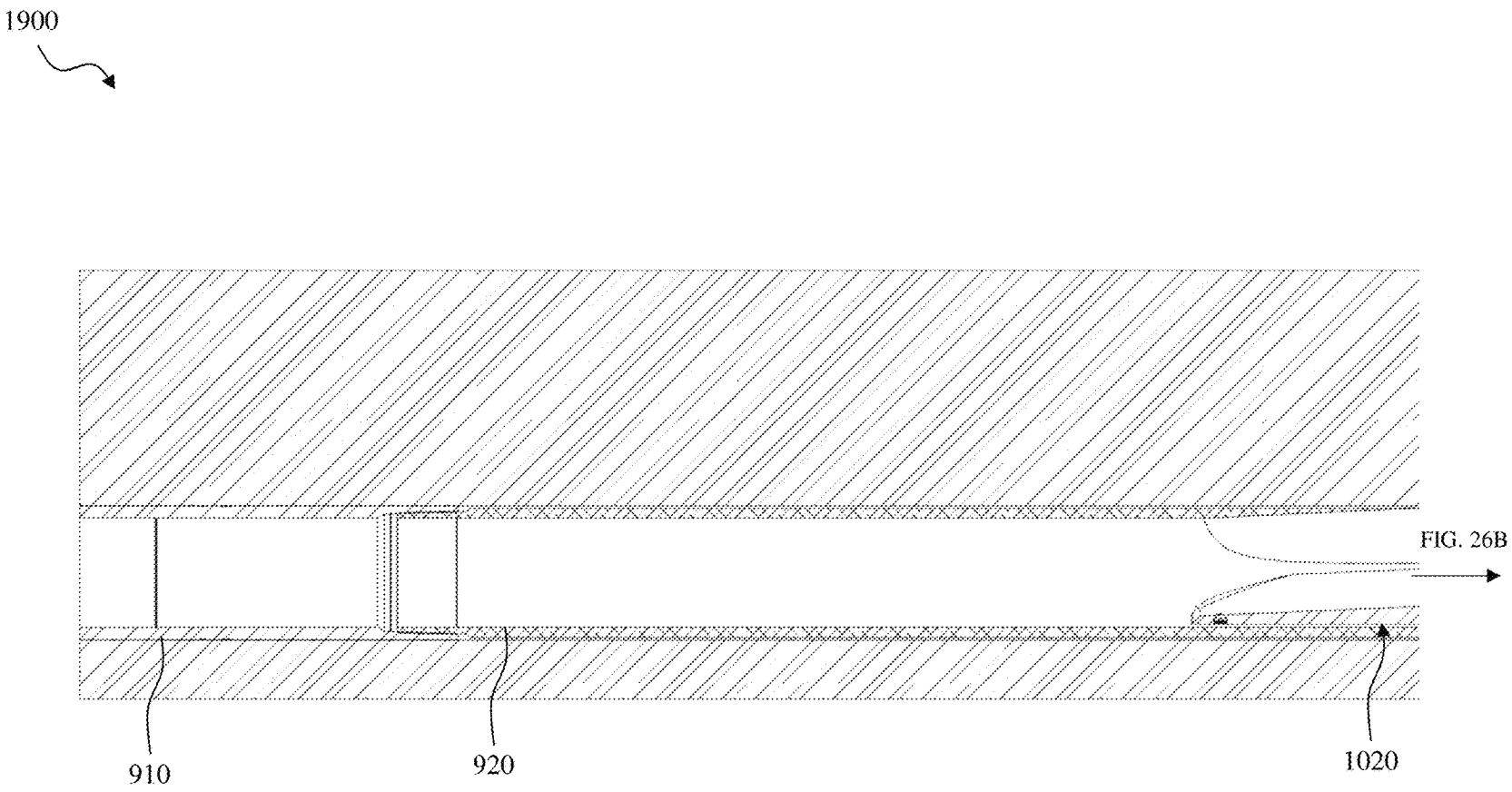
Figure 26B:
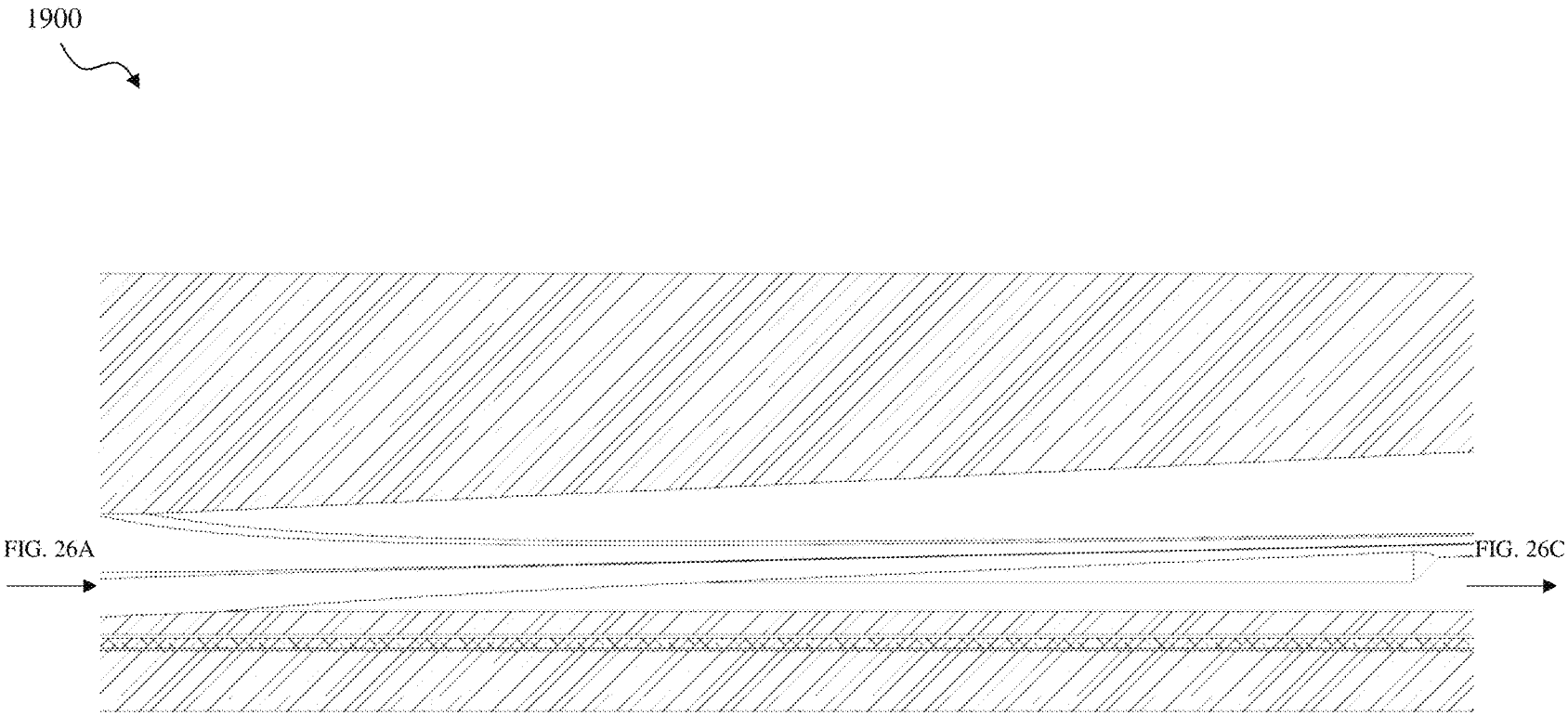
Figure 26C:
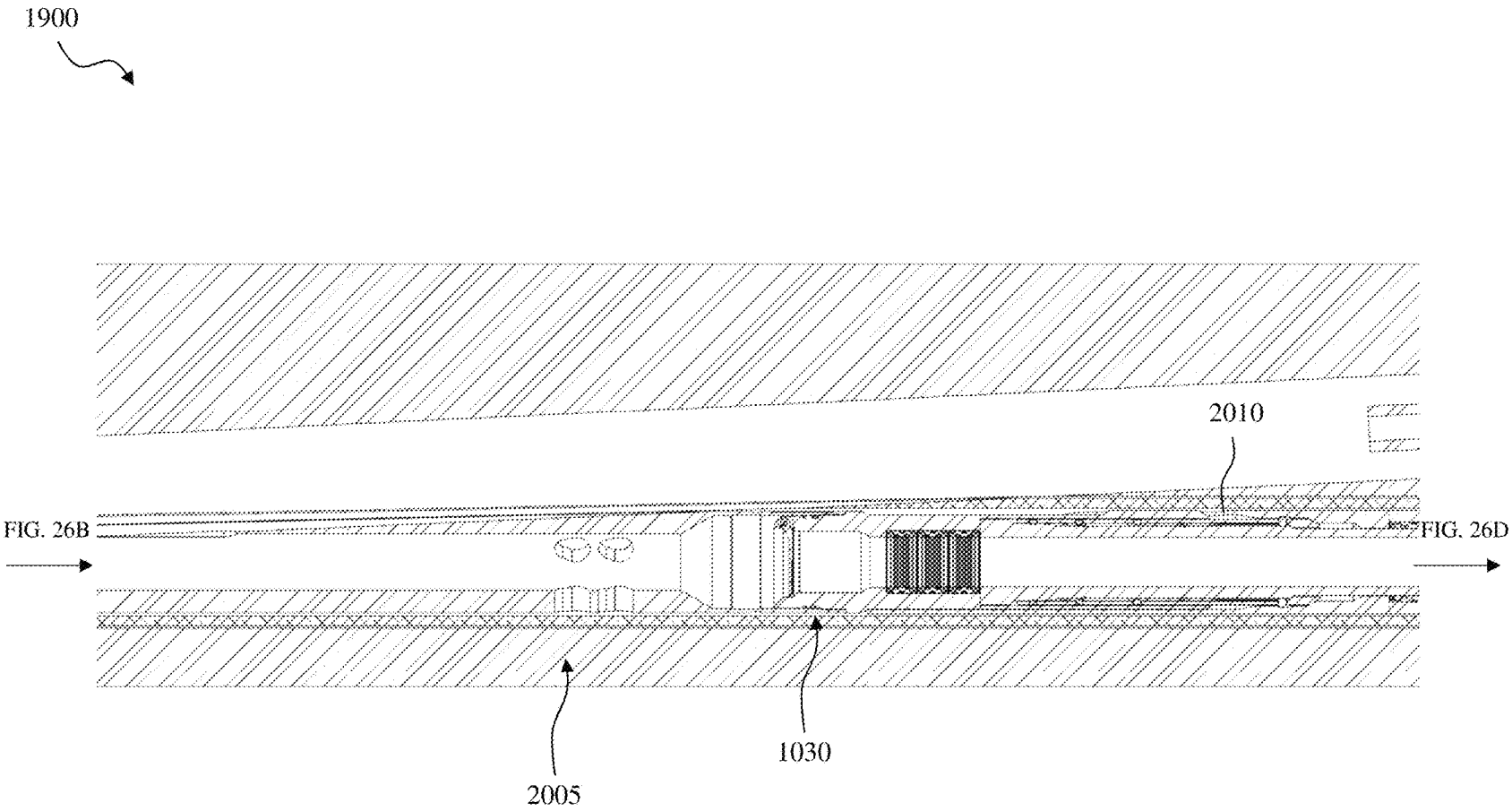
Figure 26D:
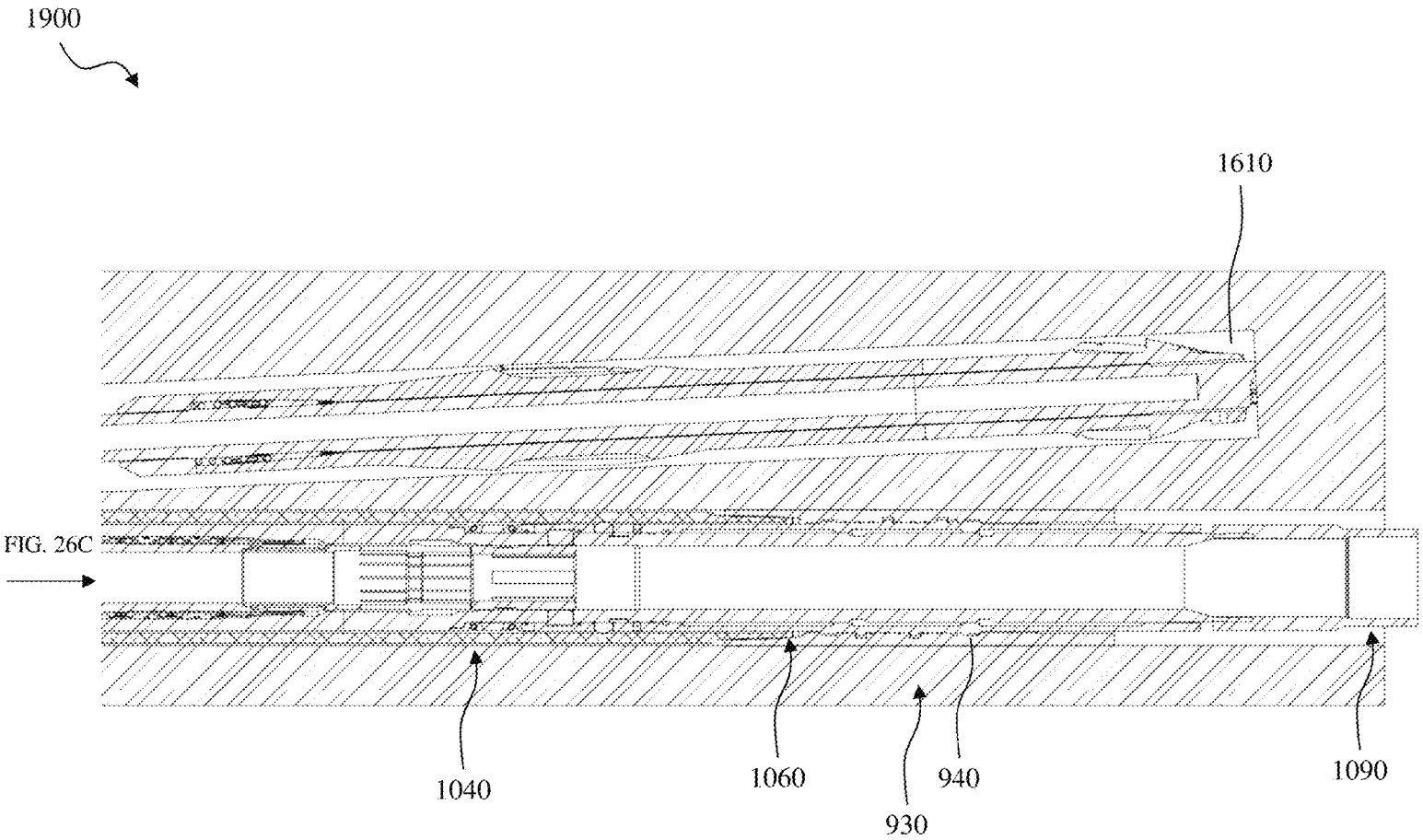
Figure 27A:
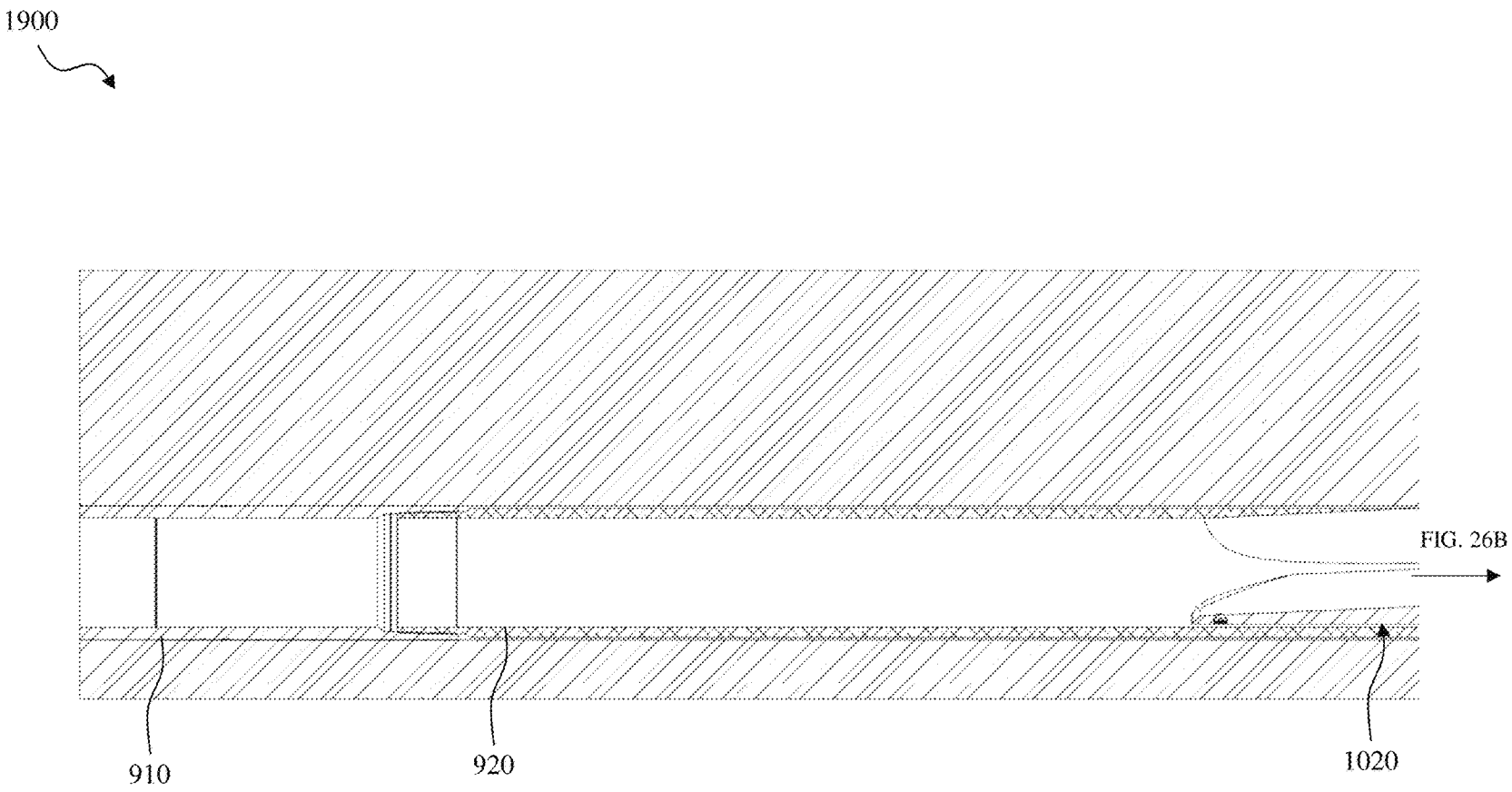
Figure 27B:
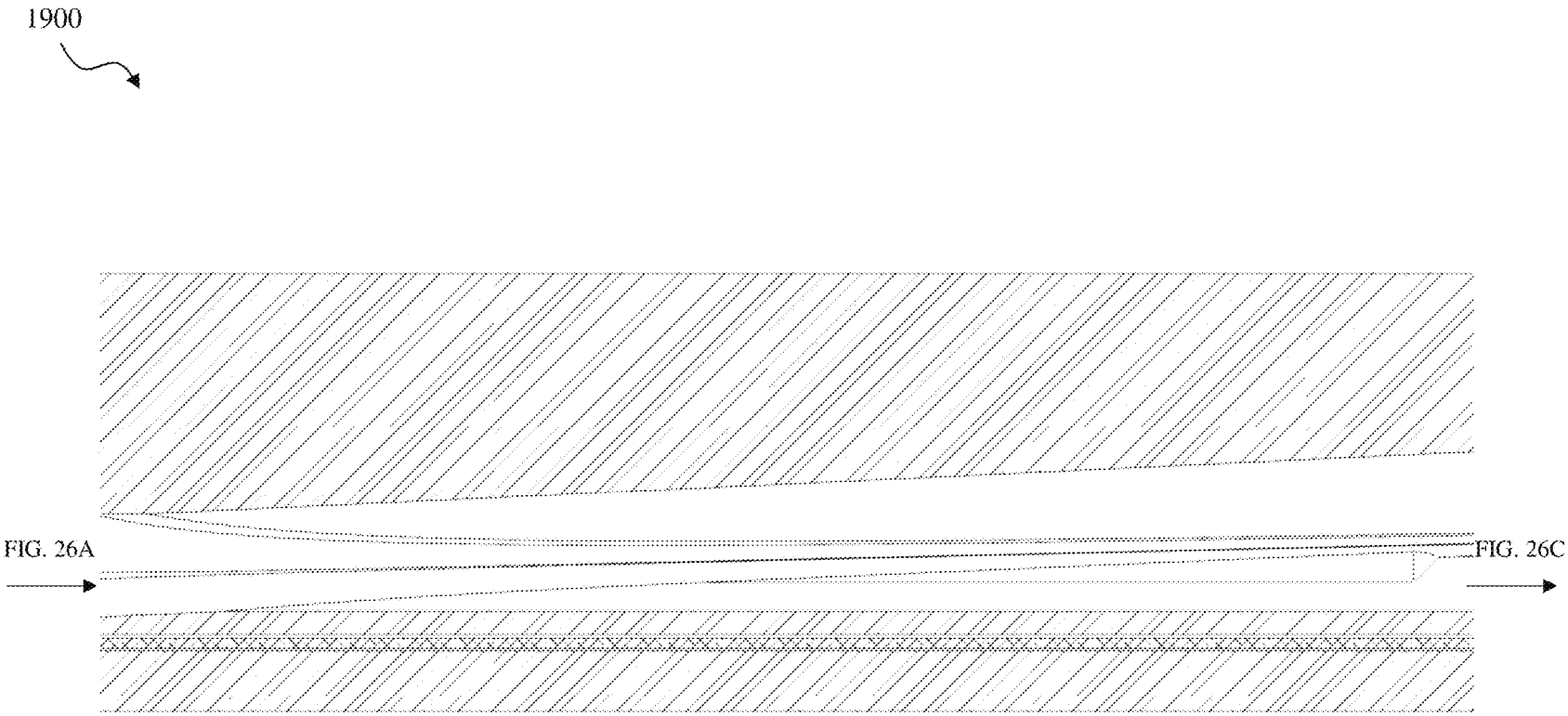
Figure 27C:
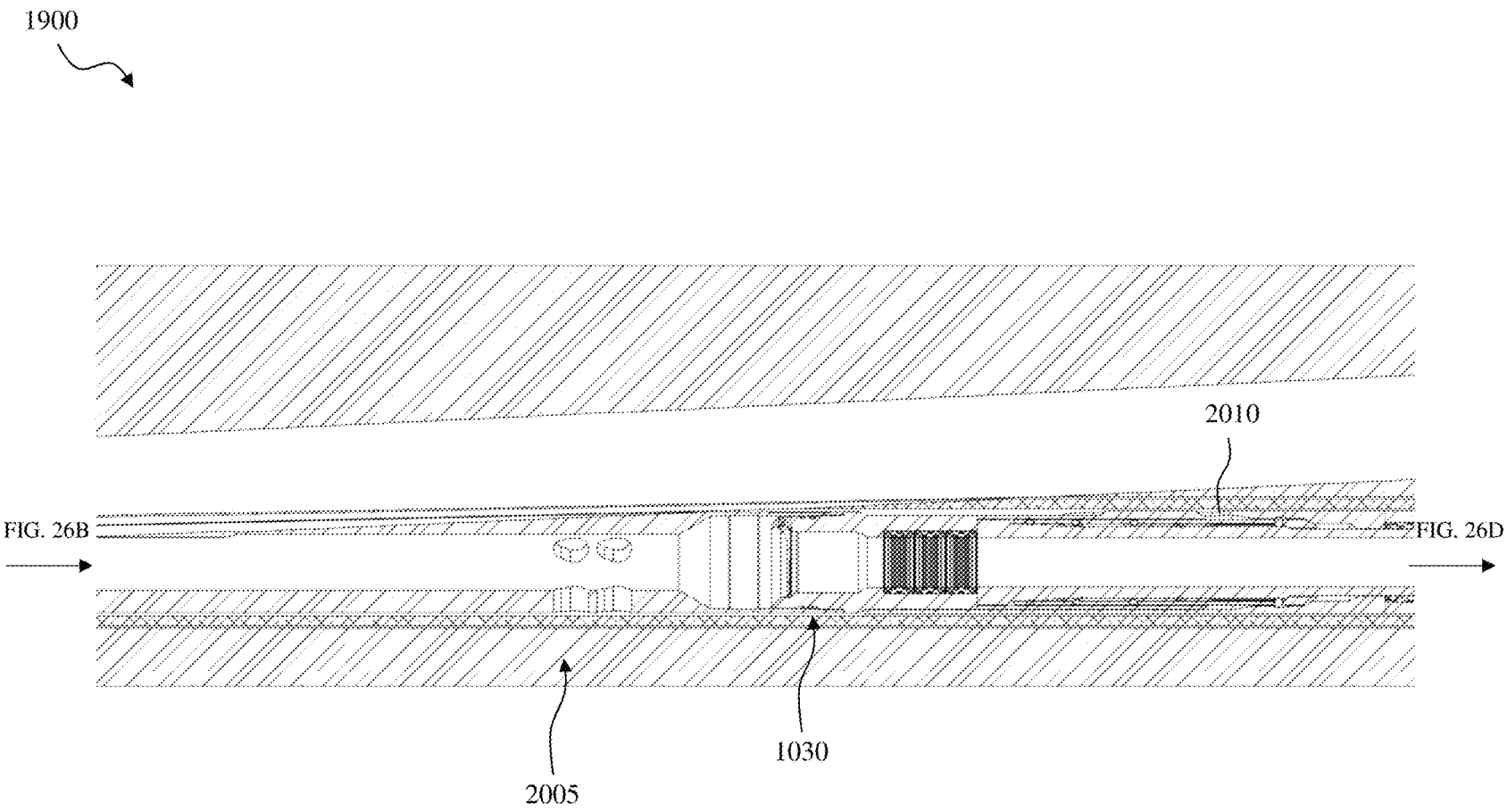
Figure 27D:
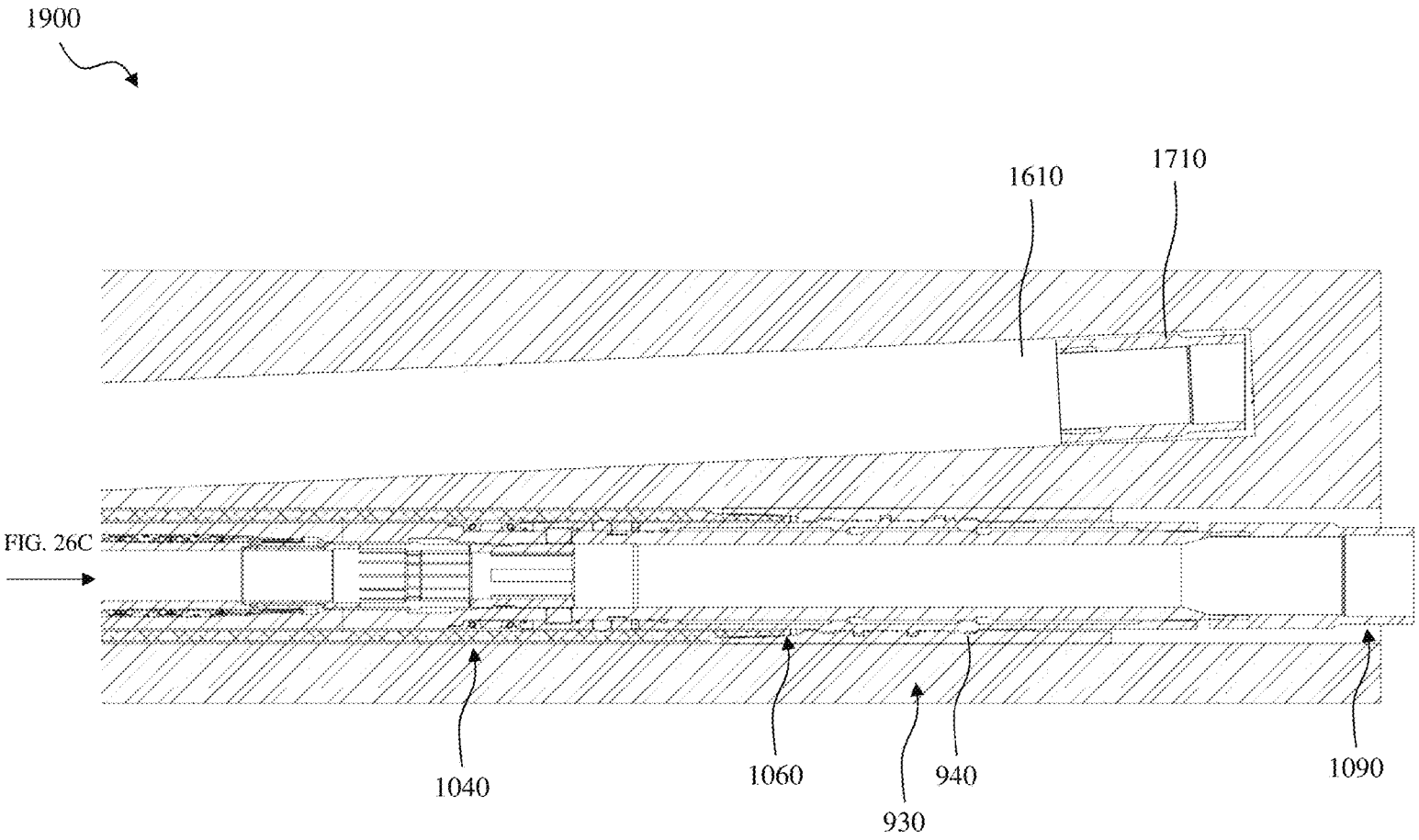
Figure 28A:
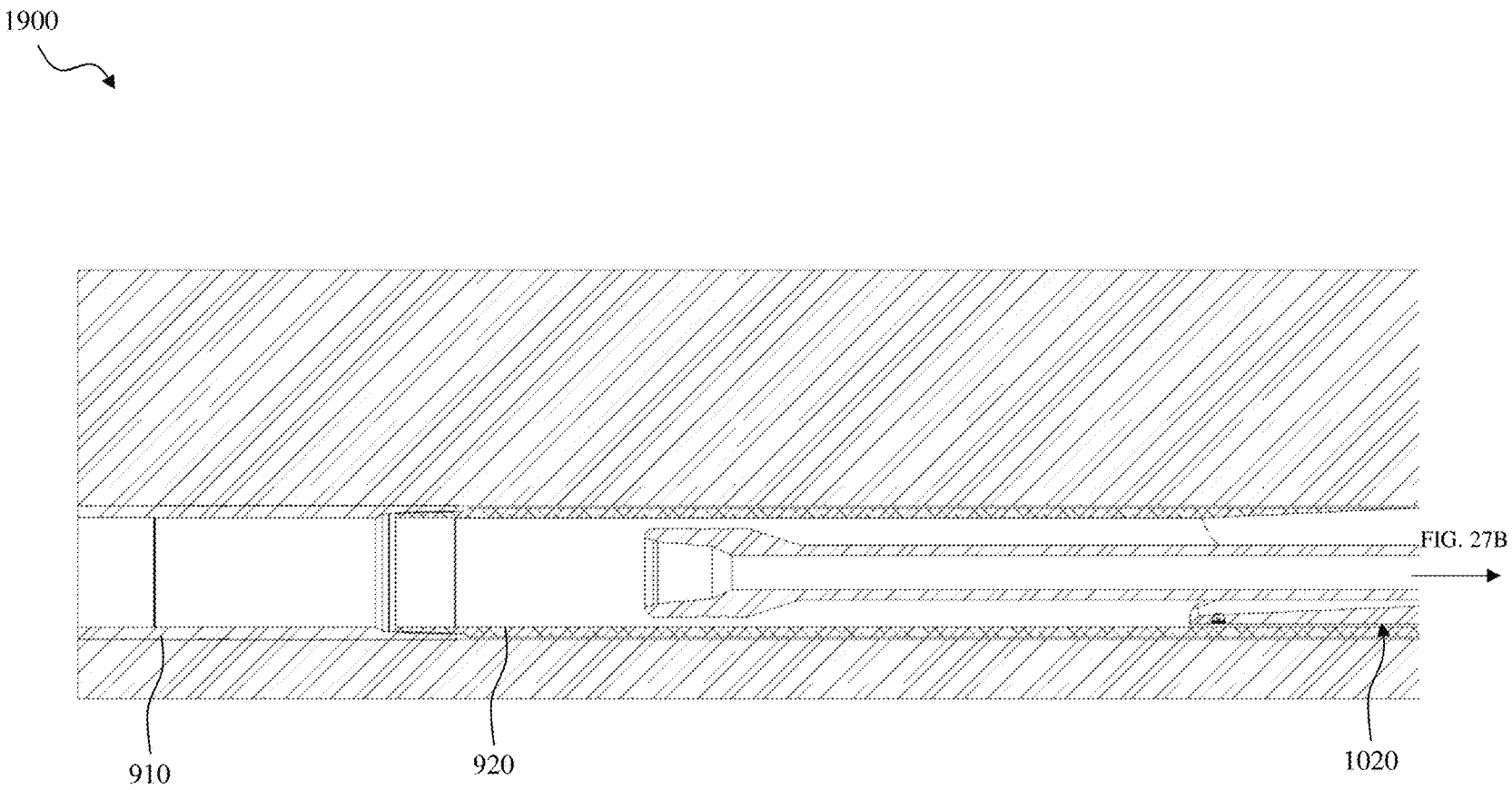
Figure 28B:
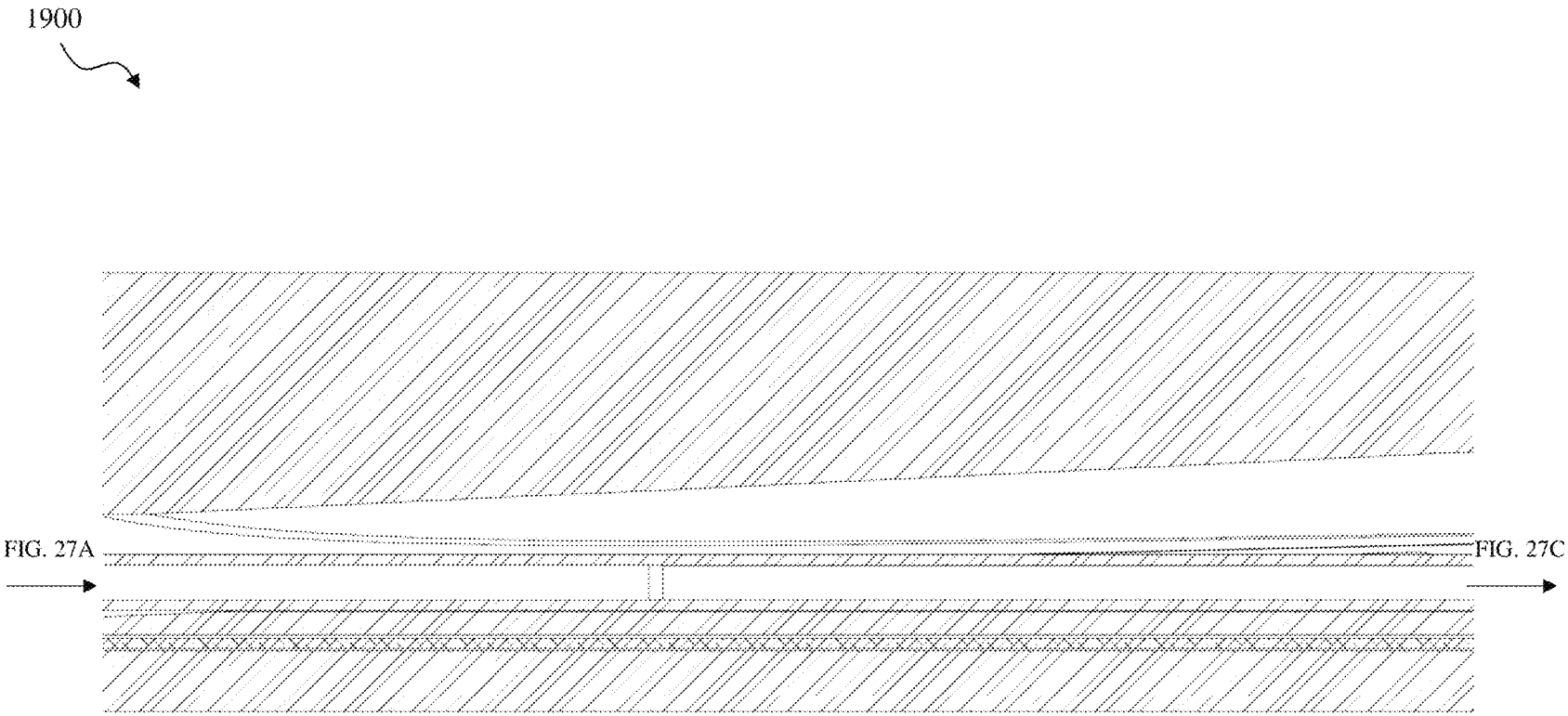
Figure 28C:
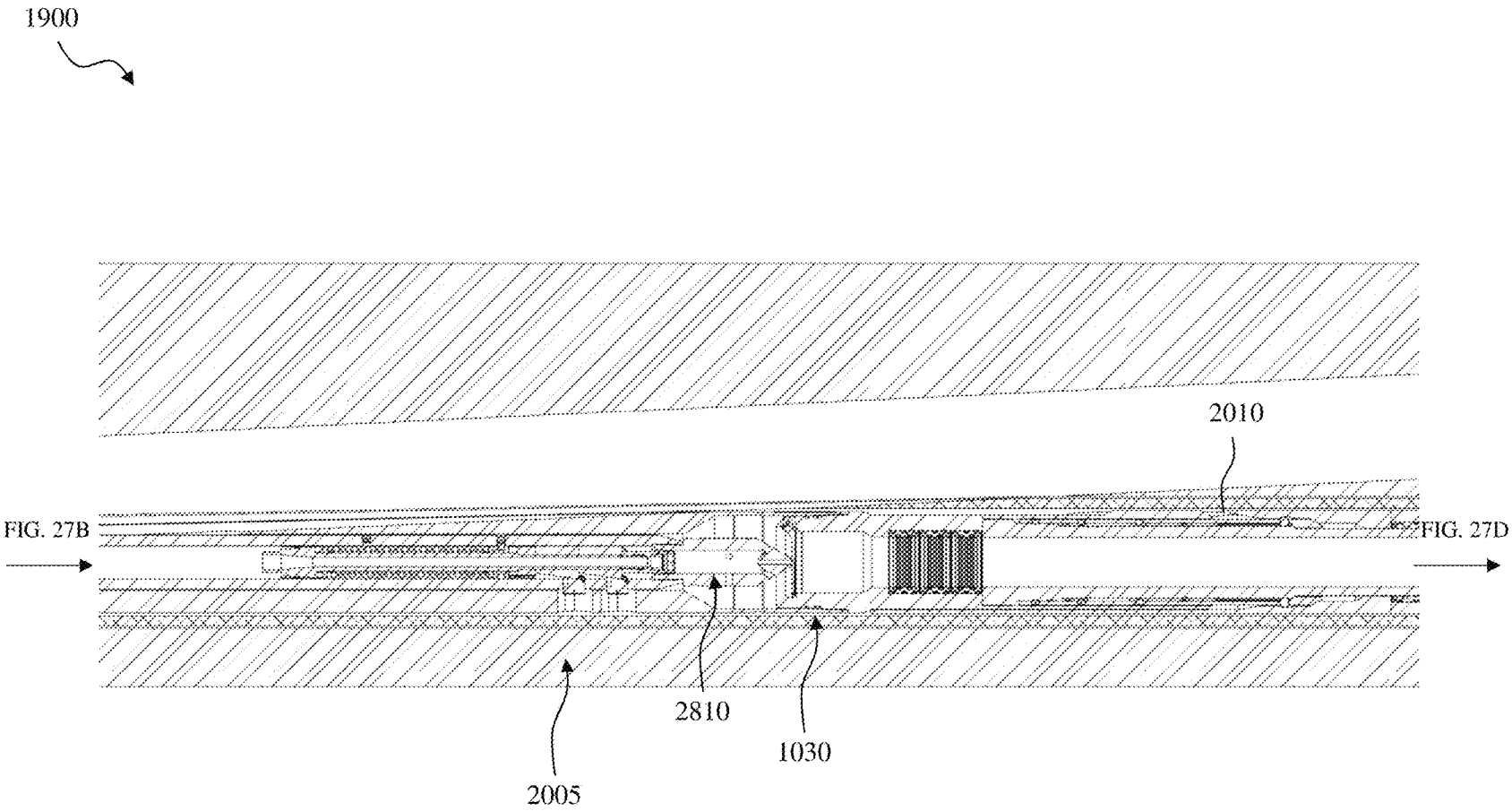
Figure 28D:
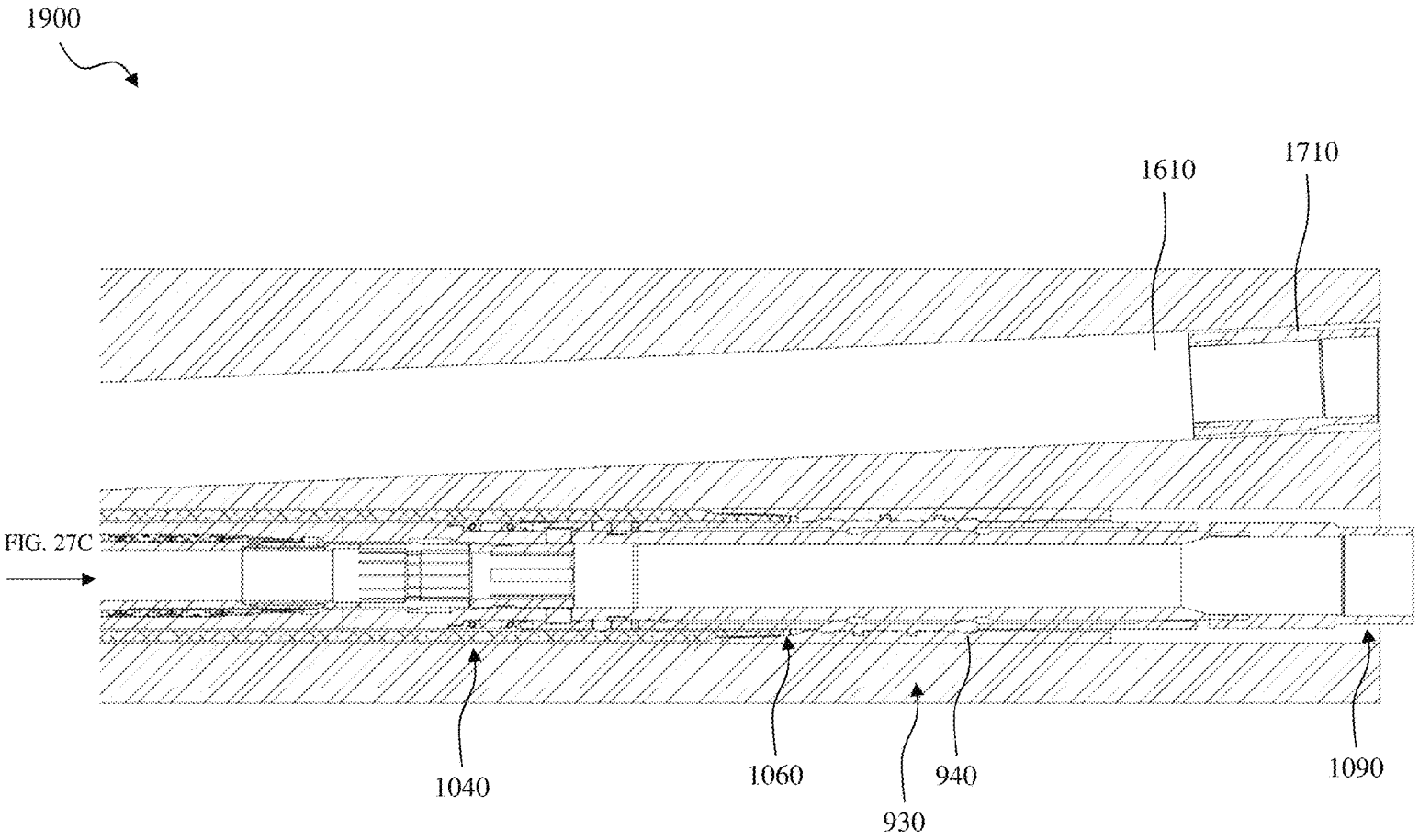
Figure 29A:
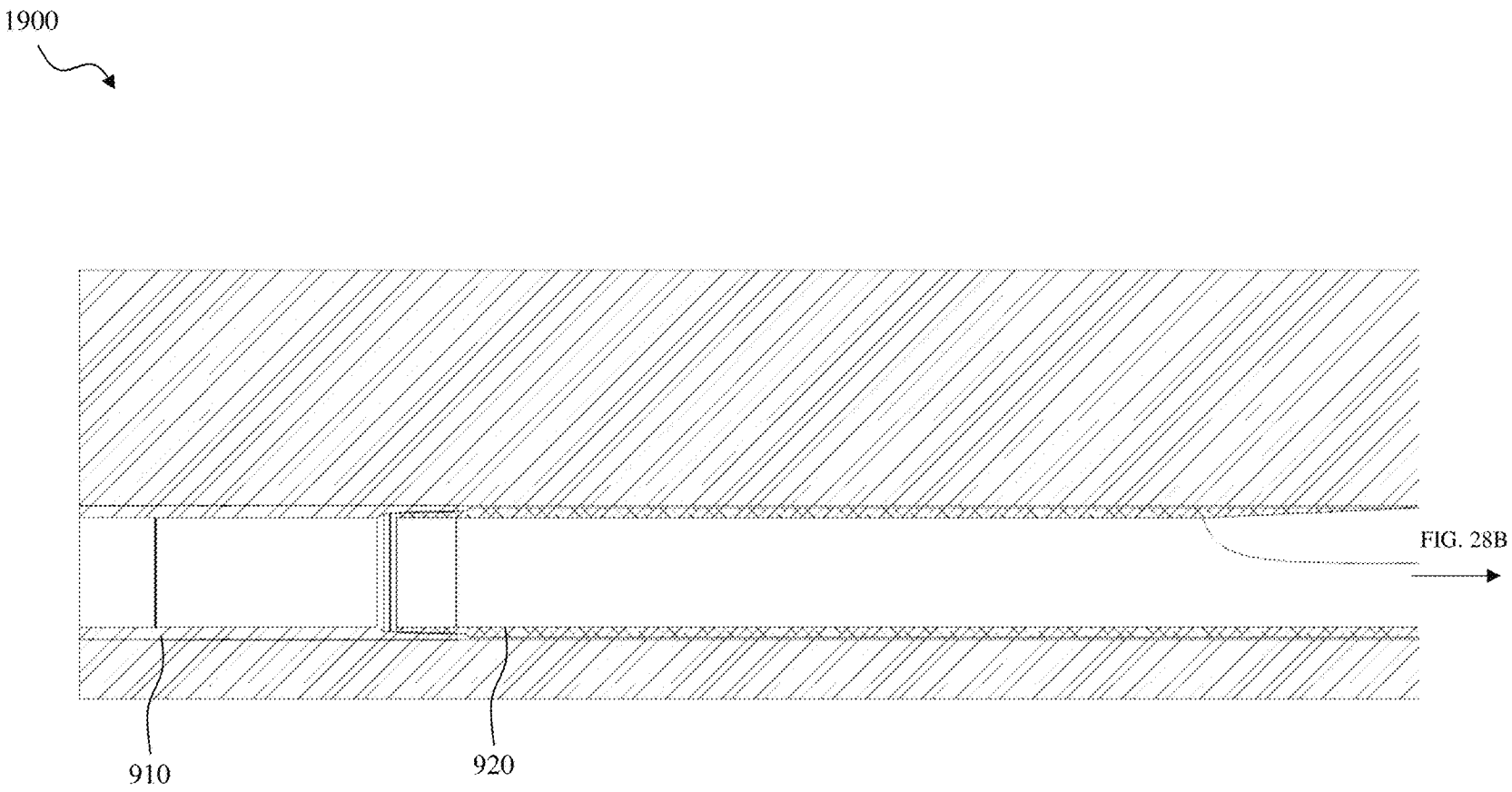
Figure 29B:
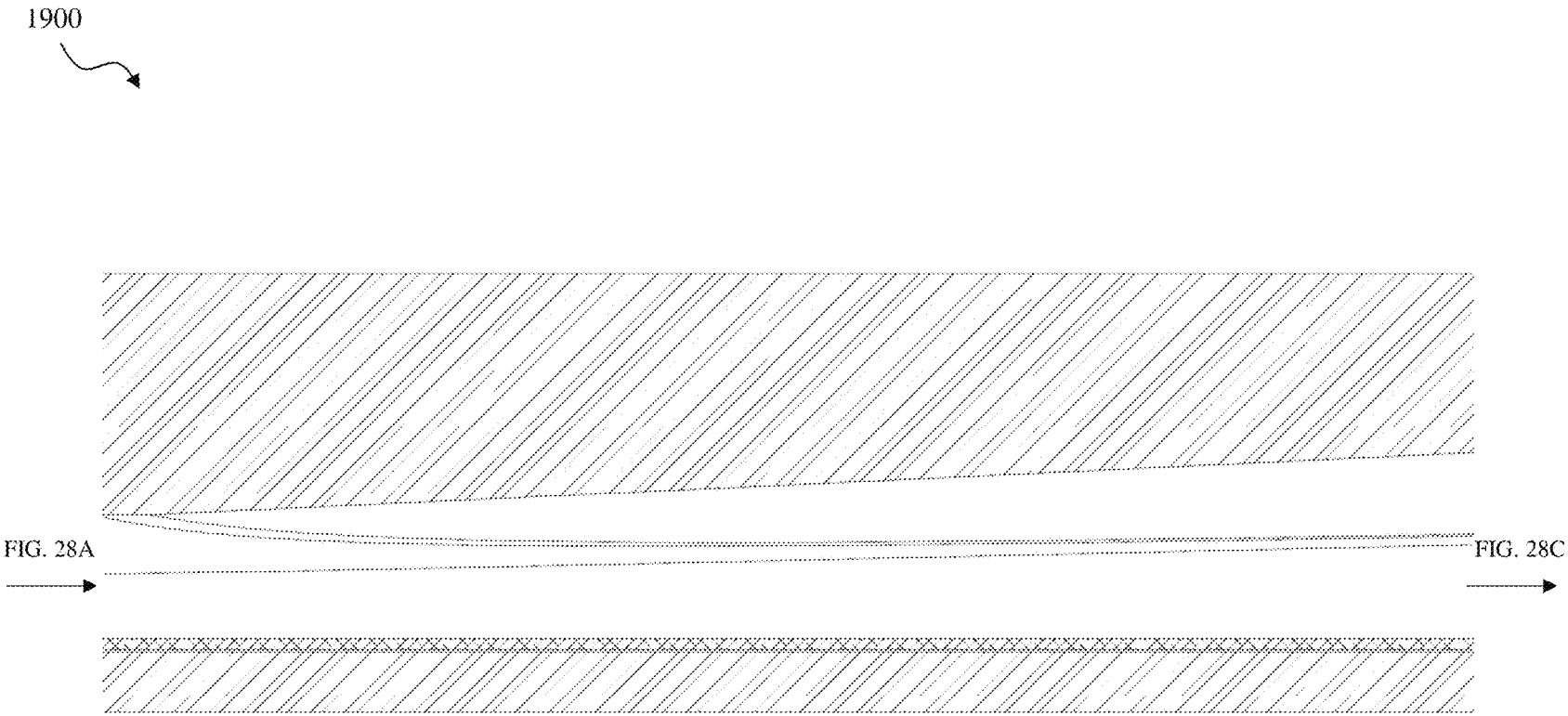
Figure 29C:
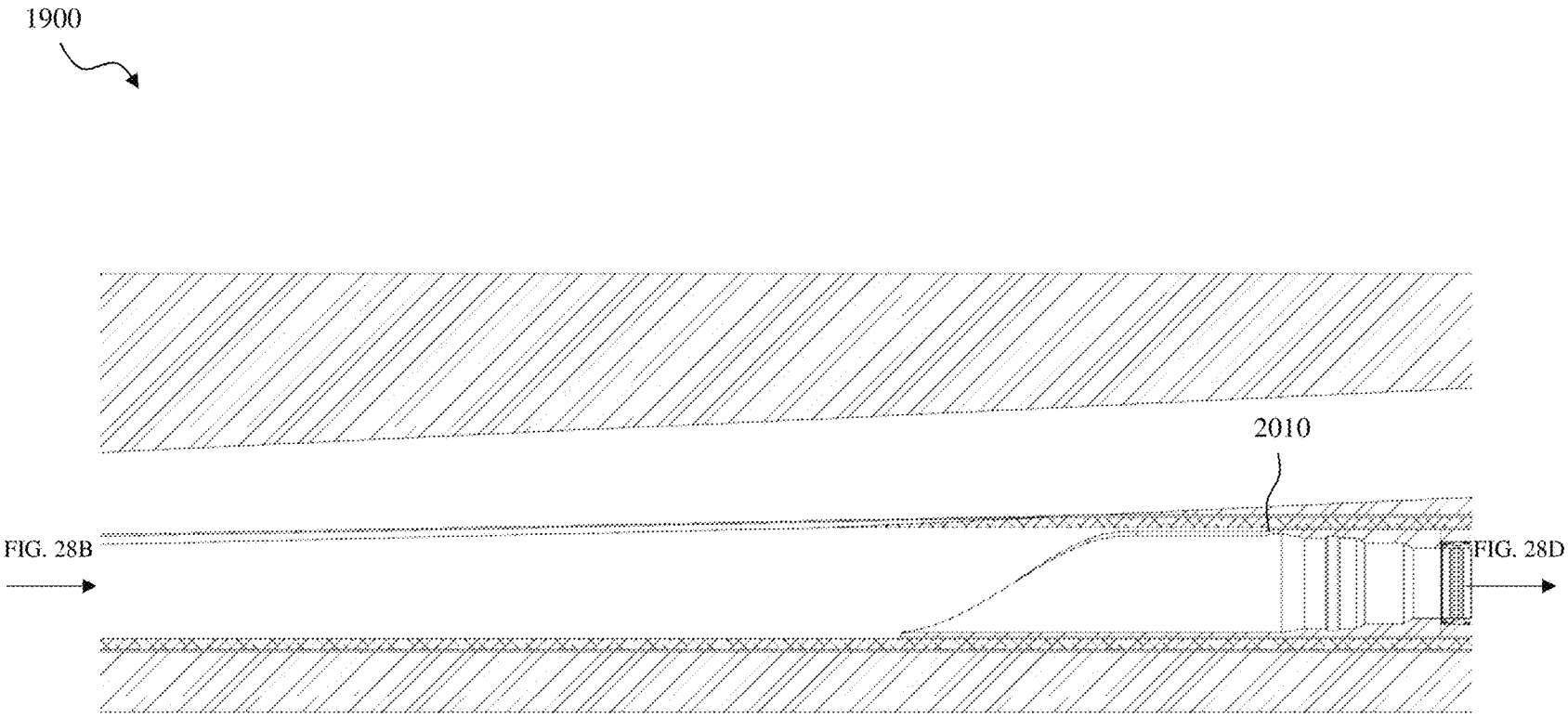
Figure 29D:
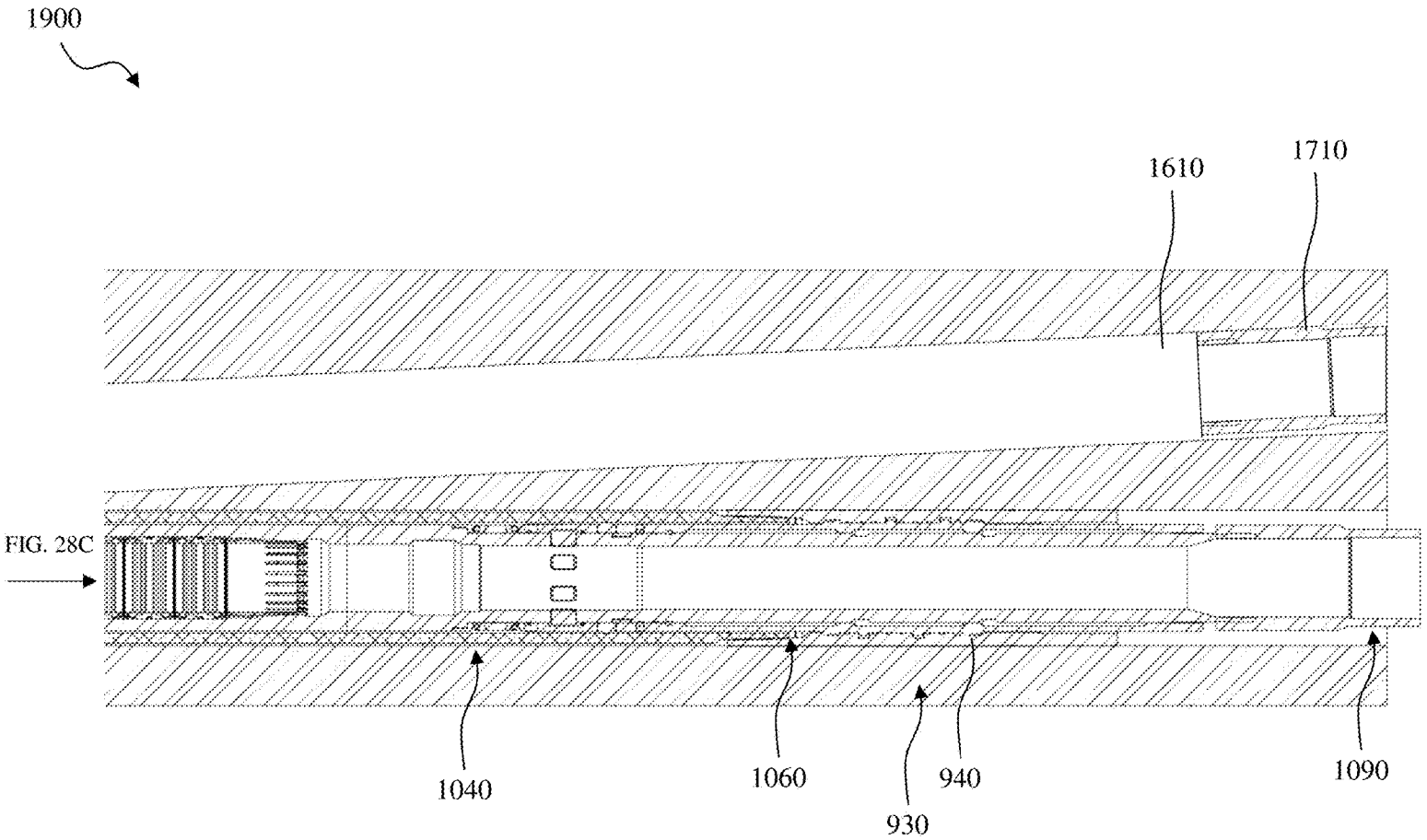
Figure 30A:
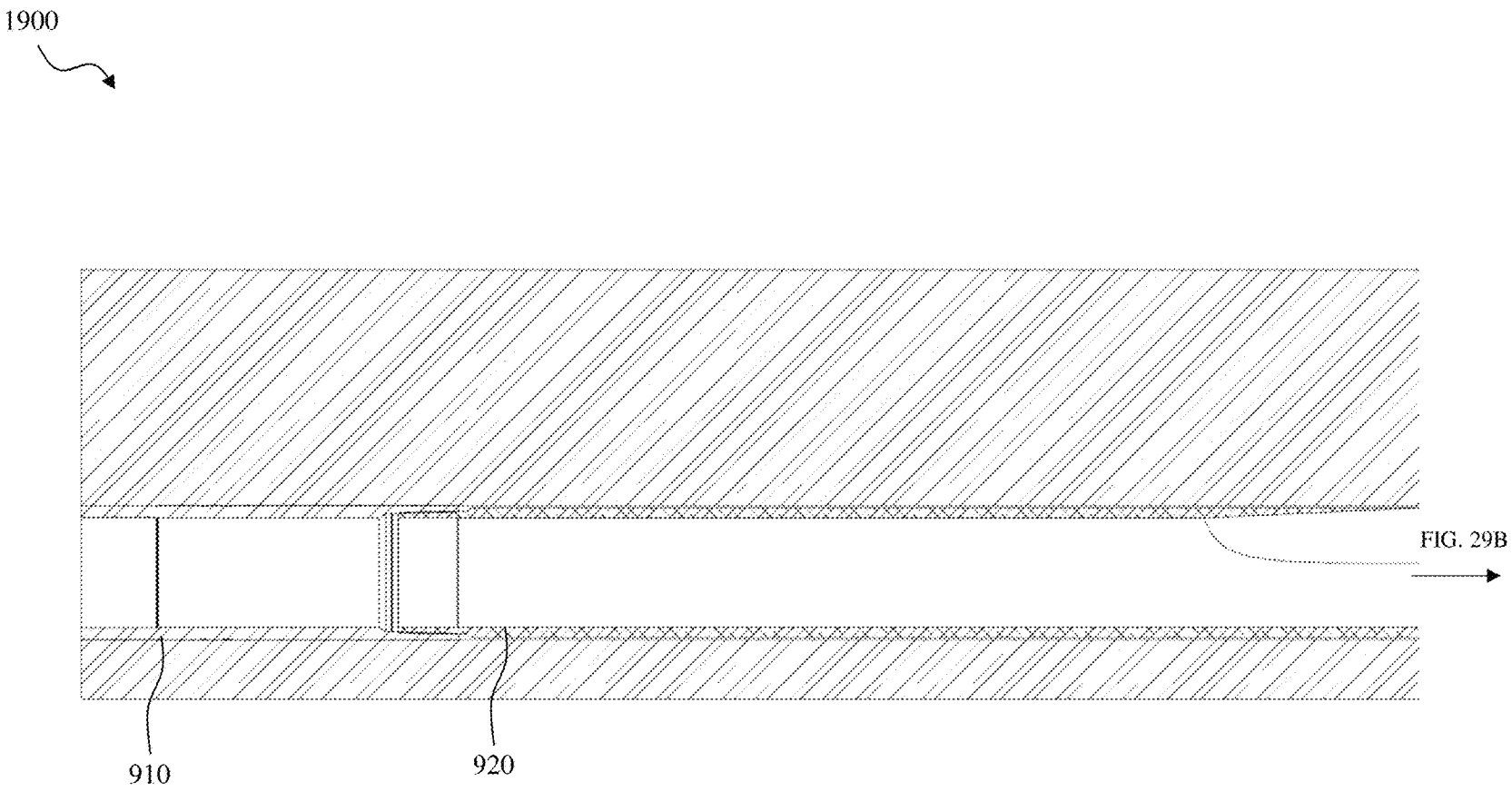
Figure 30B:
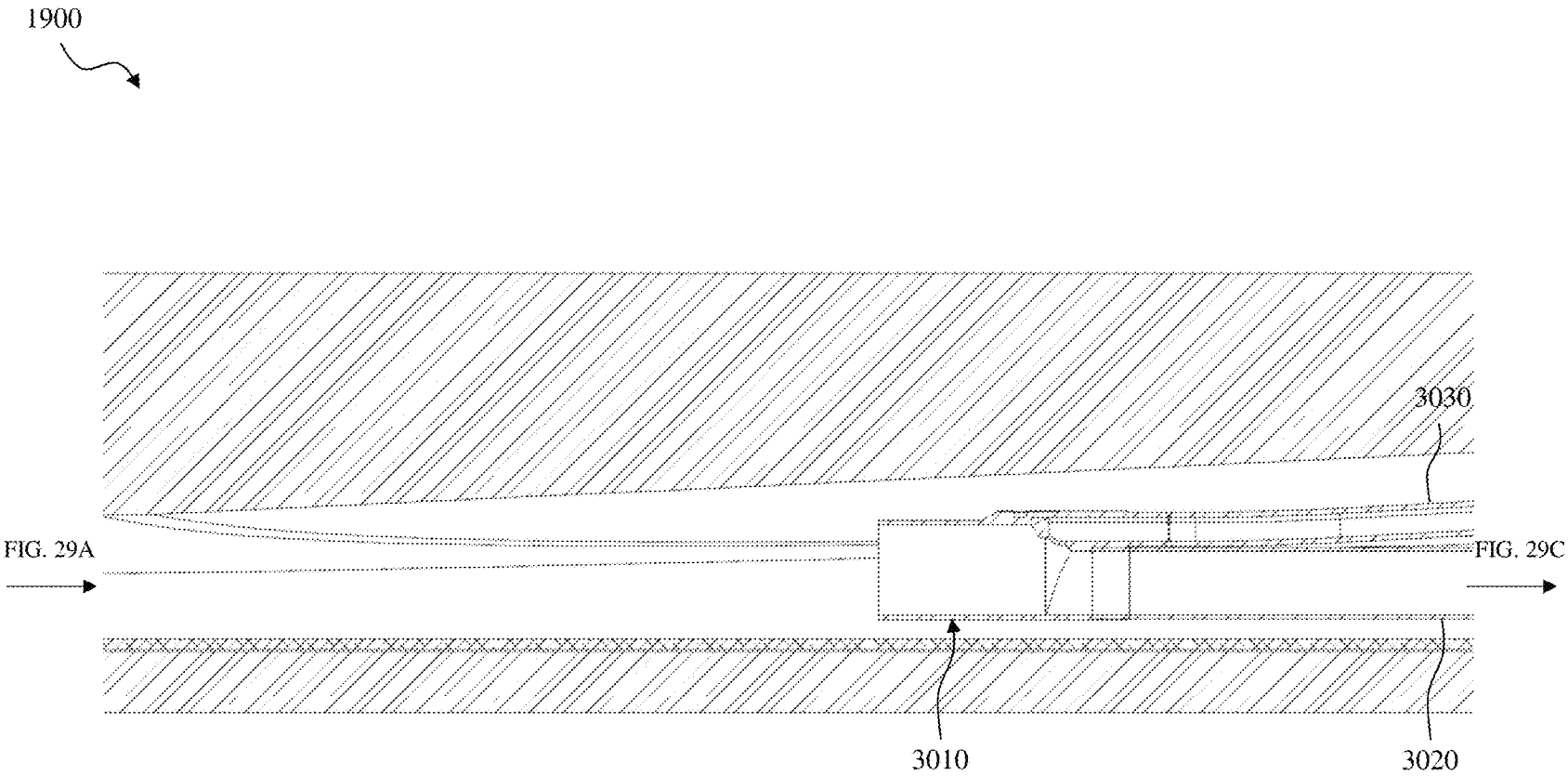
Figure 30C:
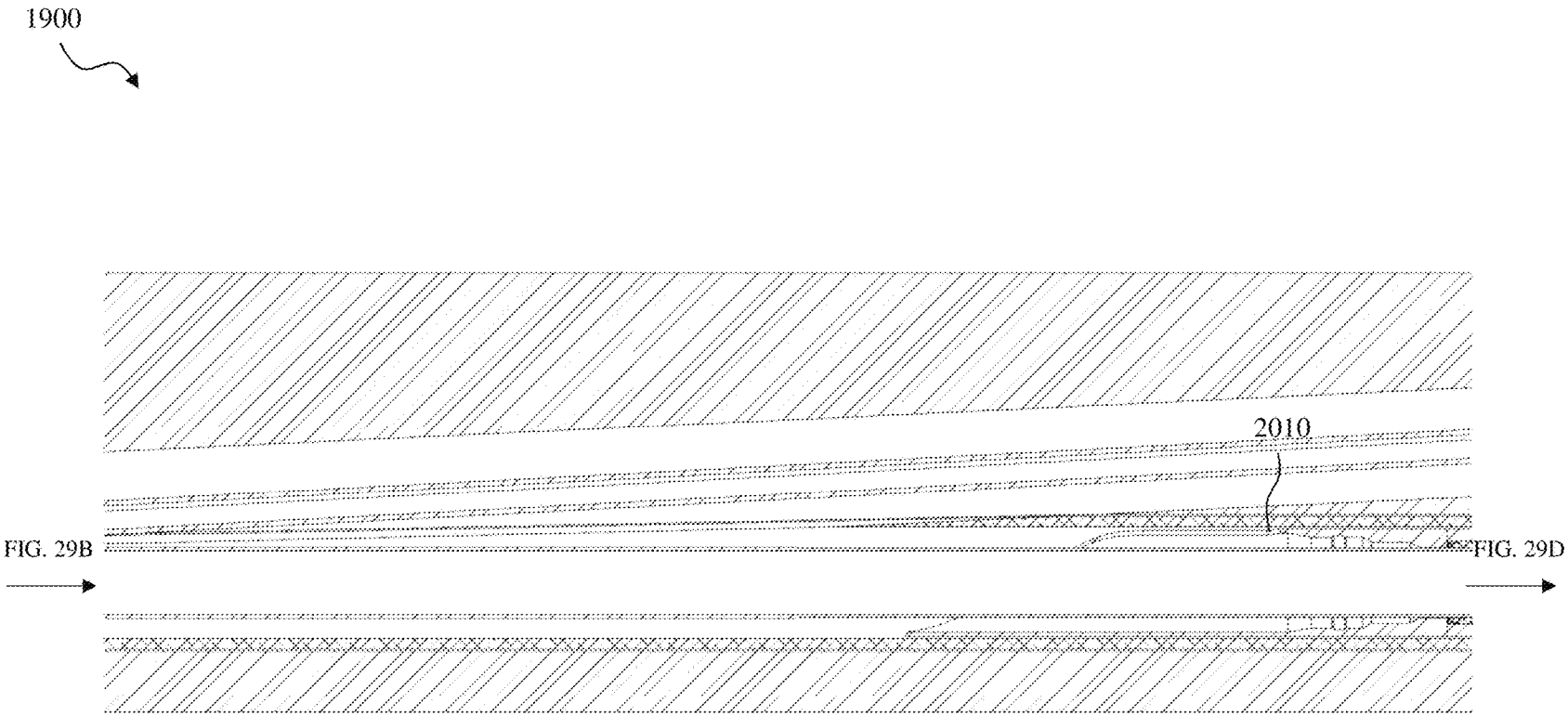
Figure 30D:
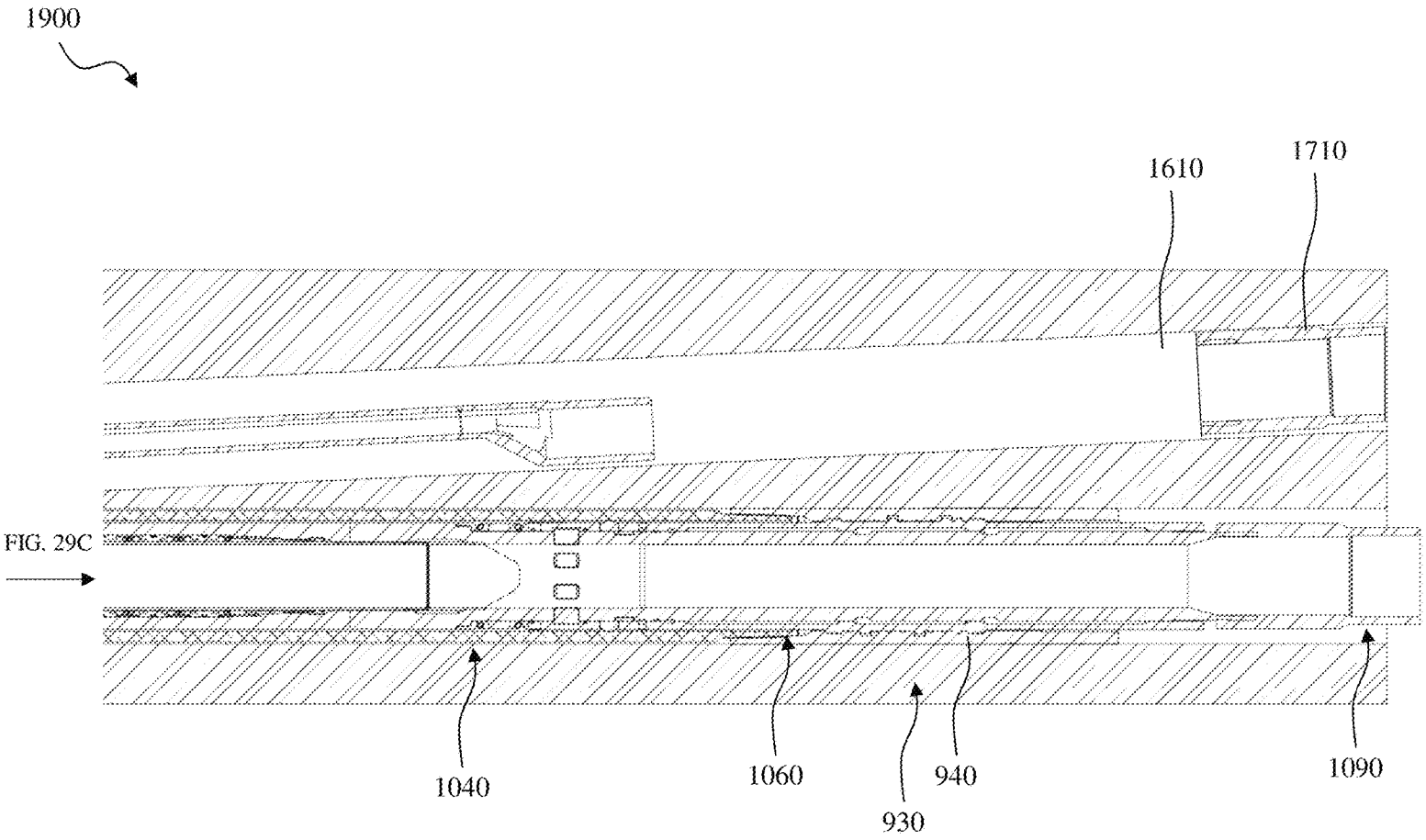
Figure 31A:
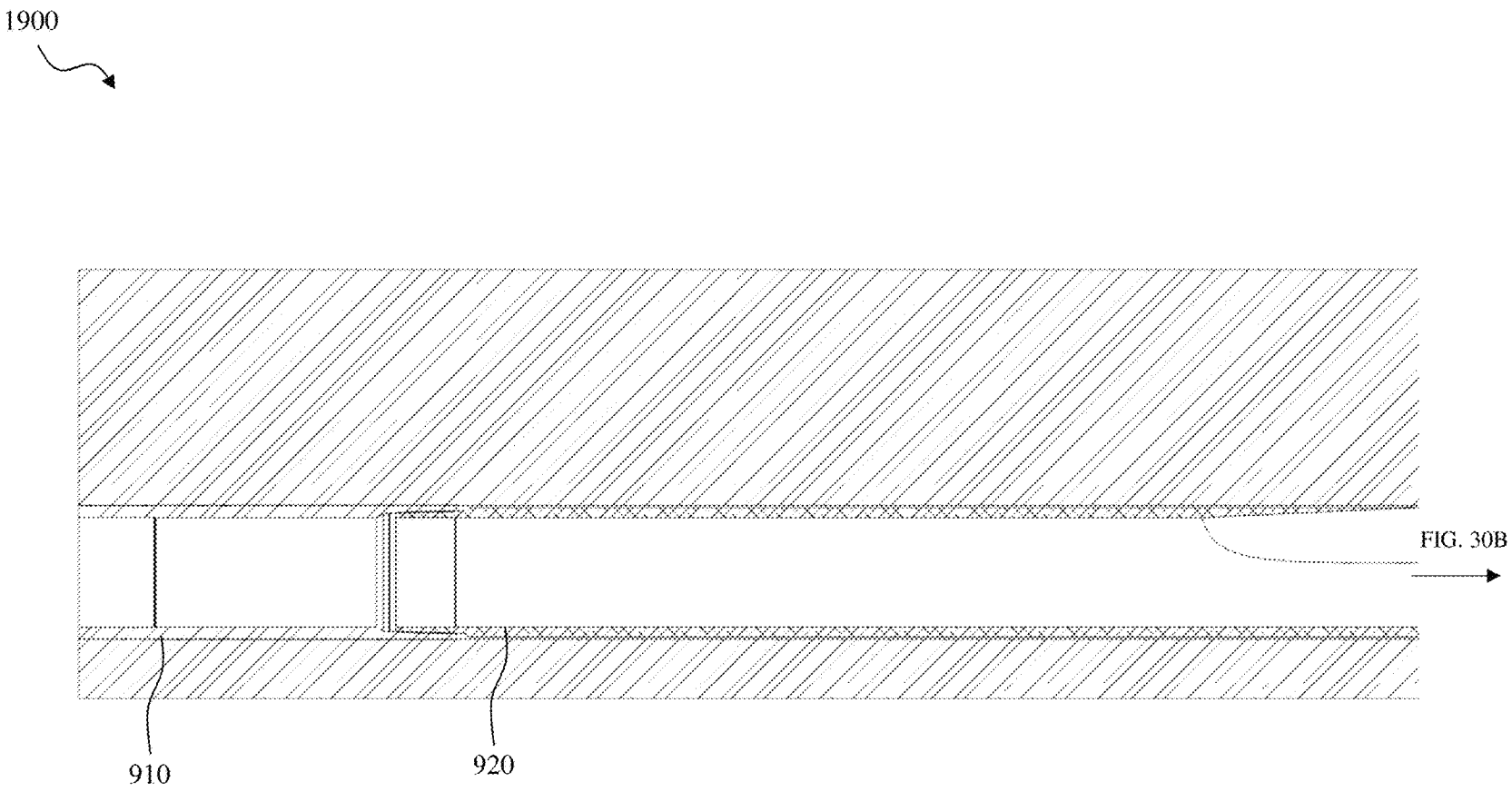
Figure 31B:
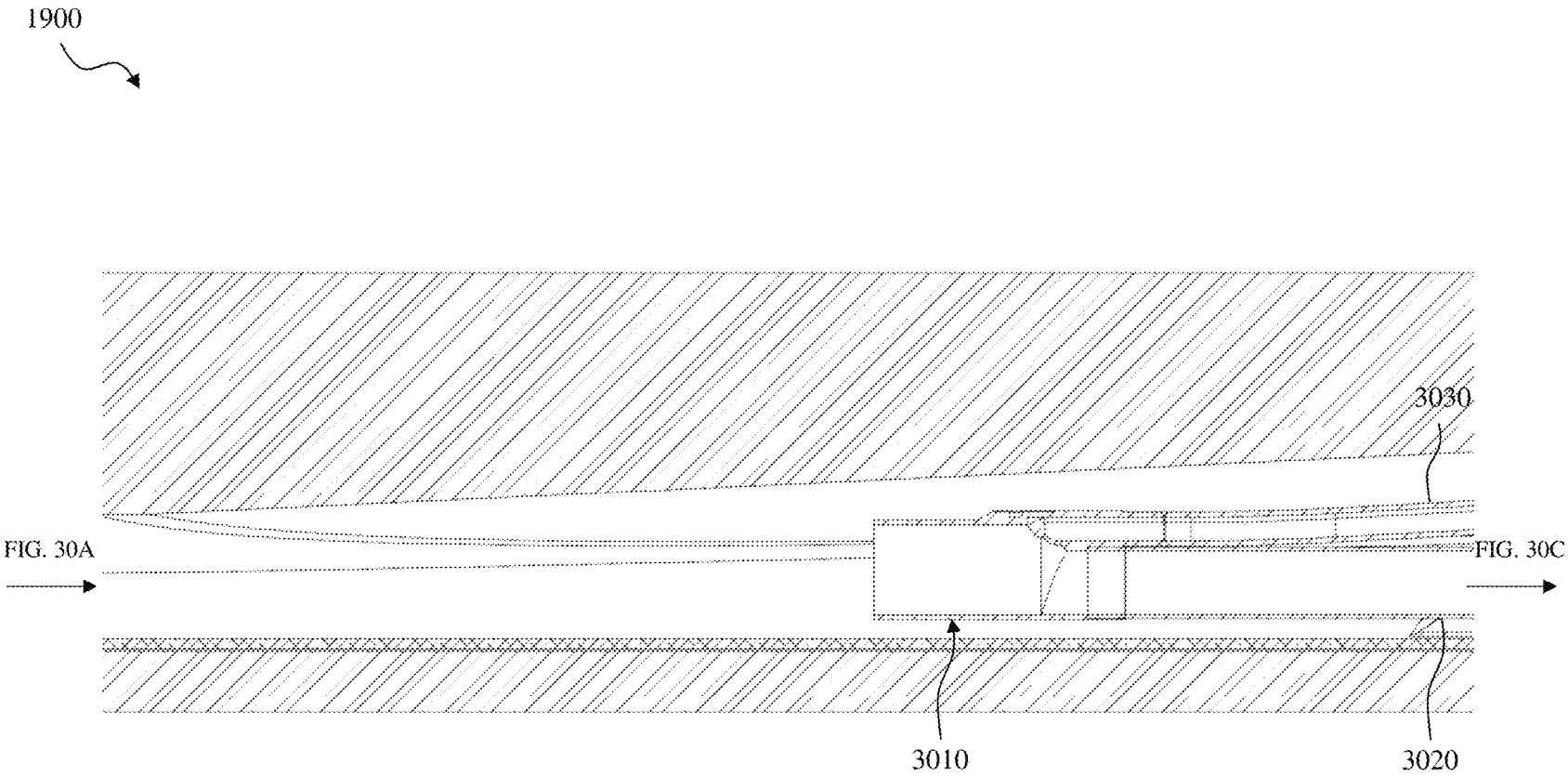
Figure 31C:
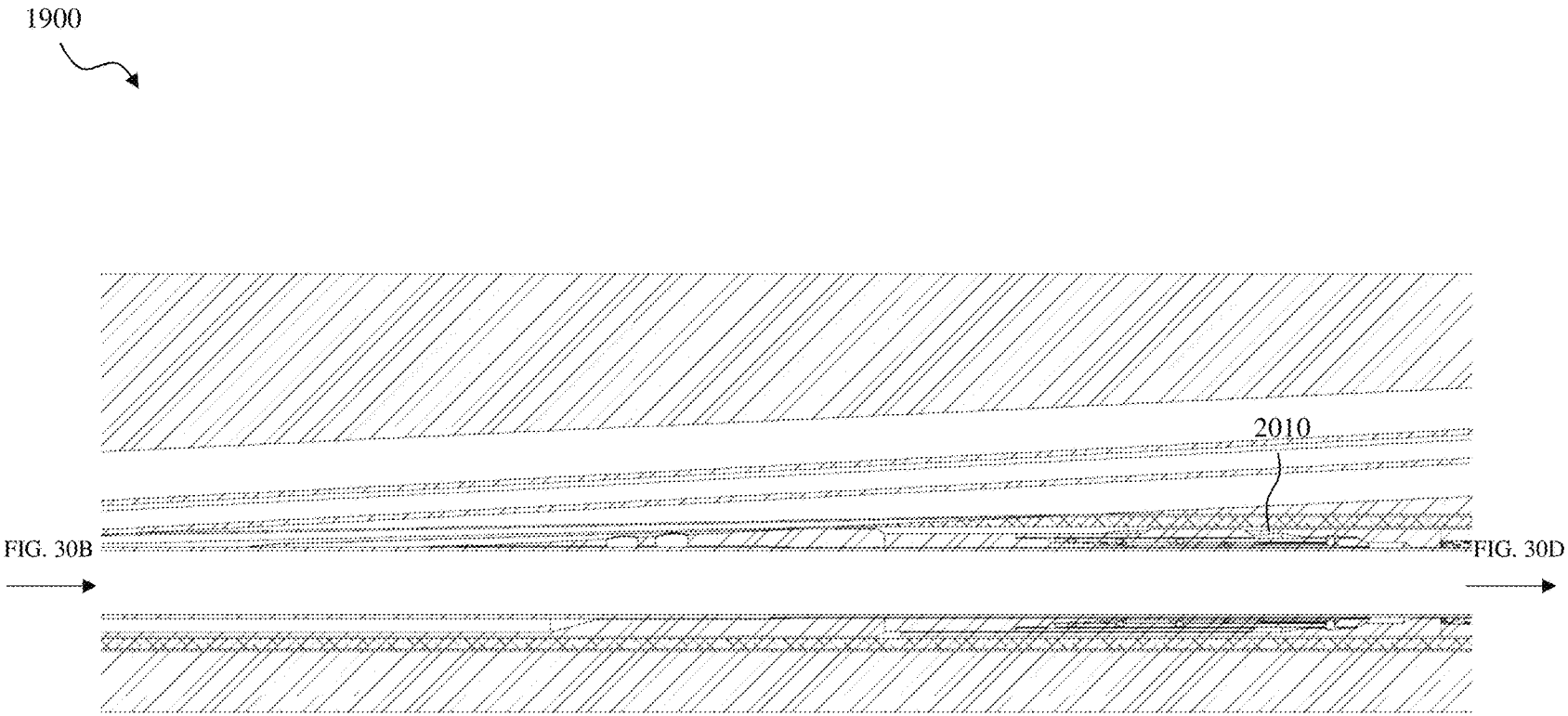
Figure 31D:
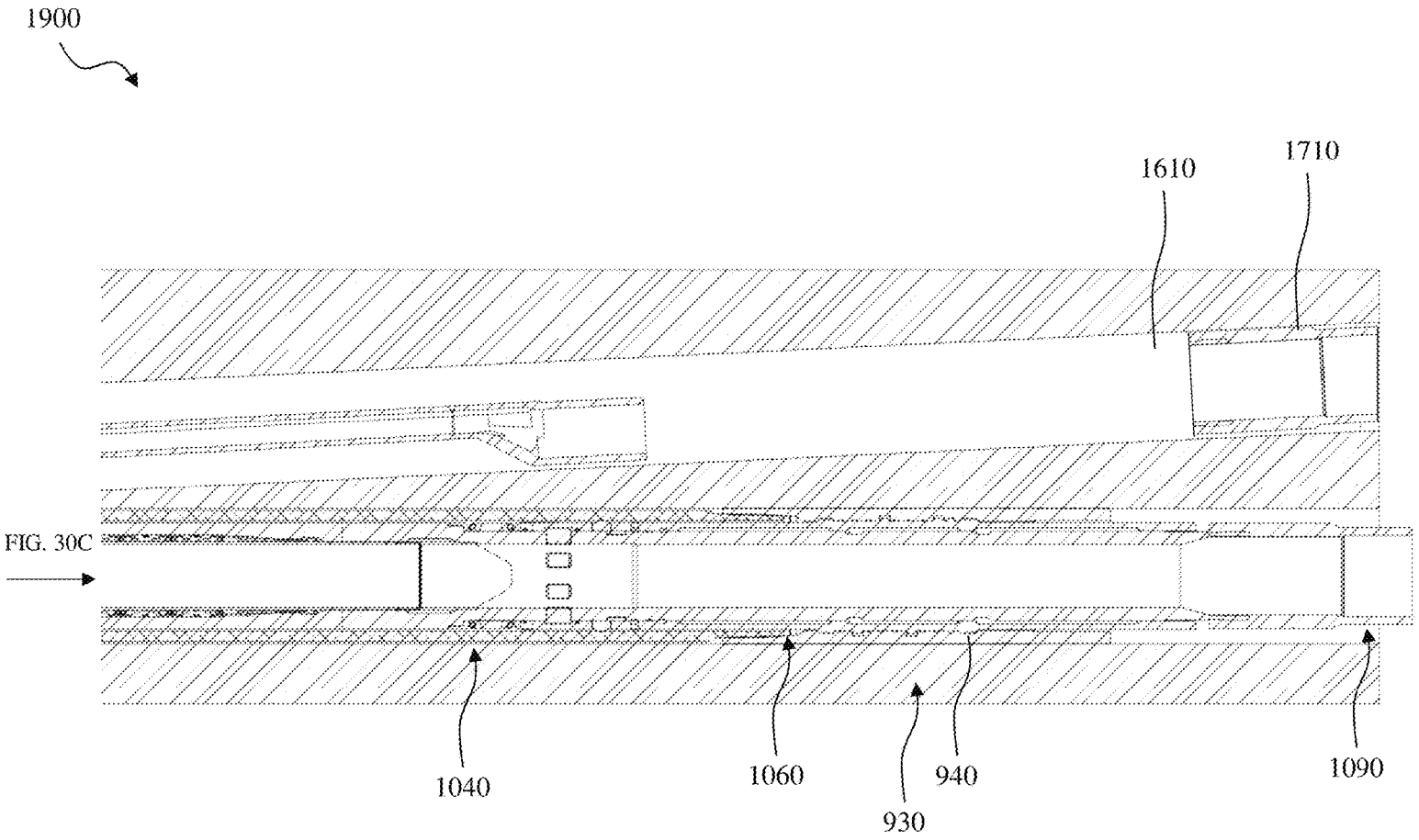

Further to the embodiment of FIGS. 8A through 8D, the wedge feature is a segmented cone 860. For example, in the illustrated embodiment of FIG. 8D, the segments of the segmented cone 860 alter between downhole and uphole ends. Unique to the present disclosure, in at least one embodiment, each segment of the segmented cone 860 has a first profile that engages with a second related profile on a radial exterior surface of the smaller assembly 820 or a radial interior surface of the larger bit assembly 830, the first profile and the second related profile rotationally fixing the smaller assembly 820 and the larger bit assembly 830 when forming the combined bit assembly 840, as shown in FIG. 8C In yet another embodiment, each segment of the segmented cone 860 has a first profile that engages with both a second related profile on a radial exterior surface of the smaller assembly 820 and a third related profile a radial interior surface of the larger bit assembly 830, the first profile, second related profile and the third related profile rotationally fixing the smaller assembly 820 and the larger bit assembly 830 when forming the combined bit assembly 840, as further shown in FIG. 8C.

In the embodiment of FIGS. 8A through 8D, a spring member 870 is positioned in the annular space 825 between a shoulder 835 of the larger bit assembly 830 and the wedge feature. The spring member 870, in one or more embodiments, is configured to maintain the one way mechanism in a desired state (e.g., downhole state in the illustrated embodiment). The smaller assembly 820 of the two-part drilling and running tool 800, in one or more embodiments, further includes a no-go shoulder 822 that prevents the smaller assembly 820 from being pulled entirely through the larger bit assembly 830.

Turning now to FIGS. 9A through 18H, illustrated are different views of a well system 900 designed, manufactured and/or operated according to one or more embodiments of the disclosure, for example at different manufacturing/operational states thereof.

With initial reference to FIGS. 9A through 9D, the well system 900 initially includes a main wellbore 910. As indicated above, the main wellbore 910 may be a primary wellbore extending from the surface, or a secondary wellbore already extending from a primary wellbore. Located in the main wellbore 910 is tubing string 920, such as casing string. In certain embodiment, while not shown, cement may be positioned between the main wellbore 910 and the tubing string 920.

In the illustrated embodiment, a latch coupling 940 portion of an anchor assembly 930 is positioned in the tubing string 920 (e.g., in line with the tubing string 920). For example, in at least one embodiment, the latch coupling 940 is a latch coupling including one or more latch coupling profiles, the one or more latch coupling profiles configure to engage with one or more torque buttons of a latch collet, such as a latch collet coupled to a whipstock assembly. In at least one embodiment, the latch coupling 940 is similar to the latch coupling discussed above with regard to FIGS. 3A and 3B. Nevertheless, the embodiment of FIGS. 9A through 18H is not limited to such a latch coupling.

Turning now to FIGS. 10A through 10H, illustrated is the well system 900 of FIGS. 9A through 9D after employing a two-part drilling and running tool 1010 to run a downhole tool 1005 within the main wellbore 910. In the illustrated embodiment, the downhole tool 1005 includes a whipstock assembly 1020, which is coupled to a fluid loss device 1030, which is coupled to a packer assembly 1040, which is coupled to a latch collet 1060 of the anchor assembly 930, which is coupled to a completion assembly 1090. In the illustrated embodiment, the whipstock assembly 1020 is rigidly coupled to the features therebelow, including the packer assembly 1040 and the fluid loss device 1030 in one or more embodiments. The term "rigidly coupled," as used herein means that the whipstock assembly 1020 is meant to remain attached to the features therebelow without significant measures to separate the two, particularly after forming the lateral wellbore and positioning a multilateral junction in the main wellbore and lateral wellbore. In at least one embodiment, these features are run-in-hole in a single trip within the main wellbore 910.

The two-part drilling and running tool 1010 of FIGS. 10A through 10H is similar in many respects to the two-part drilling and running tool 800 of FIGS. 8A through 8D. The fluid loss device 1030 of FIGS. 10A through 10H is similar in many respects to the fluid loss device 720 of FIGS. 7A and 7B. The packer assembly 1040 of FIGS. 10A through 10H is similar in many respects to the packer assembly 640 of FIGS. 6A and 6B. The anchor assembly 930, including the latch coupling 940 and the latch collet 1060 of FIGS. 10A through 10H is similar in many respects to the latch collet 200 and latch coupling 300 of FIGS. 2A through 5E. Accordingly, like reference numbers have been used to indicate similar, if not identical, features.

In the illustrated embodiment of FIGS. 10A through 10H, the larger bit assembly 830 of the two-part drilling and running tool 1010 is coupled proximate a downhole end of the whipstock assembly 1020. Furthermore, the smaller assembly 820 of the two-part drilling and running tool 1010 is propping the fluid loss device 1030 in an open position. Furthermore, at this stage, the packer assembly 1040 is in the radially retracted state.

Additionally, in the embodiment of FIGS. 10A through 10H, the latch collet 1060 has yet to engage with the latch coupling 940. For example, the torque buttons 230 of the latch collet 1060 have yet to engage with the related slots (e.g., axial alignment slots) in the latch coupling 940. Additionally, the collet prop buttons 280, 290 of the latch collet 1060 are engaged with the mandrel 520 (e.g., engaged with the mandrel slot 522 of the mandrel 520), axially fixing the mandrel 520 and the latch collet 1060 together.

Furthermore, in this embodiment, as the latch collet 1060 is located in too large size casing 598, the bore sensor 540 is in its radially extended state, and thus the snap feature 544 is located in the shear plane 546 between the latch collet 1060 and the mandrel 520. Accordingly, this stage the bore sensor 540 axially fixes the latch collet 1060 and the mandrel 520 together. Furthermore, the shear feature 590 has yet to shear, and thus also axially fixes the latch collet 1060 and the mandrel 520 together.

Moreover, as shown, the running tool collet 560 and the mandrel 520 are axially fixed to one another using the locking dog 580. For example, the locking dog 580 may be held in a radially retracted state within the running tool collet slot (e.g., running tool collet slot 562 of FIGS. 5A through 5D) by the latch collet 1060. Thus, at this stage, the smaller assembly 820 of the two-part drilling and running tool 1010, the running tool collet 560, the mandrel 520, and the latch collet 1060 are all axially fixed to one another.

Turning now to FIGS. 11A through 11H, illustrated is the well system 900 of FIGS. 10A through 10H after setting weight down on the whipstock assembly 1020, and thus the mandrel 520, thus causing the torque buttons 230 of the latch collet 1060 to engage with the related slots in the latch coupling 940. When this occurs, the latch collet 1060 moves to a radially extended state, and thus the collet prop buttons of the latch collet 1060 are no longer located within the mandrel slot of the mandrel 520.

Furthermore, at this stage the latch collet 1060 is now located in the correct size casing 599. Accordingly, the bore sensor 540 is pressed to its radially compressed state, thereby moving the snap feature 544 outside of the shear plane 546. Accordingly, at this stage the bore sensor 540, and more specifically the snap feature 544, no longer axially fix the latch collet 1060 and the mandrel 520. Nevertheless, at this stage the shear feature 590 still axially fixes the latch collet 1060 and the mandrel 520.

Furthermore, at this stage the running tool collet 560 and the mandrel 520 remain axially fixed to one another using the locking dog 580. For example, the locking dog 580 is still held in the radially retracted state within the running tool collet slot by the latch collet 1060. Thus, at this stage, the smaller assembly 820 of the two-part drilling and running tool 1010, the running tool collet 560, the mandrel 520, and the latch collet 1060 are all still axially fixed to one another.

Turning now to FIGS. 12A through 12H, illustrated is the well system 900 of FIGS. 11A through 11H after continuing to set down weight on the whipstock assembly 1020, and thus the mandrel 520, thereby setting the packer assembly 1040. The continued setting down of weight on the whipstock assembly 1020, and thus the mandrel 520, additionally shears the shear feature 590, and thus the latch collet 1060 and the mandrel 520 are no longer axially fixed to one another. Furthermore, in at least one embodiment, the mandrel 520 now holds the collet prop buttons 280, 290 radially outward, thus fixing the torque buttons 230 of the latch collet 1060 within the slots in the latch coupling.

Additionally, the continued setting down of weight on the whipstock assembly 1020 slides the running tool collet 560 and the mandrel 520 further downhole, until such a time that the locking dog 580 is now aligned with a collet body slot 518 in the latch collet 510. Additionally, another snap feature 1310 may snap into place, once again axially fixing the latch collet 1060 and the mandrel 520. The running tool collet 560 and the mandrel 520, given that the locking dog 580 may move from its radially retracted state to its radially extended state within the collet body slot, are now effectively axially free to slide relative to one another.

Turning now to FIGS. 13A through 13H, illustrated is the well system 900 of FIGS. 12A through 12H after picking up weight on the whipstock assembly 1020, and thus the running tool collet 560. This movement of the whipstock assembly 1020, through an interaction between the first and second collet slot angled ramp profiles 564*b*, 566*b*, and first and second locking dog angled ramp profiles 584*b*, 586*b*, causes the locking dog 580 to move radially outward into the collet body slot 518, thereby axially freeing the running tool collet 560 and the mandrel 520 from one another. As the running tool collet 560 and the mandrel 520 are no longer axially fixed to one another, the running tool collet 560 is free to slide uphole.

Turning now to FIGS. 14A through 14H, illustrated is the well system 900 of FIGS. 13A through 13H after the smaller assembly 820 continues to be pulled uphole, and thus disengages from the running tool collet 560, and thereafter engages with the larger bit assembly 830 to form a combined bit assembly 1410. The one way mechanism 850, in this embodiment, coupled between the smaller assembly 820 and the larger bit assembly 830 prevents the smaller bit assembly 820 and the larger bit assembly 830 from axially sliding relative to one another such that they no longer form the combined bit assembly 1410. For example, in this embodiment the smaller assembly 820 is unable to move back downhole apart from the larger bit assembly 830. Furthermore, at this stage the fluid loss device 1030 is allowed to close.

Turning now to FIGS. 15A through 15H, illustrated is the well system 900 of FIGS. 14A through 14H after the two-part drilling and running tool 1010 continues to be pulled uphole, and thus the combined bit assembly 1410 shears away from the whipstock assembly 1020.

Turning now to FIGS. 16A through 16H, illustrated is the well system 900 of FIGS. 15A through 15H after using the released two-part drilling and running tool 1010 to form a lateral wellbore 1610 off of the main wellbore 910. Those skilled in the art understand and appreciate the steps necessary to mill the exit and form the lateral wellbore 1610, particularly given the details contained herein. Thereafter, the two-part drilling and running tool 1010 is pulled out of the main wellbore 910.

Turning now to FIGS. 17A through 17H, illustrated is the well system 900 of FIGS. 16A through 16H after dropping off a lower completion 1710 in the lateral wellbore 1610. Those skilled in the art understand and appreciate the steps necessary to drop off the lower completion 1710, particularly given the details contained herein.

Turning now to FIGS. 18A through 18H, illustrated is the well system 900 of FIGS. 17A through 17H after positioning a multilateral junction assembly 1810 at a junction between the main wellbore 910 and the lateral wellbore 1610. In the illustrated embodiment, as the whipstock assembly 1020 is rigidly coupled to the feature therebelow, the multilateral junction assembly 1810 is positioned at the junction between the main wellbore 910 and the lateral wellbore 1610 using the whipstock assembly 1020. In the illustrated embodiment, a main bore leg 1820 of the multilateral junction assembly 1810 engages with a seal assembly 760 of the fluid loss device 1030, while a lateral bore leg 1830 of the multilateral junction assembly 1810 is in the lateral wellbore 1610.

Turning now to FIGS. 19A through 31D, illustrated are different views of a well system 1900 designed, manufactured and/or operated according to one or more alternative embodiments of the disclosure, for example at different manufacturing/operational states thereof. The well system 1900 of FIGS. 19A through 31D is similar in many respects to the well system 900 of FIGS. 9A through 18H. Accordingly, like reference numbers have been used to indicated similar, if not identical, features.

With initial reference to FIGS. 19A through 19D, the well system 1900 is substantially similar to the well system 900 of FIGS. 9A through 9D.

Turning now to FIGS. 20A through 20D, illustrated is the well system 1900 of FIGS. 19A through 19D after employing a two-part drilling and running tool 1010 to run a downhole tool 2005 within the main wellbore 910. In the illustrated embodiment, the downhole tool 2005 includes a whipstock assembly 1020, which is coupled to a fluid loss device 1030, which is coupled to a packer assembly 1040, which is coupled to a latch collet 1060 of the anchor assembly 930, which is coupled to a completion assembly 1090. The downhole tool 2005, in contrast to the downhole tool 1005, additionally includes a muleshoe 2010. Furthermore, the downhole tool 2005, in contrast to the downhole tool 1005, employs the whipstock assembly 1020 that is removable coupled to the features therebelow, including the packer assembly 1040 and the fluid loss device 1030 in one or more embodiments. The term "removably coupled," as used herein and unless otherwise stated, means that the whipstock assembly 1020 is meant to disengage from the features therebelow without significant measures to separate the two, particularly after forming the lateral wellbore and positioning a multilateral junction in the main wellbore and lateral wellbore. In fact, in this embodiment, the whipstock assembly 1020 is configured to be retrieved uphole prior to the multilateral junction being run-in-hole. Otherwise, the embodiment of FIGS. 20A through 20D are substantially similar to FIGS. 10A through 10H.

Turning now to FIGS. 21A through 21D, illustrated is the well system 1900 of FIGS. 20A through 20D after setting weight down on the whipstock assembly 1020, and thus the mandrel 520, thus causing the torque buttons 230 of the latch collet 1060 to engage with the related slots in the latch coupling 940.

Turning now to FIGS. 22A through 22D, illustrated is the well system 1900 of FIGS. 21A through 21D after continuing to set down weight on the whipstock assembly 1020, and thus the mandrel 520, thereby setting the packer assembly 1040. The continued setting down of weight on the whipstock assembly 1020, and thus the mandrel 520, additionally shears the shear feature 590, and thus the latch collet 1060 and the mandrel 520 are no longer axially fixed to one another. Furthermore, in at least one embodiment, the mandrel 520 now holds the collet prop buttons 280, 290 radially outward, thus fixing the torque buttons 230 of the latch collet 1060 within the slots in the latch coupling.

Additionally, the continued setting down of weight on the whipstock assembly 1020 slides the running tool collet 560 and the mandrel 520 further downhole, until such a time that the locking dog 580 is now aligned with a collet body slot 518 in the latch collet 510. Additionally, another snap feature 1310 may snap into place, once again axially fixing the latch collet 1060 and the mandrel 520. The running tool collet 560 and the mandrel 520, given that the locking dog 580 may move from its radially retracted state to its radially extended state within the collet body slot, are now effectively axially free to slide relative to one another.

Turning now to FIGS. 23A through 23D, illustrated is the well system 1900 of FIGS. 22A through 22D after picking up weight on the whipstock assembly 1020, and thus the running tool collet 560. This movement of the whipstock assembly 1020, through an interaction between the first and second collet slot angled ramp profiles 564*b*, 566*b*, and first and second locking dog angled ramp profiles 584*b*, 586*b*, causes the locking dog 580 to move radially outward into the collet body slot 518, thereby axially freeing the running tool collet 560 and the mandrel 520 from one another. As the running tool collet 560 and the mandrel 520 are no longer axially fixed to one another, the running tool collet 560 is free to slide uphole.

Turning now to FIGS. 24A through 24D, illustrated is the well system 1900 of FIGS. 23A through 23D after the smaller assembly 820 continues to be pulled uphole, and thus disengages from the running tool collet 560, and thereafter engages with the larger bit assembly 830 to form a combined bit assembly 1410. The one way mechanism 850, in this embodiment, coupled between the smaller assembly 820 and the larger bit assembly 830 prevents the smaller bit assembly 820 and the larger bit assembly 830 from axially sliding relative to one another such that they no longer form the combined bit assembly 1410. For example, in this embodiment the smaller assembly 820 is unable to move back downhole apart from the larger bit assembly 830. Furthermore, at this stage the fluid loss device 1030 is allowed to close.

Turning now to FIGS. 25A through 25D, illustrated is the well system 1900 of FIGS. 24A through 24D after the two-part drilling and running tool 1010 continues to be pulled uphole, and thus the combined bit assembly 1410 shears away from the whipstock assembly 1020.

Turning now to FIGS. 26A through 26D, illustrated is the well system 1900 of FIGS. 25A through 25D after using the released two-part drilling and running tool 1010 to form a lateral wellbore 1610 off of the main wellbore 910. Those skilled in the art understand and appreciate the steps necessary to mill the exit and form the lateral wellbore, particularly given the details contained herein. Thereafter, the two-part drilling and running tool 1010 is pulled out of the main wellbore 910.

Turning now to FIGS. 27A through 27D, illustrated is the well system 1900 of FIGS. 26A through 26D after dropping off the lower completion 1710 in the lateral wellbore 1610. Those skilled in the art understand and appreciate the steps necessary to drop off the lower completion 1710, particularly given the details contained herein.

Turning now to FIGS. 28A through 28D, illustrated is the well system 1900 of FIGS. 27A through 27D after a whipstock assembly removal tool 2810 has engaged with the whipstock assembly 1020.

Turning now to FIGS. 29A through 29D, illustrated is the well system 1900 of FIGS. 28A through 28D after the whipstock assembly removal tool 2810 has retrieved the whipstock assembly 1020 from the wellbore 910. In at least one embodiment, the lower completion 1710 is dropped off within the lateral wellbore 1610, the whipstock assembly removal tool 2810 engages with the whipstock assembly 1020, and the whipstock assembly removal tool 2810 retrieves the whipstock assembly 1020 from the wellbore 910 in a single trip downhole.

Turning now to FIGS. 30A through 30D, illustrated is the well system 1900 of FIGS. 29A through 29D after starting to position a multilateral junction assembly 3010 (e.g., including a main bore leg 3020 and a lateral bore leg 3030) at a junction between the main wellbore 910 and the lateral wellbore 1610. In the illustrated embodiment, the whipstock assembly 1020 has been retrieved uphole, thus a deflector less multilateral junction assembly is used to deploy the lateral bore leg 3030 thereof into the lateral wellbore 1610.

Turning now to FIGS. 31A through 31D, illustrated is the well system 1900 of FIGS. 30A through 30D after the multilateral junction assembly 3010 (e.g., including a main bore leg 3020 and a lateral bore leg 3030) has engaged with the muleshoe 2010 and is finally placed downhole.

Aspects disclosed herein include:

A. A latch collet, the latch collet including: 1) a collet body, the collet body having a plurality of collet fingers; and 2) a torque button located on a radial exterior of each of the plurality of collet fingers, wherein a width ($W_{TB}$) of each of the torque buttons is within 10% of each other.

B. A well system, the well system including: 1) a wellbore extending through one or more subterranean formations; 2) wellbore casing located in the wellbore, the wellbore casing including a latch coupling; and 3) a latch collet located in the wellbore and configured to engage with the latch coupling, the latch collet including: a) a collet body, the collet body having a plurality of collet fingers; and b) a torque button located on a radial exterior of each of the plurality of collet fingers, wherein a width ($W_{TB}$) of each of the torque buttons is within 10% of each other.

C. A method for forming a well system, the method including: 1) forming a wellbore through one or more subterranean formations; 2) positioning wellbore casing in the wellbore, the wellbore casing including a latch coupling; and 3) positioning a latch collet in the wellbore, the latch collet configured to engage with the latch coupling and including: a) a collet body, the collet body having a plurality of collet fingers; and b) a torque button located on a radial exterior of each of the plurality of collet fingers, wherein a width ($W_{TB}$) of each of the torque buttons is within 10% of each other.

D. A latch collet, the latch collet including: 1) a collet body, the collet body having a plurality of collet fingers; and 2) a collet prop button located on a radial interior of each of the plurality of collet fingers, the collet prop button configured to engage with a profile of a mandrel for running the latch collet downhole, and configured to be propped radially outward by the mandrel to cause torque buttons located on a radial exterior of each of the plurality of fingers to remain engaged with associated alignment profiles in a latch coupling when positioned at an acceptable position downhole.

E. A well system, the well system including: 1) a wellbore extending through one or more subterranean formations; 2) wellbore casing located in the wellbore, the wellbore casing including a latch coupling; and 3) a latch collet located in the wellbore and configured to engage with the latch coupling, the latch collet including: a) a collet body, the collet body having a plurality of collet fingers; and b) a collet prop button located on a radial interior of each of the plurality of collet fingers, the collet prop button configured to engage with a profile of a mandrel for running the latch collet downhole, and configured to be propped radially outward by the mandrel to cause torque buttons located on a radial exterior of each of the plurality of fingers to remain engaged with associated alignment profiles in a latch coupling when positioned at an acceptable position downhole.

F. A method for forming a well system, the method including: 1) forming a wellbore through one or more subterranean formations; 2) positioning wellbore casing in the wellbore, the wellbore casing including a latch coupling; and 3) positioning a latch collet in the wellbore, the latch collet configured to engage with the latch coupling and including: a) a collet body, the collet body having a plurality of collet fingers; and b) a collet prop button located on a radial interior of each of the plurality of collet fingers, the collet prop button configured to engage with a profile of a mandrel for running the latch collet downhole, and configured to be propped radially outward by the mandrel to cause torque buttons located on a radial exterior of each of the plurality of fingers to remain engaged with associated alignment profiles in a latch coupling when positioned at an acceptable position downhole.

G. A latch coupling, the latch coupling including: 1) a housing having an outside diameter (OD) and an inside diameter (ID); and 2) a plurality of axial alignment slots located along the inside diameter (ID) of the housing, wherein a width ($W_{AS}$) of each of the plurality of axial alignment slots is within 10% of each other.

H. A well system, the well system including: 1) a wellbore extending through one or more subterranean formations; 2) wellbore casing located in the wellbore, the wellbore casing including a latch coupling, the latch coupling including: a) a housing having an outside diameter (OD) and an inside diameter (ID); and b) a plurality of axial alignment slots located along the inside diameter (ID) of the housing, wherein a width ($W_{AS}$) of each of the plurality of axial alignment slots is within 10% of each other.

I. A method for forming a well system, the method including: 1) forming a wellbore through one or more subterranean formations; and 2) positioning wellbore casing in the wellbore, the wellbore casing including a latch coupling, the latch coupling including: a) a housing having an outside diameter (OD) and an inside diameter (ID); and b) a plurality of axial alignment slots located along the inside diameter (ID) of the housing, wherein a width ($W_{AS}$) of each of the plurality of axial alignment slots is within 10% of each other.

J. A downhole tool, the downhole tool including: 1) a latch collet including a collet body, the collet body having a collet body opening extending through a thickness ($t_{cb}$) thereof and a plurality of collet fingers; 2) a mandrel positioned within the collet body, the mandrel having a mandrel slot therein; and 3) a bore sensor positioned within the collet body opening and the mandrel slot, the bore sensor configured remain in a radially extended state when the latch collet is in too large size casing and thereby prevent the collet body and the mandrel from sliding relative to one another and configured to be pushed to a radially compressed state when the latch collet is in the correct size casing and thereby not prevent the collet body and the mandrel from sliding relative to one another.

K. A well system, the well system including: 1) a wellbore extending through one or more subterranean formations; 2) wellbore casing located in the wellbore, the wellbore casing including a latch coupling; and 3) a downhole tool located in the wellbore and configured to engage with the latch coupling, the downhole tool, including: a) a latch collet including a collet body, the collet body having a collet body opening extending through a thickness ($t_{cb}$) thereof and a plurality of collet fingers; b) a mandrel positioned within the collet body, the mandrel having a mandrel slot therein; and c) a bore sensor positioned within the collet body opening and the mandrel slot, the bore sensor configured remain in a radially extended state when the latch collet is in too large size casing and thereby prevent the collet body and the mandrel from sliding relative to one another and configured to be pushed to a radially compressed state when the latch collet is in the correct size casing and thereby not prevent the collet body and the mandrel from sliding relative to one another.

L. A method for forming a well system, the method including: 1) forming a wellbore through one or more subterranean formations; 2) positioning wellbore casing in the wellbore, the wellbore casing including a latch coupling; and 3) positioning a downhole tool in the wellbore and configured to engage with the latch coupling, the downhole tool, including: a) a latch collet including a collet body, the collet body having a collet body opening extending through a thickness ($t_{cb}$) thereof and a plurality of collet fingers; b) a mandrel positioned within the collet body, the mandrel having a mandrel slot therein; and c) a bore sensor positioned within the collet body opening and the mandrel slot, the bore sensor configured remain in a radially extended state when the latch collet is in too large size casing and thereby prevent the collet body and the mandrel from sliding relative to one another and configured to be pushed to a radially compressed state when the latch collet is in the correct size casing and thereby not prevent the collet body and the mandrel from sliding relative to one another.

M. A downhole tool, the downhole tool including: 1) a latch collet including a collet body, the collet body having a collet body slot on a radial interior surface thereof and a plurality of collet fingers; 2) a mandrel positioned within the collet body, the mandrel having a mandrel opening extending through a thickness ($t_m$) thereof; 3) a running tool collet located within the mandrel, the running tool collet having a running tool collet slot on a radial exterior surface thereof; and 4) a locking dog positioned within the mandrel opening, the locking dog configured to engage with the running tool collet slot when the downhole tool is in a run-in-hole state and thereby prevent the mandrel and the running tool collet from sliding relative to one another and configured to disengage from the running tool collet slot and engage with the collet body slot after the collet body and the mandrel have slid relative to one another and thereby allow the mandrel and the running tool collet to slide relative to one another.

N. A well system, the well system including: 1) a wellbore extending through one or more subterranean formations; 2) wellbore casing located in the wellbore, the wellbore casing including a latch coupling; and 3) a downhole tool located in the wellbore and configured to engage with the latch coupling, the downhole tool including: a) a latch collet including a collet body, the collet body having a collet body slot on a radial interior surface thereof and a plurality of collet fingers; b) a mandrel positioned within the collet body, the mandrel having a mandrel opening extending through a thickness ($t_m$) thereof; c) a running tool collet located within the mandrel, the running tool collet having a running tool collet slot on a radial exterior surface thereof; and d) a locking dog positioned within the mandrel opening, the locking dog configured to engage with the running tool collet slot when the downhole tool is in a run-in-hole state and thereby prevent the mandrel and the running tool collet from sliding relative to one another and configured to disengage from the running tool collet slot and engage with the collet body slot after the collet body and the mandrel have slid relative to one another and thereby allow the mandrel and the running tool collet to slide relative to one another.

O. A method for forming a well system, the method including: 1) forming a wellbore through one or more subterranean formations; 2) positioning wellbore casing in the wellbore, the wellbore casing including a latch coupling; and 3) positioning a downhole tool in the wellbore, the downhole tool configured to engage with the latch coupling, the downhole tool including: a) a latch collet including a collet body, the collet body having a collet body slot on a radial interior surface thereof and a plurality of collet fingers; b) a mandrel positioned within the collet body, the mandrel having a mandrel opening extending through a thickness ($t_m$) thereof; c) a running tool collet located within the mandrel, the running tool collet having a running tool collet slot on a radial exterior surface thereof; and d) a locking dog positioned within the mandrel opening, the locking dog configured to engage with the running tool collet slot when the downhole tool is in a run-in-hole state and thereby prevent the mandrel and the running tool collet from sliding relative to one another and configured to disengage from the running tool collet slot and engage with the collet body slot after the collet body and the mandrel have slid relative to one another and thereby allow the mandrel and the running tool collet to slide relative to one another.

P. A downhole tool, the downhole tool including: 1) a latch collet including a collet body, the collet body having a plurality of collet fingers; 2) a mandrel positioned within the collet body; and 3) a packer assembly positioned axially between the collet body and the mandrel, the packer assembly configured to move from a radially retracted state when the mandrel and collet body are being run-in-hole to a radially extended state when the collet body has engaged with a latching profile and weight is placed down upon the packer assembly.

Q. A well system, the well system including: 1) a wellbore extending through one or more subterranean formations; 2) wellbore casing located in the wellbore, the wellbore casing including a latch coupling; and 3) a downhole tool located in the wellbore and configured to engage with the latch coupling, the downhole tool including: a) a latch collet including a collet body, the collet body having a plurality of collet fingers; b) a mandrel positioned within the collet body; and c) a packer assembly positioned axially between the collet body and the mandrel, the packer assembly configured to move from a radially retracted state when the mandrel and collet body are being run-in-hole to a radially extended state when the collet body has engaged with a latching profile and weight is placed down upon the packer assembly.

R. A method for forming a well system, the method including: 1) forming a wellbore through one or more subterranean formations; 2) positioning wellbore casing in the wellbore, the wellbore casing including a latch coupling; and 3) positioning a downhole tool in the wellbore, the downhole tool configured to engage with the latch coupling, the downhole tool including: a) a latch collet including a collet body, the collet body having a plurality of collet fingers; b) a mandrel positioned within the collet body; and c) a packer assembly positioned axially between the collet body and the mandrel, the packer configured to move from a radially retracted state when the mandrel and collet body are being run-in-hole to a radially extended state when the collet body has engaged with a latching profile and weight is placed down upon the packer assembly.

S. A downhole tool, the downhole tool including: 1) a whipstock assembly; 2) a completion assembly; and 3) a fluid loss device positioned between the whipstock assembly and the completion assembly.

T. A well system, the well system including: 1) a wellbore extending through one or more subterranean formations; and 2) a downhole tool located in the wellbore, the downhole tool including: a) a whipstock assembly; b) a completion assembly; and c) a fluid loss device positioned between the whipstock assembly and the completion assembly.

U. A method for forming a well system, the method including: 1) forming a wellbore through one or more subterranean formations; and 2) positioning a downhole tool in the wellbore, the downhole tool including: a) a whipstock assembly; b) a completion assembly; and c) a fluid loss device positioned between the whipstock assembly and the completion assembly.

V. A two-part drilling and running tool, the two-part drilling and running tool including: 1) a conveyance; 2) a smaller assembly coupled to an end of the conveyance; 3) a larger bit assembly slidably coupled to the conveyance, the smaller assembly and larger bit assembly configured to slidingly engage one another downhole to form a combined bit assembly; and 4) a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another.

W. A well system, the well system including: 1) a wellbore extending through one or more subterranean formations; and 2) a two-part drilling and running tool located in the wellbore, the two-part drilling and running tool including: a) a conveyance; b) a smaller assembly coupled to an end of the conveyance; c) a larger bit assembly slidably coupled to the conveyance, the smaller assembly and larger bit assembly configured to slidingly engage one another downhole to form a combined bit assembly; and d) a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another.

X. A method for forming a well system, the method including: 1) forming a wellbore through one or more subterranean formations; 2) positioning a two-part drilling and running tool in the wellbore, the two-part drilling and running tool including: a) a conveyance; b) a smaller assembly coupled to an end of the conveyance; c) a larger bit assembly slidably coupled to the conveyance, the smaller assembly and larger bit assembly configured to slidingly engage one another downhole to form a combined bit assembly; and d) a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another.

Y. A downhole tool, the downhole tool including: 1) a whipstock assembly; 2) a packer assembly fixedly coupled to the to the whipstock assembly; 3) an anchor assembly coupled to the packer assembly; and 4) a completion assembly coupled to the anchor assembly, the whipstock assembly, packer assembly, anchor assembly and the completion assembly configured to be run-in-hole in a single trip.

Z. A method for forming a well system, the method including: 1) forming a main wellbore within a subterranean formation; 2) positioning a downhole tool within the main wellbore using a two-part drilling and running tool, the downhole tool including: a) a whipstock assembly; b) a packer assembly fixedly coupled to the to the whipstock assembly; c) an anchor assembly coupled to the packer assembly; and d) a completion assembly coupled to the anchor assembly; 3) setting the anchor assembly, setting the packer assembly, and releasing the two-part drilling and running tool from the downhole tool; 4) using the released two-part drilling and running tool to form a lateral wellbore off of the main wellbore and then pulling the two-part drilling and running tool out of the main wellbore; and 5) positioning a multilateral junction assembly at a junction between the main wellbore and the lateral wellbore using the whipstock assembly.

AA. A downhole tool, the downhole tool including: 1) a whipstock assembly; 2) a packer assembly removably coupled to the to the whipstock assembly; 3) an anchor assembly coupled to the packer assembly; and 4) a completion assembly coupled to the anchor assembly, the whipstock assembly, packer assembly, anchor assembly and the completion assembly configured to be run-in-hole in a single trip.

BB. A method for forming a well system, the method including: 1) forming a main wellbore within a subterranean formation; 2) positioning a downhole tool within the main wellbore using a two-part drilling and running tool, the downhole tool including: a) a whipstock assembly; b) a packer assembly removably coupled to the to the whipstock assembly; c) an anchor assembly coupled to the packer assembly; and d) a completion assembly coupled to the anchor assembly; 3) setting the anchor assembly, setting the packer assembly, and releasing the two-part drilling and running tool from the downhole tool; 4) using the released two-part drilling and running tool to form a lateral wellbore off of the main wellbore; 5) pulling the two-part drilling and running tool out of the lateral wellbore, the two-part drilling and running tool engaging with the whipstock assembly and withdrawing the whipstock assembly out of the main wellbore; and 6) positioning a multilateral junction assembly at a junction between the main wellbore and the lateral wellbore without the use of a deflector assembly.

Aspects A through BB may have one or more of the following additional elements in combination: Element 1: wherein each of the torque buttons includes multiple linearly aligned and spaced apart torque button portions. Element 2: wherein the torque button is a first torque button located on a radial exterior of each of the plurality of fingers, and further including a second torque button located on the radial exterior of each of the plurality of fingers, wherein the width ($W_{TB}$) of each of the second torque buttons is within 10% of each other and the first torque buttons. Element 3: wherein each of the second torque buttons includes multiple linearly aligned and spaced apart second torque button portions. Element 4: wherein the multiple linearly aligned and spaced apart torque button portions and the multiple linearly aligned and spaced apart second torque button portions are at least partially axially offset from each other thereby forming a debris path. Element 5: further including a coupling selector button located on the radial exterior of each of the plurality of fingers, the coupling selector button configured to engage with a selector profile in a latch coupling. Element 6: wherein the coupling selector button is an uphole coupling selector button located uphole of the torque buttons, and further including a downhole coupling selector button located on the radial exterior of each of the plurality of fingers and downhole of the torque buttons. Element 7: wherein each of the uphole coupling selector buttons and the downhole coupling selector buttons has a width ($W_{SP}$) greater than the width ($W_{TB}$). Element 8: wherein the width ($W_{SP}$) is at least 2 times greater than the width ($W_{TB}$). Element 9: wherein each of the uphole coupling selector buttons and the downhole coupling selector buttons has tensile and compressive shoulders. Element 10: further including automatically coupling the latch collet with the latch coupling. Element 11: wherein the collet prop button located on the radial interior of each of the plurality of fingers is a first collet prop button, and further including a second collet prop button located on the radial interior of each of the plurality of fingers. Element 12: wherein the first collet prop buttons and the second collet prop buttons are similarly shaped. Element 13: wherein the first collet prop buttons and the second collet prop buttons are located within a center 50 percent of the plurality of fingers. Element 14: further including torque buttons located on a radial exterior of each of the plurality of collet fingers. Element 15: wherein a width ($W_{TB}$) of each of the torque buttons is within 10% of each other. Element 16: wherein each of the torque buttons includes multiple linearly aligned and spaced apart torque button portions. Element 17: wherein the torque button is a first torque button located on a radial exterior of each of the plurality of fingers, and further including a second torque button located on the radial exterior of each of the plurality of fingers, wherein the width ($W_{TB}$) of each of the second torque buttons is within 10% of each other and the first torque buttons. Element 18: wherein each of the second torque buttons includes multiple linearly aligned and spaced apart second torque button portions. Element 19: wherein the multiple linearly aligned and spaced apart torque button portions and the multiple linearly aligned and spaced apart second torque button portions are at least partially axially offset from each other thereby forming a debris path. Element 20: wherein the plurality of axial alignment slots is at least six axial alignment slots, and further wherein the width ($W_{AS}$) of each of the at least six axial alignment slots is within 10% of each other. Element 21: wherein the plurality of axial alignment slots is at least ten axial alignment slots, and further wherein the width ($W_{AS}$) of each of the at least ten axial alignment slots is within 10% of each other. Element 22: wherein the plurality of axial alignment slots is at least sixteen axial alignment slots, and further wherein the width ($W_{AS}$) of each of the at least sixteen axial alignment slots is within 10% of each other. Element 23: further including a radial extending latch collet selector profile located along the inside diameter (ID) of the housing. Element 24: wherein the radial extending latch collet selector profile is an uphole radial extending latch collet selector profile located uphole of the plurality of axial alignment slots, and further including a downhole radial extending latch collet selector profile located along the inside diameter (ID) of the housing and downhole of the plurality of axial alignment slots. Element 25: wherein the uphole radial extending latch collet selector profile and the downhole radial extending latch collet selector profile each extends 360 degrees around the housing. Element 26: wherein the uphole radial extending latch collet selector profile and the downhole radial extending latch collet selector profile each include tensile shoulders or compressive shoulders. Element 27: wherein the uphole radial extending latch collet selector profile and the downhole radial extending latch collet selector profile each include tensile shoulders and compressive shoulders. Element 28: wherein the plurality of axial alignment slots each have a length ($L_{AS}$), and further wherein the length ($L_{AS}$) is at least 3 times the width ($W_{AS}$). Element 29: wherein the bore sensor includes a radially exterior push key and a snap feature positioned between the radially exterior push key and the mandrel, the radially exterior push key configured to sense for the too large size casing or the correct size casing. Element 30: wherein the bore sensor is configured such that when it is in the too large size casing the snap feature is positioned within a shear plane between the collet body and the mandrel to prevent the collet body and the mandrel from sliding relative to one another and configured such that when it is in the correct size casing the snap feature is positioned outside of the shear plane between the collet body and the mandrel to not prevent the collet body and the mandrel from sliding relative to one another. Element 31: wherein the radially exterior push key is configured to allow the snap feature to be in a radially outward state and positioned within the shear plane when the bore sensor is in the too large size casing and is configured to push the snap feature to a radially inward state and positioned outside of the shear plane when the bore sensor is in the correct size casing. Element 32: wherein the snap feature is a snap ring. Element 33: wherein the bore sensor is a first bore sensor, and further including a second bore sensor positioned within a second collet body opening in the collet body and a second mandrel slot in the mandrel, the second bore sensor configured to remain in a second radially extended state when the latch collet is in too large size casing and thereby prevent the collet body and the mandrel from sliding relative to one another and configured to be pushed to a second radially compressed state when the latch collet is in the correct size casing and thereby not prevent the collet body and the mandrel from sliding relative to one another. Element 34: further including one or more additional bore sensors positioned within additional collet body openings in the collet body and additional mandrel slots in the mandrel, the first, second, and additional bore sensors substantially equally circumferentially placed about the latch collet. Element 35: wherein the collet body opening and the mandrel slot are axially aligned when the bore sensor is in the radially extended state. Element 36: further including a torque button located on a radial exterior of each of the plurality of collet fingers. Element 37: wherein a width ($W_{TB}$) of each of the torque buttons is within 10% of each other. Element 38: wherein the collet body is configured to keep the locking dog engaged with the running tool collet slot when the downhole tool is in the run-in-hole state. Element 39: wherein the running tool collet is configured to keep the locking dog engaged with the collet body slot after the collet body and the mandrel have slid relative to one another. Element 40: wherein the running tool collet slot has a collet slot downhole edge and a collet slot uphole edge, and further wherein the collet slot downhole edge has a collet slot angled ramp profile. Element 41: wherein the collet slot angled ramp profile is a first collet slot angled ramp profile, and further wherein the collet slot uphole edge has a second collet slot angled ramp profile. Element 42: wherein the locking dog has a locking dog downhole edge and a locking dog uphole edge, and further wherein a radially interior portion of the locking dog downhole edge has locking dog angled ramp profile. Element 43: wherein locking dog angled ramp profile is a first locking dog angled ramp profile, and further wherein a radially interior portion of the locking dog uphole edge has second locking dog angled ramp profile, the first and second collet slot angled ramp profiles and first and second locking dog angled ramp profiles configured to cooperate to force the locking dog into the collet body slot. Element 44: further including a bore sensor located in the collet body between the locking dog and a shear feature. Element 45: further including first and second seal grooves located in the collet body and on opposing sides of the collet body slot. Element 46: further including first and second seal members located in the first and second seal grooves. Element 47: wherein the collet body has an uphole edge and the mandrel has an inset shoulder, and further wherein the packer assembly is positioned axially between the uphole edge of the collet body and the inset shoulder. Element 48: further including an anti-preset feature, the anti-preset feature configured to prevent the collet body and the mandrel from sliding relative to one another and prematurely setting the packer assembly. Element 49: wherein the anti-preset feature is a shear feature positioned between the collet body and the mandrel. Element 50: wherein the anti-preset feature is a collection of a collet prop button located on a radial interior of each of the plurality of collet fingers and a plurality of profiles on the outer radial surface of the mandrel. Element 51: wherein the anti-preset feature is a bore sensor positioned within a collet body opening and a mandrel slot, the bore sensor configured remain in a radially extended state when the latch collet is in too large size casing and thereby prevent the collet body and the mandrel from sliding relative to one another and be pushed to a radially compressed state when the latch collet is in the correct size casing and thereby allow the collet body and the mandrel to slide relative to one another. Element 52: wherein the anti-present feature is the bore sensor and a collection of a collet prop button located on a radial interior of each of the plurality of collet fingers and a plurality of profiles on the outer radial surface of the mandrel. Element 53: wherein the anti-present feature is the bore sensor, the collection of the collet prop button located on a radial interior of each of the plurality of collet fingers and the plurality of profiles on the outer radial surface of the mandrel, and a shear feature positioned between the collet body and the mandrel. Element 54: wherein the packer assembly includes a compressible packer element. Element 55: wherein the compressible packer element is positioned between two slidable packer element rings. Element 56: further including an anchor assembly located between the whipstock assembly and the completion assembly, the fluid loss device located between the anchor assembly and the whipstock assembly. Element 57: wherein the fluid loss device is coupled to the whipstock assembly. Element 58: wherein the fluid loss device is rigidly coupled to the whipstock assembly, such that removal of the whipstock assembly from a wellbore also removes the fluid loss device from the wellbore. Element 59: wherein the fluid loss device is removably coupled to the whipstock assembly, such that removal of the whipstock assembly from a wellbore leaves the fluid loss device within the wellbore. Element 60: wherein the fluid loss device is coupled directly to the whipstock assembly. Element 61: wherein the fluid loss device is configured to be in an open state when being run in hole, and configured to be in a closed state when the whipstock assembly is being used to drill a lateral wellbore. Element 62: wherein a running tool extends through the whipstock assembly and the fluid loss device, propping the fluid loss device in the open state. Element 63: wherein the running tool is a two-part drilling and running tool. Element 64: further including a seal assembly located along an inner radial surface of the fluid loss device. Element 65: further including an anchor assembly located between the whipstock assembly and the completion assembly, the fluid loss device located between the anchor assembly and the whipstock assembly. Element 66: wherein the fluid loss device is coupled to the whipstock assembly. Element 67: wherein the fluid loss device is rigidly coupled to the whipstock assembly, such that removal of the whipstock assembly from a wellbore also removes the fluid loss device from the wellbore. Element 68: wherein the fluid loss device is removably coupled to the whipstock assembly, such that removal of the whipstock assembly from a wellbore leaves the fluid loss device within the wellbore. Element 69: wherein the fluid loss device is coupled directly to the whipstock assembly. Element 70: wherein the one way mechanism is a wedge feature. Element 71: wherein the wedge feature is located in an annular space between the smaller assembly and the larger bit assembly. Element 72: wherein the wedge feature is configured to allow the smaller assembly to slide uphole relative to the larger bit assembly but prevent the smaller assembly from sliding downhole relative to the larger bit assembly. Element 73: wherein the wedge feature is a segmented cone. Element 74: wherein each segment of the segmented cone has a first profile that engages with a second related profile on a radial exterior surface of the smaller assembly or a radial interior surface of the larger bit assembly, the first profile and the second related profile rotationally fixing the smaller assembly and the larger bit assembly when forming the combined bit assembly. Element 75: wherein each segment of the segmented cone has a first profile that engages with both a second related profile on a radial exterior surface of the smaller assembly and a third related profile a radial interior surface of the larger bit assembly, the first profile, second related profile and the third related profile rotationally fixing the smaller assembly and the larger bit assembly when forming the combined bit assembly. Element 76: wherein the segments of the segmented cone alter between downhole and uphole ends. Element 77: further including a spring member positioned in the annular space between a shoulder of the larger bit assembly and the wedge feature. Element 78: wherein the smaller assembly includes a no-go shoulder that prevents the smaller assembly from being pulled entirely through the larger bit assembly. Element 79: wherein the anchor assembly includes a latch collet, the latch collet including: a collet body, the collet body having a plurality of collet fingers; and a torque button located on a radial exterior of each of the plurality of collet fingers, wherein a width ($W_{TB}$) of each of the torque buttons is within 10% of each other. Element 80: wherein each of the torque buttons includes multiple linearly aligned and spaced apart torque button portions. Element 81: wherein the anchor assembly includes a latch collet, the latch collet including: a collet body, the collet body having a plurality of collet fingers; and a collet prop button located on a radial interior of each of the plurality of collet fingers, the collet prop button configured to engage with a profile of a mandrel for running the latch collet downhole, and configured to be propped radially outward by the mandrel to cause torque buttons located on a radial exterior of each of the plurality of fingers to remain engaged with associated alignment profiles in a latch coupling when positioned at an acceptable position downhole. Element 82: wherein the anchor assembly includes: a latch collet including a collet body, the collet body having a collet body opening extending through a thickness ($t_{cb}$) thereof and a plurality of collet fingers; a mandrel positioned within the collet body, the mandrel having a mandrel slot therein; and a bore sensor positioned within the collet body opening and the mandrel slot, the bore sensor configured remain in a radially extended state when the latch collet is in too large size casing and thereby prevent the collet body and the mandrel from sliding relative to one another and be pushed to a radially compressed state when the latch collet is in the correct size casing and thereby not prevent the collet body and the mandrel from sliding relative to one another. Element 83: wherein the anchor assembly includes: a latch collet including a collet body, the collet body having a collet body slot on a radial interior surface thereof and a plurality of collet fingers; a mandrel positioned within the collet body, the mandrel having a mandrel opening extending through a thickness ($t_m$) thereof; a running tool collet located within the mandrel, the running tool collet having a running tool collet slot on a radial exterior surface thereof; and a locking dog positioned within the mandrel opening, the locking dog configured to engage with the running tool collet slot when the anchor assembly is in a run-in-hole state and thereby prevent the mandrel and the running tool collet from sliding relative to one another and configured to disengage from the running tool collet slot and engage with the collet body slot after the collet body and the mandrel have slid relative to one another and thereby allow the mandrel and the running tool collet to slide relative to one another. Element 84: wherein the anchor assembly includes: a latch collet including a collet body, the collet body having a plurality of collet fingers; and a mandrel positioned within the collet body, wherein the packer assembly is positioned axially between the collet body and the mandrel, the packer assembly configured to move from a radially retracted state when the mandrel and collet body are being run-in-hole to a radially extended state when the collet body has engaged with a latching profile and weight is placed down upon the packer. Element 85: further including a fluid loss device positioned between the whipstock assembly and the completion assembly. Element 86: further including a two-part drilling and running tool coupled with the anchor assembly, the two-part drilling and running tool including: a conveyance; a smaller assembly coupled to an end of the conveyance; and a larger bit assembly slidably coupled to the conveyance, the smaller assembly and larger bit assembly configured to slidingly engage one another downhole to form a combined bit assembly; and a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another. Element 86: wherein the one way mechanism is a wedge feature located in an annular space between the smaller assembly and the larger bit assembly. Element 87: wherein the anchor assembly includes a latch collet, the latch collet including: a collet body, the collet body having a plurality of collet fingers; and a torque button located on a radial exterior of each of the plurality of collet fingers, wherein a width ($W_{TB}$) of each of the torque buttons is within 10% of each other, and further wherein setting the anchor assembly includes running the anchor assembly downhole until the latch collet automatically engages with a latch coupling in the main wellbore. Element 88: wherein each of the torque buttons includes multiple linearly aligned and spaced apart torque button portions. Element 89: wherein the latch collet further includes a collet prop button located on a radial interior of each of the plurality of collet fingers, and further wherein positioning the downhole tool within the main wellbore using the two-part drilling and running tool includes positioning the downhole tool within the main wellbore as the collet prop buttons engaged with related profiles of a mandrel coupled to the two-part drilling and running tool. Element 90: further including causing the collet prop buttons to disengage from the related profiles as the latch collet automatically engages with the latch coupling in the main wellbore thereby releasing the two-part drilling and running tool from the downhole tool. Element 91: wherein the latch coupling includes: a housing having an outside diameter (OD) and an inside diameter (ID); and a plurality of axial alignment slots located along the inside diameter (ID) of the housing, wherein a width ($W_{AS}$) of each of the plurality of axial alignment slots is within 10% of each other. Element 92: wherein the anchor assembly includes: a latch collet including a collet body, the collet body having a collet body slot on a radial interior surface thereof and a plurality of collet fingers; a mandrel positioned within the collet body, the mandrel having a mandrel opening extending through a thickness ($t_m$) thereof; a running tool collet located within the mandrel, the running tool collet having a running tool collet slot on a radial exterior surface thereof; and a locking dog positioned within the mandrel opening, the locking dog engaged with the running tool collet slot while positioning the downhole tool within the wellbore, the locking dog preventing the mandrel and the running tool collet from sliding relative to one another. Element 93: further including allowing the collet body and the mandrel to slide relative to one another, the allowing permitting the locking dog to disengage from the running tool collet slot and engage with collet body slot, thereby allowing the mandrel and the running tool collet to slide relative to one another. Element 94: wherein the allowing the mandrel and the running tool collet to slide relative to one another automatically releases the two-part drilling and running tool from the downhole tool. Element 95: wherein the two-part drilling and running tool includes: a conveyance; a smaller assembly coupled to an end of the conveyance; a larger bit assembly slidably coupled to the conveyance, the smaller assembly and larger bit assembly configured to slidingly engage one another downhole to form a combined bit assembly; and a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another, and further including drawing the smaller assembly uphole to form the combined bit assembly after the releasing the two-part drilling and running tool from the downhole tool. Element 96: wherein the anchor assembly includes a latch collet, the latch collet including: a collet body, the collet body having a plurality of collet fingers; and a torque button located on a radial exterior of each of the plurality of collet fingers, wherein a width ($W_{TB}$) of each of the torque buttons is within 10% of each other. Element 97: wherein each of the torque buttons includes multiple linearly aligned and spaced apart torque button portions. Element 98: wherein the anchor assembly includes a latch collet, the latch collet including: a collet body, the collet body having a plurality of collet fingers; and a collet prop button located on a radial interior of each of the plurality of collet fingers, the collet prop button configured to engage with a profile of a mandrel for running the latch collet downhole, and configured to be propped radially outward by the mandrel to cause torque buttons located on a radial exterior of each of the plurality of fingers to remain engaged with associated alignment profiles in a latch coupling when positioned at an acceptable position downhole. Element 99: wherein the anchor assembly includes: a latch collet including a collet body, the collet body having a collet body opening extending through a thickness ($t_{cb}$) thereof and a plurality of collet fingers; a mandrel positioned within the collet body, the mandrel having a mandrel slot therein; and a bore sensor positioned within the collet body opening and the mandrel slot, the bore sensor configured remain in a radially extended state when the latch collet is in too large size casing and thereby prevent the collet body and the mandrel from sliding relative to one another and be pushed to a radially compressed state when the latch collet is in the correct size casing and thereby not prevent the collet body and the mandrel from sliding relative to one another. Element 100: wherein the anchor assembly includes: a latch collet including a collet body, the collet body having a collet body slot on a radial interior surface thereof and a plurality of collet fingers; a mandrel positioned within the collet body, the mandrel having a mandrel opening extending through a thickness ($t_m$) thereof; a running tool collet located within the mandrel, the running tool collet having a running tool collet slot on a radial exterior surface thereof; and a locking dog positioned within the mandrel opening, the locking dog configured to engage with the running tool collet slot when the anchor assembly is in a run-in-hole state and thereby prevent the mandrel and the running tool collet from sliding relative to one another and configured to disengage from the running tool collet slot and engage with the collet body slot after the collet body and the mandrel have slid relative to one another and thereby allow the mandrel and the running tool collet to slide relative to one another. Element 101: wherein the anchor assembly includes: a latch collet including a collet body, the collet body having a plurality of collet fingers; and a mandrel positioned within the collet body, wherein the packer assembly is positioned axially between the collet body and the mandrel, the packer assembly configured to move from a radially retracted state when the mandrel and collet body are being run-in-hole to a radially extended state when the collet body has engaged with a latching profile and weight is placed down upon the packer. Element 102: further including a fluid loss device positioned between the whipstock assembly and the completion assembly, the fluid loss device rigidly coupled to the whipstock assembly and removable coupled to the anchor assembly. Element 103: further including a two-part drilling and running tool coupled with the anchor assembly, the two-part drilling and running tool including: a conveyance; a smaller assembly coupled to an end of the conveyance; a larger bit assembly slidably coupled to the conveyance, the smaller assembly and larger bit assembly configured to slidingly engage one another downhole to form a combined bit assembly; and a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another. Element 104: wherein the one way mechanism is a wedge feature located in an annular space between the smaller assembly and the larger bit assembly. Element 105: wherein the anchor assembly includes a latch collet, the latch collet including: a collet body, the collet body having a plurality of collet fingers; and a torque button located on a radial exterior of each of the plurality of collet fingers, wherein a width ($W_{TB}$) of each of the torque buttons is within 10% of each other, and further wherein setting the anchor assembly includes running the anchor assembly downhole until the latch collet automatically engages with a latch coupling in the main wellbore. Element 106: wherein each of the torque buttons includes multiple linearly aligned and spaced apart torque button portions. Element 107: wherein the latch collet further includes a collet prop button located on a radial interior of each of the plurality of collet fingers, and further wherein positioning the downhole tool within the main wellbore using the two-part drilling and running tool includes positioning the downhole tool within the main wellbore as the collet prop buttons engaged with related profiles of a mandrel coupled to the two-part drilling and running tool. Element 108: further including causing the collet prop buttons to disengage from the related profiles as the latch collet automatically engages with the latch coupling in the main wellbore thereby releasing the two-part drilling and running tool from the downhole tool. Element 109: wherein the latch coupling includes: a housing having an outside diameter (OD) and an inside diameter (ID); and a plurality of axial alignment slots located along the inside diameter (ID) of the housing, wherein a width ($W_{AS}$) of each of the plurality of axial alignment slots is within 10% of each other. Element 110: wherein the anchor assembly includes: a latch collet including a collet body, the collet body having a collet body slot on a radial interior surface thereof and a plurality of collet fingers; a mandrel positioned within the collet body, the mandrel having a mandrel opening extending through a thickness ($t_m$) thereof; a running tool collet located within the mandrel, the running tool collet having a running tool collet slot on a radial exterior surface thereof; and a locking dog positioned within the mandrel opening, the locking dog engaged with the running tool collet slot while positioning the downhole tool within the wellbore, the locking dog preventing the mandrel and the running tool collet from sliding relative to one another. Element 111: further including allowing the collet body and the mandrel to slide relative to one another, the allowing permitting the locking dog to disengage from the running tool collet slot and engage with collet body slot, thereby allowing the mandrel and the running tool collet to slide relative to one another. Element 112: wherein the allowing the mandrel and the running tool collet to slide relative to one another automatically releases the two-part drilling and running tool from the downhole tool. Element 113: wherein the two-part drilling and running tool includes: a conveyance; a smaller assembly coupled to an end of the conveyance; a larger bit assembly slidably coupled to the conveyance, the smaller assembly and larger bit assembly configured to slidingly engage one another downhole to form a combined bit assembly; and a one way mechanism coupled between the smaller assembly and the larger bit assembly, the one way mechanism configured to allow the smaller assembly and larger bit assembly to axially slide in one direction relative to one another and prevent the smaller assembly and larger bit assembly from axially sliding in an opposite direction relative to one another, and further including drawing the smaller assembly uphole to form the combined bit assembly after the releasing the two-part drilling and running tool from the downhole tool.

Those skilled in the art to which this application relates will appreciate that other and further additions, deletions, substitutions and modifications may be made to the described embodiments.

What is claimed is:

1. A latch coupling, comprising:

a housing having an outside diameter (OD) and an inside diameter (ID); and a plurality of axial alignment slots located along the inside diameter (ID) of the housing, wherein a width ($W_{AS}$) of each of the plurality of axial alignment slots is within 10% of each other.

2. The latch coupling as recited in claim 1, wherein the plurality of axial alignment slots is at least six axial alignment slots, and further wherein the width ($W_{AS}$) of each of the at least six axial alignment slots is within 10% of each other.

3. The latch coupling as recited in claim 1, wherein the plurality of axial alignment slots is at least ten axial alignment slots, and further wherein the width ($W_{AS}$) of each of the at least ten axial alignment slots is within 10% of each other.

4. The latch coupling as recited in claim 1, wherein the plurality of axial alignment slots is at least sixteen axial alignment slots, and further wherein the width ($W_{AS}$) of each of the at least sixteen axial alignment slots is within 10% of each other.

5. The latch coupling as recited in claim 1, further including a radial extending latch collet selector profile located along the inside diameter (ID) of the housing.

6. The latch coupling as recited in claim 5, wherein the radial extending latch collet selector profile is an uphole radial extending latch collet selector profile located uphole of the plurality of axial alignment slots, and further including a downhole radial extending latch collet selector profile located along the inside diameter (ID) of the housing and downhole of the plurality of axial alignment slots.

7. The latch coupling as recited in claim 6, wherein the uphole radial extending latch collet selector profile and the downhole radial extending latch collet selector profile each extends 360 degrees around the housing.

8. The latch coupling as recited in claim 6, wherein the uphole radial extending latch collet selector profile and the downhole radial extending latch collet selector profile each include tensile shoulders or compressive shoulders.

9. The latch coupling as recited in claim 6, wherein the uphole radial extending latch collet selector profile and the downhole radial extending latch collet selector profile each include tensile shoulders and compressive shoulders.

10. The latch coupling as recited in claim 1, wherein the plurality of axial alignment slots each have a length ($L_{AS}$), and further wherein the length ($L_{AS}$) is at least 3 times the width ($W_{AS}$).

11. A well system, comprising:

a wellbore extending through one or more subterranean formations; and wellbore casing located in the wellbore, the wellbore casing including a latch coupling, the latch coupling including:

a housing having an outside diameter (OD) and an inside diameter (ID); and a plurality of axial alignment slots located along the inside diameter (ID) of the housing, wherein a width ($W_{AS}$) of each of the plurality of axial alignment slots is within 10% of each other.

12. The well system as recited in claim 11, wherein the plurality of axial alignment slots is at least six axial alignment slots, and further wherein the width ($W_{AS}$) of each of the at least six axial alignment slots is within 10% of each other.

13. The well system as recited in claim 11, wherein the plurality of axial alignment slots is at least ten axial alignment slots, and further wherein the width ($W_{AS}$) of each of the at least ten axial alignment slots is within 10% of each other.

14. The well system as recited in claim 11, wherein the plurality of axial alignment slots is at least sixteen axial alignment slots, and further wherein the width ($W_{AS}$) of each of the at least sixteen axial alignment slots is within 10% of each other.

15. The well system as recited in claim 11, further including a radial extending latch collet selector profile located along the inside diameter (ID) of the housing.

16. The well system as recited in claim 15, wherein the radial extending latch collet selector profile is an uphole radial extending latch collet selector profile located uphole of the plurality of axial alignment slots, and further including a downhole radial extending latch collet selector profile located along the inside diameter (ID) of the housing and downhole of the plurality of axial alignment slots.

17. The well system as recited in claim 16, wherein the uphole radial extending latch collet selector profile and the downhole radial extending latch collet selector profile each extends 360 degrees around the housing.

18. The well system as recited in claim 16, wherein the uphole radial extending latch collet selector profile and the downhole radial extending latch collet selector profile each include tensile shoulders or compressive shoulders.

19. The well system as recited in claim 16, wherein the uphole radial extending latch collet selector profile and the downhole radial extending latch collet selector profile each include tensile shoulders and compressive shoulders.

20. The well system as recited in claim 11, wherein the plurality of axial alignment slots each have a length ($L_{AS}$), and further wherein the length ($L_{AS}$) is at least 3 times the width ($W_{AS}$).

21. A method for forming a well system, comprising:

forming a wellbore through one or more subterranean formations; and positioning wellbore casing in the wellbore, the wellbore casing including a latch coupling, the latch coupling including:

a housing having an outside diameter (OD) and an inside diameter (ID); and a plurality of axial alignment slots located along the inside diameter (ID) of the housing, wherein a width ($W_{AS}$) of each of the plurality of axial alignment slots is within 10% of each other.

* * * * *